US007551048B2

(12) United States Patent
Iwata et al.

(10) Patent No.: US 7,551,048 B2
(45) Date of Patent: Jun. 23, 2009

(54) MICRO-RELAY AND METHOD OF FABRICATING THE SAME

(75) Inventors: Hideki Iwata, Shinagawa (JP); Takashi Yuba, Shinagawa (JP); Hirofumi Saso, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 503 days.

(21) Appl. No.: 10/634,876

(22) Filed: Aug. 6, 2003

(65) Prior Publication Data

US 2005/0280975 A1 Dec. 22, 2005

(30) Foreign Application Priority Data

Aug. 8, 2002 (JP) ..... 2002-232182
Aug. 8, 2002 (JP) ..... 2002-232183
Aug. 8, 2002 (JP) ..... 2002-232184
Nov. 7, 2002 (JP) ..... 2002-324384

(51) Int. Cl.
*H01H 51/22* (2006.01)

(52) U.S. Cl. ..... 335/78; 200/181; 361/56

(58) Field of Classification Search ..... 335/78–80, 335/124, 128; 200/181; 361/56, 58, 111
See application file for complete search history.

(56) References Cited

U.S. PATENT DOCUMENTS 4,480,162 A 10/1984 Greenwood
5,136,366 A 8/1992 Worp et al.
5,336,931 A 8/1994 Juskey et al.
5,367,429 A * 11/1994 Tsuchitani et al. ..... 361/280
5,372,515 A * 12/1994 Miller et al. ..... 439/138
5,627,396 A 5/1997 James et al.
5,802,911 A 9/1998 Cahill et al.
5,872,496 A * 2/1999 Asada et al. ..... 335/78
5,901,031 A * 5/1999 Ishige et al. ..... 361/277
6,064,126 A 5/2000 Beardmore
6,191,671 B1 2/2001 Schlaak et al.
6,384,353 B1 5/2002 Huang et al.
6,426,687 B1 7/2002 Osborn
6,504,118 B2 * 1/2003 Hyman et al. ..... 200/181

(Continued)

FOREIGN PATENT DOCUMENTS

DE 4205340 8/1993

(Continued)

OTHER PUBLICATIONS

European Search Report dated, Feb. 10, 2006, for European Patent Application 03254928.9-2214.

(Continued)

*Primary Examiner*—Elvin G Enad
*Assistant Examiner*—Bernard Rojas
(74) *Attorney, Agent, or Firm*—Staas & Halsey LLP

(57) ABSTRACT

A micro-relay includes a first substrate having stationary contacts and a stationary electrode, a second substrate arranged so as to face the first substrate, and a movable plate arranged between the first and second substrates. The movable plate has a frame and a movable portion. The frame is sandwiched between the first and second substrates to realize a hermetical sealed structure. The movable portion has a movable electrode facing the stationary electrode, and a movable contact faces the stationary contacts. The movable portion moves between the first and second substrates due to electrostatic attraction that develops between the movable electrode and the stationary electrode.

25 Claims, 109 Drawing Sheets

U.S. PATENT DOCUMENTS

| | | | | |
|---|---|---|---|---|
| 6,621,135 | B1 * | 9/2003 | Sridhar et al. | 257/415 |
| 6,633,212 | B1 * | 10/2003 | Ruan et al. | 335/78 |
| 6,734,513 | B2 * | 5/2004 | Seki et al. | 257/422 |
| 6,828,888 | B2 * | 12/2004 | Iwata et al. | 335/78 |
| 6,841,839 | B2 * | 1/2005 | Sridhar et al. | 257/415 |
| 6,876,482 | B2 * | 4/2005 | DeReus | 359/290 |
| 2001/0022541 | A1 | 9/2001 | Kasai et al. | |
| 2002/0005341 | A1 | 1/2002 | Seki | |
| 2002/0160583 | A1 | 10/2002 | Song | |
| 2002/0163408 | A1 | 11/2002 | Fujii et al. | |

FOREIGN PATENT DOCUMENTS

| | | | |
|---|---|---|---|
| DE | 4305033 | | 10/1993 |
| EP | 0520407 | | 6/1992 |
| EP | 0 709 911 | A2 | 5/1996 |
| FR | 2706075 | A1 | 12/1994 |
| JP | 5-002975 | | 1/1993 |
| JP | 5-242788 | | 9/1993 |
| JP | 7-176255 | | 7/1995 |
| JP | 7-321594 | | 12/1995 |
| JP | 8-083547 | | 3/1996 |
| JP | 8-509093 | | 9/1996 |
| JP | 9-92116 | | 4/1997 |
| JP | 9-180616 | | 7/1997 |
| JP | 10-162713 | | 6/1998 |
| JP | 11-054016 | | 2/1999 |
| JP | 11-219652 | | 8/1999 |
| JP | 2000-500274 | | 1/2000 |
| JP | 2000-164104 | | 6/2000 |
| JP | 2001-52587 | | 2/2001 |
| JP | 2001-177112 | | 6/2001 |
| JP | 2002-207048 | | 7/2002 |
| WO | WO 96/41359 | | 12/1996 |
| WO | WO 99/62089 | | 12/1999 |
| WO | WO 01/82323 | | 11/2001 |
| WO | WO 02/11188 | A2 | 2/2002 |

OTHER PUBLICATIONS

Japanese Patent Office Action, mailed Jun. 10, 2008 and issued in corresponding Japanese Patent Application No. 2002-232182.

* cited by examiner 120
171
172
124
124
130
(a)BONDING MOVABLE PLATE TO STATIONARY SUBSTRATE
(b) REMOVING SUPPORTING LAYER AND OXIDE FILM
119
(c) ETCHING FOR DEFINING MOVABLE CONTACT
119
(d) IMPURITY DOPING
119
(e) FORMING SURFACE INSULATION FILM
123
(f) FORMING MOVABLE CONTACT
128
(g) FORMING FRAME AND PROTRUSIONS
120
121
122
(h) FORMING SLITS IN MOVABLE PLATE
130
125
110
(i) BONDING CAP SUBSTRATE TO MOVABLE PLATE
120
124
130
124

220
223
271
272
273
224
273
224
230
(a)BONDING MOVABLE PLATE TO STATIONARY SUBSTRATE
(b) REMOVING SUPPORTING LAYER AND OXIDE FILM
273
(c) IMPURITY DOPING
273
279
(d) FORMING SURFACE INSULATION FILM
228
223
228
(e) FORMING MOVABLE CONTACT
222
221
(f) FORMING SLITS IN MOVABLE PLATE
220
230
225
210
223
(g) BONDING CAP SUBSTRATE TO MOVABLE PLATE
220
224
230
224

1ST SW: CLOSED
2ND SW: OPEN

NEUTRAL
1ST,2ND SW: OPEN

1ST SW: OPEN
2ND SW: CLOSED

1ST SW: CLOSED
2ND SW: CLOSED

MICRO-RELAY AND METHOD OF FABRICATING THE SAME

BACKGROUND OF THE INVENTION

1. Field of the Invention

The present invention generally relates to micro-relays. The micro-relays may be fabricated by using semiconductor fabrication techniques. The micro-relay has various marked advantages over the conventional relays, and is one of the devices that are getting most of the attention these days.

2. Description of the Related Art

Generally, the micro-relays have a movable plate that faces a stationary substrate. There is a type of micro-relay that utilizes electrostatic attraction (electrostatic force) that develops when a given voltage is applied between the stationary substrate and the movable plate. In this type of micro-relay, the movable plate may shift towards the stationary substrate due to the function of the electrostatic attraction, so that a contact can be made. The contact can be released by stopping the voltage supply. There are several proposals of the electrostatically actuated micro-relays. For example, Japanese Laid-Open Patent Application No. 5-242788 discloses a micro-relay that has a pair of stationary bodies between which a movable plate is interposed. This proposal is made by taking into consideration easy deformation of the micro-relay due to temperature change and difficulty in forming the electrodes.

However, the above proposal has a disadvantage in that hermetically sealing the interior of the micro-relay cannot be secured because wiring lines are extracted from the inside of the micro-relay to the outside. The relays are required to have a characteristic such that the ON resistance is as low as possible and is stable. Since the ON resistance is affected by the ambient atmosphere, the hermetically sealed structure is desired. The micro-relay has a great advantage in that many micro-chips are formed on a wafer using the semiconductor fabrication techniques and are divided into separate pieces by dicing, and is therefore suitable for mass production. In this case, it is required to protect the fine actuator and contacts of the micro-relay from water and scattering powders during dicing. However, in the micro-relay disclosed in Japanese Laid-Open Patent Application No. 5-242788, the hermetically sealed structure is not secured prior to dicing. Thus, there is difficulty in securing the desired relay performance.

Besides the hermetically sealed structure, the micro-relay has several problems to be solved as described below, and it is therefore desired to provide an improved micro-relay in which these problems have been solved as many as possible.

(1) The use of electrostatic force for actuating the movable contact makes it possible to realize a simple structure and low power consumption. In this type, it is important to secure the contact-to-contact distance as long as possible in order to improve isolation. As the contact-to-contact distance increases, the degree of signal leakage between the contacts decreases. It should be noted that the electrostatic force that actuates the movable plate is proportional to the square of the voltage applied and is inversely proportional to the square of the distance between the contacts. Further, the contact-to-contact distance is as very short as a few μm, when the maximum drive voltage applicable in practice (up to about 10 V) and the size of the micro-relay are considered. Consequently, it is very difficult to realize a micro-relay structure having a long contact-to-contact distance. It will be noted that the contact-to-contact distance is obtained when the movable contact is located at the home position.

(2) The micro-relay is suitable for switching of fine signals rather than conventional power switching in light of electrostatic force, contact size and contact-to-contact distance. The micro-relay is suitable for a relay of high-frequency signals (RF relay) because of easy forming of signal lines and small contacts. In the RF relay, it is particularly important to improve the isolation performance. This requires reducing the electrostatic capacitance between the contacts in the OFF state. Reducing the electrostatic capacitance may be effectively achieved by reducing the areas of the facing contacts and securing the reasonably long contact-to-contact distance.

However, reducing the areas of the facing contacts decreases the contacting area and thus increases the ON-resistance or contact resistance. Further, there is a limit on the available contact-to-contact distance. Thus, it is not easy to design the micro-relay having satisfactory RF performance.

(3) The micro-relay utilizing electrostatic attraction is equipped with driving electrodes respectively provided to the stationary substrate and the movable plate in addition to the contacts. The shorter the distance between the electrodes, the greater developing force based on the electrostatic attraction. This may cause an unwanted situation in which the movable plate is brought into contact with the stationary electrode at a position besides the original contact-made position. In this case, the movable plate is sticking to (or tightly attached to) the stationary electrode due to the residual charge between the electrodes (charge up), and is no longer detached therefrom. In this case, the micro-relay does not provide the original switching function.

(4) The contact force based on the electrostatic force is weak in the micro-relay. Generally, the relay is desired to have large contact force and small contact resistance in order to stabilize the relay. It is thus desired to provide a micro-relay that has large contact force although it is driven by a low voltage. However, such a desire for the micro-relay will not be fulfilled in practice because the large contact force and the small contact resistance are incompatible. The micro-relay is further required to accurately define the distance between the electrodes and improve the production yield. It is desired to avoid connections made outside of the micro-relay such as wire bonding and to provide an advanced structure that enables downsizing of package and reduced resistance of signal lines.

SUMMARY OF THE INVENTION

It is an object of the present invention to provide a micro-relay having an improved isolation characteristic and an improved hermetically sealing structure and to provide a method of fabricating the same.

Another object of the present invention is to overcome the above-mentioned problems to be solved.

The objects of the present invention are achieved by a micro-relay comprising: a first substrate having stationary contacts and a stationary electrode; a second substrate arranged so as to face the first substrate; and a movable plate arranged between the first and second substrates, the movable plate having a frame and a movable portion, the frame being sandwiched between the first and second substrates to realize a hermetical sealed structure, the movable portion having a movable electrode facing the stationary electrode, and a movable contact facing the stationary contacts, the movable portion moving between the first and second substrates due to electrostatic attraction that develops between the movable electrode and the stationary electrode.

The above objects of the present invention are also achieved by a micro-relay comprising: a first substrate having stationary contacts and a stationary electrode; a second substrate arranged so as to form a cavity in collaboration with the first substrate; and a movable plate arranged between the first and second substrates, the movable plate having a frame and multiple movable portions, the frame being sandwiched between the first and second substrates so that an internal space can be hermetically sealed, each of the movable portions having a movable electrode facing the stationary electrode, and a movable contact facing corresponding ones of the stationary contacts, each of the movable portions moving between the first and second substrates due to electrostatic attraction that develops between the movable electrode and the stationary electrode.

The above-objects of the present invention are also achieved by a method of fabricating a micro-relay comprising the steps of: forming a first substrate having stationary contacts and a stationary electrode; forming a second substrate; forming a movable plate having a frame and a movable portion movably supported by the frame, the movable portion having a movable electrode and a movable contact; and joining the movable plate and the first and second substrates.

The above-objects of the present invention are also achieved by a method of fabricating a micro-relay comprising the steps of: patterning an SOI substrate so that a cavity is formed in an insulation layer of the SOI substrate; etching an active layer of the SOI substrate to define a shape of a movable plate; forming an insulation film on the active layer that has been etched; forming a movable contact on the insulation film; and etching a peripheral portion of the active layer so that an integrated body suitable for the movable plate supported by a stationary electrode of the micro-relay can be formed.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

A description will now be given of embodiments of the present invention with reference to the accompanying drawings.

First Embodiment

Figure 1:
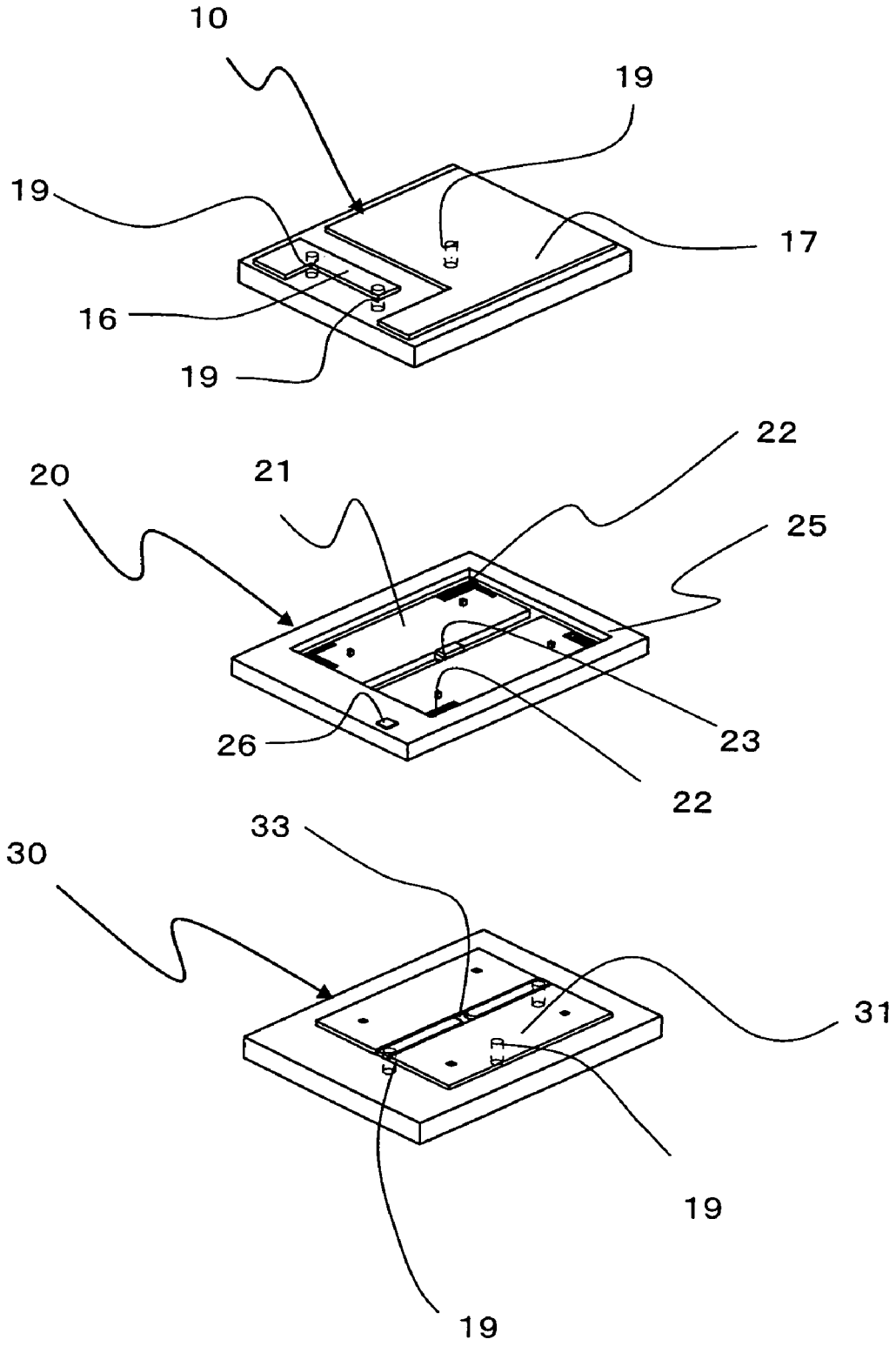
FIG. 1 is an exploded perspective view of a chip part of a micro-relay according to a first embodiment of the present invention.
Figure 2A:
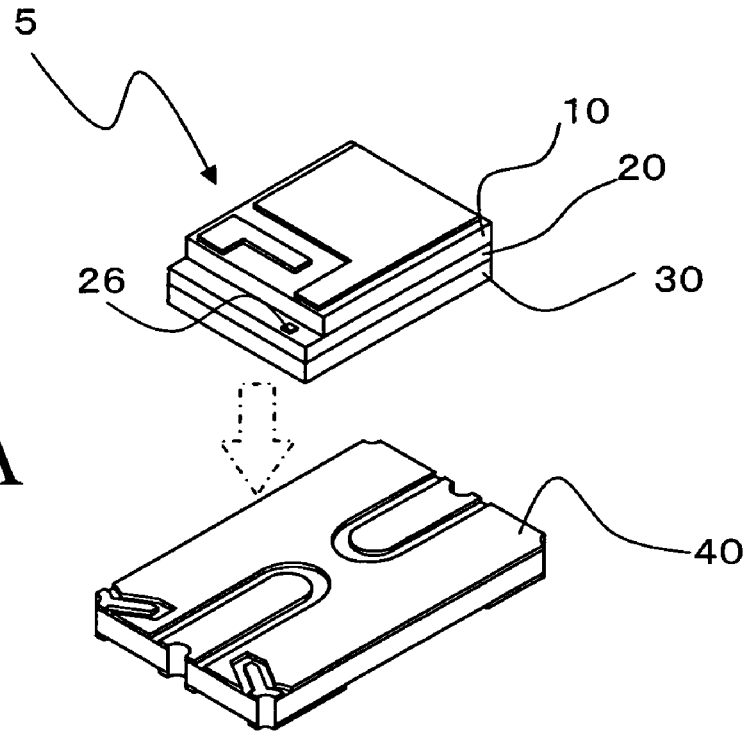
FIGS. 2A, 2B and 2C are respectively perspective views showing how to assemble a micro-relay device using the chip shown in FIG. 1.
Figure 2B:
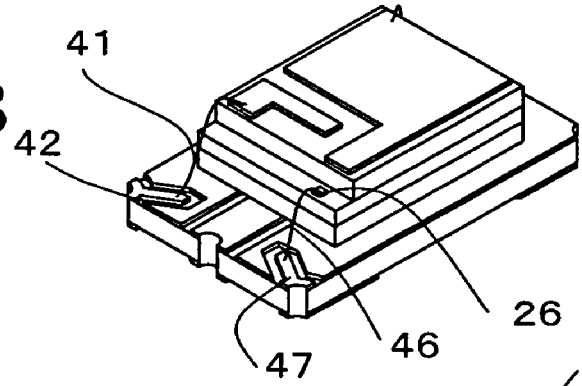
Figure 2C:
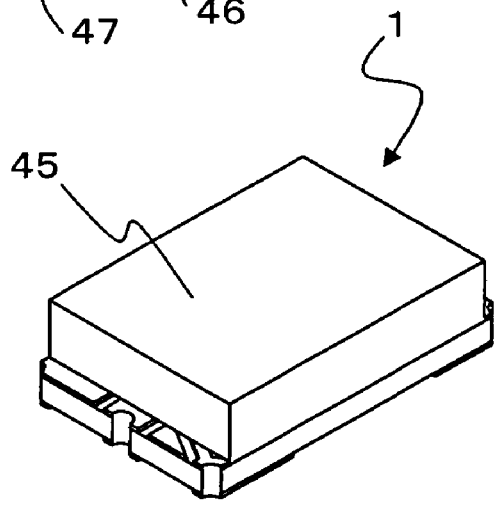
Figure 3:
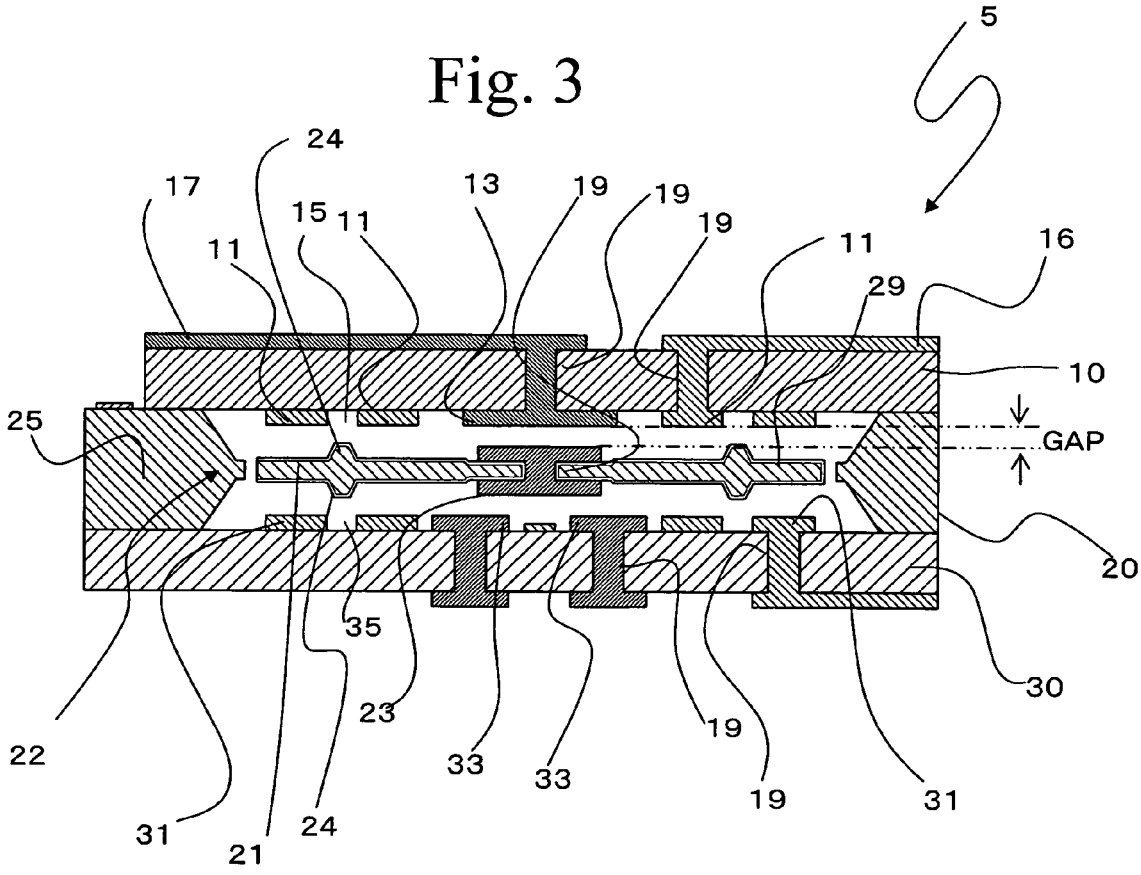
FIG. 3 is a cross-sectional view of the micro-relay chip shown in FIG. 3.

FIGS. 1 through 3 illustrate a micro-relay according to a first embodiment of the present invention. More particularly, FIG. 1 is an exploded perspective view of a chip part of the micro-relay. FIGS. 2A through 2C show how to assemble a micro-relay device 1 using a micro-relay chip 5. FIG. 3 schematically shows a cross section of the micro-relay chip 5. In the following, an outline of the micro-relay according to the present embodiment will be described first, and an internal structure will be described second.

The micro-relay chip 5 has a basic structure composed of an upper stationary substrate 10, a lower stationary substrate 30, and a movable plate 20 interposed between the substrates 10 and 30. Hereinafter, the upper stationary substrate 10 is referred to as cap substrate 10.

The movable plate 20 is formed by using a semiconductor material such as silicon single-crystal. The movable plate 20 includes a frame 25 shaped into a ring, and a movable portion 21, which moves up and down within the frame 25. The direction in which the movable portion 21 moves up and down is perpendicular to the plate surfaces of the cap substrate 10 and the stationary substrate 30. In order to realize the up/down movement of the movable portion 21, the movable portion 21 is connected to the frame 25 by hinge springs 22 that are elastically deformable members. Though the frame 25 has a rectangular shape, it is not limited thereto but may have any shape having line symmetry. The multiple hinge springs 22 that support the movable portion 21 are provided at the line-symmetrical positions on the frame 25. In the first embodiment of the invention, the hinge springs 22 are provided at the four corners of the frame 25 to support the movable portion 21. As will be described later, an electrostatic attraction is exerted on the movable portion 21, which is thus moved up and down. The four hinge springs 22 act to enable the movable portion 21 to move up and down while being kept in the parallel state.

The movable portion 21 includes a movable electrode and a movable contact. As shown in the middle of FIG. 1, the movable portion 21 has an appearance such that two rectangular plates are joined via a small protrusion 23. This protrusion 23 is a movable contact, and the rectangular plates serve as a movable electrode. The movable portion 21 is mostly the movable electrode, and only a part of the central portion of the movable portion 21 is occupied by the movable contact 23. Thus, the movable portion 21 is substantially the movable electrode in the present embodiment. The movable contact 23 and the movable electrode are electrically isolated. The movable portion 21 has a base portion made of, for example, a silicon single-crystal, which is covered by an insulation film and is electrically isolated from the movable contact 23. As will be described in detail later, the movable contact 23 is provided in a through hole formed in the movable portion 21, and provides contact areas on the front and back surfaces thereof. The movable contact 23 itself or the surface thereof may be made of an electrically conductive material such as gold, platinum or copper.

The cap substrate 10 and the stationary substrate 30 are arranged so as to vertically sandwich the movable plate 20. More particularly, the frame 25 of the movable plate 20 is joined to the cap substrate 10 and the stationary substrate 30, and the movable portion 21 can be moved up and down in the spacing defined by joining. Each of the cap substrate 10 and the stationary substrate 30 has a respective base formed by an insulation member and a respective stationary electrode and stationary contact. In FIG. 1, a stationary electrode 31 and stationary contacts 33 of the stationary substrate 30 are illustrated. A similar stationary electrode and stationary contact are provided on the lower surface of the cap substrate 10. The stationary electrodes and the stationary contacts are electrically isolated as in the case of the movable portion 21.

The stationary electrodes of the cap substrate 10 and the stationary substrate 30 are disposed so as to face the movable electrode of the movable portion 21. The stationary contacts of the cap substrate 10 and the stationary substrate 30 are disposed so as to face the movable contacts 23 of the movable portion 21. The movable contact 23 shown in FIG. 1 is associated with the cap substrate 10. Hereinafter, this movable contact 23 is also referred to as upper movable contact 23. Besides the upper movable contact 23, there is the lower movable contact 23 provided on the lower surface of the movable portion 21. The lower movable contact 23 is associated with the stationary substrate 30. The upper and lower movable contacts 23 are connected via the through hole and are a single-piece member. The stationary substrate 30 has a pair of stationary contacts 33, which are spaced apart from each other. When the movable portion 21 goes down, the lower movable contact 23 is brought into contact with the two stationary contacts 33, so that a signal line including the lower movable contact 23 and the pair of stationary contacts 33 can be established.

As shown in FIG. 1, through holes 19 are respectively provided in the cap substrate 10 and the stationary substrate 30. The through holes 19 are used to extract wiring or interconnection lines from the cavity defined by the cap substrate 10 and the stationary substrate 30. When the cap substrate 10 and the stationary substrate 30 are joined to the frame 25 so as to have airtightness, the resultant internal space can be hermetically sealed. Electrode pads 16 and 17 are provided on the upper surface of the cap substrate 10 and are connected to inner patterns via the through holes 19 formed in the cap substrate 10. The pad 16 is connected to the stationary electrode of the cap substrate 10, and the electrode pad 17 is connected to the stationary contact. The electrode pad 17 may be grounded when it is practically used.

The hermetically sealed micro-relay chip 5 is fixed to a base substrate 40 as shown in FIGS. 2A and 2B. Finally, the assembly is covered with resin 45 as shown in FIG. 2C, so that a resin-packaged micro-relay can be provided. A reference numeral 42 in FIG. 2B indicates an electrode pad on the base substrate 40, and a reference numeral 41 indicates a bonding wire that makes a connection between the micro-relay chip and the electrode pad 42. The movable plate 20 is equipped with an external pad 26, which is provided on a step-like portion of the micro-relay chip 5. The pad 26 is connected to an electrode pad 47 by a bonding wire 46. The base substrate 40 may be replaced with a leadframe.

The structure such that the cap substrate 10 and the stationary substrate 30 are joined to the frame 25 of the movable plate 20 with hermetical sealing can be realized by using glass for the cap substrate 10 and the stationary substrate 30. Silicon and glass can be tightly joined with ease by anodic bonding. In anodic bonding, a flat glass surface and a flat silicon surface that are brought into contact with each other are respectively connected to a negative power source and ground at a given temperature, and is supplied with a high dc voltage. It is recommended to use Pyrex glass (registered trademark) as glass used for the cap substrate 10 and the stationary substrate 30. Pyrex glass has a thermal expansion coefficient close to that of silicon, and is thermally stable. Besides silicon, a metal may be processed by anodic bonding. Thus, the frame 25 of the movable plate 20 may be made of a metal usable in anodic bonding. In anodic bonding, there is no need to fuse part of adhesive or joining interface. Hence, the designed dimensions can be accurately achieved. It is desired to define the gaps between the movable portion 21 and the stationary substrates 10 and 20 with dimensional accuracy as high as possible. The gaps defined by anodic plating have high dimensional accuracy. During anodic bonding, oxygen gas is evolved. In case where gas remains in the hermetically sealed space, inner pressure increases. Increasing inner pressure may affect relay operation and break hermetical sealing. It is therefore preferred to perform anodic bonding in an inactive gas with reduced pressure.

When the micro-relay chip 5 is mounted on the base substrate 40 as shown in FIGS. 2A and 2B, flip-chip bonding may be used. The use of flip-chip bonding may further downsize the micro-relay. For downsizing, it is also possible to employ groove-like side casting lines on the periphery as lines commonly used by the cap substrate 10, the stationary substrate 30 and the movable plate 20, as will be described later.

FIG. 3 illustrates a cross section of the micro-relay chip 5 shown in FIGS. 1 and 2. It is noted that FIG. 3 schematically illustrates the cross section so as to facilitate understanding the positional relationships among the structural parts of the micro-relay chip shown in FIGS. 1 and 2A-2C. For example, the pair of stationary contacts 33 extends up to the right and left ends in FIG. 1, but is shortened in FIG. 3 for illustrating the stationary electrodes 31. A further description of the micro-relay chip 5 will now be described with reference to FIG. 3. This figure shows the detailed structures of the cap substrate 10, the stationary substrate 30 and the movable plate 20. It will be noted that the stationary electrodes 11 and the stationary contacts 13 of the cap substrate 10, which are not illustrated in FIGS. 1 and 2A-2C, appear in FIG. 3.

The stationary electrode 31 and the stationary contacts 33 of the lower stationary substrate 30 are positioned with respect to the movable portion 21 and the movable contact 23, which substantially act as the movable electrode. The upper stationary electrode 11 and the stationary contact 13 are positioned with respect to the movable portion 21 and the movable contact 23. As has been described previously, the pair of stationary contacts 33 provided to the stationary substrate 30 are used for the signal line, and a connection therebetween is made when the movable contact 23 is brought into contact with the stationary contacts 33. In contrast, the single stationary contact 13 is provided to the cap substrate 10. The stationary contact 13 is grounded via the electrode pad 17. When the signal line is OFF, the movable contact 23 contacts the stationary contact 13, so that electrostatic coupling between the movable contact 13 and the stationary contacts 33 can be prevented and isolation therebetween can be improved. The movable contact 23 has the contact areas respectively provided on the upper and lower surfaces of the movable portion 21 and integrally connected via the through hole 19.

A given voltage may be applied between the stationary electrode 11 of the cap substrate 10 and the movable portion 21, which substantially acts as the movable electrode. Similarly, a given voltage may be applied between the stationary electrode 31 of the stationary substrate 30 and the movable portion 21. The stationary electrode 11 is extracted to the upper (back) side of the cap substrate 10 via the through hole 19. Similarly, the stationary electrode 31 is extracted to the lower (back) side of the stationary substrate 30 via the through hole 19. The movable plate 20 is made of, for example, silicon, which is doped with an impurity to make conductivity. The inner walls of the through holes 19 are filled with or plated with a conductor. Thus, the internal space defined b the cap substrate 10, the stationary substrate 30 and the frame 25 of the movable plate 20 can be hermetically sealed.

The interconnection or wiring lines connected to the stationary electrodes 11 and 31 and the movable plate 20 are not shown in FIG. 3 for the sake of simplicity. These wiring lines are connected to a switch, which selectively forms circuits, as will be described later.

The movable plate 20 includes the frame 25, the movable portion 21 and the hinge springs 22, which can be integrally formed from the silicon substrate. By doping the silicon substrate with the impurity, conductivity from the frame 25 to the movable portion 21 can be easily secured. The movable portion 21 is not limited to the silicon substrate doped with the impurity, but may be formed by a silicon substrate on which metal electrodes are provided. It should be noted that an insulation film 29 is formed on the surfaces of the movable portion 21 in order to electrically isolate the movable portion 21 from the movable contact 23.

As is shown in FIG. 1, the movable portion 21 is supported by the hinge springs 22 respectively provided to the four corners of the frame 25 so that the movable portion 21 can move up and down. More particularly, when a voltage is applied between the movable portion 21 and the stationary electrode 11 or 31, the electrostatic attraction that develops therebetween moves the movable portion 21 towards the cap substrate 10 or the stationary substrate 30. That is, the movable portion 21 can move up or down between the cap substrate 10 and the stationary substrate 30. The movable contact 23 that is moving up is brought into contact with the stationary contact 13 of the cap substrate 10. In contact, the movable contact that is moving down is brought into contact with the stationary contacts 33 of the stationary substrate 30, so that the signal line can conduct via the stationary contacts 33 closed by the movable contact 23. As described above, the relay operation is achieved.

FIG. 3 shows the neutral state in which no voltage is applied to the stationary contacts 33 and the movable electrode 21. The movable plate 20 can be produced by etching a silicon single crystal substrate. When the voltage is applied between the stationary electrode 31 and the movable portion (movable electrode) 21 or between the stationary electrode 11 and the movable portion 21, the movable portion 21 is moved up or down and is then maintained in the contact state. The distance or gap between the movable and stationary contacts in the contact state is approximately twice that in the neutral state. As a result, the contact-to-contact distance is substantially short, as compared to an arrangement in which the stationary contacts are provided only at one side of the movable portion 21. The reduced contact-to-contact distance allows the use of a reduced driving voltage.

Preferably, as shown in FIG. 3, there are provided protrusions 24 that are provided to the movable portion 21 and protrude upwards and downwards. The protrusions serve as stoppers. Even if the movable portion 21 is moved up or down to make a contact with the stationary contact 13 or 33 and is further moved due to electrostatic attraction, the protrusions 24 will prevent the movable portion 21 from sticking to the stationary contact 13 or 33. As shown in FIG. 3, recesses 15 are provided in the stationary electrode 11 so as to face the upper protrusions 24, and recesses 35 are provided in the stationary electrode 31 so as to fact the lower protrusions 24. Preferably, the protrusions 24 have a height greater than the depth of the recesses 15 and 35 in order to prevent the movable portion 21 from tightly sticking to the stationary electrode 11 or 31. Instead of the recesses 15 and 35 respectively provided in the stationary electrodes 11 and 31, these electrodes may be provided with comparatively low protrusions.

Figure 4:
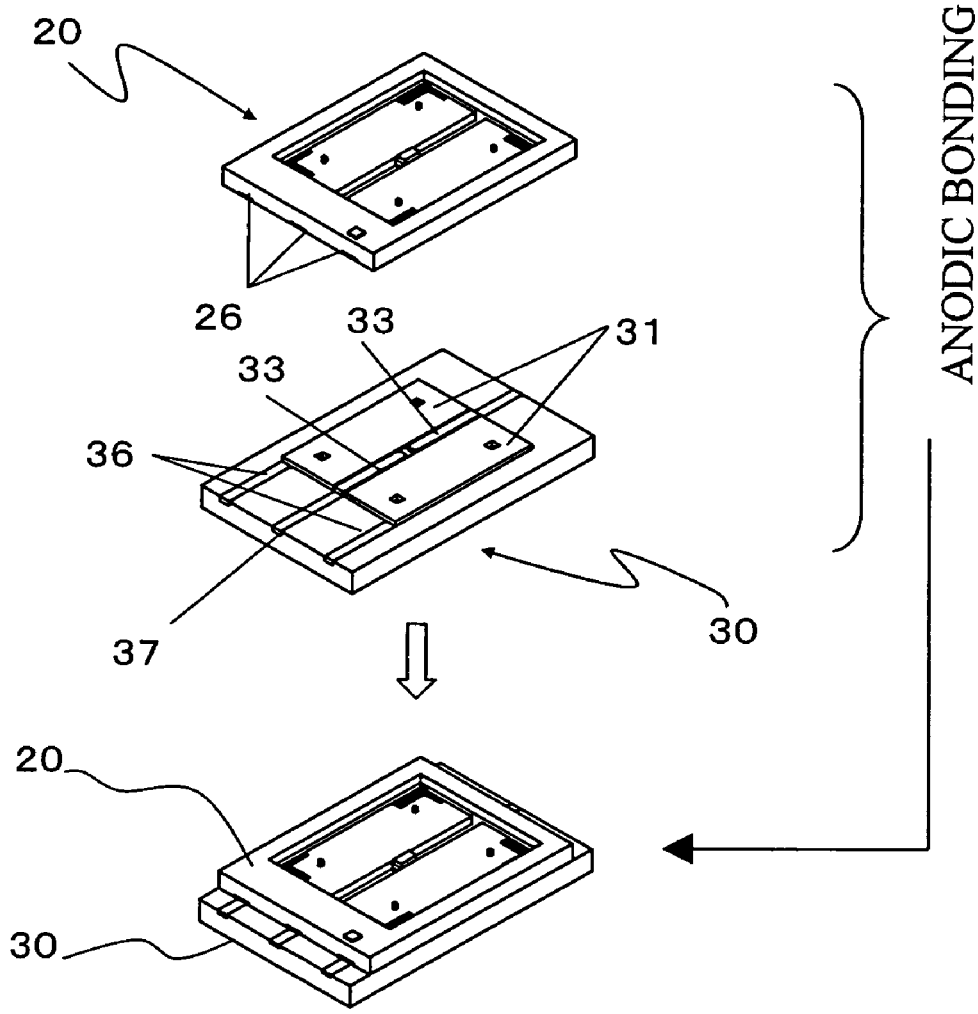
FIG. 4 is an exploded perspective view of a variation of the first embodiment of the present invention in which a buried interconnection line is provided between a movable plate and a stationary substrate.
Figure 5:
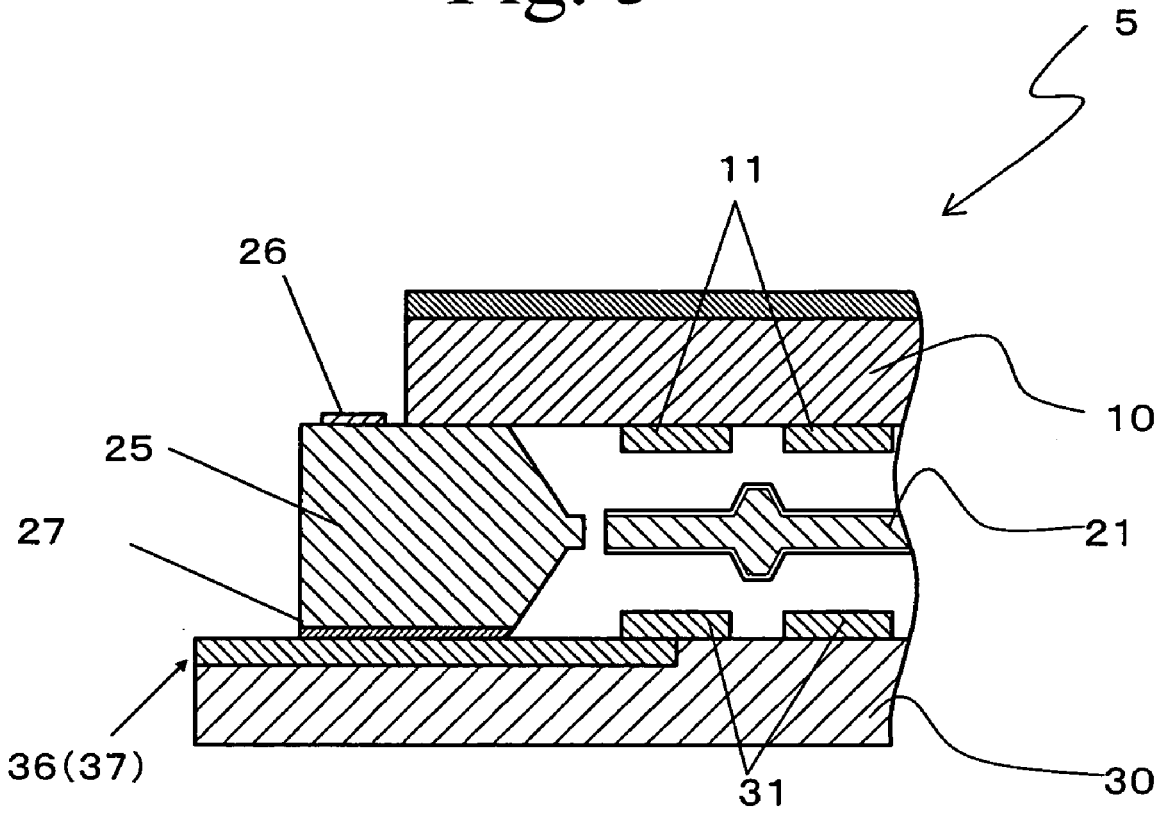
FIG. 5 is a cross-sectional view of a side portion of the micro-relay shown in FIG. 4.

FIGS. 4 and 5 show a variation of the above-mentioned first embodiment of the present invention. As has been described, the through holes 19 are used to extract the wiring lines to the outside of the chip 5 from the substrates 10 and 30. The through holes 19 may be replaced by extraction lines that are buried in the substrates 10 and 30 in such a way that the flatness of the joining surfaces of the substrates 10 and 30 and the frame 25 of the movable plate 20 can be secured. The variation shown in FIGS. 4 and 5 employs such a structure as described above.

More particularly, FIG. 4 is an exploded perspective view of the variation, and FIG. 5 is a cross-sectional view of a side portion of the variation. The micro-relay chip 5 of this variation employs an extraction line that is buried in the stationary substrate 30 joined to the movable plate 20. As is shown in FIG. 4, an extraction line 36 extending from the stationary electrode 31 is buried in the stationary substrate 30 so as to be flush with the surface of the stationary substrate 30. Similarly, extraction lines 37 extending from the stationary contacts 33 are buried in the stationary substrate 30 so as to be flush with the surface of the stationary substrate 30. The flat surface of the stationary substrate 30 secures reliable hermetical sealing made by anodic bonding. It should be noted that the use of the buried extraction lines 36 and 37 needs an insulation film 27 to secure electrical isolation from the stationary substrate 30. The cap substrate 10 may employ an extraction arrangement as described above.

Figure 6:
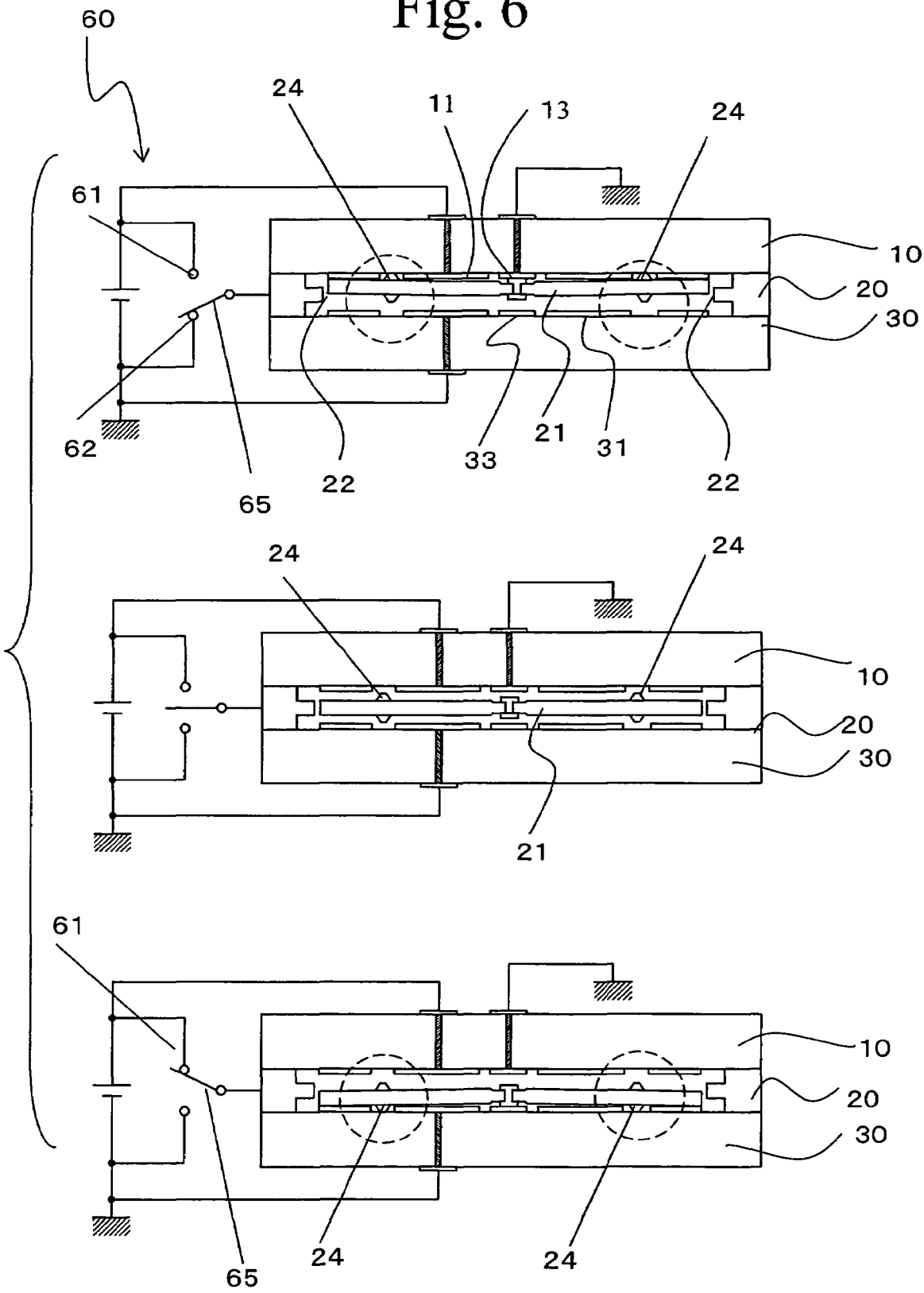
FIG. 6 shows an operation of the micro-relay according to the first embodiment of the present invention.

FIG. 6 shows an operation of the micro-relay according to the first embodiment of the present invention. A drive circuit 60 that drives the micro-relay is shown in FIG. 6. When a movable contact 65 is connected to a stationary contact 61, the stationary electrode 11 and the cap substrate 10 and the movable plate 20 conduct. When the movable contact 65 is connected to another stationary contact 62, a voltage develops between the stationary contact 31 and the movable plate 20. The middle part of FIG. 6 shows a neutral state in which no voltage is applied to the movable plate 20. The upper part of FIG. 6 shows a state in which the movable contact 65 contacts the stationary contact 62, and the lower part thereof shows another state in which the movable contact 65 contacts the stationary contact 61.

The stationary electrode 31 of the stationary substrate 30 is set at the ground potential, and a positive voltage is applied to the stationary electrode 11 of the cap substrate 10. As is shown in the lower part of FIG. 6, when the movable plate 20 is set at the positive potential, the movable plate 20 is attracted towards the stationary electrode 31, and the movable contact 23 is brought into contact with the stationary contacts 33. Even after the contact is made, the movable portion 21 is continuously attracted to the stationary electrode 31 due to further increased force. The movable portion 21 is thus bent, so that further increased contacting force exerted on the movable contact 23 and the stationary contacts 33 can reduce the contact resistance.

The protrusions 24 that serve as the stopper securely prevent surface-to-surface contact between the movable portion 21 and the stationary electrode 31 and prevent the movable portion 21 from sticking to the stationary electrode 31. Since the surfaces of the movable portion 21 are coated with the insulation film 29, the movable portion 21 is not short-circuited to the stationary electrode 31 even when it is brought into contact. If the protrusions 24 securely prevent the movable portion 21 from contacting the stationary electrode 31, the insulation film 29 may be omitted.

As is shown in the upper part of FIG. 6, the movable plate 20 is changed to the ground potential when the movable contact 65 is switched to the stationary contact 61. In this case, the movable portion 21 is attracted to the stationary electrode 11 of the cap substrate 10. Thus, the movable portion 21 can be forcedly detached from the stationary electrode 31 on the lower side of the micro-relay chip 5. Then, the movable contact 23 is brought into contact with the stationary contact 13 (ground contact). The sufficient spacing between the movable contact 23 and the stationary contacts 33 can be secured and the electrostatic capacitance formed therebetween can be reduced. It is therefore possible to reduce leakage of high-frequency signals between the movable contact 23 and the stationary contacts 33.

Second Embodiment

Figure 7:
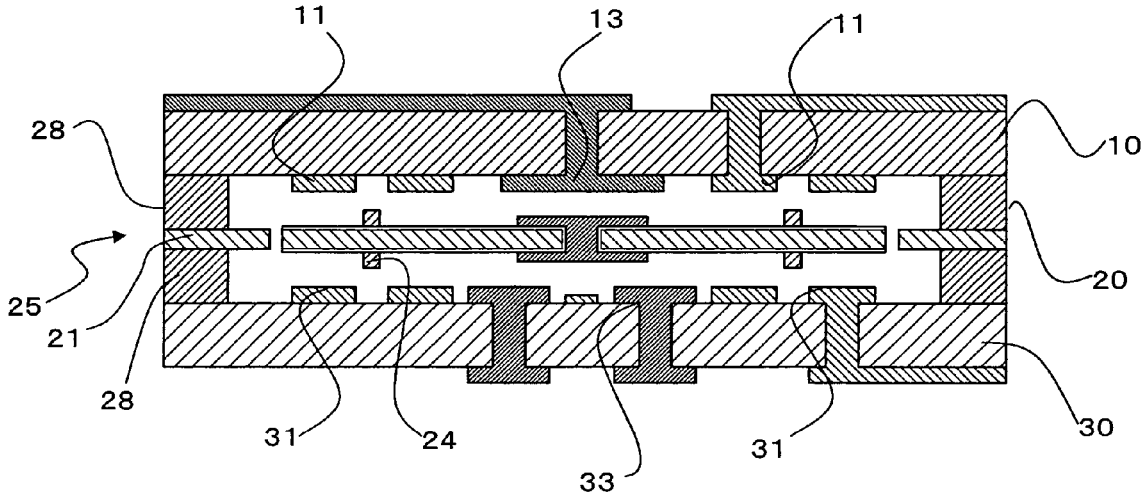
FIG. 7 is a cross-sectional view of a micro-relay according to a second embodiment of the present invention.

FIG. 7 is a cross-sectional view of a micro-relay according to a second embodiment of the present invention. In the first embodiment, the movable plate 20 is formed by etching. The height of the frame 25 of the movable plate 20 defines the contact-to-contact gap, and is therefore required to be produced accurately. The second embodiment of the present invention is a micro-relay that employs a spacer for defining the gap. The basic structure of the second embodiment is the same as that of the first embodiment, so that the same reference numerals refer to the same structural elements and a description thereof will be omitted.

The spacers 28 form the frame 25 according to the second embodiment of the invention. The spacers 28 may be formed by depositing polycrystalline silicon (polysilicon) or a metal. The spacers 28 thus formed can be subjected to anodic bonding, and realize the hermetically sealed micro-relay. The contact-to-contact gap can be accurately defined by the spacers 28 as in the case of etching. Generally, it takes a relatively long time to define the gap by etching, while it does not take such a long time to define the gap using the spacers 28.

Third Embodiment

Figure 8:
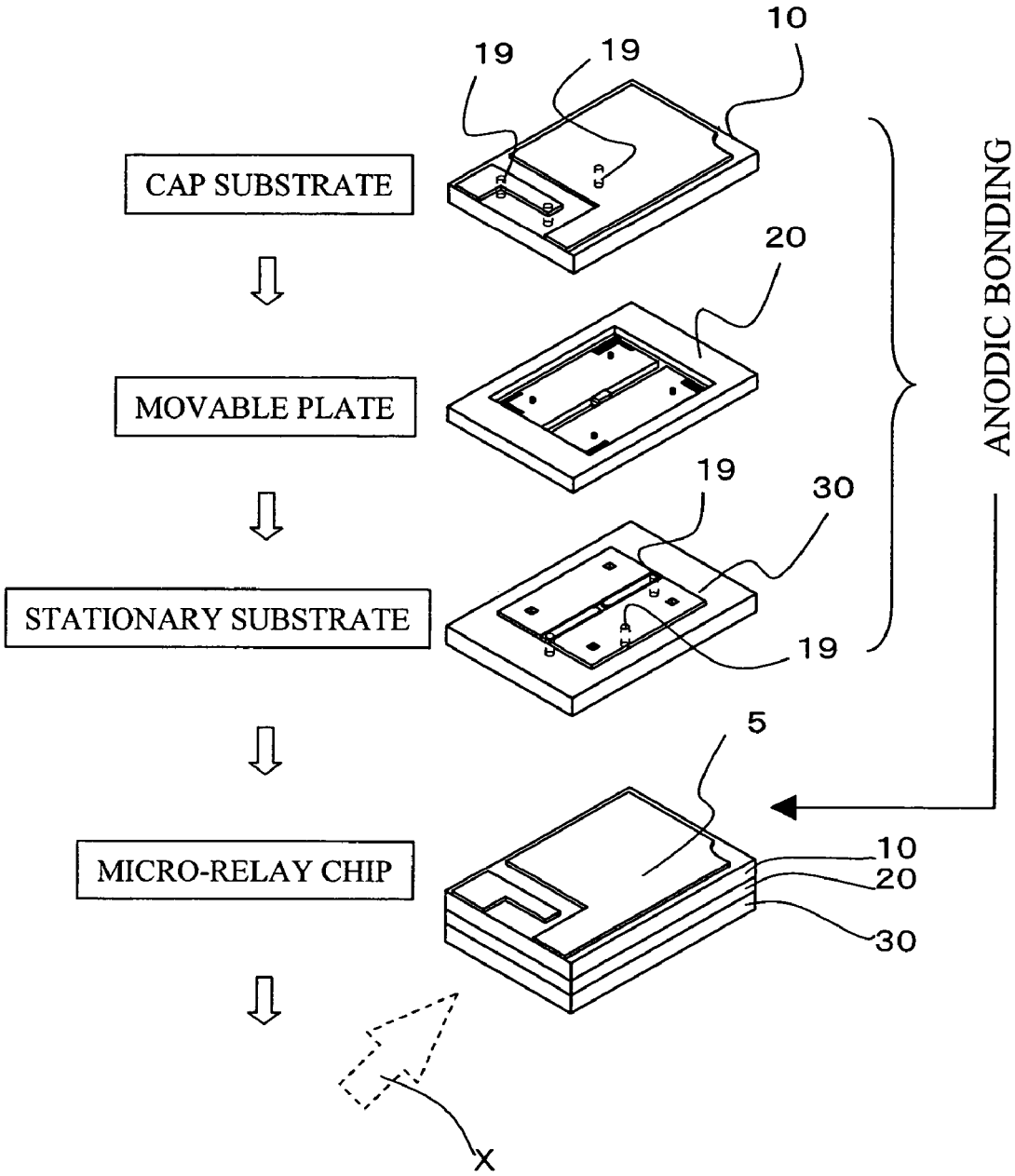
FIG. 8 is an exploded perspective view of a micro-relay according to a third embodiment of the present invention.
Figure 9:
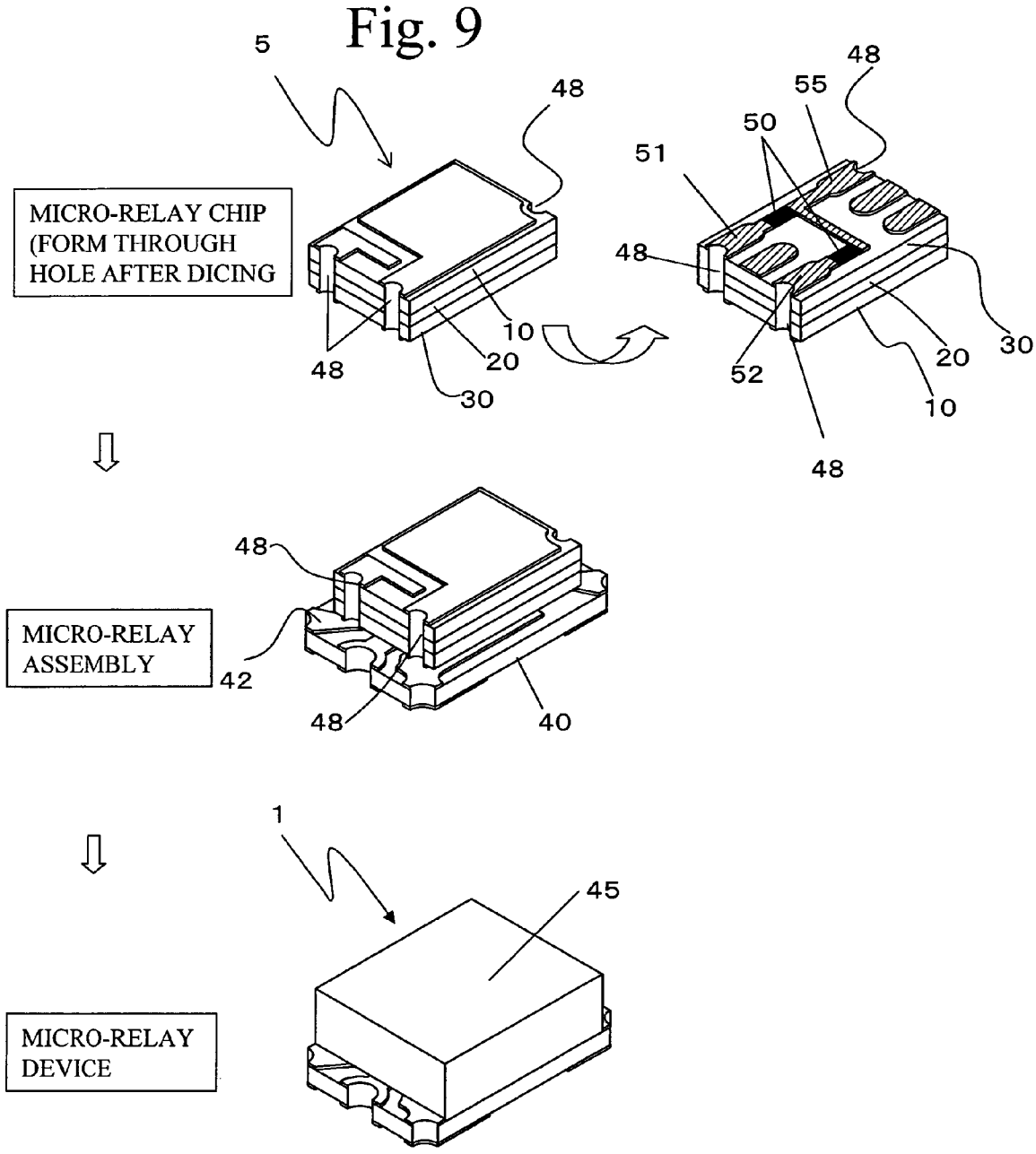
FIG. 9 is an exploded perspective view of a variation of the third embodiment of the present invention.

FIGS. 8 and 9 show a micro-relay according to a third embodiment of the present invention. This micro-relay uses an interconnection line shared by the cap substrate 10, the stationary substrate 30 and the movable plate 20. In FIGS. 8 and 9, the same reference numerals as those shown previously refer to the same structural elements.

The micro-relay chip 5 shown in FIG. 8 has the movable plate 20 that is sandwiched between the cap substrate 10 and the stationary substrate 30 and is joined thereto by anodic bonding as in the case of the first and second embodiments of the present invention. As is shown by an arrow X in FIG. 8, the side surfaces of the members 10, 20 and 30 are flush with each other so that the outer appearance is simple. The through holes 19 are used to extract the electrical lines from the insides of the stationary substrate 30 and the cap substrate 10 to the outsides thereof as in the case of the first embodiment of the invention.

The micro-relay chip 5 shown in FIG. 9 has common interconnection paths (side castellation) 48, each of which is continuously provided on side surfaces of the cap substrate 10, the stationary substrate 30 and the movable plate 20. In the upper part of FIG. 9, the back surface of the micro-relay chip 5 on the right side thereof is illustrated on the right side thereof. The back surface of the micro-relay 5 is the bottom surface of the stationary substrate 30. On the bottom surface, provided are ground pads 51, electrode pads 52 and a pad connected to the movable plate 20. Discharge resistors 50, which will be described layer, are provided on the bottom surface.

As is shown in the middle part of FIG. 9, the micro-relay chip 5 is flip-chip bonded to the base substrate 40 by solder balls, so that a micro-relay assembly can be formed. There is no need to use wire bonding for making connections between the micro-relay chip 5 and the base substrate 40. It can be seen from comparison with FIG. 2 that the base substrate 40 shown in FIG. 9 has a reduced size and a reduced wiring resistance can be obtained. Further, the micro-relay chip 5 does not need any steps for pads. In production, three layers are bonded and are processed to form through holes that are penetrated through these layers. An electrically conductive material is provided to the inner walls of the through holes. Then, the three layers are cut in the dicing process so as to equally divide each through hole into two. In this manner, the micro-relays with the side castellation paths 48 can be easily fabricated.

The top surface of the micro-relay chip 5 that is provided by the back surface of the cap substrate 10 may be coated with an appropriate protection film or the like. In this case, the base substrate 40 may be no longer needed. There may be no need to subject the micro-relay chip 5 to molding with resin. The micro-relay chip 5 is mountable in the bare state. Downsizing of the micro-relay may be further facilitated.

Fourth Embodiment

Figure 10:
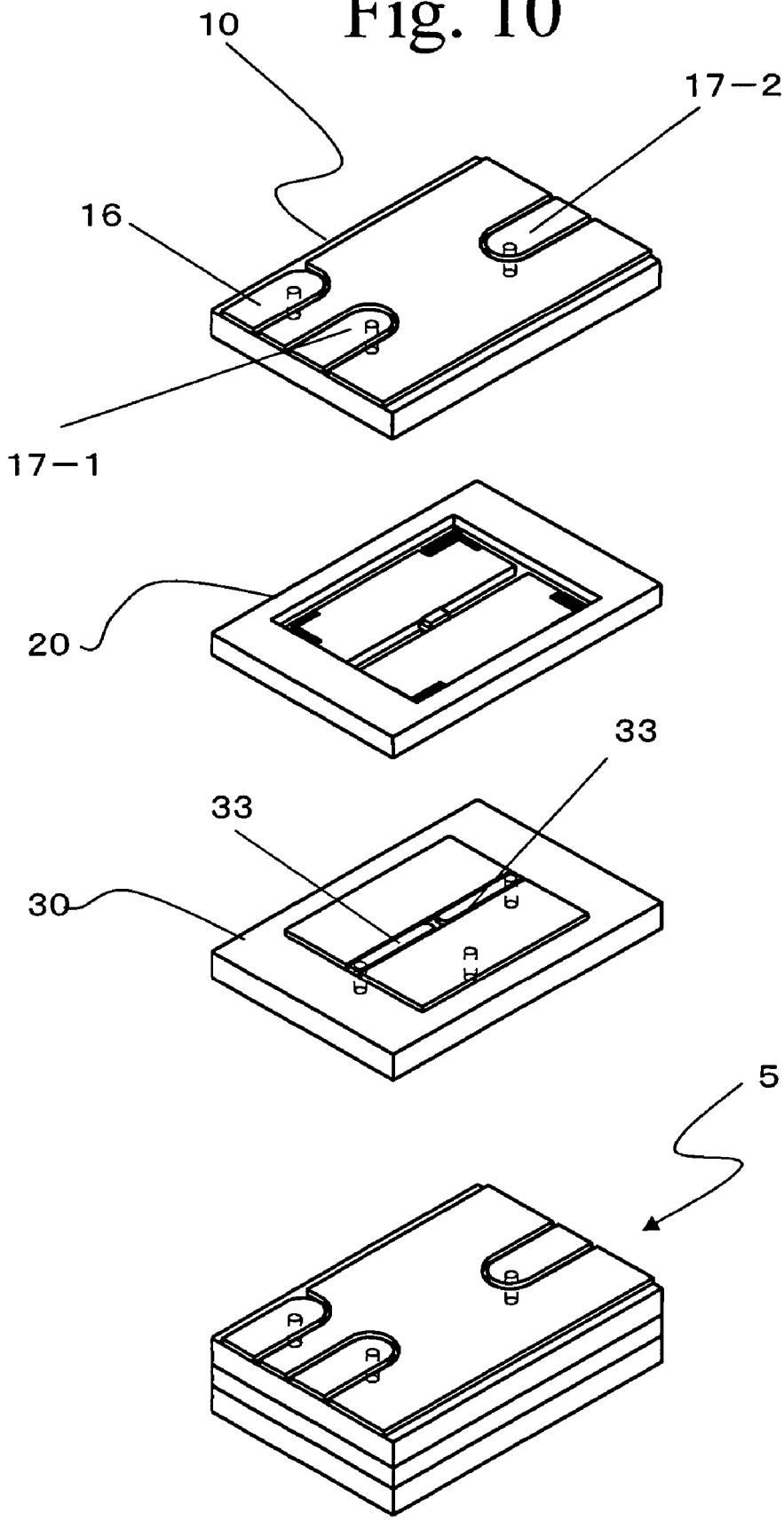
FIG. 10 is an exploded perspective view of a micro-relay according to a fourth embodiment of the present invention.
Figure 11:
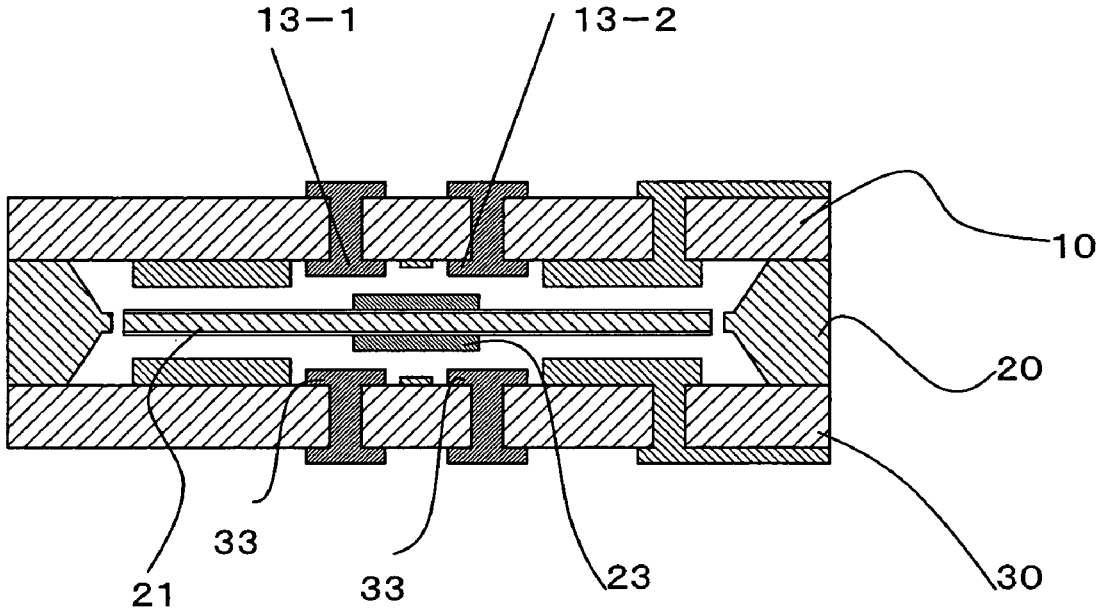
FIG. 11 is a cross-sectional view of the micro-relay shown in FIG. 10.

FIGS. 10 and 11 show a micro-relay according to a fourth embodiment of the present invention. More particularly, FIG. 10 is an exploded perspective view of the micro-relay chip, and FIG. 11 schematically illustrates a cross section of the chip of the micro-relay. The fourth embodiment of the present invention is available by replacing the stationary contact 13 provided to the cap substrate 10 in the first embodiment by contacts provided in a signal line.

More particularly, stationary contacts 13-1 and 13-2 are provided to the cap substrate 10 so as to face the pair of stationary contacts 33 provided to the stationary substrate 30. As shown in FIG. 10, a pair of electrode pads 17-1 and 17-2 on the cap substrate 10 is substituted for the electrode pad 17 used in the first embodiment. The micro-relay according to the fourth embodiment of the present invention is equipped with two signal-line systems, while the first embodiment has only one signal-line system. Thus, downsizing is enabled as compared to a case where two micro-relays of the first embodiment are used for the two signal-line systems. In addition, the number of components can be reduced by using the micro-relay of the fourth embodiment. Two separate micro-switches may be replaced by the single micro-switch with the two signal-line systems.

Figure 12:
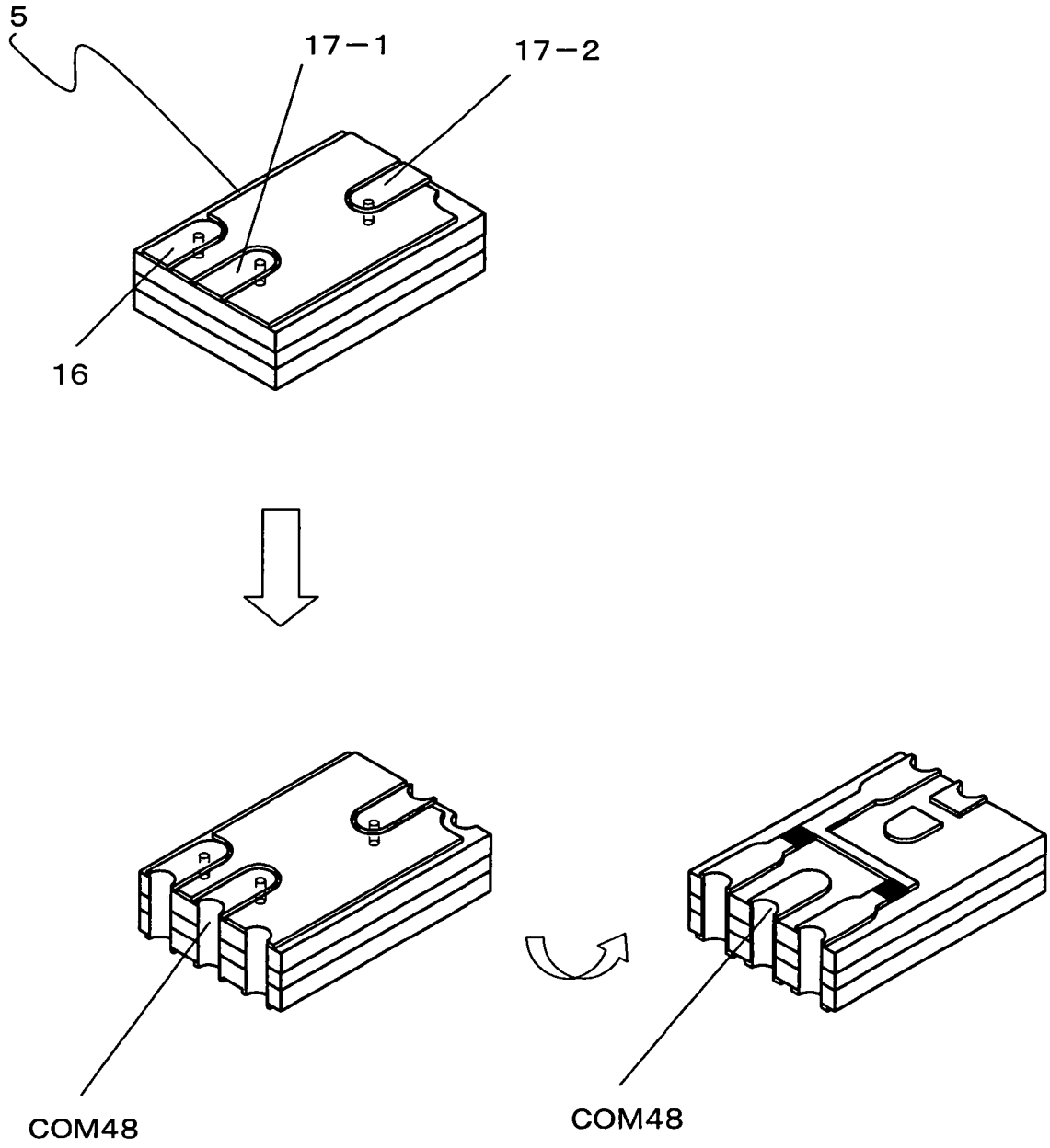
FIG. 12 is a perspective view of a variation of the fourth embodiment of the present invention.

FIG. 12 shows a variation of the micro-relay shown in FIG. 11. This variation utilizes the side castellation paths 48 used in the third embodiment. Common side castellation (COM) 48 are provided for connecting the stationary substrate 30 and the cap substrate 10. The variation has the two signal-line systems like the micro-relay shown in FIG. 11.

Fifth Embodiment

Figure 13:
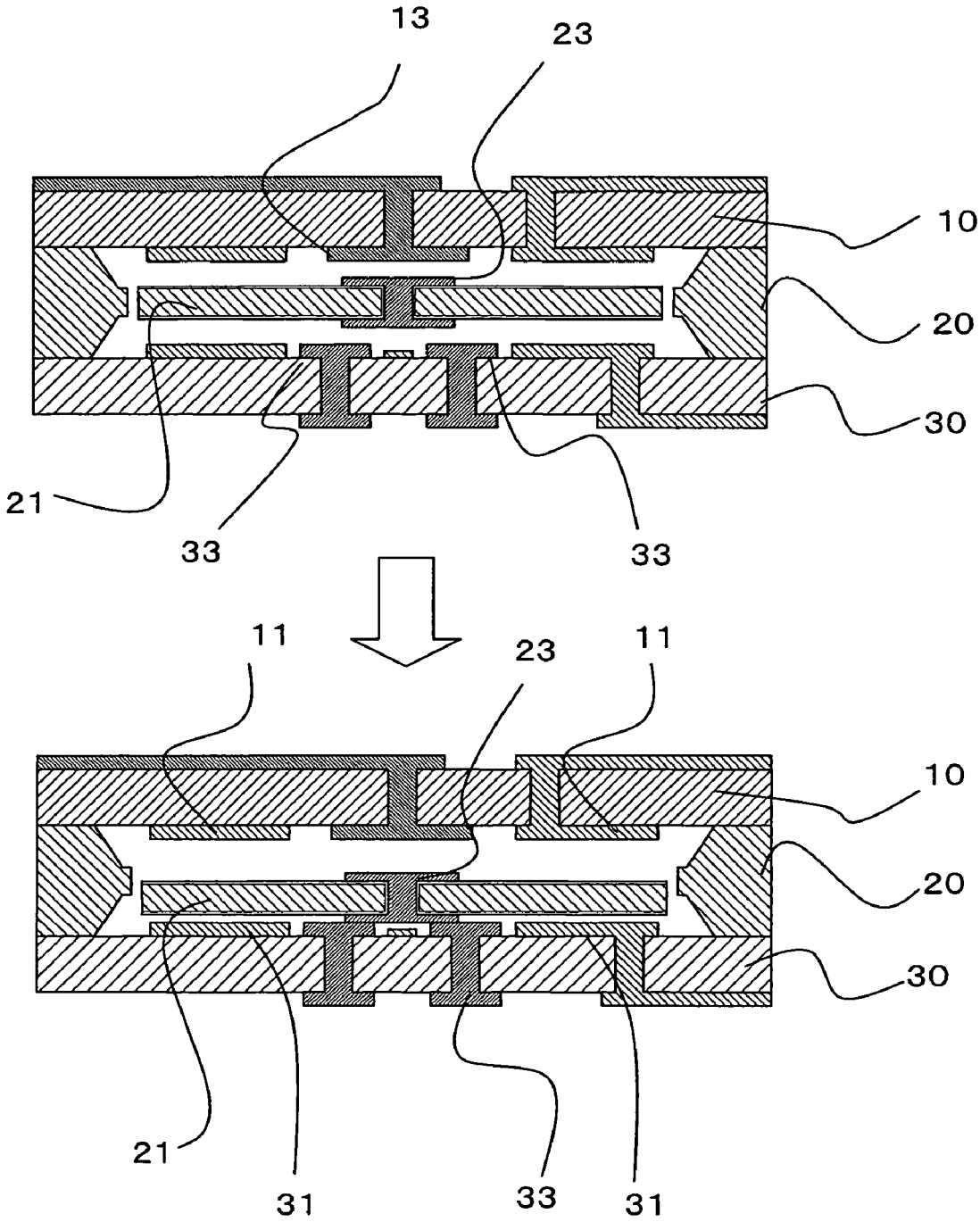
FIG. 13 is a cross-sectional view of a micro-relay according to a fifth embodiment of the present invention.

FIG. 13 shows cross sections of a micro-relay according to a fifth embodiment of the present invention. The movable plate 20 used in this embodiment is comparatively thick. More particularly, the thickness of the movable plate 20 is designed to have stiffness sufficient to prevent the movable portion 21 from being bent after the movable portion 21 is moved due to electrostatic attraction and the movable contact 23 is then brought into contact with the stationary contacts 33. It will be noted that the protrusions 24 in the first embodiment of the invention are taken into consideration bending of the movable portion 21 and are employed in order to prevent the movable portion 21 from sticking to the stationary electrodes 11 and 31. In contrast, the movable portion 21 employed in the present embodiment is not bent, so that it does not need any protrusions like the protrusions 24. This simplifies the production process. The stationary electrodes 11 and 31 have a height sufficient to prevent the movable portion 21 from contacting them when the movable contact 23 is in contact with the stationary electrode 11 or the stationary electrodes 31.

Figure 14:
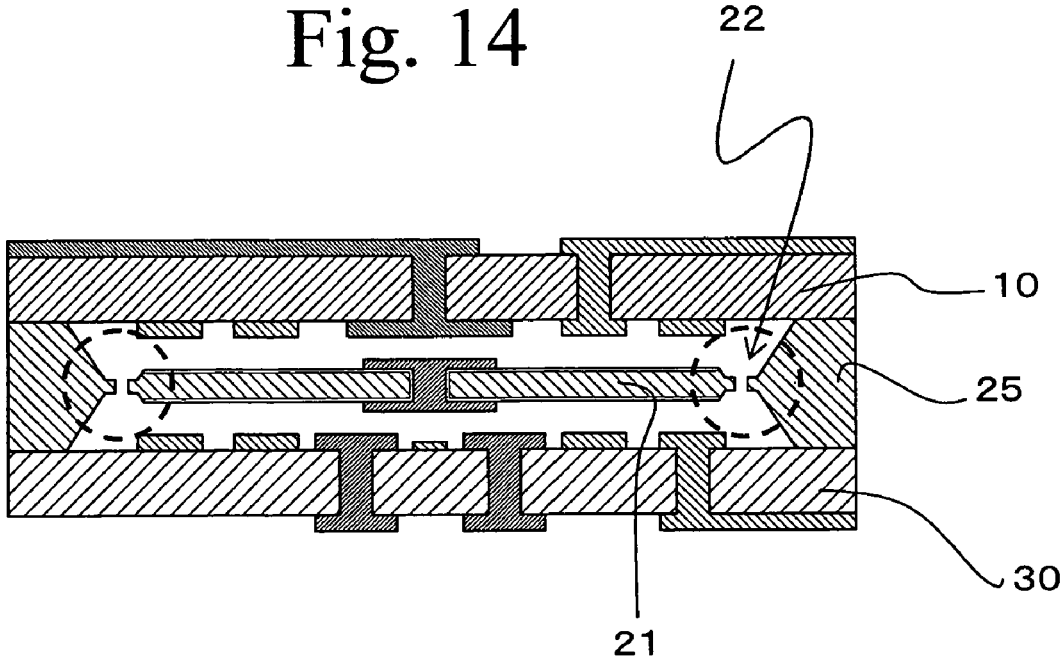
FIG. 14 is a cross-sectional view of a variation of the fifth embodiment of the present invention.

FIG. 14 shows a variation of the above-mentioned fifth embodiment of the present invention. As the thickness of the movable portion 21 increases, the stiffness of the hinge springs 22 surrounded by a circle increases. However, increased stiffness of the hinge springs 22 may make it more difficult for the movable portion 21 to move up and down. Taking into the above into consideration, the hinge springs 22 have a thickness less than that of the movable portion 21 in order to have reduced stiffness and secure smooth up/down movement.

Sixth Embodiment

Figure 15A:
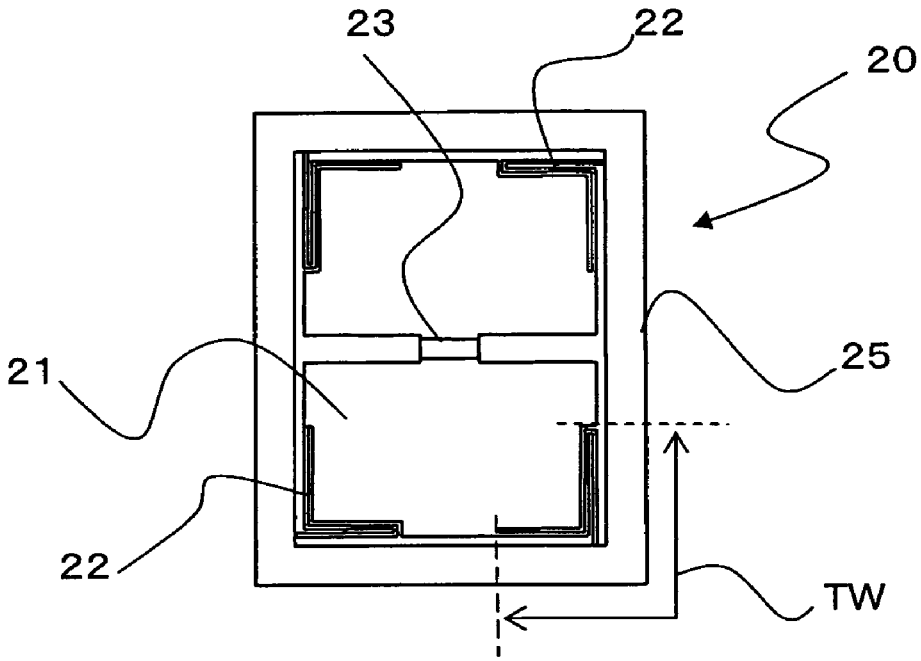
FIGS. 15A and 15B are respectively plan view of a micro-relay according to a sixth embodiment of the present invention.
Figure 15B:
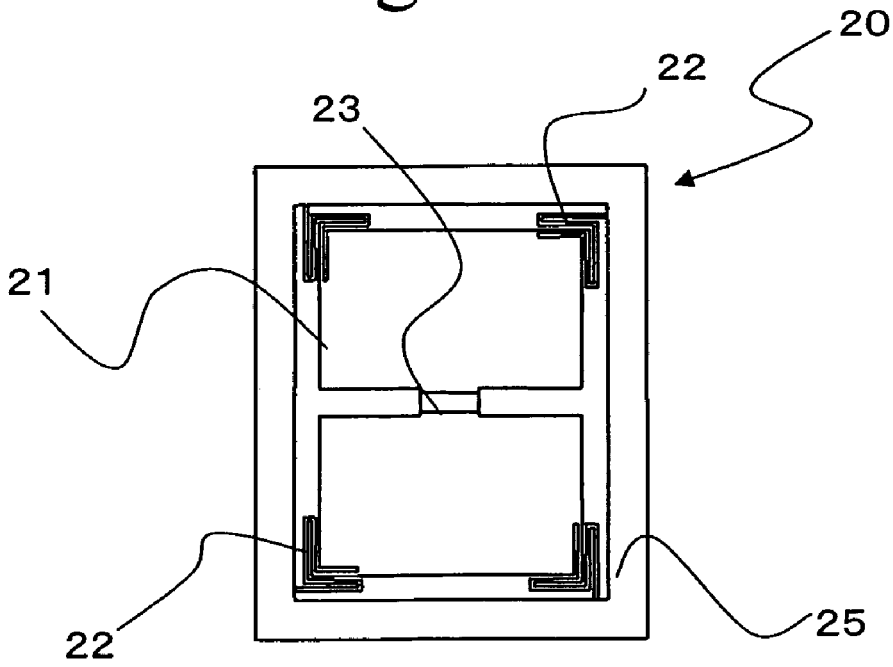

FIGS. 15A and 15B respectively show micro-relays according to a sixth embodiment of the present invention. The hinge springs 22 of the movable plate 20 used in this embodiment has a unique structure. The hinge springs 22 shown in FIG. 15A that are folded multiple times run within an extended range TW in order to reduce the stiffness. FIG. 15B shows another variation of the hinge springs 22 that has an increased number of times the hinge springs 22 are folded for the same purpose as mentioned above. The variations of the hinge springs 22 enable the movable portion 21 to smoothly move up and down, and are particularly suitable for the movable portion 21 having enhanced stiffness.

Seventh Embodiment

Figure 16A:
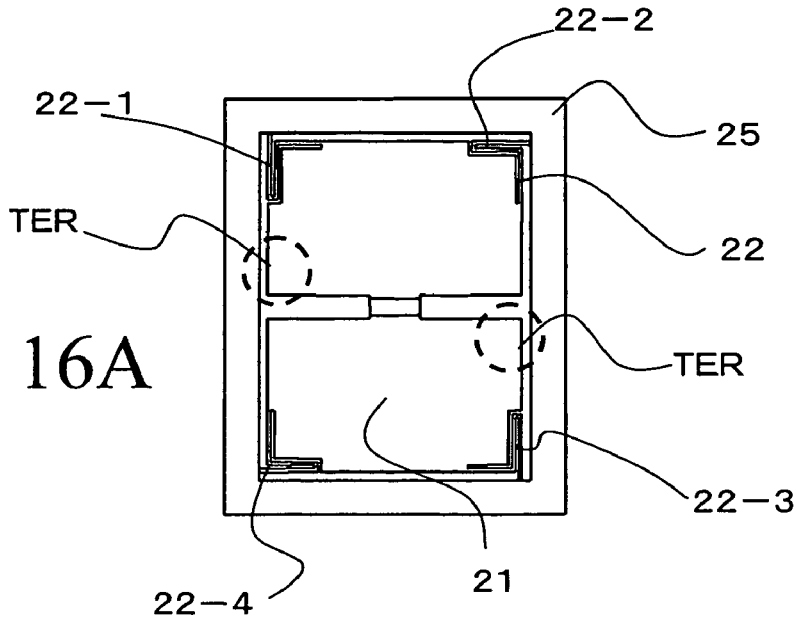
FIGS. 16A, 16B and 16C are respectively plan views of a micro-relay according to a seventh embodiment of the present invention.
Figure 16B:
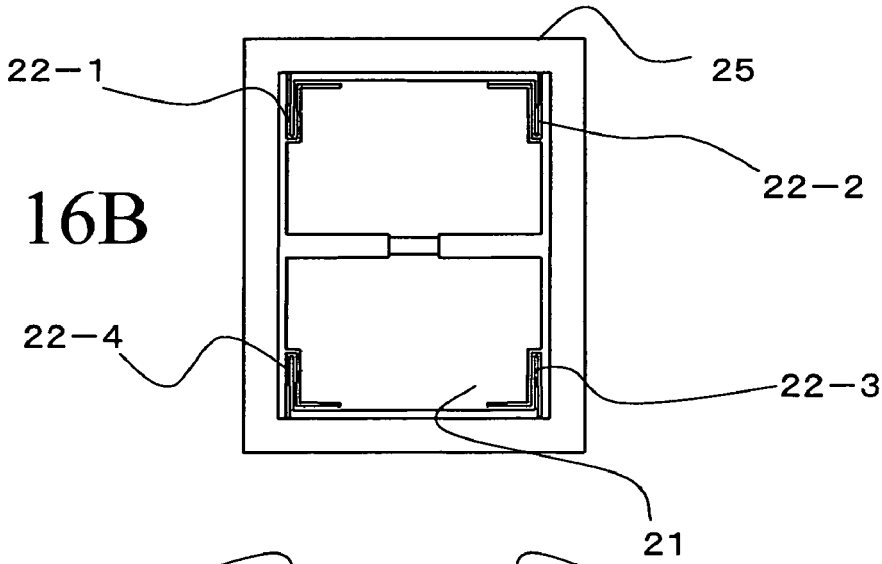
Figure 16C:
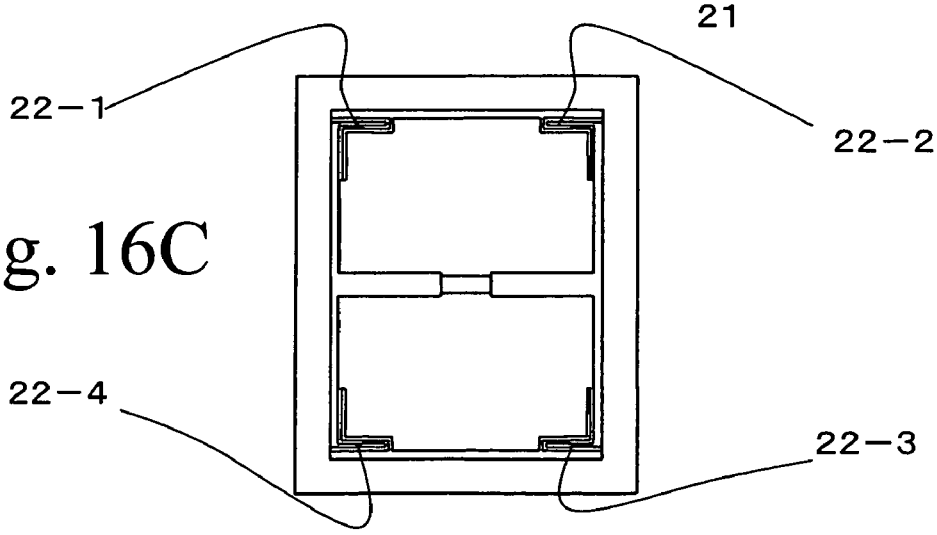

FIGS. 16A, 16B and 16C respectively show micro-relays according to a seventh embodiment of the present invention. The movable plate 20 has hinge springs mentioned below. FIG. 16A shows four hinge springs 22-1 through 22-4, each of which is connected to the respective side of the frame 25, thus supporting the movable portion 21. The hinge springs 22-1 through 22-4 enable the movable portion 21 to move up and down. However, it should be noted that a portion indicated by a circle TER tends to move considerably. Such a considerable movement may disturb smooth up/down movement of the movable portion 21.

In order to avoid the above problem, the hinge springs 22-1 through 22-4 shown in FIGS. 16B and 16C are joined to only two opposite sides of the frame 25. More particularly, in FIG. 16B, the hinge springs 22-1 and 22-4 are jointed to the left side of the frame 25, and the hinge springs 22-2 and 22-3 are joined to the right side thereof. In FIG. 16C, the hinge springs 22-1 and 22-2 are joined to the upper side of the frame 25, and the hinge springs 22-3 and 22-4 are joined to the lower side thereof. In FIGS. 16B and 16C, the hinge springs 22-1 through 22-4 are symmetrically arranged. The symmetrical arrangement balances the movable portion 21 very well and enables its smooth up/down movement. Further, the stability of the movable plate 20 can be improved, so that the protrusions 24 provided to the movable portion 21 in the first embodiment of the present invention may be omitted.

Eighth Embodiment

Figure 17A:
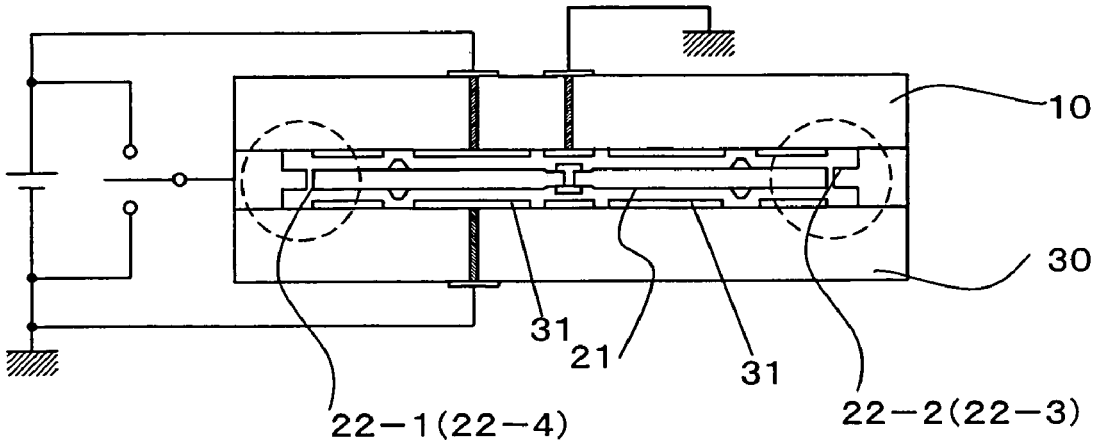
FIGS. 17A, 17B and 17C show a micro-relay according to an eighth embodiment of the present invention.
Figure 17B:
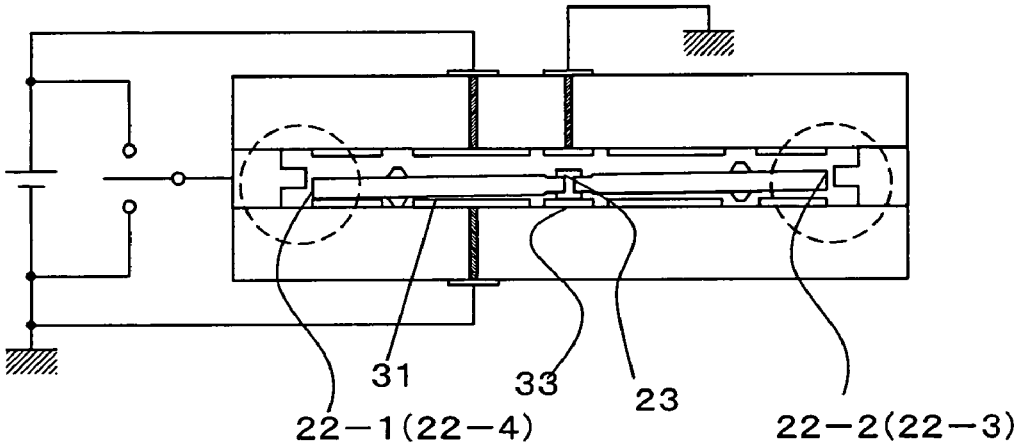
Figure 17C:
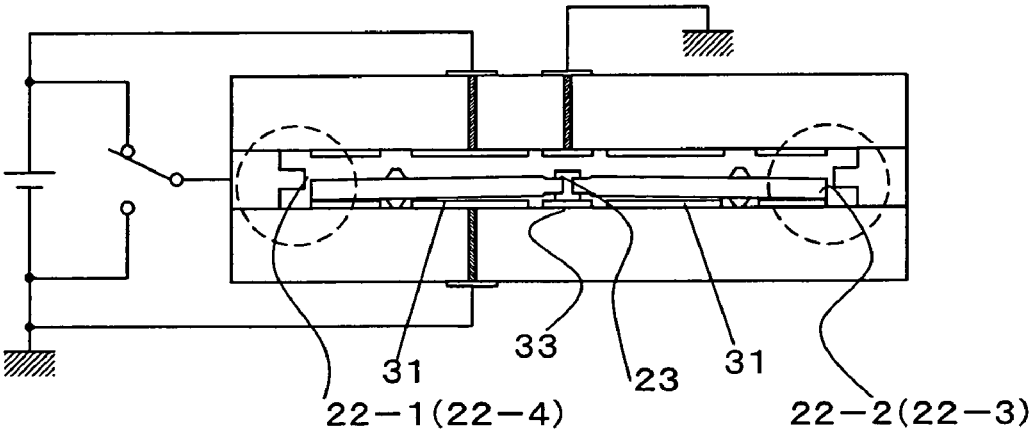

FIGS. 17A, 17B and 17C show a micro-relay according to an eighth embodiment of the present invention. The balance of the spring constants of the hinge springs is changed so that an extremely minute friction can develop between the movable contact and the stationary contact. In the first embodiment of the present invention, the movable portion 21 moves up and down while it is kept in the horizontal state. In contrast, according to the eighth embodiment, the spring constants of the hinge springs are positively adjusted so as to have different values. The four hinge springs 22-1 through 22-4 shown in FIG. 17 have different spring constants. The spring constants of the hinge springs 22-1 through 22-4 can be adjusted by changing their lengths, widths and/or thicknesses.

When the hinge springs 22-1 through 22-4 have different spring constants, the micro-relay operates as shown in FIGS. 17A through 17C. When electrostatic attraction develops in the neutral state, at least one of the hinge springs having a comparatively small spring constant moves first, and only one side of the movable portion 21 is attracted to the stationary electrode 31 as shown in FIG. 17B. In FIG. 17B, the hinge springs 22-1 and 22-4 have a comparatively small spring constant. Then, as shown in FIG. 17C, the distance between the movable portion 21 and the stationary electrode 31 decreases gradually, and the side of the movable portion supported by the remaining hinge springs 22-2 and 22-3 that have a comparatively large spring constant is attracted to the stationary electrode 31. Finally, both the opposite sides of the movable portion 21 are attracted to the stationary electrode 31. On the way from the state of FIG. 17B to that of FIG. 17C, the movable contact and the stationary contacts 33 slightly rub against each other (this is called wiping). The rubbing develops new contact surfaces due to wiping. That is, the rubbing inhibits an insulation coating film from being formed on the contact surfaces and inhibits insulation material from being deposited due to wiping. According to the present invention, the wiped contact surfaces are always available, this stabilizing the contact resistance and improving the reliability of the micro-relay.

The hinge springs 22-1 through 22-4 may be divided into groups, each of which has a respective spring constant. For example, in FIGS. 16A through 16C, the hinge springs 22-1 and 22-4 are grouped and assigned an identical spring constant, and the high springs 22-2 and 22-3 are grouped and assigned another identical spring constant.

Ninth Embodiment

Figure 18:
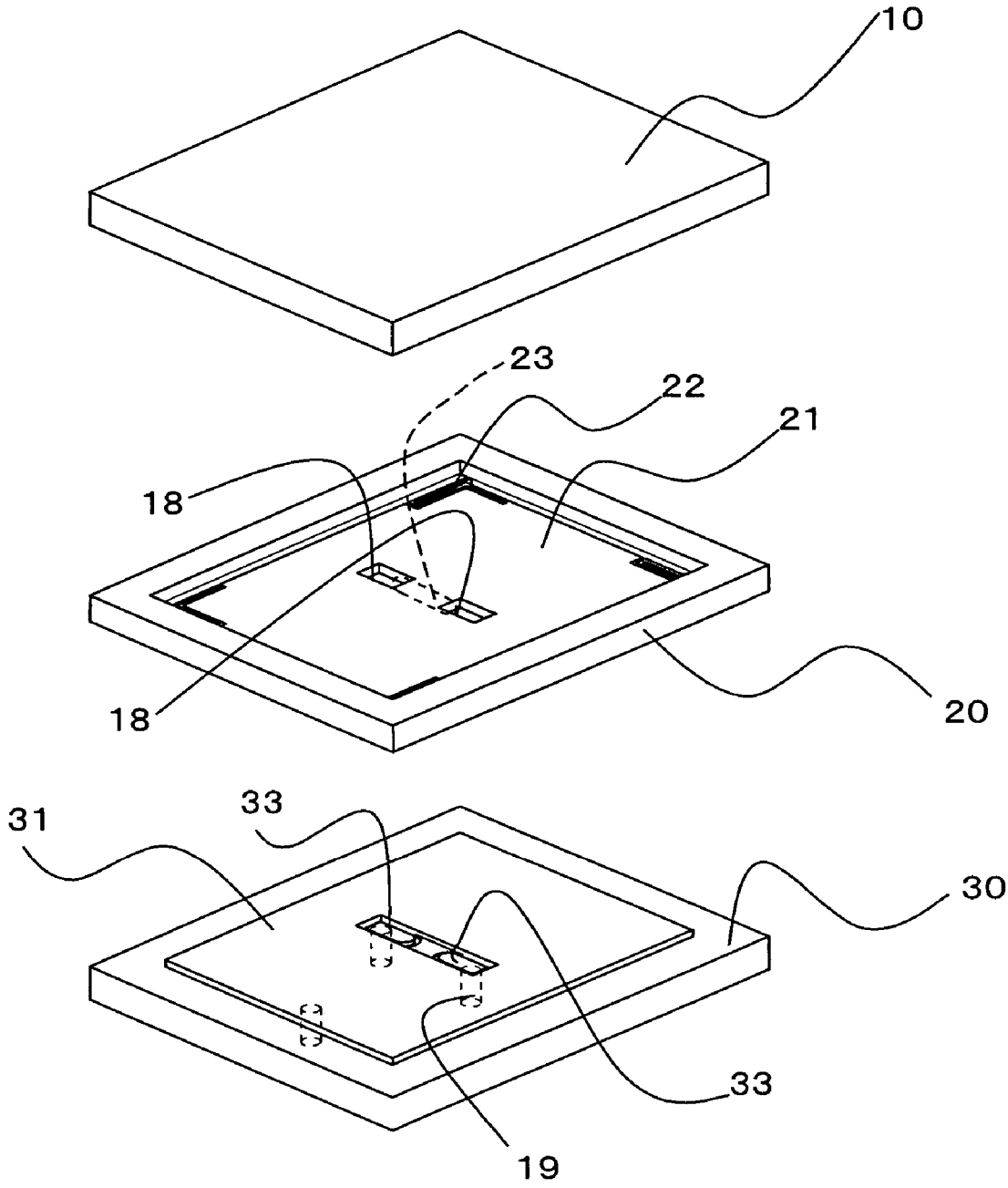
FIG. 18 is an exploded perspective view of a micro-relay according to a ninth embodiment of the present invention.

FIG. 18 is an exploded perspective view of a micro-relay according to a ninth embodiment of the present invention. The stationary electrode 31 and the movable portion 21 employed in this embodiment have improved stiffness in order to enable increased electrostatic attraction to develop therebetween. The movable portion 21 has a plate shape in which a pair of through holes 18 is formed, while the movable portion 21 used in the first embodiment is configured so as to have two plates joined by the movable contact 23. In FIG. 18, the movable contact 23 is attached to a surface portion on the backside of the movable portion 21 interposed between the through holes 18. The movable portion 21 used in this embodiment has higher stiffness than that composed of two plates joined by the movable contact 23. Further, the movable portion 21 in FIG. 18 has an increased electrode area, which develops stronger electrostatic attraction.

The stationary contacts 33 used in the ninth embodiment have a reduced length, and are extracted from the backside of the stationary substrate 30 via the through holes 19. The stationary substrate 30 used in the present embodiment has an increased electrode area of the stationary electrode 31 because of reduction in the lengths of the stationary contacts 33. This structure improves the stiffness of the stationary electrode 31 and increases the electrostatic attraction exerted on the movable portion 21. The micro-relay thus configured has the mechanically strengthened movable portion 21 and the stationary electrode 31, which accepts increased electrostatic force. The driving efficiency is thus improved.

Even in a case where only one of the stationary electrode 31 and the movable portion 21 is employed, similar effects can be provided. The structure of the stationary electrode 31 can be applied to the cap substrate 10 and the stationary electrode 11 for the arrangement of the fourth embodiment shown in FIG. 10, in which the stationary contact 13 of the cap substrate 10 is composed of the signal contacts provided in the signal line.

Tenth Embodiment

Figure 19A:
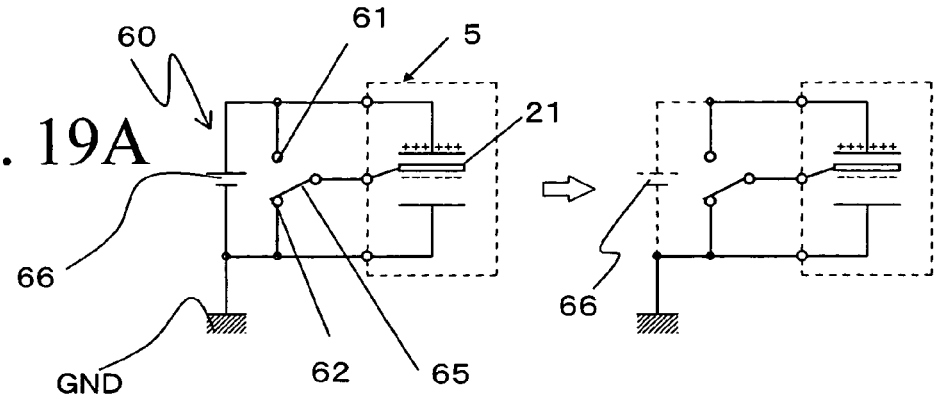
FIGS. 19A, 19B and 19C show a micro-relay according to a tenth embodiment of the present invention.
Figure 19B:
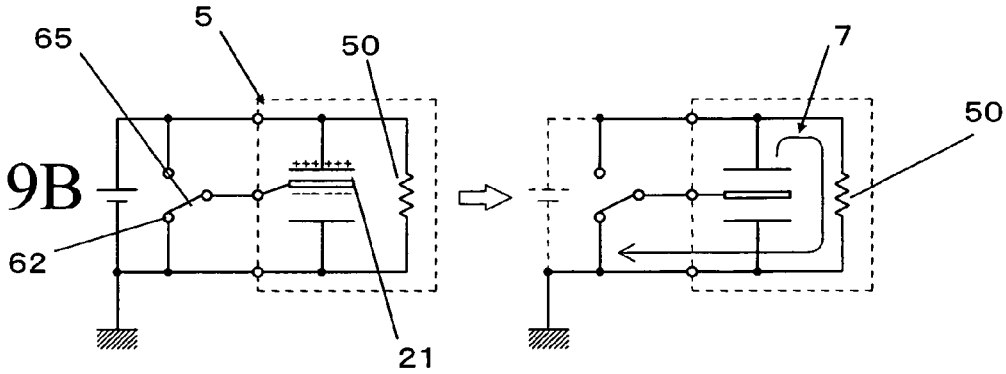
Figure 19C:
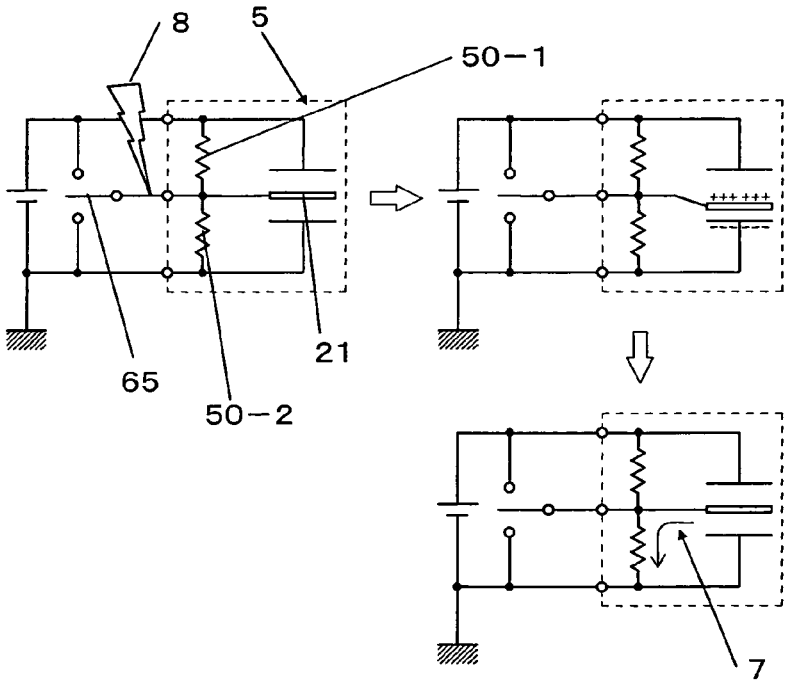

FIGS. 19A, 19B and 19C show a micro-relay according to a tenth embodiment of the present invention. This micro-relay is equipped with a mechanism capable of removing charges in the stationary electrode 31 and the movable portion 21. A drive circuit 60 drives the micro-relay. FIG. 19A shows a fault that may occur in the absence of a discharge resistor. When a DC power supply 66 is turned OFF, charges remain the stationary electrode 31 and the movable electrode 21. The residual charges causes an unwanted state in which the movable portion 21 is maintained in the contact state or another unwanted state in which a leakage current flows to gradually discharge the stationary electrode 31 and the movable portion 21, so that the movable portion 21 is returned to the neutral state. Further, the residual charges may cause unstable movement of the movable portion 21.

FIG. 19B shows a discharge resistor 50 connected between the power supply 66 and the ground. FIG. 19C shows a discharge resistor 50-1 connected between the power supply 66 and the movable portion 21, and a discharge resistor 50-2 connected between the movable portion 21 and the ground. In FIG. 19B, current 7 flows through the discharge resistor 50 when the power supply is turned OFF. Thus, no charge remains and the movable portion 21 is rapidly returned to the neutral state.

In FIG. 19C, even if the movable portion 21 is driven due to an external disturbance 8 when the movable contact 65 is in the neutral position, current 7 flows through the discharge resistor 50-2, so that the micro-relay cannot be affected at all.

Eleventh Embodiment

Figure 20A:
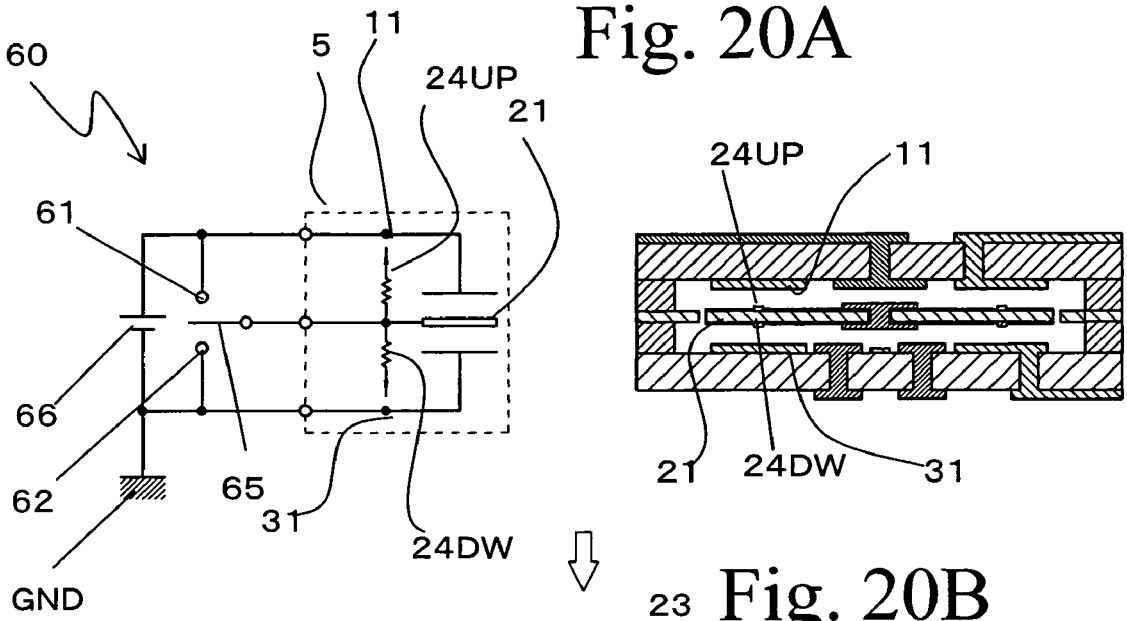
FIGS. 20A, 20B and 20C show a micro-relay according to an eleventh embodiment of the present invention.
Figure 20B:
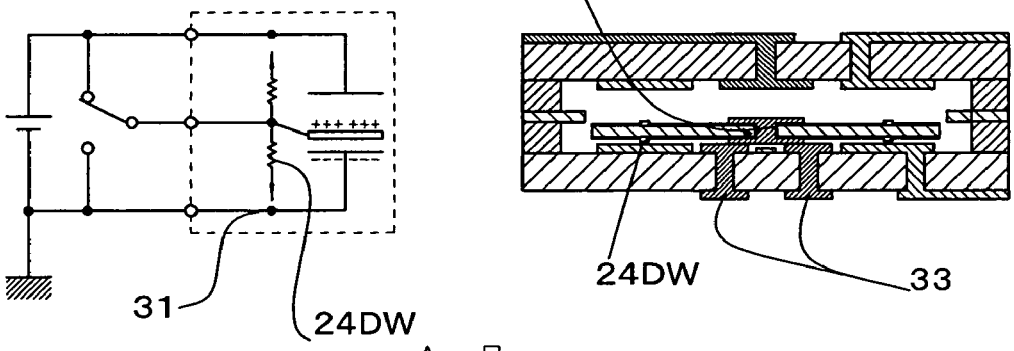
Figure 20C:
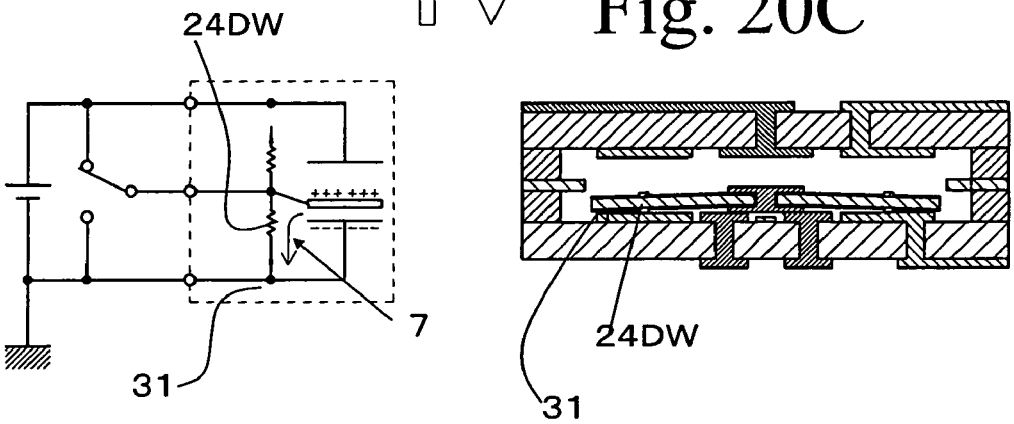

FIGS. 20A, 20B and 20C show a micro-relay according to an eleventh embodiment of the present invention, in which the protrusions provided to the movable portion are assigned a discharge resistance function. As has been described previously, the protrusion 24 provided to the movable portion 21 serve as the stoppers that prevent the movable portion 21 from sticking to the stationary electrodes 11 and 31. According to the eleventh embodiment of the present invention, the protrusions 24 also function as discharge resistors, which remove the residual charges.

A resistor is provided on the surface of each protrusion 24 by doping silicon or polysilicon with an impurity. FIGS. 20A through 20C show an operation in which the movable portion 21 goes down. The movable contact 65 of the switch, which is in the neutral position, is changed so as to make a connection with the contact 61, as shown in FIG. 20B. The movable portion 21 is thus electrically attracted to the stationary electrode 31. The movable contact 23 of the micro-relay is brought into contact with the stationary contacts 33, so that the circuit including the micro-relay is looped. At this time, the lower protrusions 24DW have not yet been brought into contact with the stationary electrode 31. Then, the movable portion 21 is further attracted and the lower protrusions 24DW are pressed against the stationary electrode 31. At that time, the lower protrusions 24DW prevent the movable portion 21 from sticking to the stationary electrode 31 and simultaneously function as the discharge resistors between the movable portion 21 and ground. Thus, the lower protrusions 24DW prevent the charges from remaining in the movable portion 21 and the stationary electrode 31. It is therefore possible to relax exclusive electrostatic attraction after the circuit is looped and effectively prevent sticking of the movable portion 21. Preferably, it is desired to take the time constant and the resonance frequency of the movable portion 21 into account in order to prevent vibration.

Twelfth Embodiment

Figure 21:
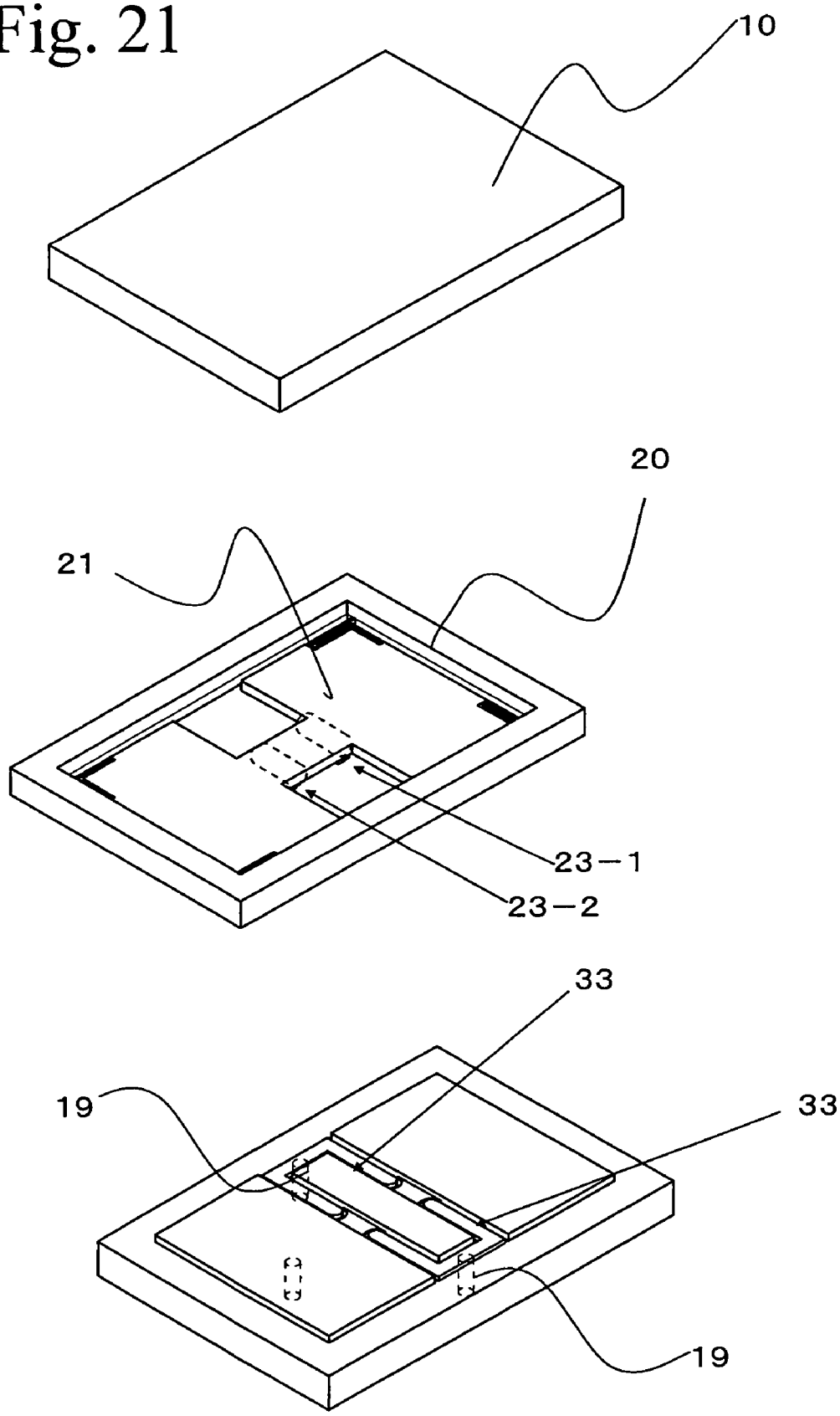
FIG. 21 is an exploded perspective view of a micro-relay according to a twelfth embodiment of the present invention.

FIG. 21 is an exploded perspective view of a micro-relay according to a twelfth embodiment of the present invention. The movable portion employed in this embodiment is equipped with two movable contacts 23-1 and 23-2. Correspondingly, the stationary contacts 33 provided to the stationary substrate 30 are approximately C-shaped contacts. The movable contact 23-1 makes contact with the two C-shaped contacts 33, and the movable contact 23-2 makes contact therewith. This is a redundant arrangement. That is, even if either the movable contact 23-1 or 23-2 or one of the C-shaped stationary contacts 33 becomes defective, the original function of the relay can be secured. The movable portion 21 may have three or more movable contacts. The structure of the movable portion 21 can be applied to the stationary contact 13 of the cap substrate 10 composed of the signal contacts provided in the signal line shown in FIG. 10 that depicts the fourth embodiment of the present invention.

Figure 22:
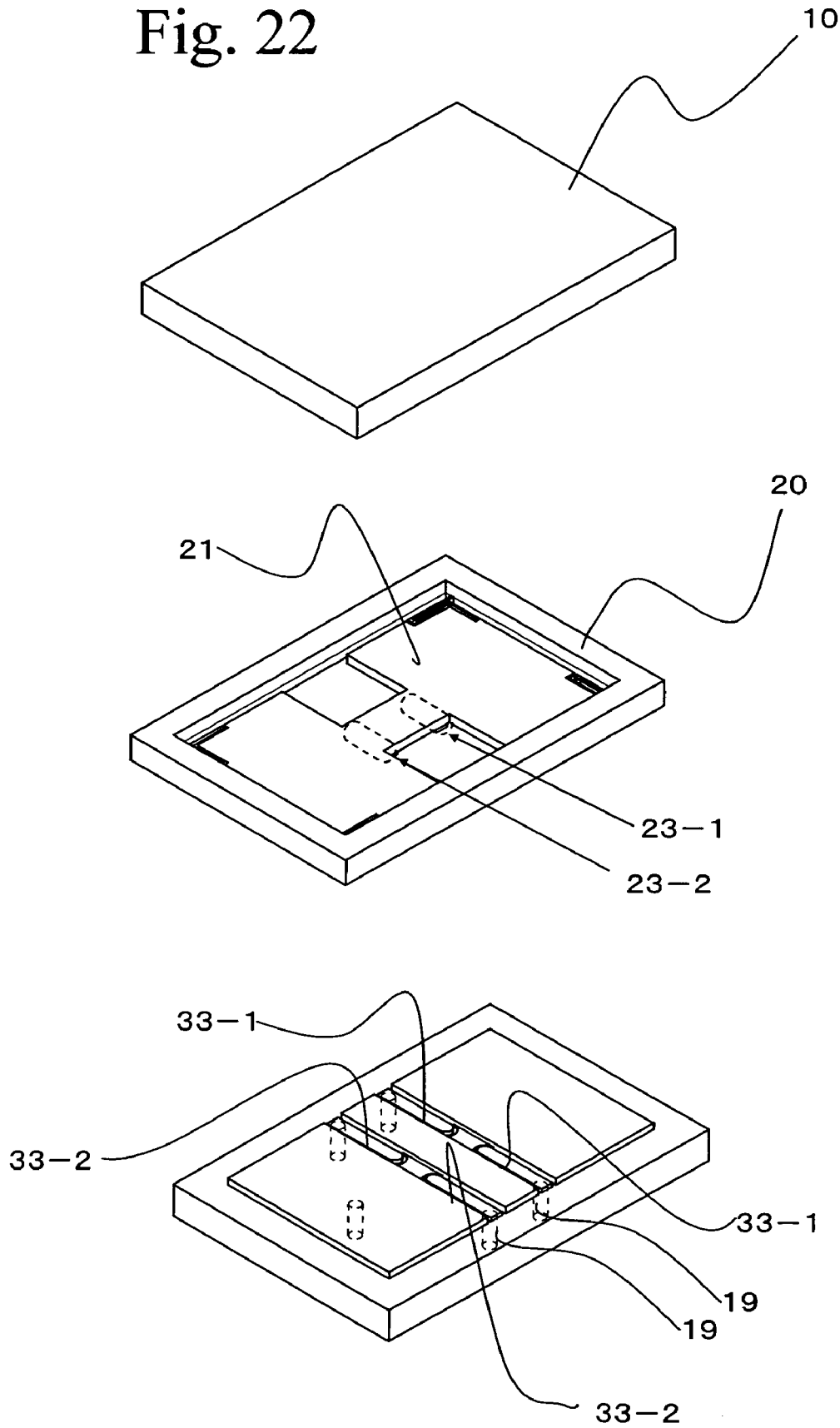
FIG. 22 is an exploded perspective view of a variation of the twelfth embodiment of the present invention.

FIG. 22 is an exploded perspective view of a micro-relay that is a variation of the fourth embodiment of the present invention. In the above-mentioned structure shown in FIG. 22, each of the C-shaped stationary contacts 33 shown in FIG. 21 is divided into two contacts 33-1 and 33-2. The movable contact 23-1 makes contact with a pair of stationary contacts 33-1 and 33-2. Similarly, the movable contact 23-2 makes contact with another part of stationary contacts 33-1 and 33-2. According to this variation, the signal line has a redundant structure in addition to the redundant structure of contacts. Thus, the micro-relay of FIG. 22 is more reliable.

Thirteenth Embodiment

Figure 23A:
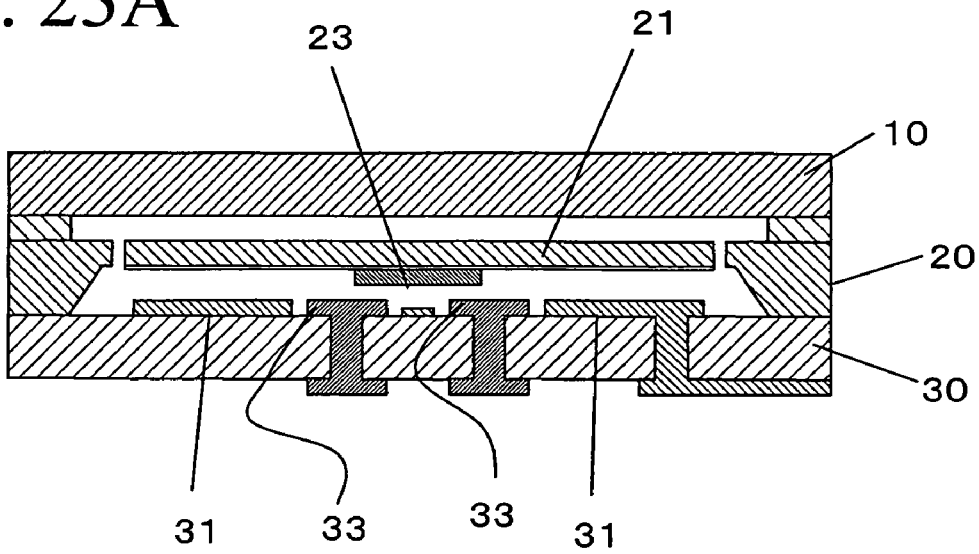
FIGS. 23A, 23B and 23C are respectively cross-sectional views of a micro-relay according to a thirteenth embodiment of the present invention.
Figure 23B:
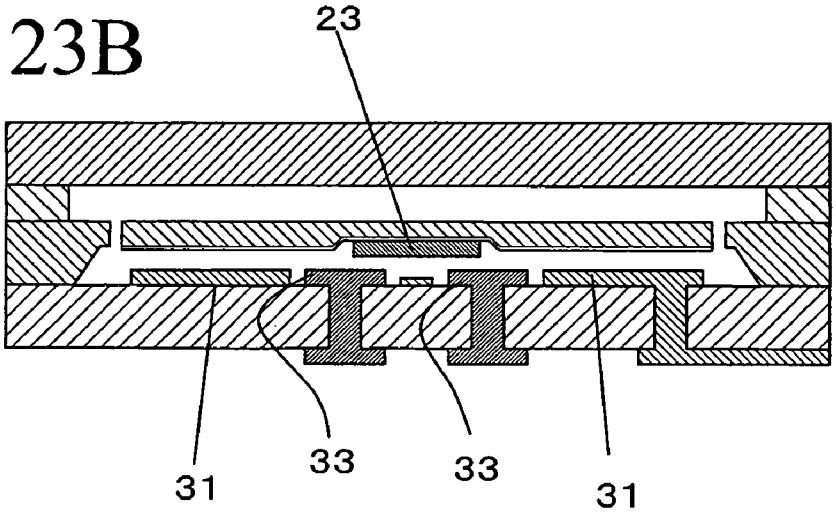
Figure 23C:
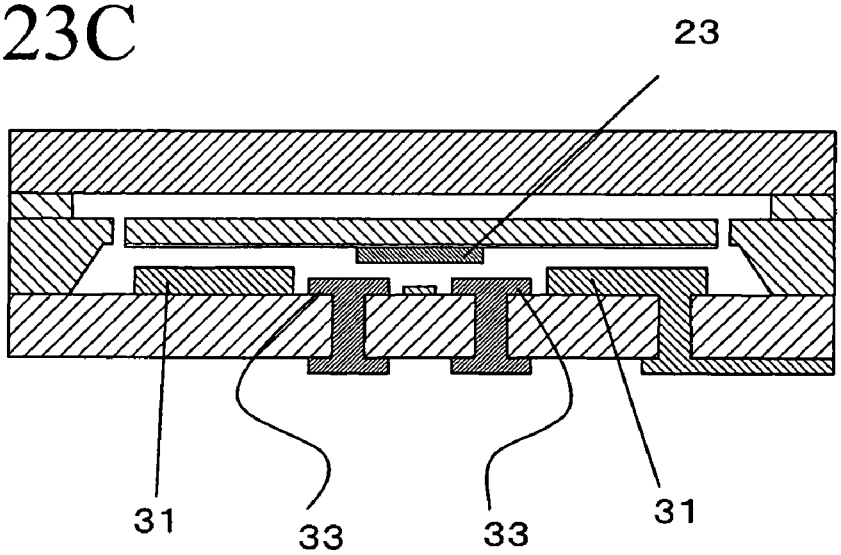

FIGS. 23A, 23B and 23C respectively relate to a micro-relay according to a thirteenth embodiment of the present invention. The present embodiment employs a preferable structure of the stationary electrode formed on the stationary electrode. FIGS. 23A and 23B are respectively cross-sectional views of comparative examples, and FIG. 23C is a cross-sectional view of a micro-relay according to the thirteenth embodiment of the invention. In the micro-relay shown in FIG. 23A, the stationary electrode 31 and the stationary contacts 33 supported by the stationary substrate 30 are approximately flush with each other. Thus, there is a large spacing between the stationary electrode 31 and the movable portion 33 serving as the movable electrode. Such a large spacing needs for a high drive voltage in order to obtain the designed electrostatic attraction. The structure shown in FIG. 23B may solve the above problem. In FIG. 23B, the movable contact 23 is placed in a recess formed on the inner surface of the movable portion 21, so that the movable contact 23 shifts upwards. However, it is difficult to form the structure of FIG. 23B, and an increased number of production steps is needed. This raises the cost.

In contrast, the stationary electrode 31 shown in FIG. 23C is higher than the stationary contacts 33. It is preferable that the difference in height between the stationary electrode 31 and the stationary contacts 33 is made slightly less than the height of the movable contact 23 measured from the top surface of the stationary substrate 30. According to the present embodiment, the structure is simple and the movable portion 21 can be surely attracted.

The insulation film on the upper side of the movable portion 21 and the structure of the cap substrate 10 are simply illustrated. It is preferable to modify the stationary electrode provided to the cap substrate 10 in the same manner as the stationary electrode 31.

Fourteenth Embodiment

Figure 24:
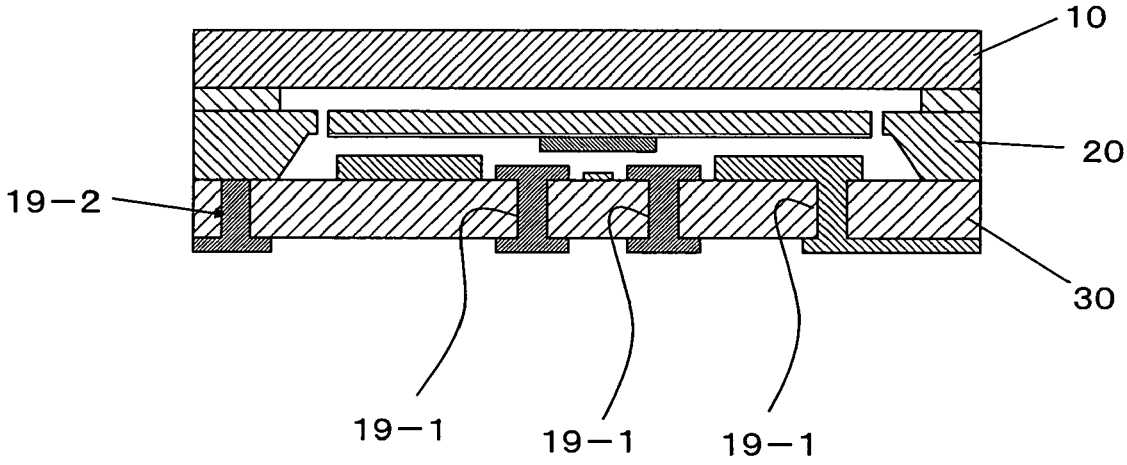
FIG. 24 is a cross-sectional view of a micro-relay according to a fourteenth embodiment of the present invention.

FIG. 24 is a cross-sectional view of a micro-relay according to a fourteenth embodiment of the present invention. This micro-relay is equipped with the movable plate 20 that has a unique interconnection structure. A through hole 19-2 is formed in the stationary substrate 30 via which the interconnection line extending from the movable plate 20 is extracted to the backside of the stationary substrate 30. The through hole 19-2 can be formed simultaneously with the through holes 19-1. Thus, the production process can be simplified as compared to the aforementioned embodiments of the present invention. The through hole 19-2 may be formed in the cap substrate 10 instead of the stationary substrate 30. It will be noted that the periphery of the movable portion and the structure of the cap substrate 10 are simply illustrated.

Fifteenth Embodiment

Figure 25:
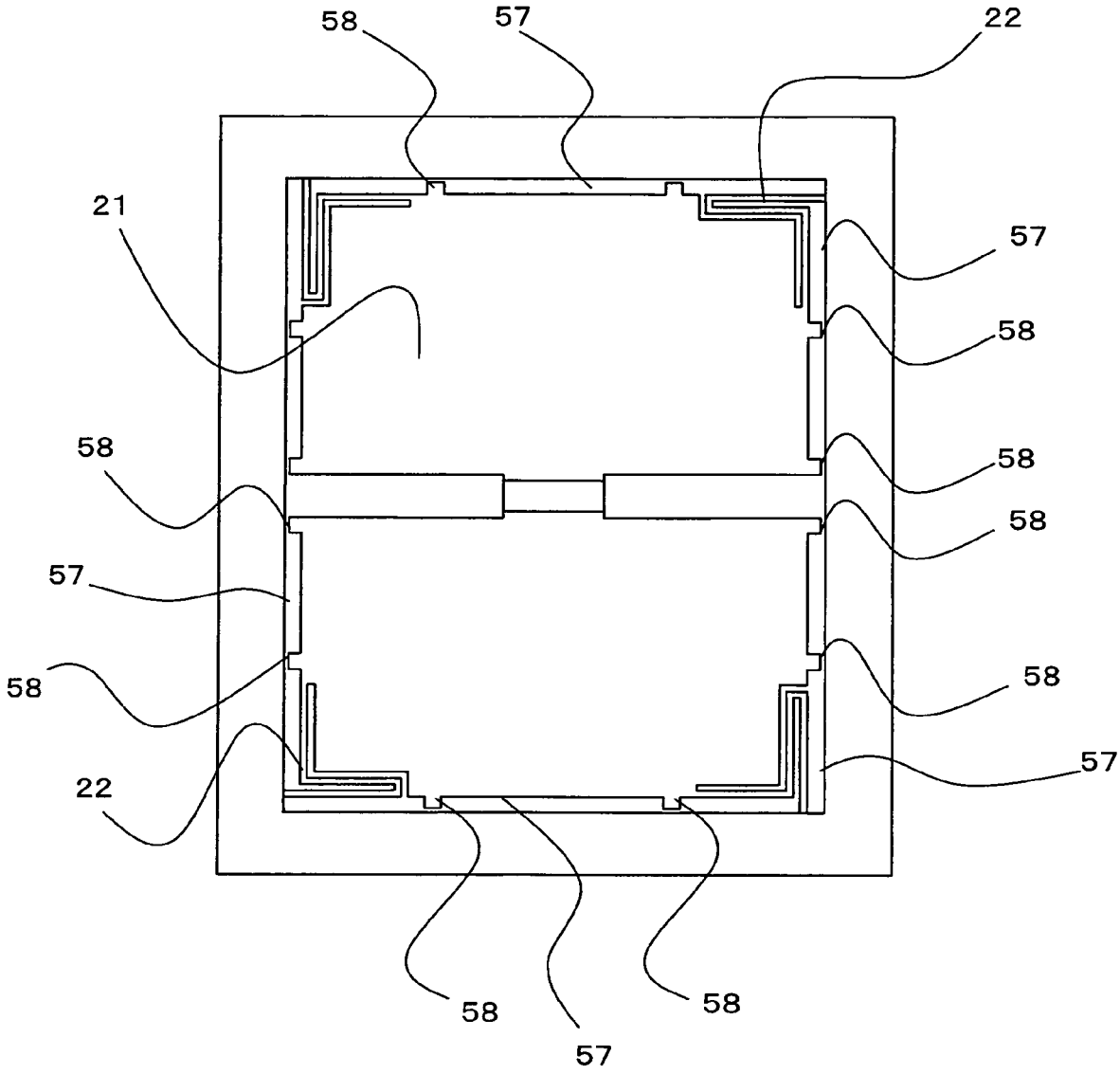
FIG. 25 is a plan view of a micro-relay according to a fifteenth embodiment of the present invention.

FIG. 25 is a plan view of a micro-relay according to a fifteenth embodiment of the present invention. This micro-relay is equipped with the movable plate 20 that has a unique structure. As shown in FIG. 25, there are provided gaps 57 between the side edges and the frame 25, and multiple outer stoppers 58 that protrude from the side edges of the movable portion 21 towards the inner sides of the frame 25. The stoppers 58 restrict horizontal movement (in-plane movement) of the movable portion 21. The stoppers 58 may be formed integrally with the movable portion 21. Alternatively, a material having excellent elasticity may be added to the movable portion 21, so that crushproof can be improved.

Preferably, the stoppers 58 may be symmetrically arranged. The stoppers 58 are very small projections and do not prevent airflow caused by the up/down movement of the movable portion 21. The stoppers 58 integrally formed with the movable portion 21 do not need an additional production step.

The stoppers 58 may be provided to the frame 25 instead of the movable portion 21. It is also possible to provide the stoppers 58 to both the movable portion 21 and the frame 25.

As a variation of all the aforementioned embodiments of the present invention, a ground pad or pattern may be provided on the entire outer or top surface of the cap substrate 10, so that the signal line can be shielded more effectively. The ground pattern also functions to protect electrostatic attraction from being affected by external turbulence such as static electricity and to prevent malfunctions of the micro-relay. It is also possible to provide an insulation film on the side surfaces of the laminated structure of the micro-relay chip on which a metal layer is provided for obtaining the shield effect. Preferably, the movable contacts 23 and the stationary contacts 13 and 33 have an underlying layer of Au, which is coated with a platinum-base metal such as Rh, Ru, Pd or Pt. The Au underlying layer serves as a cushioning member, and the surface layer of the platinum-base metal has a high degree of hardness. The contacts of the above multilayer structure do not easily stick to each other.

Figure 26:
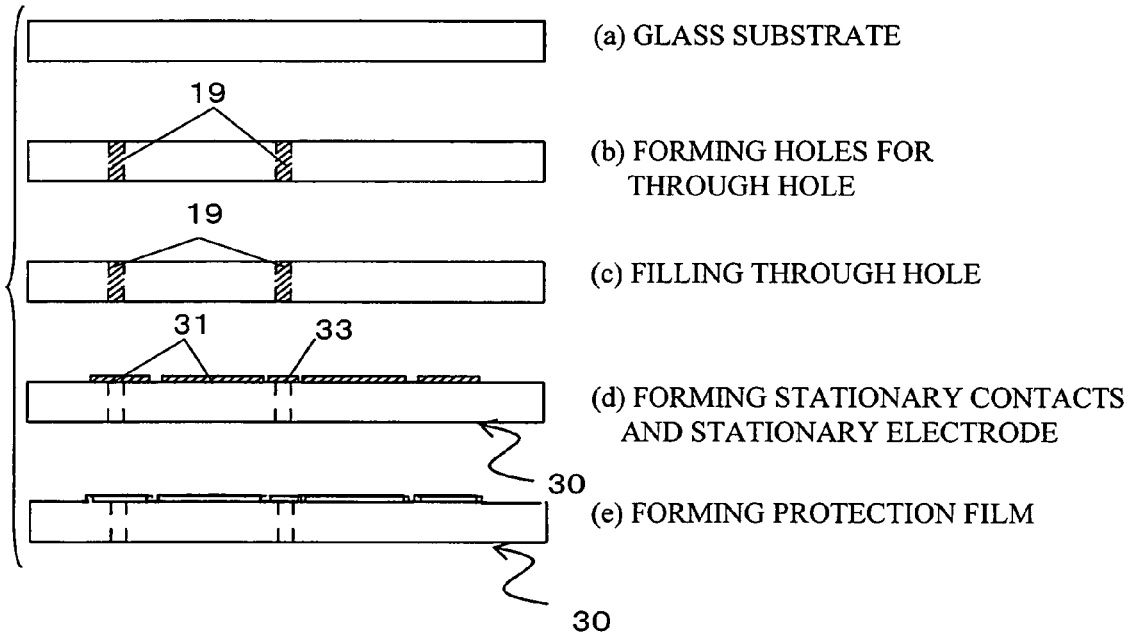
FIG. 26 shows a process for producing a stationary substrate used in the second embodiment of the present invention.
Figure 27:
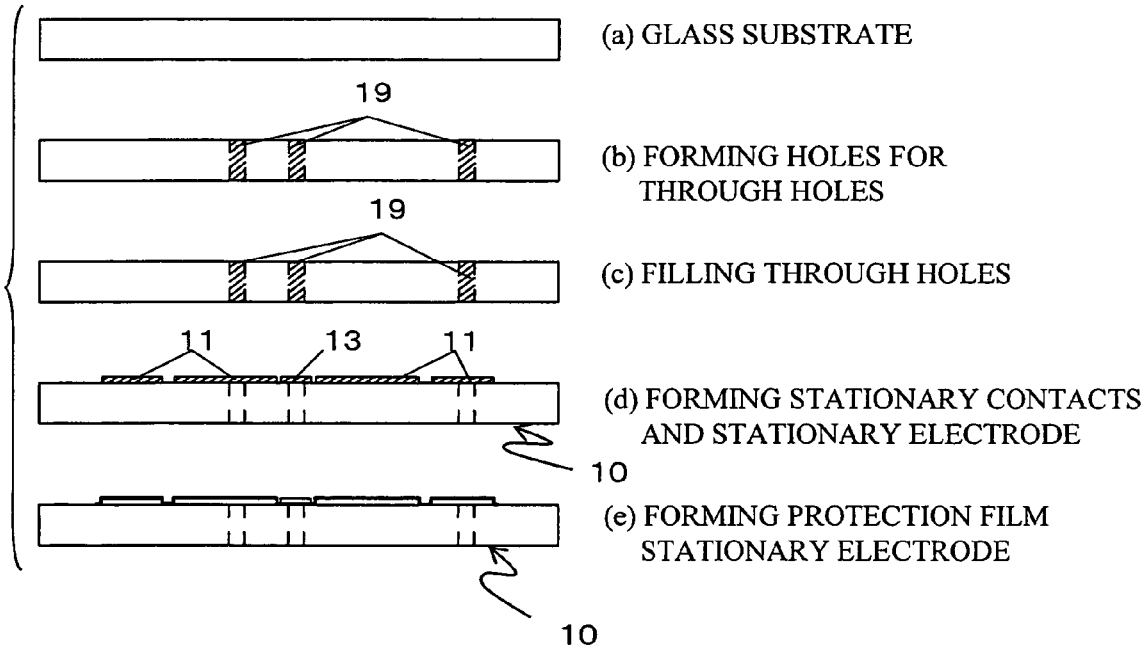
FIG. 27 shows a process for producing a cap substrate used in the second embodiment of the present invention.
Figure 28:
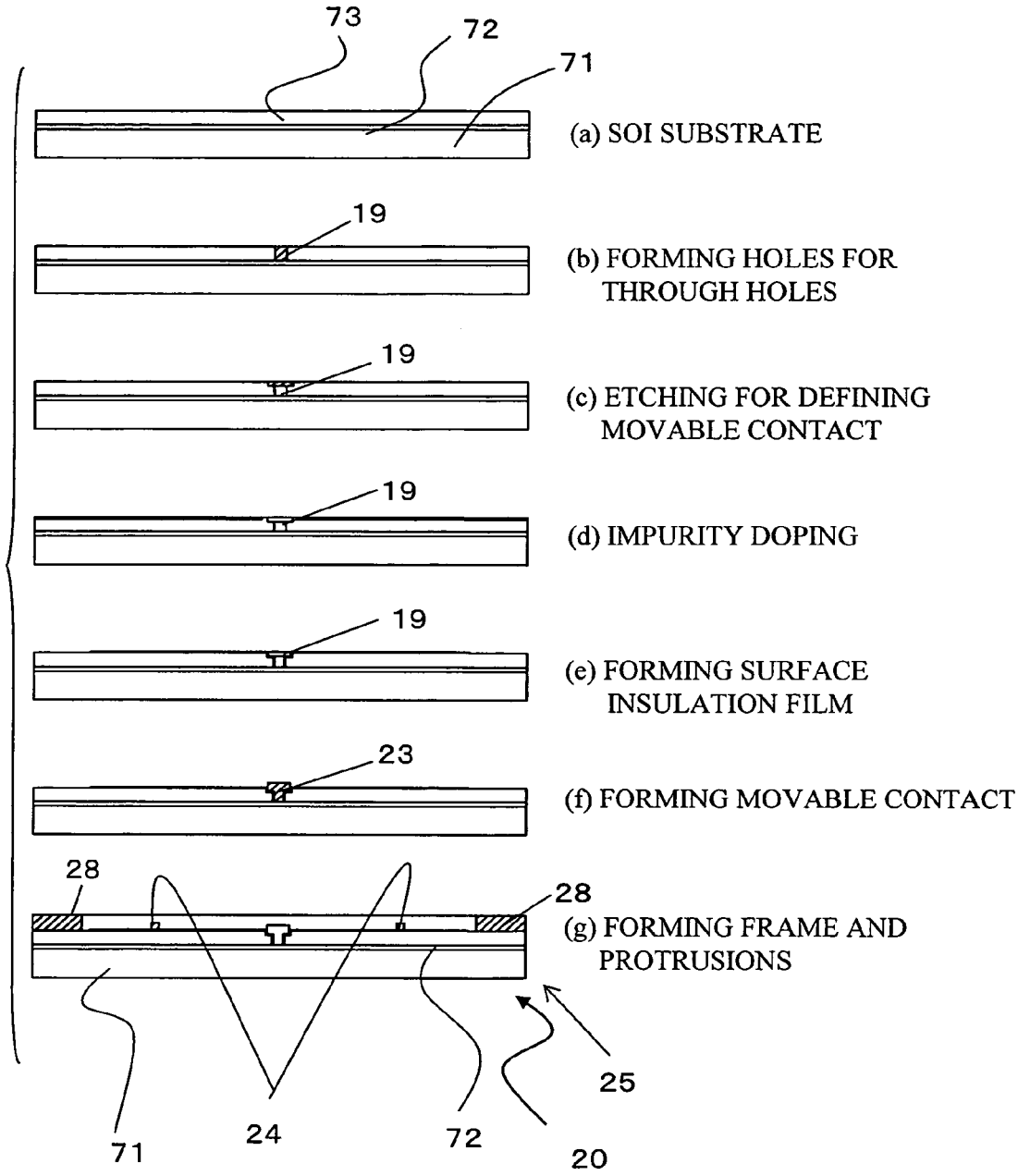
FIG. 28 shows a process for producing a movable plate used in the second embodiment of the present invention.
Figure 29:
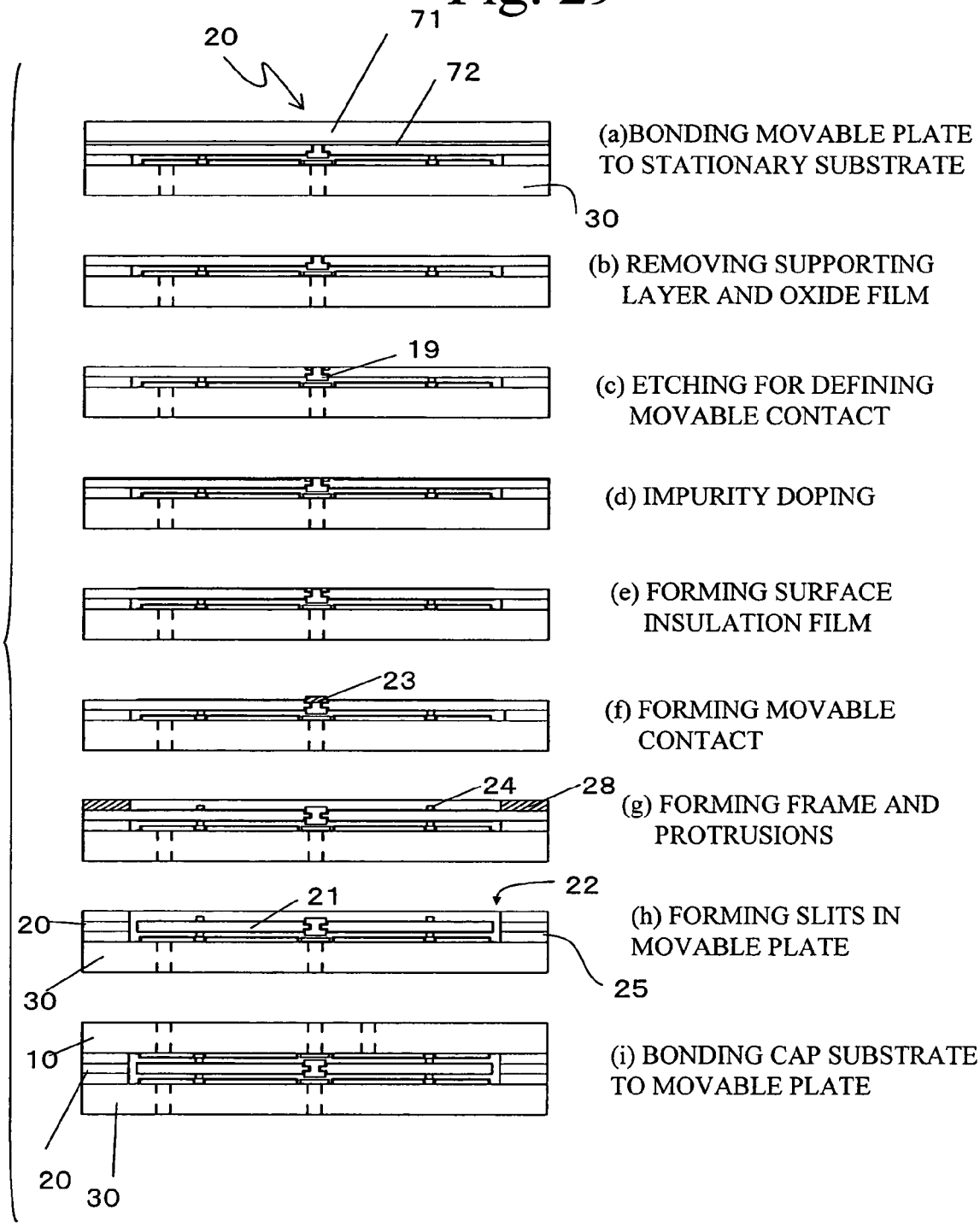
FIG. 29 shows a process for completing a micro-relay chip using a semifinished assembly obtained by the processes shown in FIGS. 26 through 28.

A description will now be given, with reference to FIGS. 26 through 29, of a method of fabricating the micro-relay chip 5 according to the second embodiment of the present invention that employs the spacers for defining the gap. FIG. 26 shows a process for producing the stationary substrate 30, and FIG. 27 shows a process for producing the cap substrate 10. FIG. 28 shows a process for producing the movable plate 20, and FIG. 29 shows a process for assembling the above structural parts. These processes utilize the semiconductor production techniques, such as film growth, exposure and etching.

The stationary substrate 30 is produced as shown in FIG. 26. The glass substrate 30 that is 0.2-0.4 mm thick is prepared (step (a)). Preferably, the glass substrate 30 is made of Pyrex glass (registered trademark). As will be described later, this glass has a thermal expansion coefficient close to that of single crystal silicon used for the movable plate 20 that will be described later, so that the glass substrate 30 and the movable plate 10 can be joined very well.

Next, holes for the through holes 19 are formed in the glass stationary substrate 30 (step (b)). The inner walls of the holds are plated with are filled with an electrically conductive material (step (c)). Examples of the conductive material are gold, copper or aluminum.

Then, the stationary electrode 31 and the stationary contacts 33 are formed by sputtering or another appropriate process (step (d)). The electrode 31 and the contacts 33 may be made of gold or platinum, or may have a multilayer structure that has an Au underlying layer on which a platinum-base metal such as Rh, Ru, Pd or Pt may be deposited. Particularly, it is preferable that the stationary contacts 33 that are brought into contact with the movable contact have a surface layer made of a platinum-based metal that has abrasion resistance. The Au underlying layer serves as a cushion and simultaneously reduces the resistance. The stationary substrate 30 thus formed has the glass substrate on which the stationary electrode 31 and the stationary contacts 33 are provided. As shown in step (e) of FIG. 26, as necessary, a protection film made of $Si_3N_4$ or the like may be formed on the surface of the stationary electrode 31 by CVD (Chemical Vapor Deposition) or the like.

The process for producing the cap substrate 10 shown in FIG. 27 is the same as that shown in FIG. 26. That is, the cap substrate 10 can be produced in the same manner as the stationary substrate 30.

The movable plate 20 is produced as shown in FIG. 28, which shows the process for producing the movable plate 20 up to a step just before the movable plate 20 is joined to the stationary substrate 30. After the movable plate 20 is joined to the stationary substrate 30, it is further processed so that the movable plate 20 is finally completed. First, an SOI (Silicon On Insulator) substrate is prepared (step (a)). The SOI substrate has a laminate structure in which an oxide film 72 such as an $SiO_2$ film is formed on a comparatively thick supporting layer 71, and an active layer 73 made of single crystal silicon is formed on the oxide film 72.

Next, a through hole 19 used to form the movable contact 23 is formed in the SOI substrate (step (b)). As has been described, the movable contact 23 is penetrated through the through hole 19 and protrudes from both the upper and lower surfaces of the movable portion 21. A peripheral portion that surrounds the upper edge of the through hole 19 is etched so as to define a surface area for accommodating the upper contact portion of the movable contact 23 (step (c)). Then, the active layer 73 is doped with an impurity so that the active layer 73 has conductivity (step (d)). An insulation film made of $SiO_2$ or the like is deposited on the surface of the active layer 73 (step (e)). The insulation film electrically isolates the movable plate 21 from the movable contact 23.

Then, the through hole 19 is filled with a metal by plating or sputtering, so that the upper half of the movable contact 23 including the upper contact portion can be formed. Thereafter, polysilicon is deposited on an outer ring-like surface area that corresponds to the frame 25 of the movable plate 20. Thus, the spacer 28 of polysilicon is formed. Further, the protrusions 24 serving as the stoppers are formed on the insulation film.

The stationary substrate 30, the cap substrate 10 and the movable plate 20 are assembled so as to form a laminate, as shown in FIG. 29. First, the semifinished movable plate 20 is bonded to the stationary substrate 30 (step (a)). The semifinished movable plate 20 obtained by the process of FIG. 28 is turned upside down. Then, the plate 20 is mounted on the stationary substrate 30 and is bonded thereto. Preferably, anodic bonding is used. When the stationary substrate 30 is set at a positive potential and the movable plate 20 is set at the ground potential, they can be tightly bonded with ease.

Subsequently, a process for forming the remaining half of the movable plate 20 is carried out. First, the supporting layer 71 and the oxide film 72 are removed (step (b)). Then, the semifinished plate 20 is processed by the same process as shown in FIG. 28. That is, the surface portion around the edge of the through hole is etched in order to form the other contact portion of the movable contact 23 (step (c)). Then, the substrate 71 is doped with an impurity (step (d)). An insulation film is formed on the surface of the substrate 71 (step (e)), and the remaining half of the movable contact 23 is completed (step (f)). Then, polysilicon is deposited on the area corresponding to the frame 25 to thus form the spacer 28 and the protrusions 24 (step (g)).

Thereafter, slits for defining the hinge springs 22 are formed in the movable plate 20. The frame 25 and the movable portion 21 are connected via the hinge springs 22 (step (h)). When the movable plate 20 is made of single crystal silicon, the hinge springs 22 that are formed several times can be easily formed by RIE (Reactive Ion Etching).

Finally, the cap substrate 10 is mounted on the movable plate 20, and is bonded thereto by anodic bonding. Preferably, anodic bonding is carried out in a pressure-reduced atmosphere, more preferably, in an inactive gas. Thus, the micro-relay can be hermetically sealed with no gas remaining in the interior. Now, multiple micro-relay chips arranged on the wafer are available. These chips are divided into the individual chips by dicing. Since the micro-relay chips are already hermetically sealed, the interiors thereof are not affected by dicing at all. The individual chips are respectively subjected to the process shown in FIGS. 2A through 2C, so that the micro-relay devices 1 can be obtained.

Sixteenth Embodiment

Figure 30:
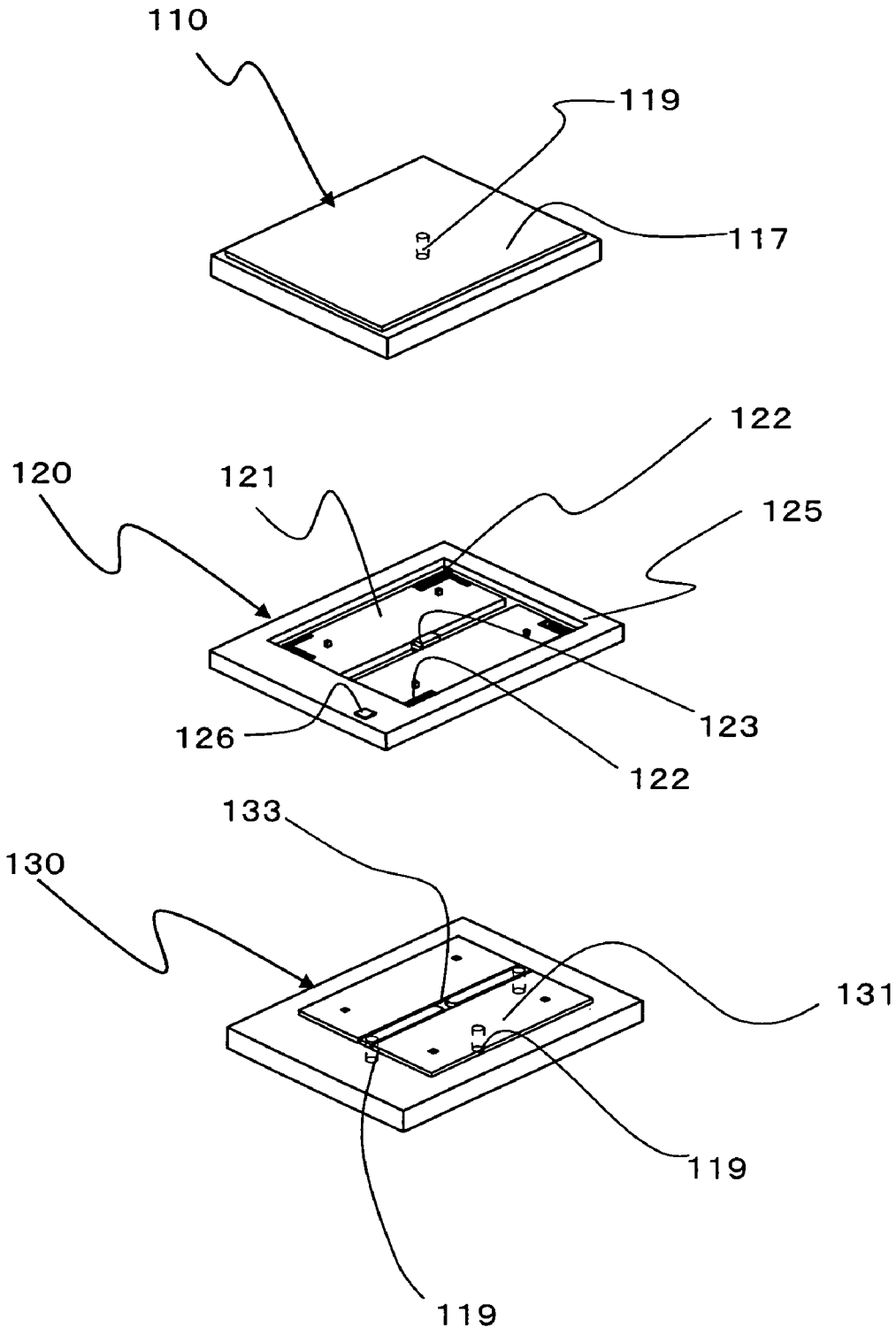
FIG. 30 is an exploded perspective view of a chip part of a micro-relay according to a sixteenth embodiment of the present invention.
Figure 31A:
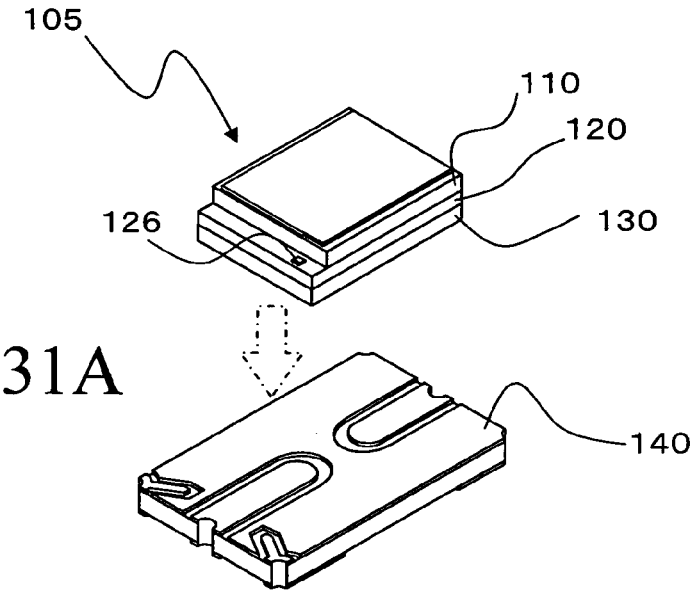
FIGS. 31A, 31B and 31C show how to assemble a micro-relay device 100 using the micro-relay chip shown in FIG. 30.
Figure 31B:
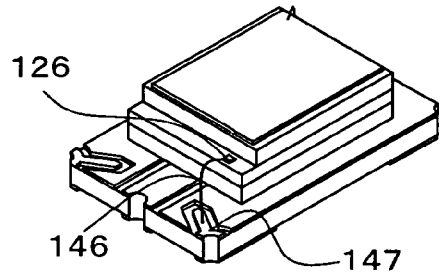
Figure 31C:
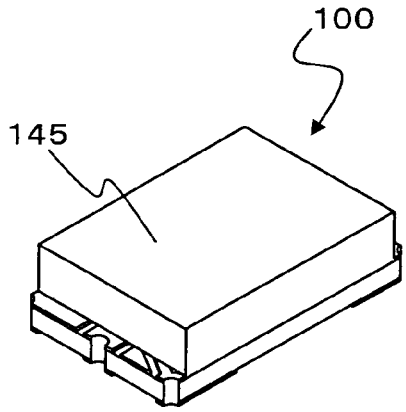
Figure 32:
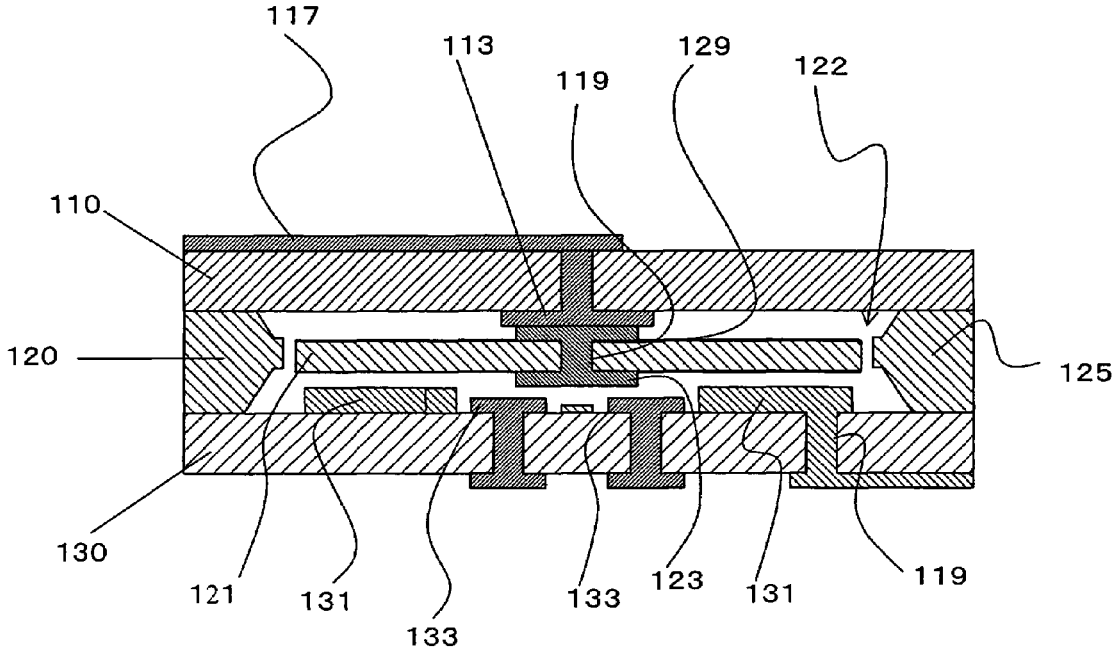
FIG. 32 is a cross-sectional view of the micro-relay according to the sixteenth embodiment of the present invention.

FIGS. 30 through 32 illustrate a micro-relay according to a sixteenth embodiment of the present invention. More particularly, FIG. 30 is an exploded perspective view of a chip part of the micro-relay. FIGS. 31A through 31C show how to assemble a micro-relay device 100 using a micro-relay chip 105. FIG. 32 schematically shows a cross section of the micro-relay chip 105. In the following, an outline of the micro-relay according to the present embodiment will be described first, and an internal structure will be described second.

The micro-relay chip 105 has a basic structure composed of an upper stationary substrate 110, a lower stationary substrate 130, and a movable plate 120 interposed between the substrates 110 and 130. Hereinafter, the upper stationary substrate 110 is referred to as cap substrate 110.

The movable plate 120 is formed by using a semiconductor material such as silicon single-crystal. The movable plate 120 includes a frame 125 shaped into a ring, and a movable portion 121, which moves up and down within the frame 125. The direction in which the movable portion 121 moves up and down is perpendicular to the plate surfaces of the cap substrate 110 and the stationary substrate 130. In order to realize the up/down movement of the movable portion 121, the movable portion 121 is connected to the frame 125 by hinge springs 122 that are elastically deformable. Though the frame 125 has a rectangular shape, it is not limited thereto but may have any shape having line symmetry. The multiple hinge springs 122 that support the movable portion 121 are provided at the line-symmetrical positions on the frame 125. In the sixteenth embodiment of the invention, the hinge springs 122 are provided at the four corners of the frame 125 to support the movable portion 121. As will be described later, an electrostatic attraction is exerted on the movable portion 121, which is thus moved up and down. The four hinge springs 122 act to enable the movable portion 121 to move up and down while being kept in the parallel state.

The movable portion 121 includes a movable electrode and a movable contact. As shown in the middle of FIG. 30, the movable portion 121 has an appearance such that two rectangular plates are joined via a small protrusion 123. This protrusion 123 is a movable contact, and the rectangular plates serve as a movable electrode. The movable portion 121 is mostly the movable electrode, and only a part of the central portion of the movable portion 121 is occupied by the movable contact 123. Thus, the movable portion 121 is substantially the movable electrode in the present embodiment. The movable contact 123 and the movable electrode are electrically isolated. The movable portion 121 has a base portion made of, for example, a silicon single-crystal, which is covered by an insulation film and is electrically isolated from the movable contact 123. As will be described in detail later, the movable contact 123 is provided in a through hole formed in the movable portion 121, and provides contact areas on the front and back surfaces thereof. The movable contact 123 itself or the surface thereof may be made of an electrically conductive material such as gold, platinum or copper.

The cap substrate 110 and the stationary substrate 130 are arranged so as to vertically sandwich the movable plate 120. More particularly, the frame 125 of the movable plate 120 is joined to the cap substrate 110 and the stationary substrate 130, and the movable portion 121 can be moved up and down in the spacing defined by joining. Each of the cap substrate 110 and the stationary substrate 130 has a respective base formed by an insulation member and a respective stationary electrode and stationary contact. In FIG. 30, a stationary electrode 131 and first stationary contacts 133 of the stationary substrate 130 are illustrated. A similar stationary electrode and stationary contact (second stationary contact) are provided on the lower surface of the cap substrate 110. The stationary electrodes and the stationary contacts are electrically isolated as in the case of the movable portion 121.

The stationary electrode 131 of the stationary substrate 110 is disposed so as to face the movable portion 121 serving as the movable electrode. The first stationary contact of the cap substrate 110 and the second stationary contacts 133 of the stationary substrate 130 are disposed so as to face the movable contact of the movable portion 121. The movable contact 123 shown in FIG. 30 is associated with the cap substrate 110. Hereinafter, this movable contact 123 is also referred to as upper movable contact 123. Besides the upper movable contact 123, there is the lower movable contact 123 provided on the lower surface of the movable portion 121. The lower movable contact 123 is associated with the stationary substrate 130. The upper and lower movable contacts 123 are connected via the through hole and are a single-piece member. The stationary substrate 130 has a pair of stationary contacts 133, which are spaced apart from each other. When the movable portion 121 goes down, the lower movable contact 123 is brought into contact with the two stationary contacts 133, so that a signal line including the lower movable contact 123 and the pair of stationary contacts 133 can be established.

As shown in FIG. 30, through holes 119 are respectively provided in the cap substrate 110 and the stationary substrate 130. The through holes 119 are used to extract wiring or interconnection lines from the cavity defined by the cap substrate 110 and the stationary substrate 130. When the cap substrate 110 and the stationary substrate 130 are joined to the frame 125 so as to have airtightness, the resultant internal space can be hermetically sealed. An electrode pad 117 is provided on the upper surface of the cap substrate 110 and is connected to inner patterns via a through hole 119 formed in the cap substrate 110. The electrode pad 117 is connected to the second stationary contact of the cap substrate 110. The electrode pad 117 may be grounded when it is practically used.

The hermetically sealed micro-relay chip 105 is fixed to a base substrate 140 as shown in FIGS. 31A and 31B. Finally, the assembly is covered with resin 145 as shown in FIG. 31C, so that a resin-packaged micro-relay can be provided. The movable plate 120 is equipped with an external pad 126, which is provided on a step-like portion of the micro-relay chip 105. The pad 126 is connected to an electrode pad 147 by a bonding wire 146. The base substrate 140 may be replaced with a leadframe.

The structure such that the cap substrate 110 and the stationary substrate 130 are joined to the frame 125 of the movable plate 120 with hermetical sealing can be realized by using glass for the cap substrate 110 and the stationary substrate 130. Silicon and glass can be tightly joined with ease by anodic bonding. In anodic bonding, a flat glass surface and a flat silicon surface that are brought into contact with each other are respectively connected to a negative power source and ground at a given temperature, and is supplied with a high dc voltage. It is recommended to use Pyrex glass (registered trademark) as glass used for the cap substrate 110 and the stationary substrate 130. Pyrex glass has a thermal expansion coefficient close to that of silicon, and is thermally stable. Besides silicon, a metal may be processed by anodic bonding. Thus, the frame 125 of the movable plate 120 may be made of a metal usable in anodic bonding. In anodic bonding, there is no need to fuse part of adhesive or joining interface. Hence, the designed dimensions can be accurately achieved. It is desired to define the gaps between the movable portion 121 and the stationary substrates 110 and 130 with dimensional accuracy as high as possible. The gaps defined by anodic plating have high dimensional accuracy. During anodic bonding, oxygen gas is evolved. In case where gas remains in the hermetically sealed space, inner pressure increases. Increasing inner pressure may affect relay operation and break hermetical sealing. It is therefore preferred to perform anodic bonding in an inactive gas with reduced pressure.

When the micro-relay chip 105 is mounted on the base substrate 140 as shown in FIGS. 31A and 31B, flip-chip bonding may be used. The use of flip-chip bonding may further downsize the micro-relay. For downsizing, it is also possible to employ groove-like side casting lines on the periphery as lines commonly used by the cap substrate 110, the stationary substrate 130 and the movable plate 120, as will be described later.

FIG. 32 illustrates a cross section of the micro-relay chip 105 shown in FIGS. 30 and 31A through 31C. It is noted that FIG. 32 schematically illustrates the cross section so as to facilitate understanding the positional relationships among the structural parts of the micro-relay chip shown in FIGS. 30 and 31A-31C. For example, the pair of stationary contacts 133 extends up to the right and left ends in FIG. 30, but is shortened in FIG. 32 for illustrating the stationary electrodes 131. A further description of the micro-relay chip 105 will now be described with reference to FIG. 32. This figure shows the detailed structures of the cap substrate 110, the stationary substrate 130 and the movable plate 120. It will be noted that the stationary contacts 113 of the cap substrate 110, which are not illustrated in FIGS. 30 and 31A-31C, appear in FIG. 32.

The stationary electrodes 131 on the lower stationary substrate 130 are positioned so as to face the movable portion 121. The movable contact 123 may bridge over the first stationary contacts 133 on the stationary substrate 130. Further, the movable contact 123 is in contact with the second stationary contact 113 on the cap substrate 110. As has been described, the pair of first stationary contacts 133 is provided in the signal lines. When the movable contact 123 is moved down and is brought into contact with the stationary contacts 133, a circuit including the first stationary contacts 133 can be made. In contrast, only the single (second) stationary contact 113 is provided on the cap substrate 110. The second stationary contact 113 is connected to ground (GND) via the electrode pad 117.

Particularly, it is to be noted that the second stationary contact 113 is in contact with the movable contact 123 when the movable contact 123 is not electrostatically attracted toward the stationary contacts 131. That is, in the initial state of the micro-relay or the movable portion 121, the movable contact 123 is kept in contact with the second stationary contact 113. When the supply of the drive voltage is turned OFF, the movable contact 123 is disconnected from the stationary contacts 133 and is brought into contact with the stationary contact 113 that is grounded. It is therefore possible to securely release the micro-relay from the electrostatically coupled state. This improves the isolation between the contacts. For this purpose, the movable contact 123 formed on the both sides of the movable portion 121 are integrally formed via the through hole 119.

A given voltage can be applied between the stationary electrodes 131 of the stationary substrate 130 and the movable portion 121. Each of the stationary electrodes 131 extends to the backside of the stationary substrate 130 via the respective through hole 119. The movable plate 120 may be made of silicon, and has been doped with an impurity for giving conductivity thereto. The through holes 119 may be filled with a conductor, or the inner walls thereof may be plated. The use of the through holes 119 makes it possible to hermetically seal the internal space defined by the stationary substrate 130 and the frame 125 of the movable plate 120.

In FIG. 32, the movable plate 120 and the stationary electrodes 131 may be selectively connected by a switch connected to interconnection lines (not shown) extending therefrom.

The movable plate 120 includes the frame 125, the movable portion 121 and the hinge springs 122, which can be integrally formed from the silicon substrate. By doping the silicon substrate with the impurity, conductivity from the frame 125 to the movable portion 121 can be easily secured. The movable portion 121 is not limited to the silicon substrate doped with the impurity, but may be formed by a silicon substrate on which metal electrodes are provided. It should be noted that an insulation film 129 is formed on the surfaces of the movable portion 121 in order to electrically isolate the movable portion 121 from the movable contact 123.

As is shown in FIG. 30, the movable portion 121 is supported by the hinge springs 122 respectively provided to the four corners of the frame 125 so that the movable portion 121 can move up and down. More particularly, when a voltage is applied between the movable portion 121 and the stationary electrode 131, the electrostatic attraction that develops therebetween moves the movable portion 121 towards the stationary substrate 130. That is, the movable portion 121 can move between the initial or home position and the stationary substrate 130. In the home position, the movable contact 123 is in contact with the stationary contact 113 without any electrostatic attraction. When the movable portion 121 is driven, the movable contact 123 is brought into contact with the stationary contacts 133 and is then maintained. Thus, the switch of the stationary contacts 113 and 133 and the movable contact 123 switch over so that the relay operation can be achieved.

Figure 33:
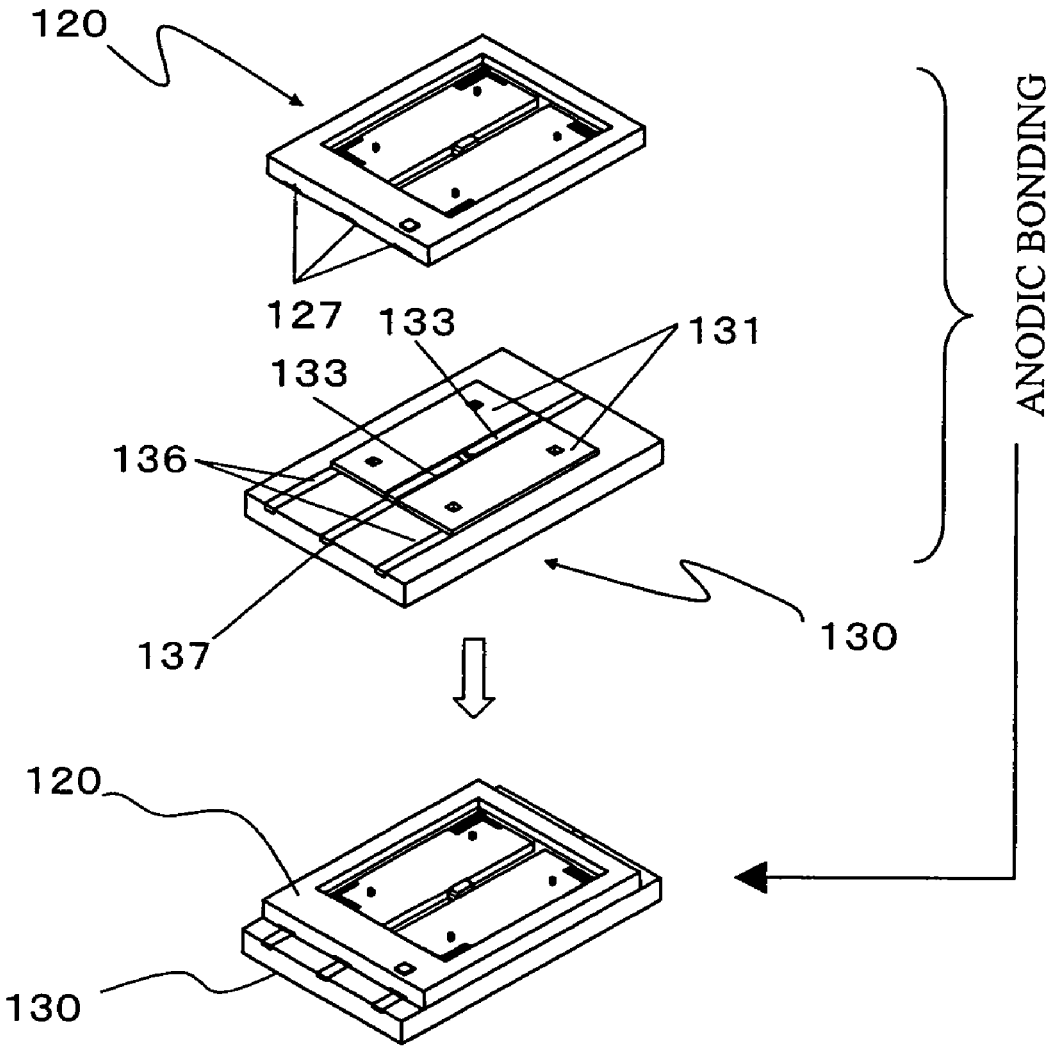
FIG. 33 is an exploded perspective view of a variation of the sixteenth embodiment of the present invention.
Figure 34:
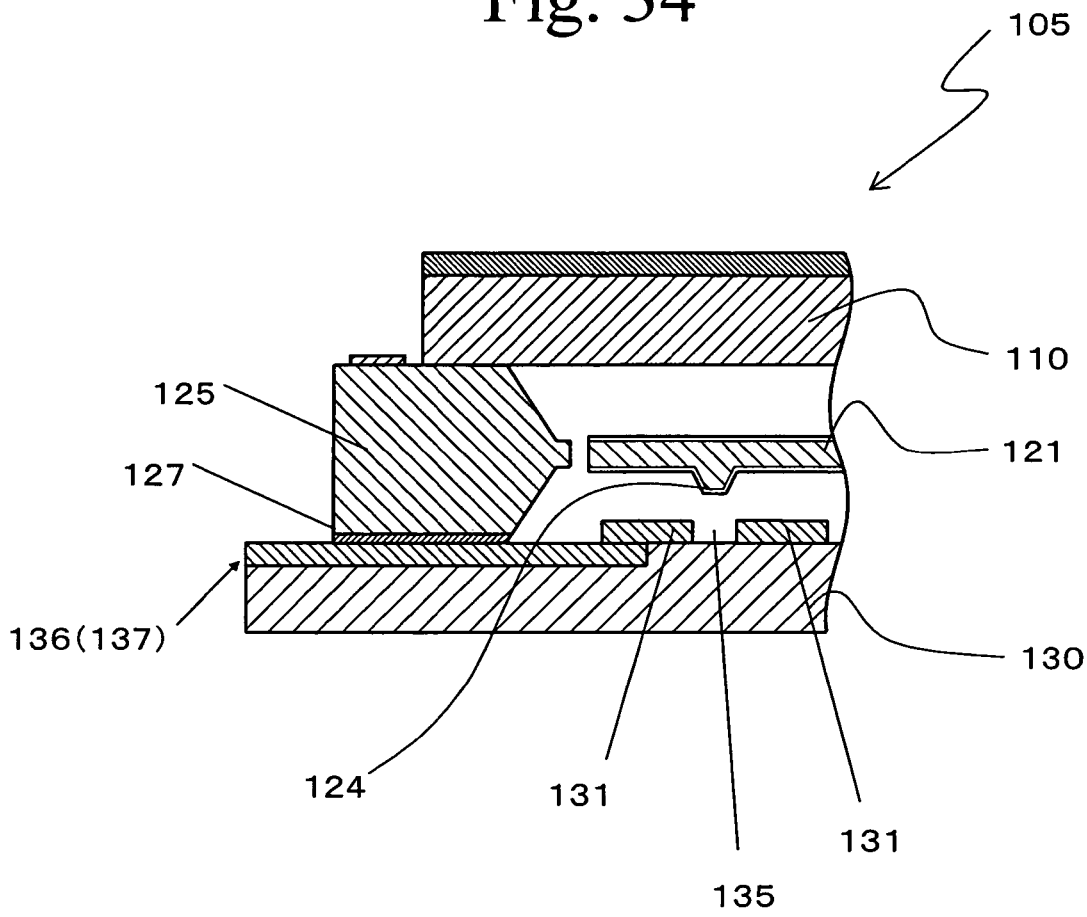
FIG. 34 is a cross-sectional view of the variation shown in FIG. 33.

FIGS. 33 and 34 show a variation of the above-mentioned sixteenth embodiment of the present invention. As has been described, the through holes 119 are used to extract the wiring lines to the outside of the chip 105 from the substrates 110 and 130. The through holes 119 may be replaced by extraction lines that are buried in the substrates 110 and 130 in such a way that the flatness of the joining surfaces of the substrates 110 and 130 and the frame 125 of the movable plate 120 can be secured. The variation shown in FIGS. 33 and 34 employs such a structure as described above.

FIG. 33 is an exploded perspective view of the variation, and FIG. 34 is a cross-sectional view of a side portion of the variation. The micro-relay 105 of this variation employs an extraction line that is buried in the stationary substrate 130 joined to the movable plate 120. As is shown in FIG. 33, an extraction line 136 extending from the stationary electrode 131 is buried in the stationary substrate 130 so as to be flush with the surface of the stationary substrate 130. Similarly, extraction lines 137 extending from the stationary contacts 133 are buried in the stationary substrate 130 so as to be flush with the surface of the stationary substrate 130. The flat surface of the stationary substrate 130 secures reliable hermetical sealing made by anodic bonding. It should be noted that the use of the buried extraction lines 136 and 137 needs an insulation film 127 to secure electrical isolation from the stationary substrate 130. The cap substrate 110 may employ an extraction arrangement as described above.

Preferably, as shown in FIG. 34, there are provided protrusions 124 that are provided to the lower surface of the movable portion 121 and protrude downwards. The protrusions 124 serve as stoppers. Even if the movable portion 121 is moved down to make a contact with the stationary contact 133 and is further moved due to electrostatic attraction, the protrusions 124 will prevent the movable portion 121 from sticking to the stationary contacts 133. As shown in FIG. 34, recesses 135 are provided in the stationary electrode 131 so as to fact the lower protrusions 124. Preferably, the protrusions 124 have a height greater than the depth of the recesses 135 in order to prevent the movable portion 121 from tightly sticking to the stationary electrode 131. Instead of the recesses 135 provided in the stationary electrode 131, these electrodes may be provided with comparatively low protrusions.

Figure 35:
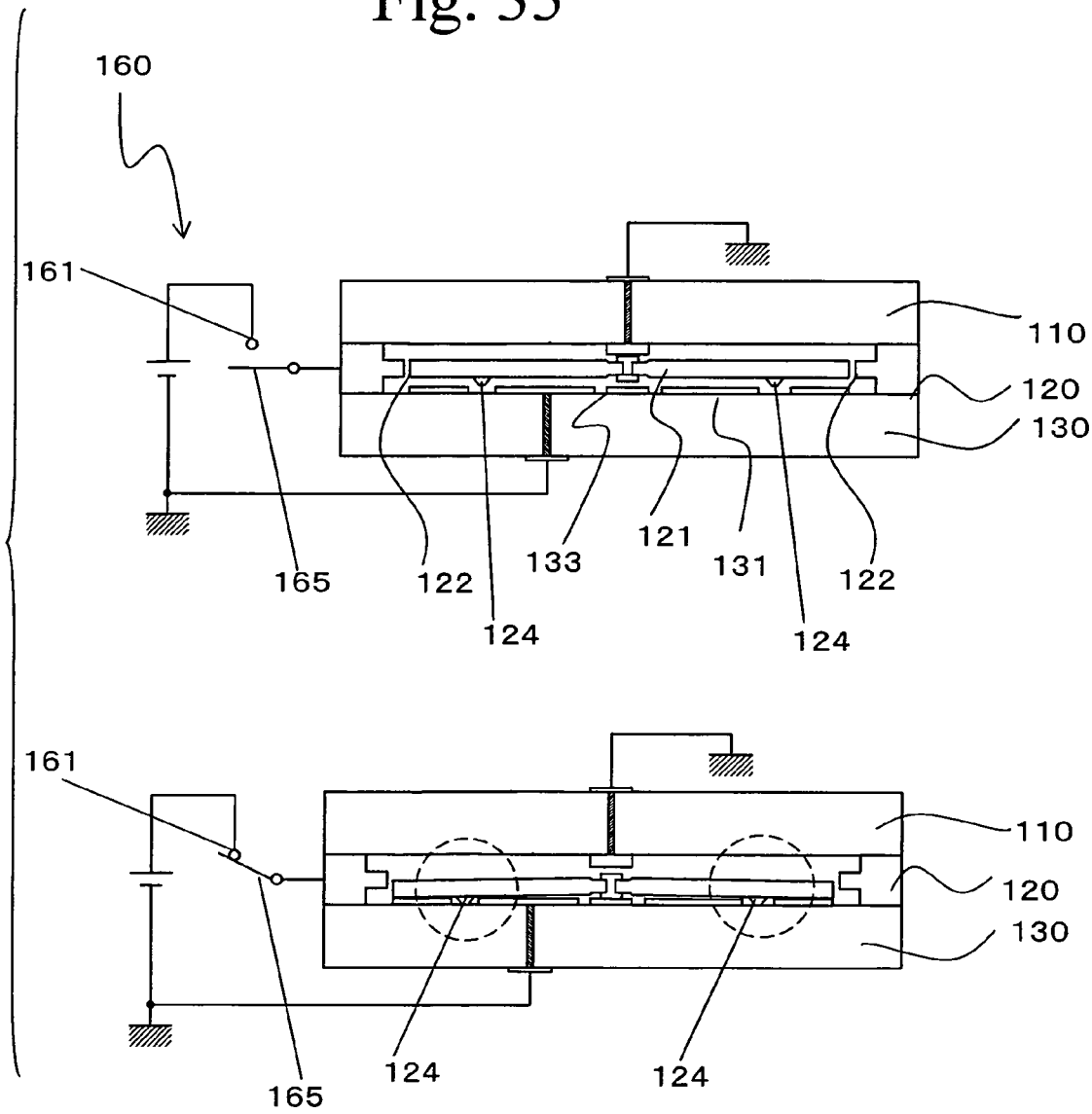
FIG. 35 shows an operation of the micro-relay according to the sixteenth embodiment of the present invention.

FIG. 35 shows an operation of the micro-relay according to the sixteenth embodiment of the present invention. A drive circuit 160 that drives the micro-relay is shown in FIG. 35. When a movable contact 165 is connected to a stationary contact 161, a voltage develops between the stationary electrode 131 and the movable plate 120. The upper part of FIG. 35 shows a neutral state in which no voltage is applied to the movable plate 120. The lower part of FIG. 35 shows the state in which the movable contact 165 contacts the stationary contact 161.

The stationary electrode 131 of the stationary substrate 130 is set at the ground potential in advance. As is shown in the lower part of FIG. 35, when the movable plate 120 is set at the positive potential, the movable plate 120 is attracted towards the stationary electrode 131, and the movable contact 123 is brought into contact with the stationary contacts 133. Even after the contact is made, the movable portion 121 is continuously attracted to the stationary electrode 131 due to further increased force. The movable portion 121 is thus bent, so that further increased contacting force exerted on the movable contact 123 and the stationary contacts 133 can reduce the contact resistance.

The protrusions 124 that serve as the stopper securely prevent surface-to-surface contact between the movable portion 121 and the stationary electrode 131 and prevent the movable portion 121 from sticking to the stationary electrode 131. Since the surfaces of the movable portion 121 are coated with the insulation film 129, the movable portion 121 is not short-circuited to the stationary electrode 131 even when it is brought into contact. If the protrusions 124 securely prevent the movable portion 121 from contacting the stationary electrode 131, the insulation film 129 may be omitted.

As shown in FIG. 35, when the movable contact 165 is detached from the stationary contact 161, the movable portion 121 returns to the initial position, and is brought into contact with the stationary contact 113 that is grounded. Thus, the electrostatic capacitance between the movable contact 123 and the stationary contacts 133 can be reduced. It is therefore possible to reduce RF signal leakage between the contacts and improve the isolation.

Seventeenth Embodiment

Figure 36:
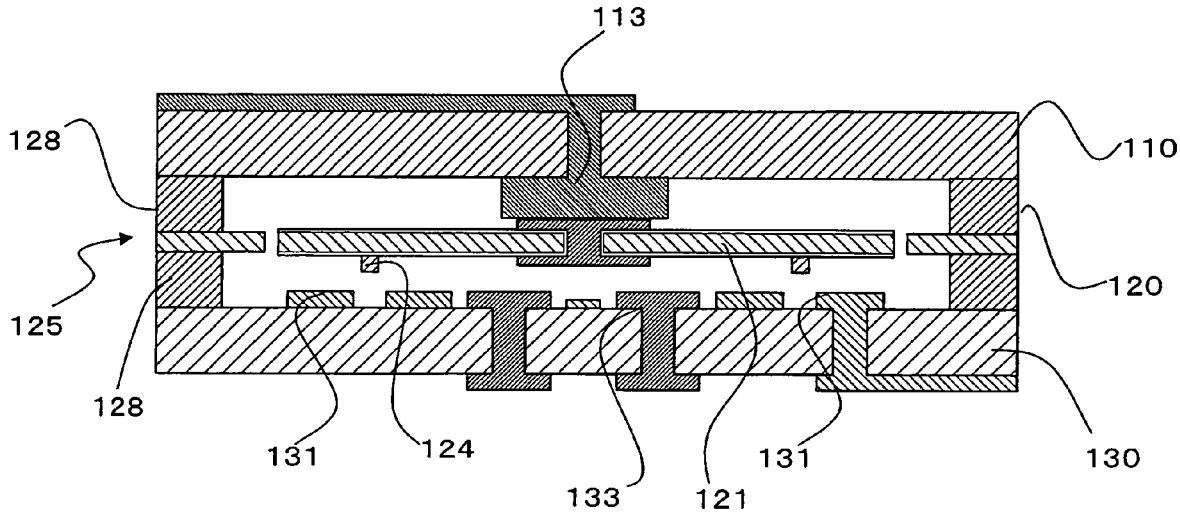
FIG. 36 is a cross-sectional view of a micro-relay according to a seventeenth embodiment of the present invention.

FIG. 36 is a cross-sectional view of a micro-relay according to a seventeenth embodiment of the present invention. In the above-mentioned sixteenth embodiment of the present invention, the movable plate 120 is formed by etching. The height of the frame 125 of the movable plate 120 defines the contact-to-contact gap, and is therefore required to be produced accurately. The seventeenth embodiment of the present invention is a micro-relay that employs a spacer for defining the gap. The basic structure of the seventeenth embodiment is the same as that of the first embodiment, so that the same reference numerals refer to the same structural elements and a description thereof will be omitted.

The spacers 128 form the frame 125 according to the seventeenth embodiment of the invention. The spacers 128 may be formed by depositing polycrystalline silicon (polysilicon) or a metal. The spacers 128 thus formed can be subjected to anodic bonding, and realize the hermetically sealed micro-relay. The contact-to-contact gap can be accurately defined by the spacers 128 as in the case of etching. Generally, it takes a relatively long time to define the gap by etching, while it does not take such a long time to define the gap using the spacers 128.

Eighteenth Embodiment

Figure 37:
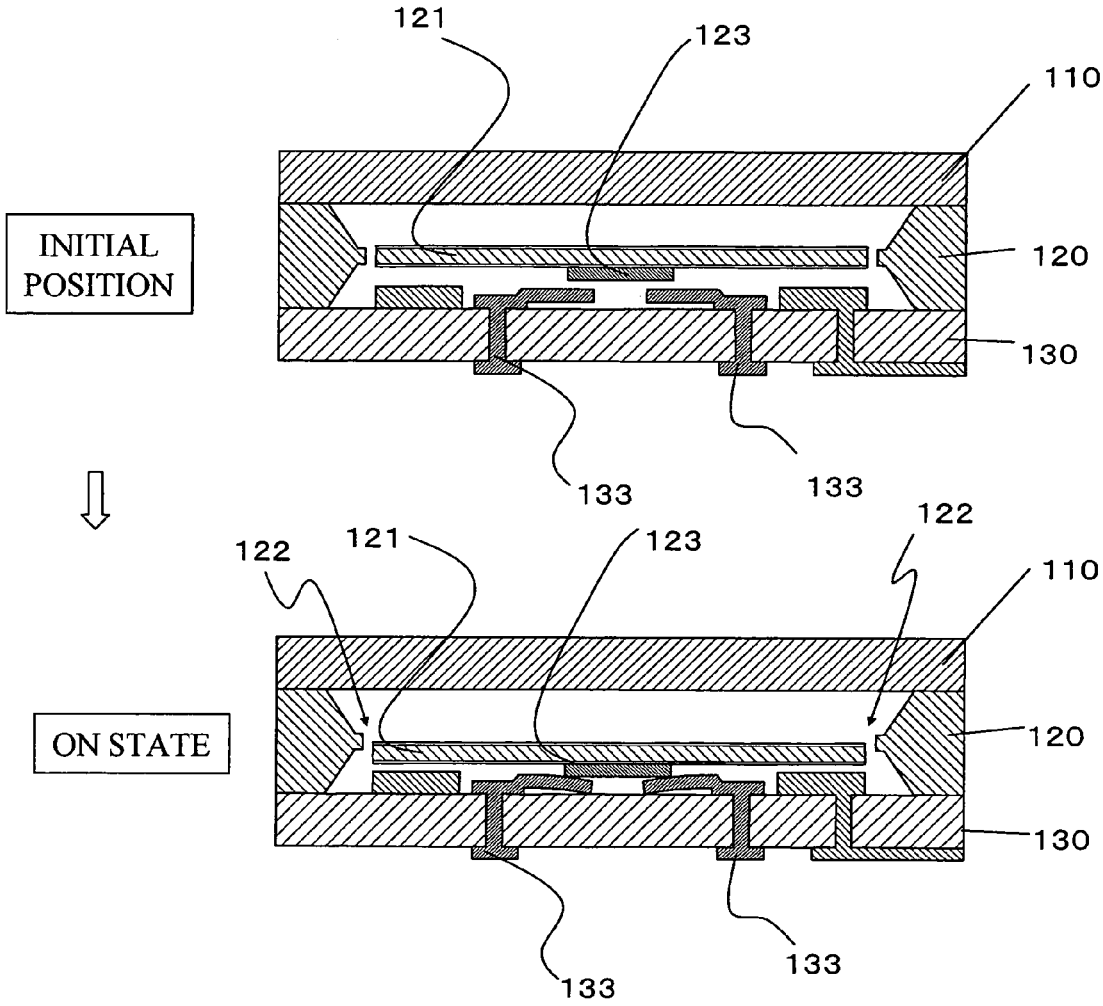
FIG. 37 shows a micro-relay according to the eighteenth embodiment of the present invention.

FIG. 37 shows a micro-relay according to an eighteenth embodiment of the present invention. This embodiment is characterized in that the first stationary contacts of the stationary substrate have a cantilever structure. The same reference numerals as those used in the sixteenth embodiment of the invention are given to the same parts as those used therein. For the sake of simplicity, the second stationary contact 113 of the cap substrate 110 is omitted.

Each of the stationary contacts 133 has a cantilever structure and a free end that is brought into contact with the movable contact 123. When the movable portion 121 moves down from the initial state in response to the drive voltage, the movable contact 123 depresses the free ends of the stationary contacts 133, so that a connection between the stationary contacts 133 can be made. When the supply of the drive voltage is stopped, the stationary contacts 133 that are in a deformed state push back the movable contact 123 due to restoring force caused by the deformation. In addition, there is another restoring force by the hinge springs 122. Therefore, enhanced restoring force is exerted on the movable portion 121, so that the movable contact 123 can be detached from the stationary contacts 133 with enhanced force. It is therefore possible to securely detach the movable contact 123 from the stationary contacts 133 and returns it to the initial position.

Nineteenth Embodiment

Figure 38:
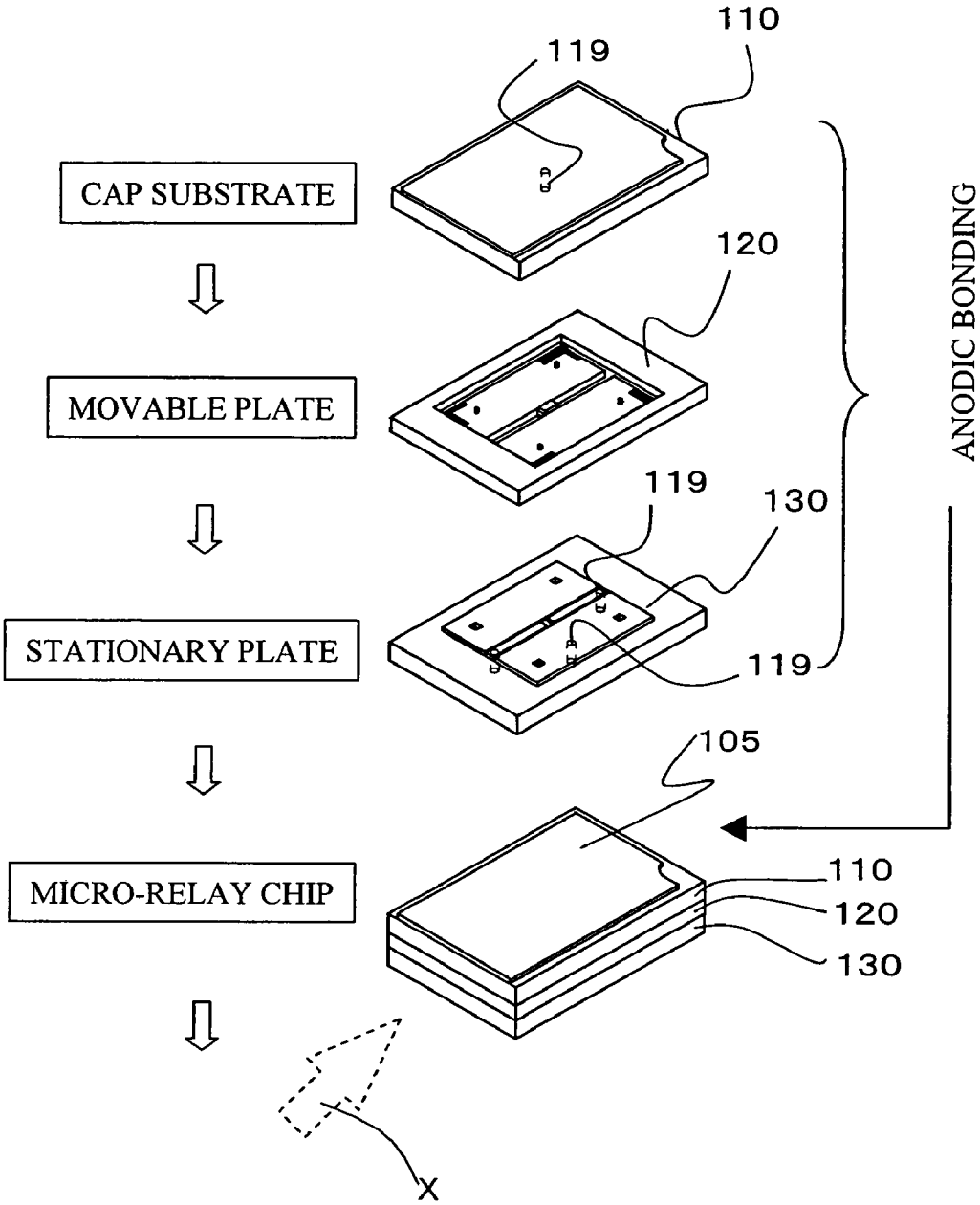
FIG. 38 is an exploded perspective view of a micro-relay according to a nineteenth embodiment of the present invention.
Figure 39:
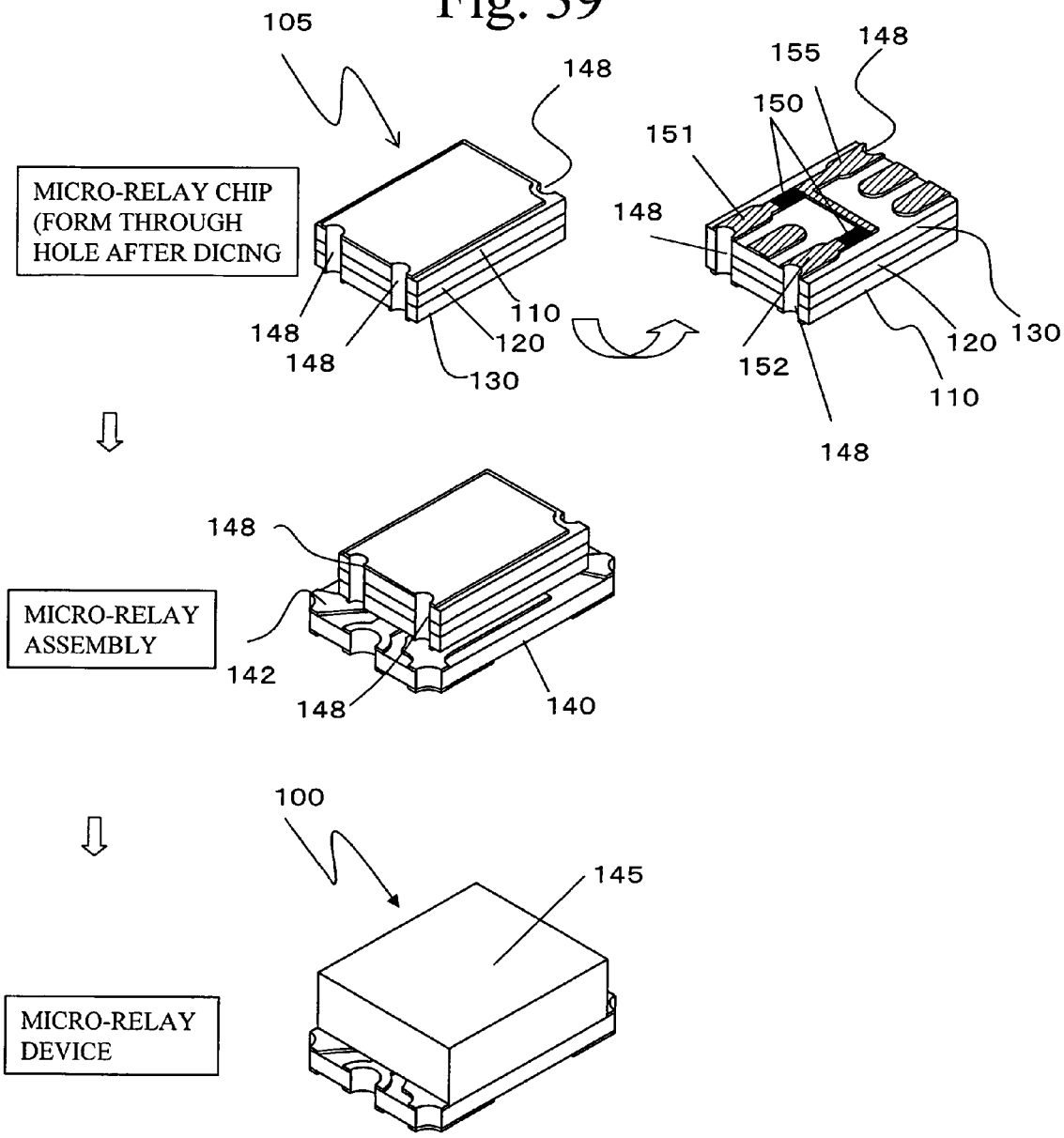
FIG. 39 is an exploded perspective view of the micro-relay shown in FIG. 38.

FIGS. 38 and 39 show a micro-relay according to a nineteenth embodiment of the present invention. This micro-relay uses an interconnection line shared by the cap substrate 110, the stationary substrate 130 and the movable plate 120. In FIGS. 38 and 38, the same reference numerals as those shown previously refer to the same structural elements.

The micro-relay 105 shown in FIG. 38 has the movable plate 120 that is sandwiched between the cap substrate 110 and the stationary substrate 130 and is joined thereto by anodic bonding as in the case of the first and second embodiments of the present invention. As is shown by an arrow X in FIG. 38, the side surfaces of the members 110, 120 and 130 are flush with each other so that the outer appearance is simple. The through holes 119 are used to extract the electrical lines from the insides of the stationary substrate 130 and the cap substrate 110 to the outsides thereof as in the case of the sixteenth embodiment of the invention.

The micro-relay 105 shown in FIG. 39 has common interconnection paths (side castellation) 148, each of which is continuously provided on side surfaces of the cap substrate 110, the stationary substrate 130 and the movable plate 120. In the upper part of FIG. 39, the back surface of the micro-relay 105 on the right side thereof is illustrated on the right side thereof. The back surface of the micro-relay 105 is the bottom surface of the stationary substrate 130. On the bottom surface, provided are ground pads 151, electrode pads 152 and a pad connected to the movable plate 120. Discharge resistors 150, which will be described layer, are provided on the bottom surface.

As is shown in the middle part of FIG. 39, the micro-relay chip 105 is flip-chip bonded to the base substrate 140 by solder balls, so that a micro-relay assembly can be formed. There is no need to use wire bonding for making connections between the micro-relay 105 and the base substrate 140. It can be seen from comparison with FIG. 31 that the base substrate 140 shown in FIG. 39 has a reduced size and a reduced wiring resistance can be obtained. Further, the micro-relay chip 105 does not need any steps for pads. In production, three layers are bonded and are processed to form through holes that are penetrated through these layers. An electrically conductive material is provided to the inner walls of the through holes. Then, the three layers are cut in the dicing process so as to equally divide each through hole into two. In this manner, the micro-relays with the side castellation paths 148 can be easily fabricated.

The top surface of the micro-relay chip 105 that is provided by the back surface of the cap substrate 110 may be coated with an appropriate protection film or the like. In this case, the base substrate 140 may be no longer needed. There may be no need to subject the micro-relay chip 105 to molding with resin. The micro-relay chip 105 is mountable in the bare state. Downsizing of the micro-relay may be further facilitated.

Twentieth Embodiment

Figure 40:
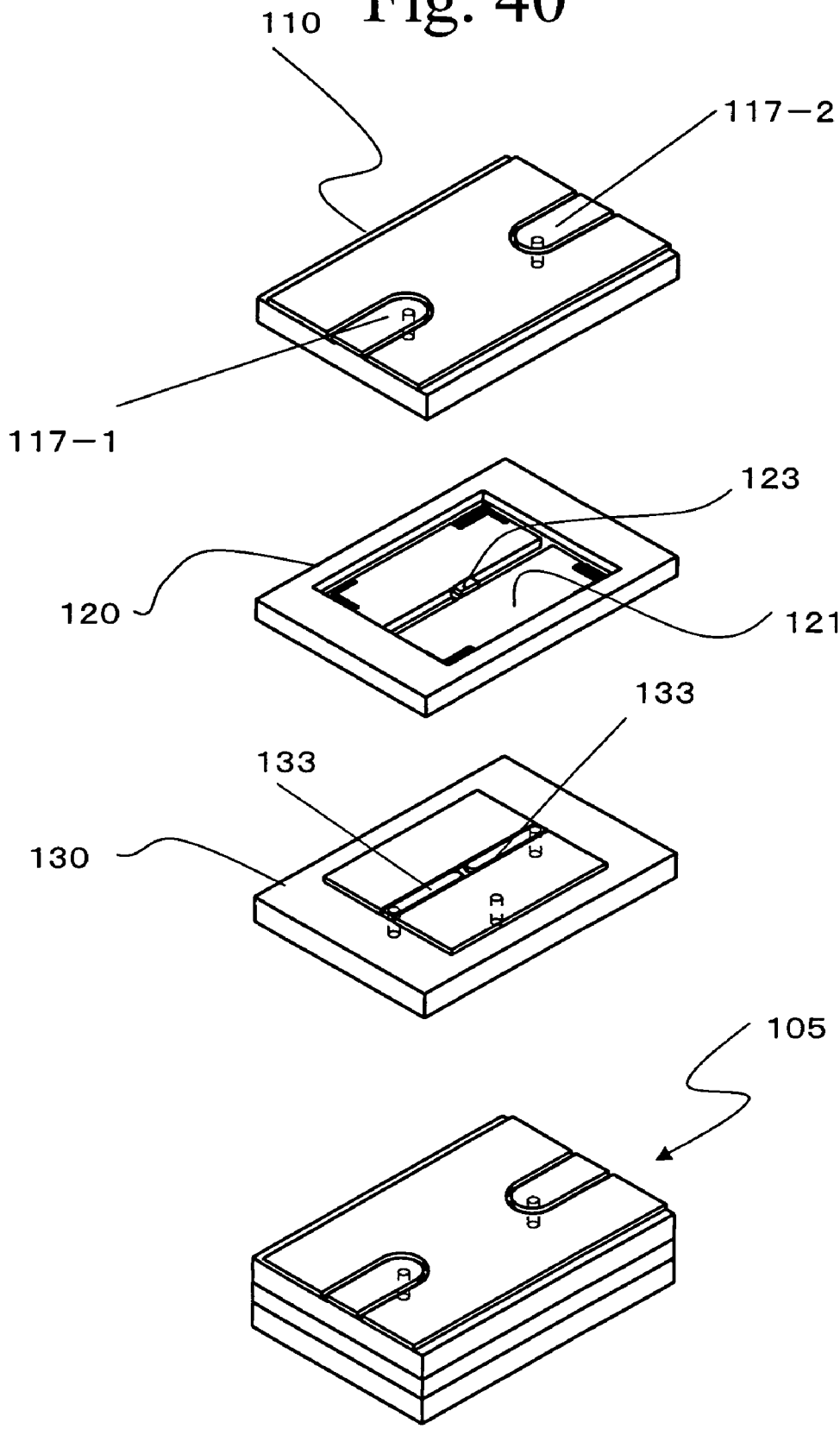
FIG. 40 is an exploded perspective view of a micro-relay according to a twentieth embodiment of the present invention.
Figure 41:
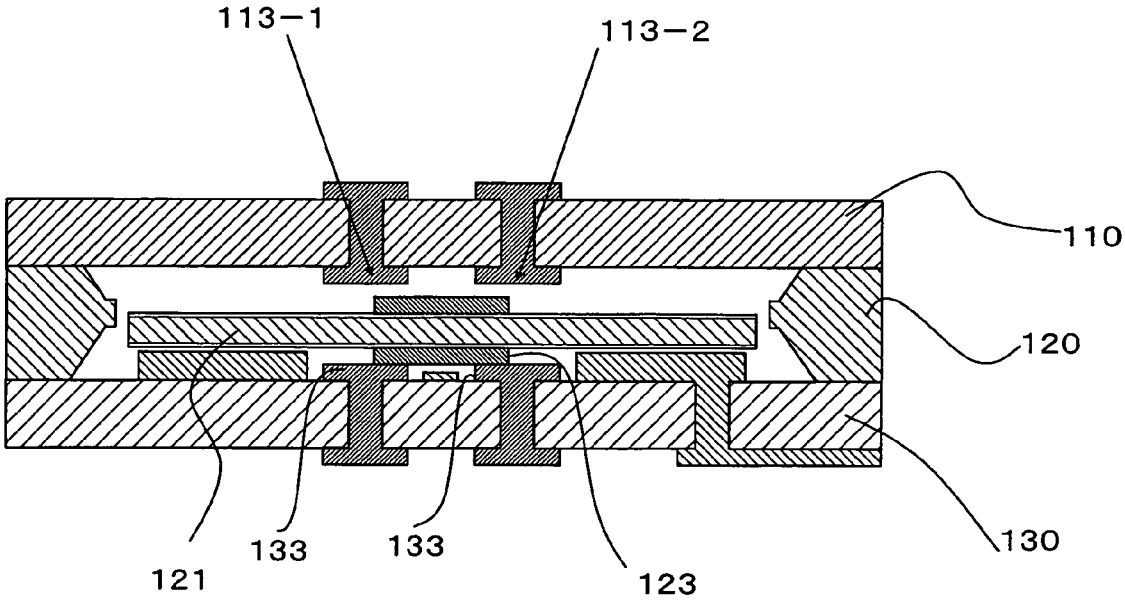
FIG. 41 is a cross-sectional view of the micro-relay shown in FIG. 40.

FIGS. 40 and 41 show a micro-relay according to a twentieth embodiment of the present invention. More particularly, FIG. 40 is an exploded perspective view of the micro-relay chip, and FIG. 41 schematically illustrates a cross section of the chip of the micro-relay. The twentieth embodiment of the present invention is available by replacing the stationary contact 113 provided to the cap substrate 110 in the sixteenth embodiment by contacts provided in a signal line.

More particularly, stationary contacts 113-1 and 113-2 are provided to the cap substrate 110 so as to face the pair of stationary contacts 133 provided to the stationary substrate 130. As shown in FIG. 40, a pair of electrode pads 117-1 and 117-2 on the cap substrate 110 is substituted for the electrode pad 117 used in the sixteenth embodiment. The micro-relay according to the twentieth embodiment of the present invention is equipped with two signal-line systems, while the sixteenth embodiment has only one signal-line system. Thus, downsizing is enabled as compared to a case where two micro-relays of the sixteenth embodiment are used for the two signal-line systems. In addition, the number of components can be reduced by using the micro-relay of the twentieth embodiment. Two separate micro-switches may be replaced by the single micro-switch with the two signal-line systems.

Figure 42:
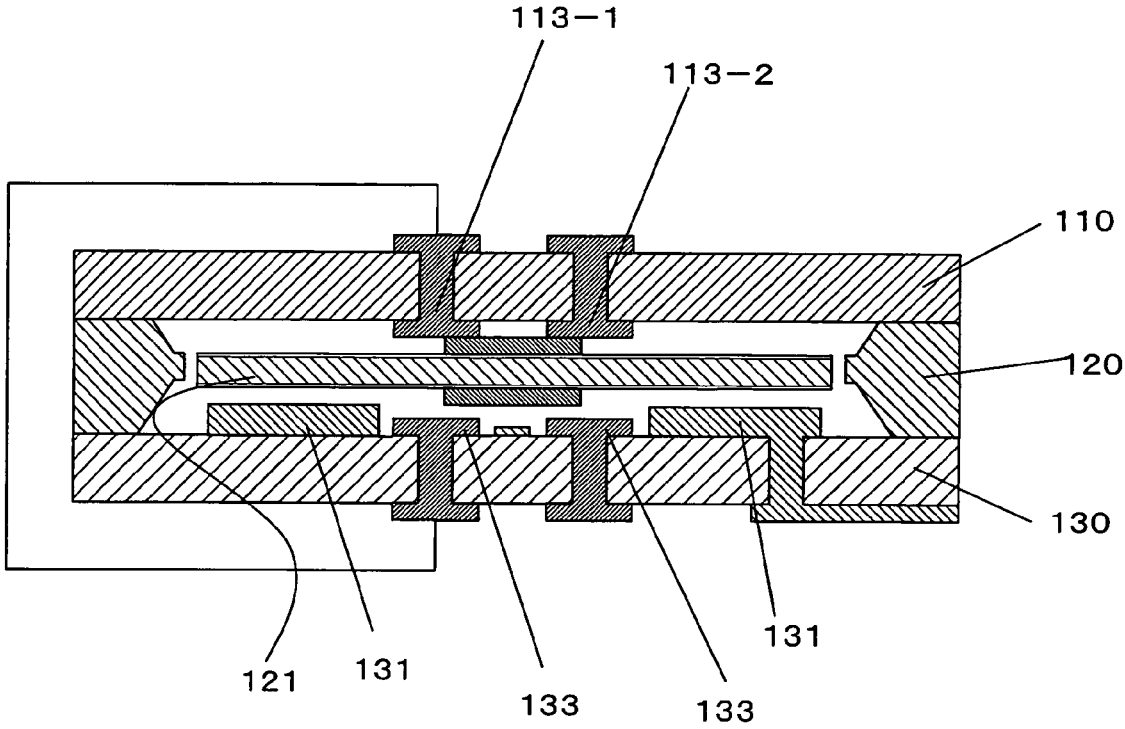
FIG. 42 is a cross-sectional view of a variation of the twentieth embodiment of the present invention.
Figure 43:
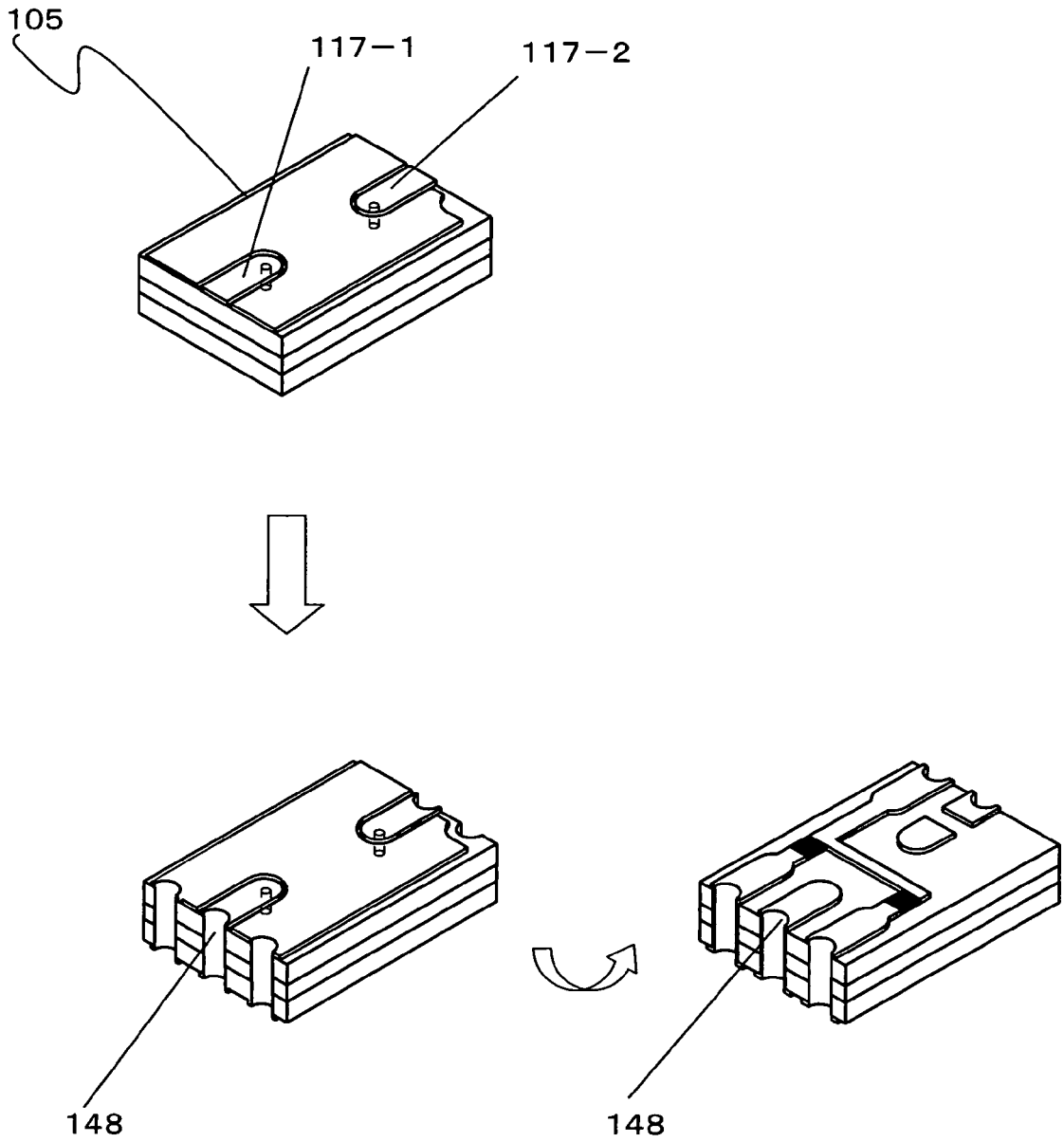
FIG. 43 is a perspective view of the variation shown in FIG. 42.

FIGS. 42 and 43 show a variation of the micro-relay according to the twentieth embodiment of the present invention. One of the two stationary contacts 133 is connected to the stationary contact 113-1 of the cap substrate 110. With this structure, a variety of contact formation can be provided. FIG. 43 shows the use of the aforementioned side castellation paths 148 used in the nineteenth embodiment. Common side castellation (COM) 148 are provided for connecting the stationary substrate 130 and the cap substrate 110. The variation has the two signal-line systems like the micro-relay shown in FIG. 40.

Twenty-First Embodiment

Figure 44:
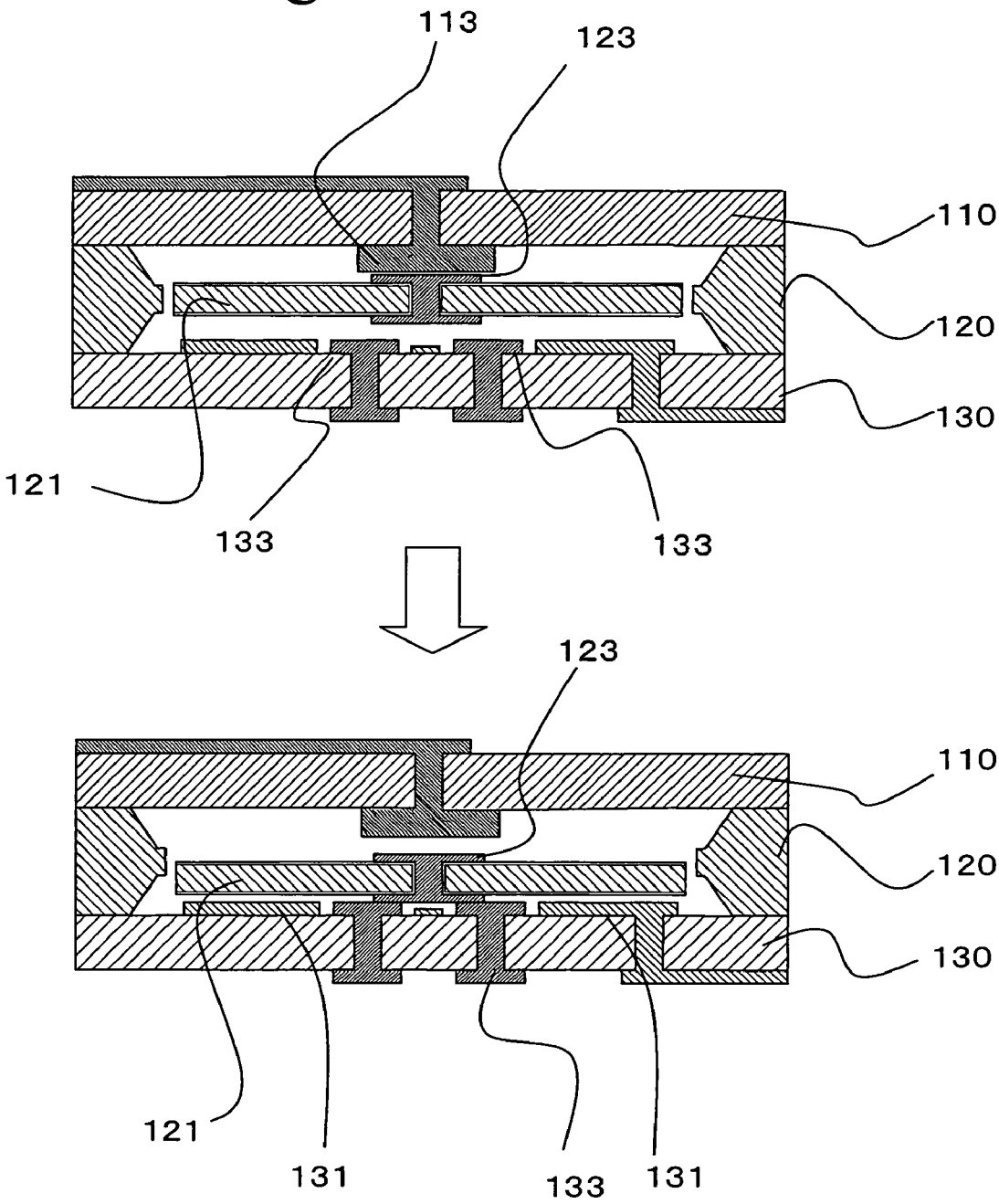
FIG. 44 shows a micro-relay according to a twentieth-first embodiment of the present invention.

FIG. 44 shows cross sections of a micro-relay according to a twenty-first embodiment of the present invention. The movable plate 121 used in this embodiment is comparatively thick. More particularly, the thickness of the movable plate 121 is designed to have stiffness sufficient to prevent the movable portion 121 from being bent after the movable portion 121 is moved due to electrostatic attraction and the movable contact 123 is then brought into contact with the stationary contacts 133. It will be noted that the protrusions 124 in the sixteenth embodiment of the invention are taken into consideration bending of the movable portion 121 and are employed in order to prevent the movable portion 121 from sticking to the stationary electrodes 131. In contrast, the movable portion 121 employed in the present embodiment is not bent, so that it does not need any protrusions like the protrusions 124. This simplifies the production process. The stationary electrodes 131 have a height sufficient to prevent the movable portion 121 from contacting them when the movable contact 123 is in contact with the stationary electrode 131 or the stationary electrodes 133.

Figure 45:
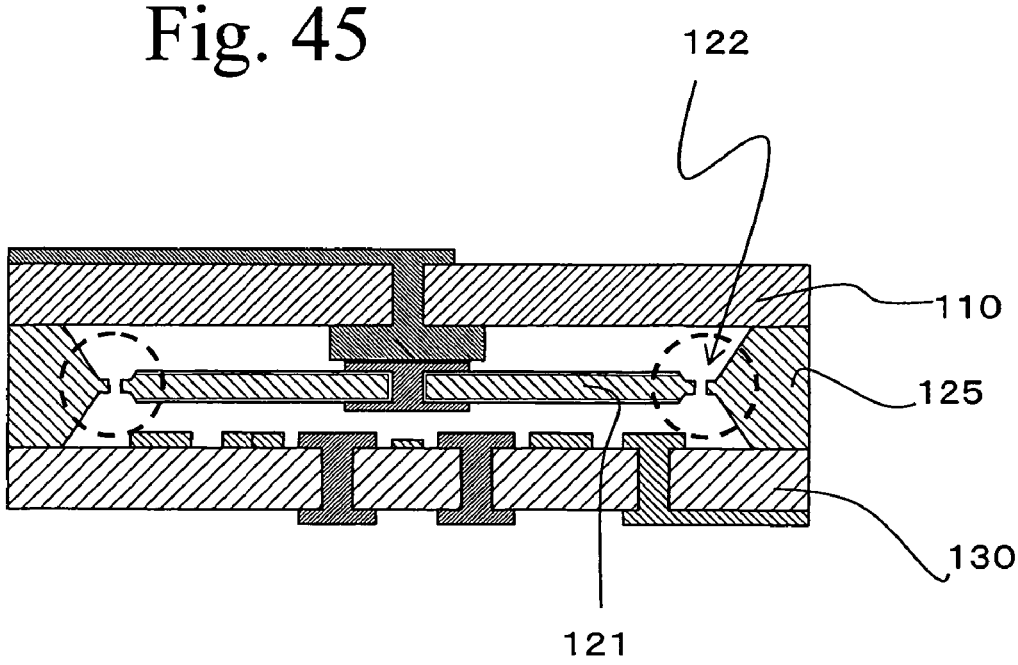
FIG. 45 is a cross-sectional view of a variation of the micro-relay shown in FIG. 44.

FIG. 45 shows a variation of the above-mentioned twenty-first embodiment of the present invention. As the thickness of the movable portion 121 increases, the stiffness of the hinge springs 122 surrounded by a circle increases. However, increased stiffness of the hinge springs 122 may make it more difficult for the movable portion 121 to move down from the initial position. Taking into the above into consideration, the hinge springs 122 have a thickness less than that of the movable portion 121 in order to have reduced stiffness and secure smooth descent from the home position.

Twenty-Second Embodiment

Figure 46A:
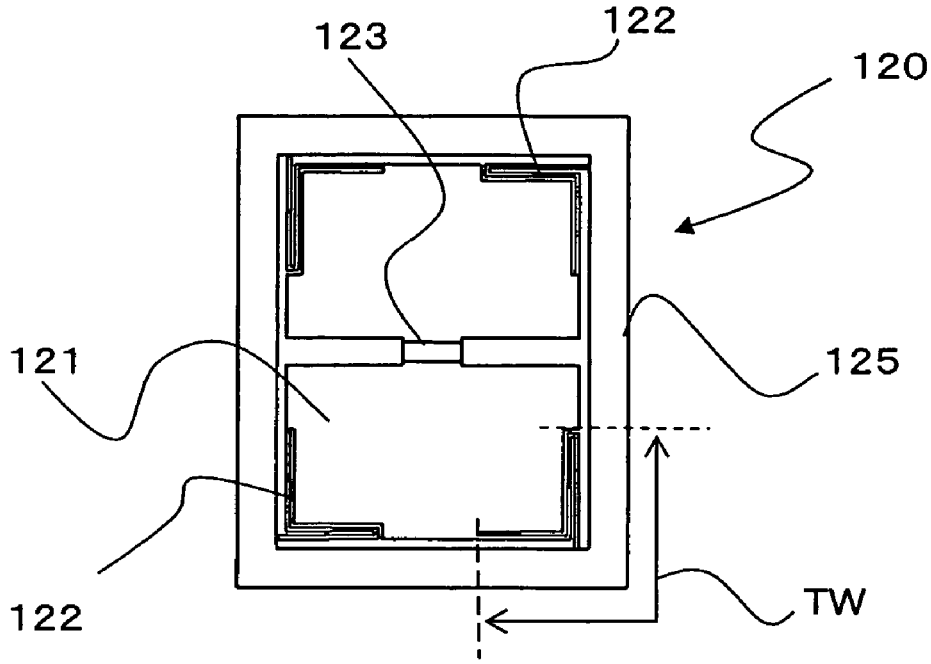
FIGS. 46A and 46B are plan views of micro-relays according to a twenty-second embodiment of the present invention.
Figure 46B:
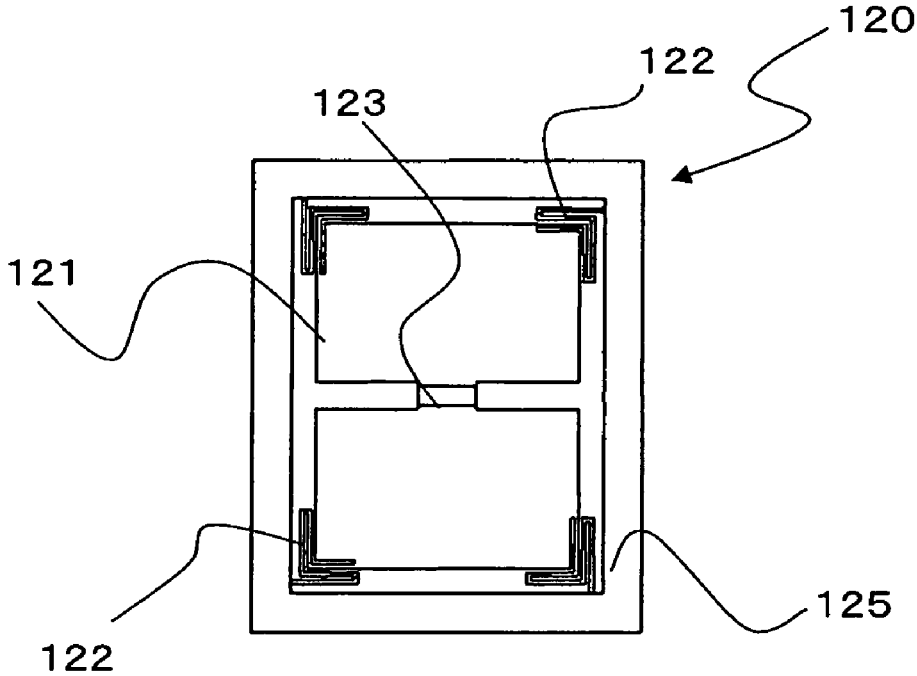

FIGS. 46A and 46B respectively show micro-relays according to a twenty-second embodiment of the present invention. The hinge springs 122 of the movable plate 120 used in this embodiment has a unique structure. The hinge springs 122 shown in FIG. 46A that are folded multiple times run within an extended range TW in order to reduce the stiffness. FIG. 46B shows another variation of the hinge springs 122 that has an increased number of times the hinge springs 122 are folded for the same purpose as mentioned above. The variations of the hinge springs 122 enable the movable portion 121 to smoothly move up and down, and are particularly suitable for the movable portion 121 having enhanced stiffness.

Twenty-Third Embodiment

Figure 47A:
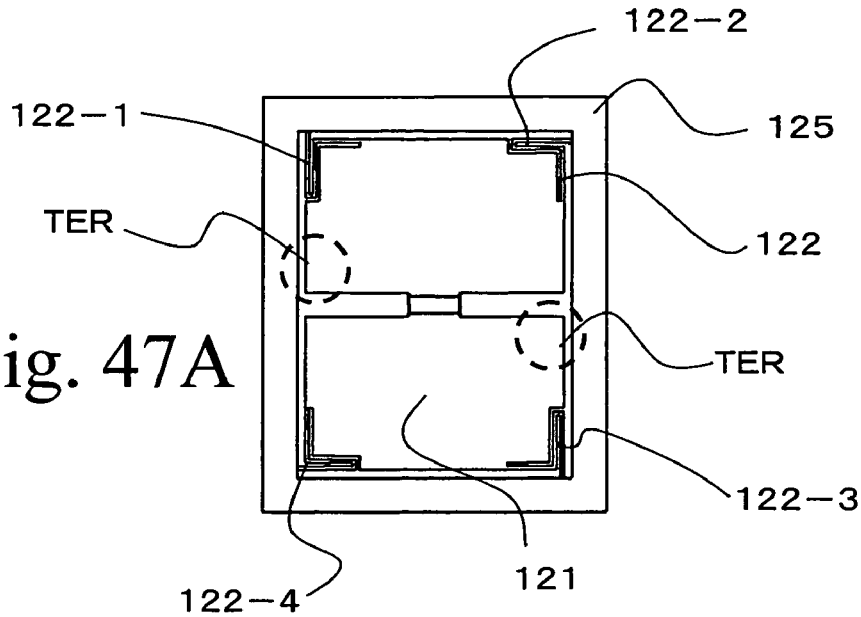
FIGS. 47A, 47B and 47C are plan view of micro-relays according to a twenty-third embodiment of the present invention.
Figure 47B:
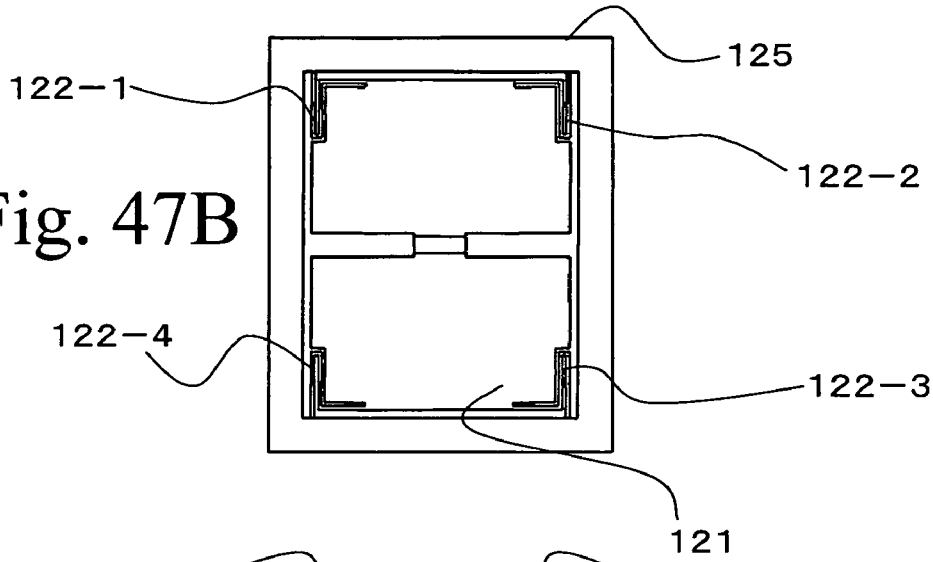
Figure 47C:
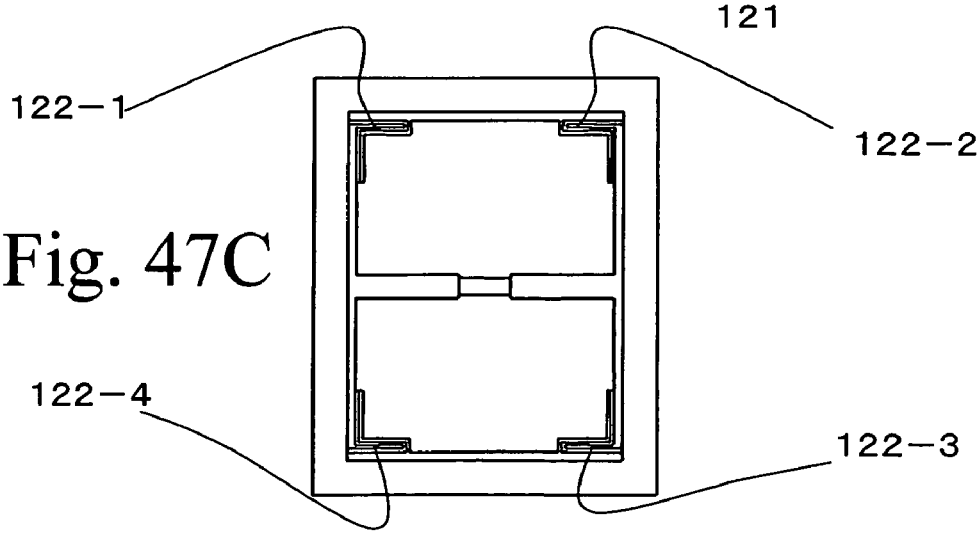

FIGS. 47A, 47B and 47C respectively show micro-relays according to a twenty-third embodiment of the present invention. The movable plate 120 has hinge springs mentioned below. FIG. 47A shows four hinge springs 122-1 through 122-4, each of which is connected to the respective side of the frame 125, thus supporting the movable portion 121. The hinge springs 122-1 through 122-4 enable the movable portion 121 to move up and down. However, it should be noted that a portion indicated by a circle TER tends to move considerably. Such a considerable movement may disturb smooth up/down movement of the movable portion 121.

In order to avoid the above problem, the hinge springs 122-1 through 122-4 shown in FIGS. 47B and 47C are joined to only two opposite sides of the frame 125. More particularly, in FIG. 47B, the hinge springs 122-1 and 122-4 are jointed to the left side of the frame 125, and the hinge springs 122-2 and 122-3 are joined to the right side thereof. In FIG. 47C, the hinge springs 122-1 and 122-2 are joined to the upper side of the frame 125, and the hinge springs 122-3 and 122-4 are joined to the lower side thereof. In FIGS. 47B and 47C, the hinge springs 122-1 through 122-4 are symmetrically arranged. The symmetrical arrangement balances the movable portion 121 very well and enables its smooth up/down movement. Further, the stability of the movable plate 120 can be improved, so that the protrusions 124 provided to the movable portion 121 in the sixteenth embodiment of the present invention may be omitted.

Twenty-Fourth Embodiment

Figure 48A:
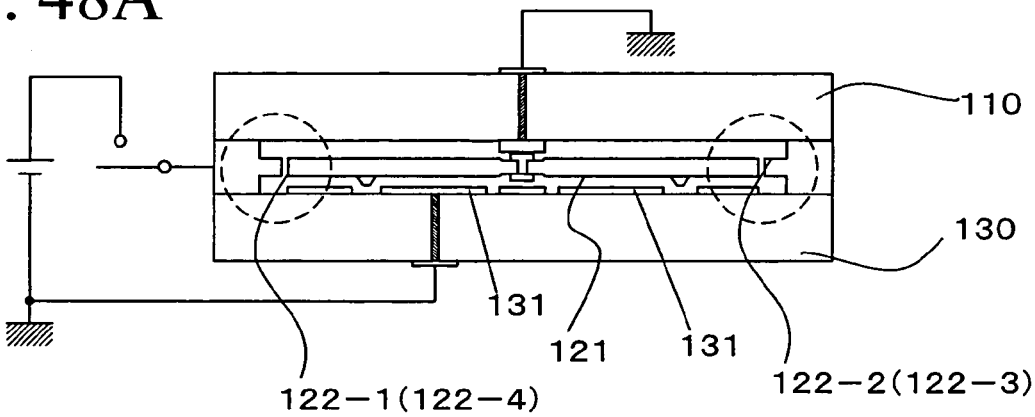
FIGS. 48A, 48B and 48C are cross-sectional views of a micro-relay according to a twenty-fourth embodiment of the present invention.
Figure 48B:
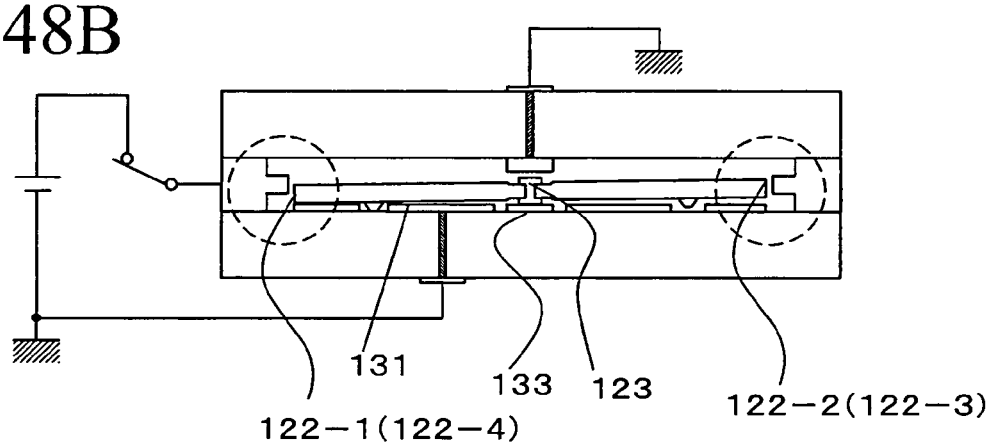
Figure 48C:
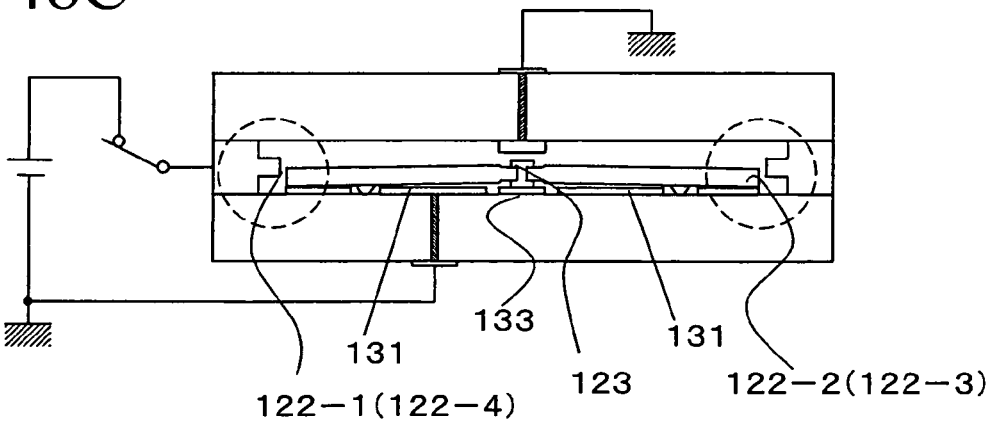

FIGS. 48A, 48B and 48C show a micro-relay according to a twenty-fourth embodiment of the present invention. The balance of the spring constants of the hinge springs is changed so that an extremely minute friction can develop between the movable contact and the stationary contact. In the sixteenth embodiment of the present invention, the movable portion 121 moves up and down while it is kept in the horizontal state. In contrast, according to the twenty-fourth embodiment, the spring constants of the hinge springs are positively adjusted so as to have different values. The four hinge springs 122-1 through 122-4 shown in FIG. 48A through 48C have different spring constants. The spring constants of the hinge springs 122-1 through 122-4 can be adjusted by changing their lengths, widths and/or thicknesses.

When the hinge springs 122-1 through 122-4 have different spring constants, the micro-relay operates as shown in FIGS. 48A through 48C. When electrostatic attraction develops in the neutral state, at least one of the hinge springs having a comparatively small spring constant moves first, and only one side of the movable portion 121 is attracted to the stationary electrode 131 as shown in FIG. 48B. In FIG. 48B, the hinge springs 122-1 and 122-4 have a comparatively small spring constant. Then, as shown in FIG. 48C, the distance between the movable portion 121 and the stationary electrode 131 decreases gradually, and the side of the movable portion supported by the remaining hinge springs 122-2 and 122-3 that have a comparatively large spring constant is attracted to the stationary electrode 131. Finally, both the opposite sides of the movable portion 121 are attracted to the stationary electrode 131. On the way from the state of FIG. 48B to that of FIG. 48C, the movable contact and the stationary contacts 133 slightly rub against each other (this is called wiping). The rubbing develops new contact surfaces due to wiping. That is, the rubbing inhibits an insulation coating film from being formed on the contact surfaces and inhibits insulation material from being deposited due to wiping. According to the present invention, the wiped contact surfaces are always available, this stabilizing the contact resistance and improving the reliability of the micro-relay.

The hinge springs 122-1 through 122-4 may be divided into groups, each of which has a respective spring constant. For example, in FIGS. 47A through 47C, the hinge springs 122-1 and 122-4 are grouped and assigned an identical spring constant, and the high springs 122-2 and 122-3 are grouped and assigned another identical spring constant.

Twenty-Fifth Embodiment

Figure 49:
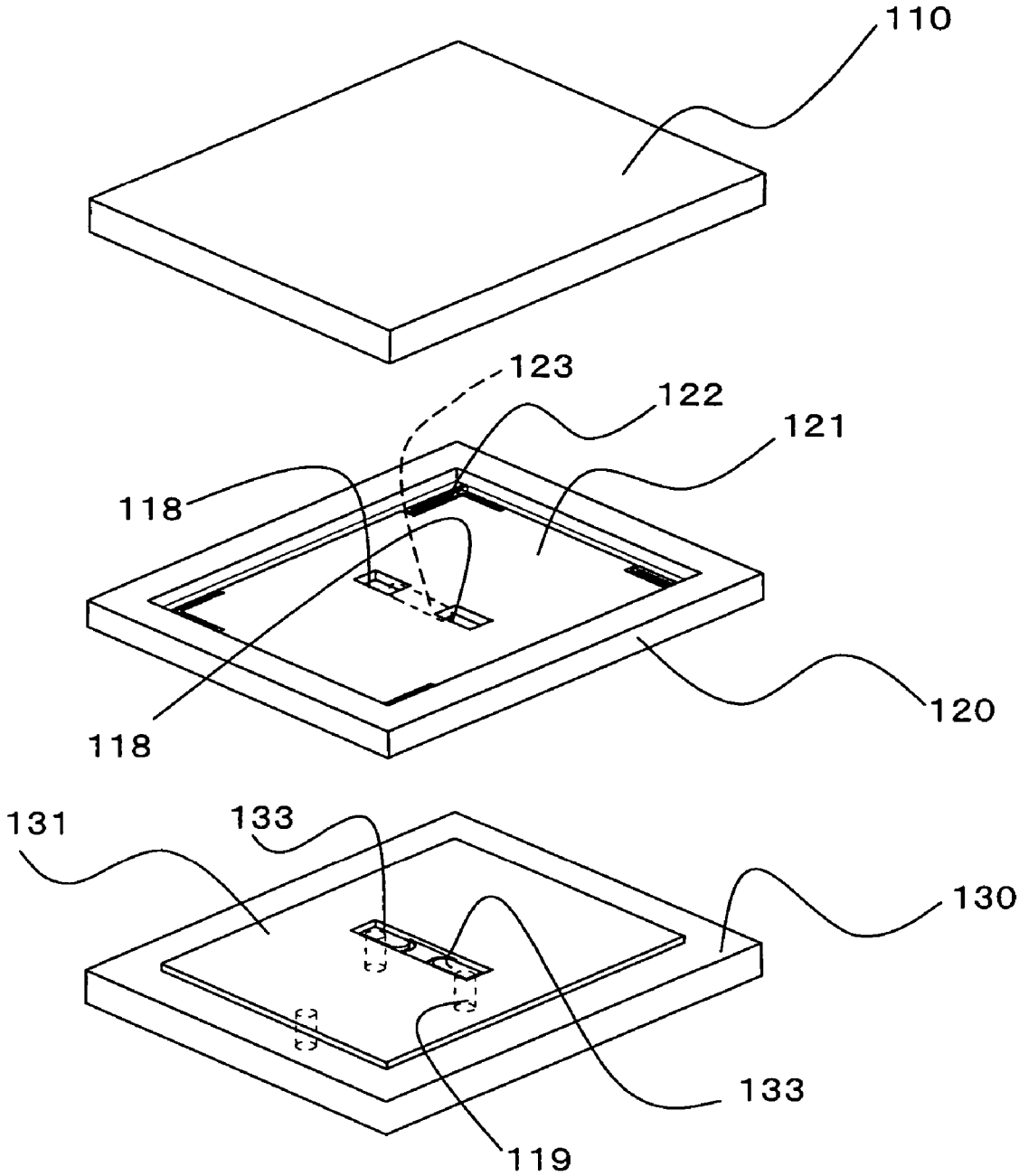
FIG. 49 is an exploded perspective view of a micro-relay according to a twenty-fifth embodiment of the present invention.

FIG. 49 is an exploded perspective view of a micro-relay according to a twenty-fifth embodiment of the present invention. The stationary electrode 131 and the movable portion 121 employed in this embodiment have improved stiffness in order to enable increased electrostatic attraction to develop therebetween. The movable portion 121 has a plate shape in which a pair of through holes 118 is formed, while the movable portion 121 used in the sixteenth embodiment is configured so as to have two plates joined by the movable contact 123. In FIG. 49, the movable contact 123 is attached to a surface portion on the backside of the movable portion 121 interposed between the through holes 118. The movable portion 121 used in this embodiment has higher stiffness than that composed of two plates joined by the movable contact 123. Further, the movable portion 121 in FIG. 49 has an increased electrode area, which develops stronger electrostatic attraction.

The stationary contacts 133 used in the twenty-fifth embodiment have a reduced length, and are extracted from the backside of the stationary substrate 130 via the through holes 119. The stationary substrate 130 used in the present embodiment has an increased electrode area of the stationary electrode 131 because of reduction in the lengths of the stationary contacts 133. This structure improves the stiffness of the stationary electrode 131 and increases the electrostatic attraction exerted on the movable portion 121. The micro-relay thus configured has the mechanically strengthened movable portion 121 and the stationary electrode 131, which accepts increased electrostatic force. The driving efficiency is thus improved.

Even in a case where only one of the stationary electrode 131 and the movable portion 121 is employed, similar effects can be provided.

Twenty-Sixth Embodiment

Figure 50A:
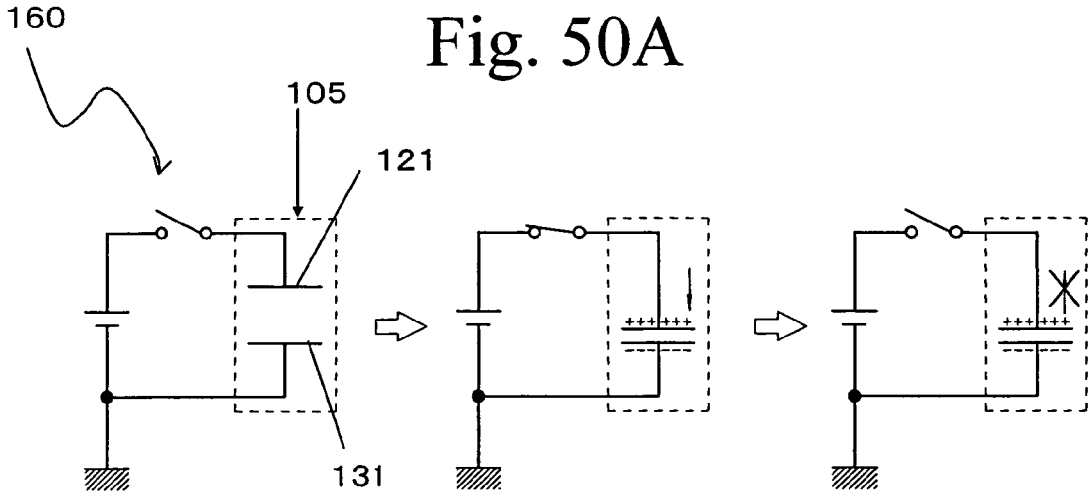
FIGS. 50A and 50B show a micro-relay according to a twenty-sixth embodiment of the present invention.
Figure 50B:
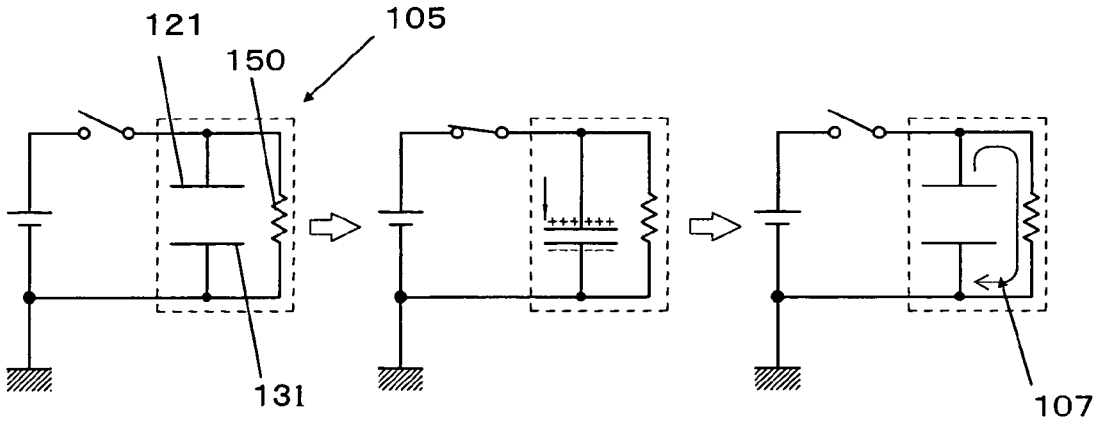

FIGS. 50A and 50B show a micro-relay according to a twenty-sixth embodiment of the present invention. The present embodiment is equipped with a mechanism intended to remove the charges in the stationary electrode 131 and the movable portion 121. FIG. 50A shows a faulty that may occur in the absence of the discharge resistor. When a power supply 166 is turned OFF, charges remain in the stationary electrode 131 and the movable contact 121. In this case, the movable portion 121 may remain in the contact state, or a leakage current may flow to discharge the movable portion 121, so that the movable portion 121 returns to the initial state. There is also a possibility that the movement of the movable portion 121 is instable due to the remaining charges.

In contrast, a discharge resistor 150 is provided between the stationary electrode 131 and the movable portion 121. In other words, the resistor 150 is connected in parallel to the capacitor defined by the movable portion 121 and the stationary electrode 131. When the voltage is applied to the movable portion 121, the capacitor is charged. When the supply of the voltage is stopped, a current 107 flows to the ground as shown in FIG. 50B, so that the movable portion 121 can be discharged promptly and return to the initial position. The discharge resistor 150 may have a resistance of hundreds of kΩ to a few MΩ.

Twenty-Seventh Embodiment

Figures 51A, 51B, 51C:
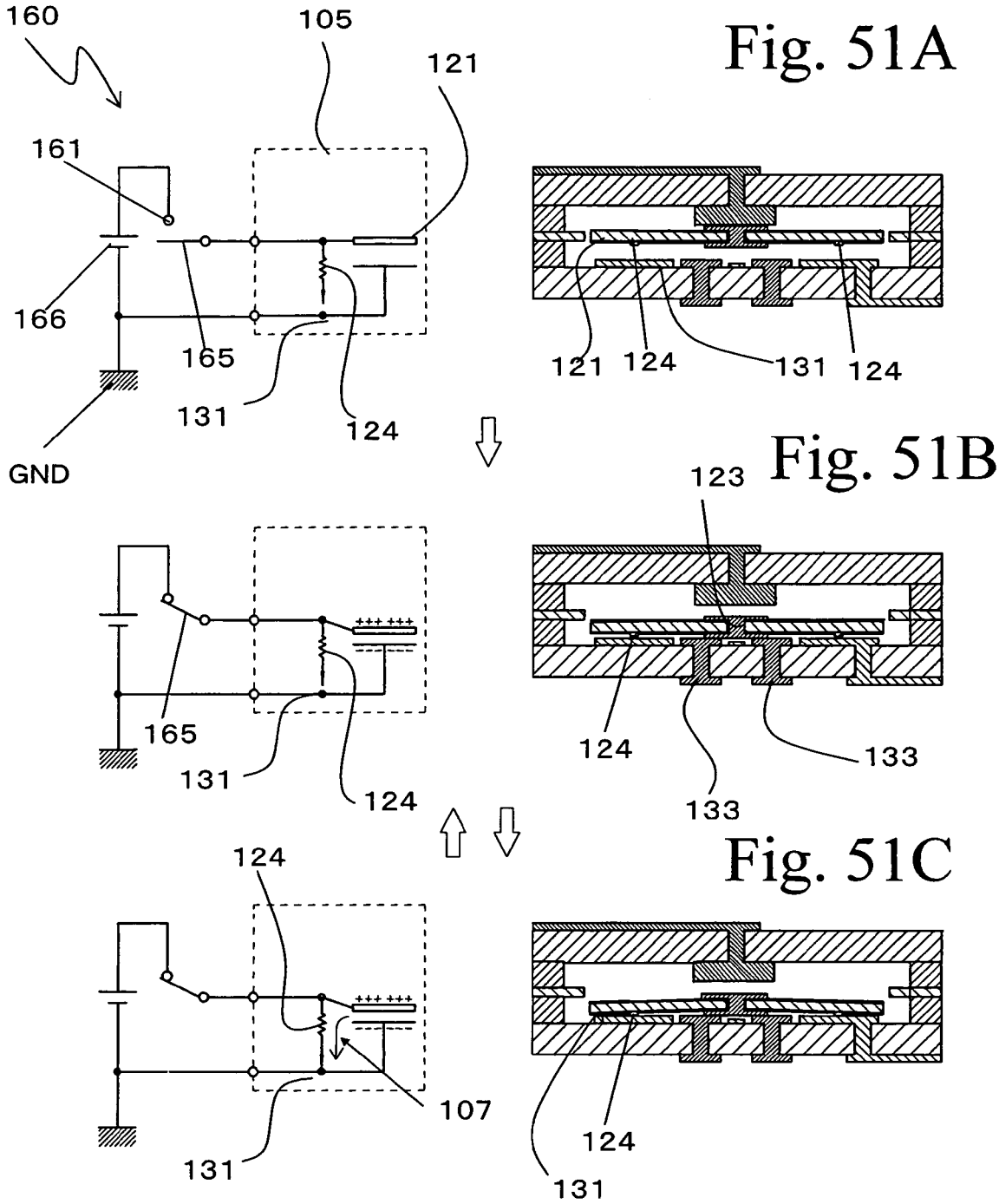
FIGS. 51A, 51B and 51C show a micro-relay according to a twenty-seventh embodiment of the present invention.

FIGS. 51A, 51B and 51C show a micro-relay according to a twenty-seventh embodiment of the present invention, in which the protrusions provided to the movable portion are assigned a discharge resistance function. As has been described previously, the protrusion 124 provided to the lower surface of the movable portion 121 serve as the stoppers that prevent the movable portion 121 from sticking to the stationary electrodes 131. According to the twenty-seventh embodiment of the present invention, the protrusions 124 also function as discharge resistors, which remove the residual charges.

A resistor is provided on the surface of each protrusion 124 by doping silicon or polysilicon with an impurity. FIGS. 51A through 51C show an operation in which the movable portion 121 goes down. The movable contact 165 of the switch is turned ON from the state of FIG. 51A to make a connection with the contact 161, as shown in FIG. 51B. The movable portion 121 is thus electrically attracted to the stationary electrode 131. The movable contact 123 of the micro-relay is brought into contact with the stationary contacts 133, so that the circuit including the micro-relay is looped. At this time, the lower protrusions 124 have not yet been brought into contact with the stationary electrode 131. Then, the movable portion 121 is further attracted and the lower protrusions 124 are pressed against the stationary electrode 131. At that time, the lower protrusions 124 prevent the movable portion 121 from sticking to the stationary electrode 131 and simultaneously function as the discharge resistors between the movable portion 121 and ground. Thus, the lower protrusions 124 prevent the charges from remaining in the movable portion 121 and the stationary electrode 131. It is therefore possible to relax exclusive electrostatic attraction after the circuit is looped and effectively prevent sticking of the movable portion 121. Preferably, it is desired to take the time constant and the resonance frequency of the movable portion 121 into account in order to prevent vibration.

Twenty-Eighth Embodiment

Figure 52:
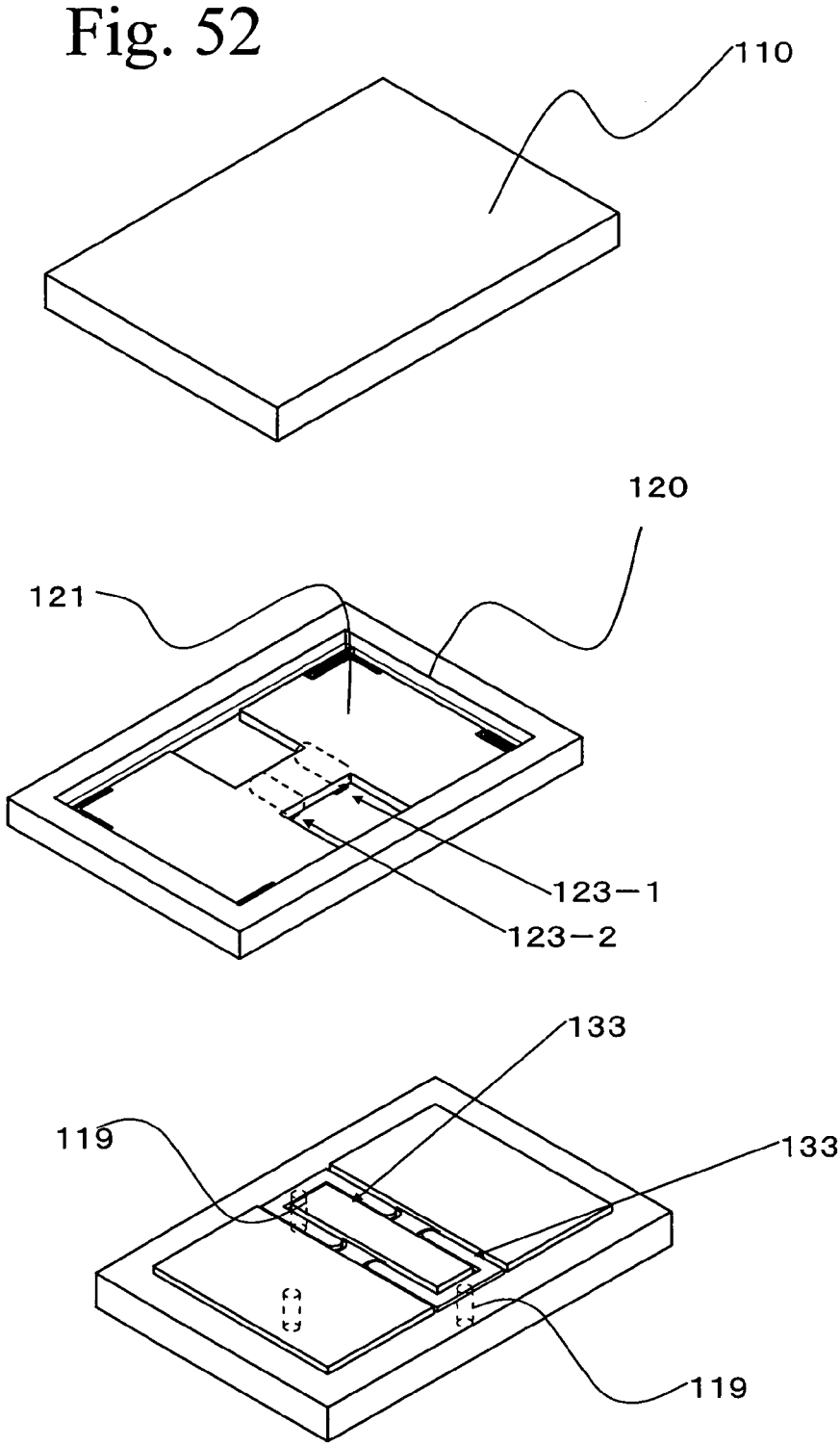
FIG. 52 is an exploded perspective view of a micro-relay according to a twenty-eighth embodiment of the present invention.

FIG. 52 is an exploded perspective view of a micro-relay according to a twenty-eighth embodiment of the present invention. The movable portion employed in this embodiment is equipped with two movable contacts 123-1 and 123-2. Correspondingly, the stationary contacts 133 provided to the stationary substrate 130 are approximately C-shaped contacts. The movable contact 123-1 makes contact with the two C-shaped contacts 133, and the movable contact 123-2 makes contact therewith. This is a redundant arrangement. That is, even if either the movable contact 123-1 or 123-2 or one of the C-shaped stationary contacts 133 becomes defective, the original function of the relay can be secured. The movable portion 121 may have three or more movable contacts. The structure of the movable portion 121 can be applied to the stationary contact 113 of the cap substrate 10 composed of the signal contacts provided in the signal line shown in FIGS. 40 and 41 that depict the twentieth embodiment of the present invention.

Figure 53:
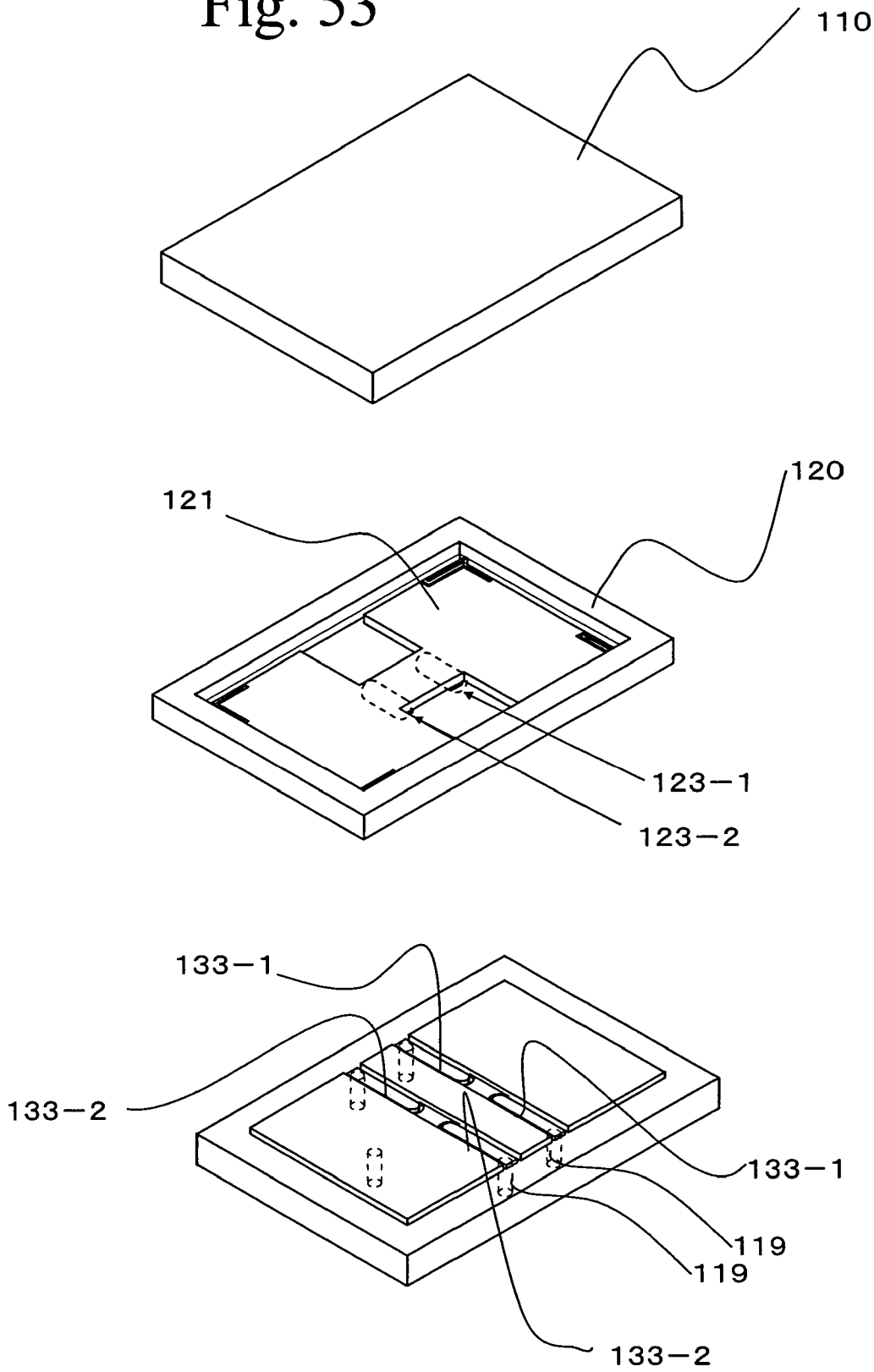
FIG. 53 is an exploded perspective view of a variation of the micro-relay shown in FIG. 52.

FIG. 53 is an exploded perspective view of a micro-relay that is a variation of the twenty-eighth embodiment of the present invention. In the above-mentioned structure shown in FIG. 53, each of the C-shaped stationary contacts 133 shown in FIG. 52 is divided into two contacts 133-1 and 133-2. The movable contact 123-1 makes contact with a pair of stationary contacts 133-1 and 133-2. Similarly, the movable contact 123-2 makes contact with another part of stationary contacts 133-1 and 133-2. According to this variation, the signal line has a redundant structure in addition to the redundant structure of contacts. Thus, the micro-relay of FIG. 53 is more reliable.

Twenty-Ninth Embodiment

Figure 54A:
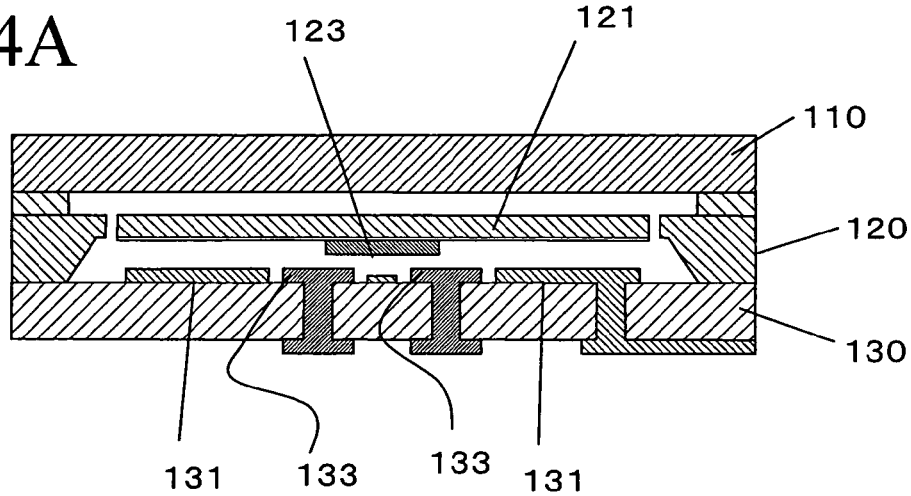
FIGS. 54A, 54B and 54C are cross-sectional views of a micro-relay according to a twenty-ninth embodiment of the present invention.
Figure 54B:
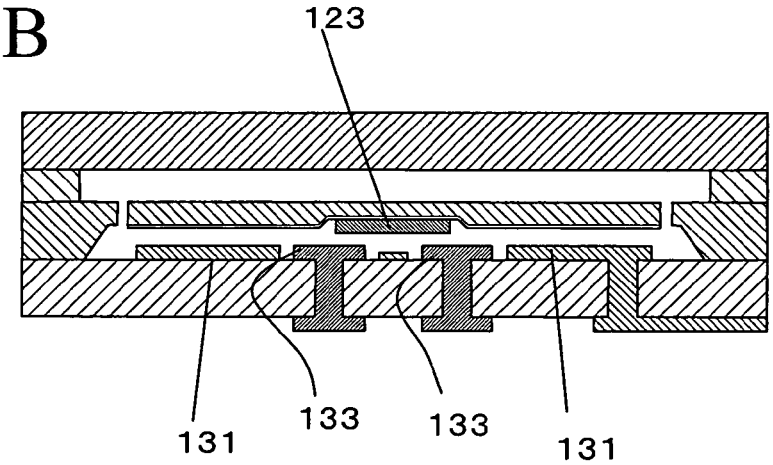
Figure 54C:
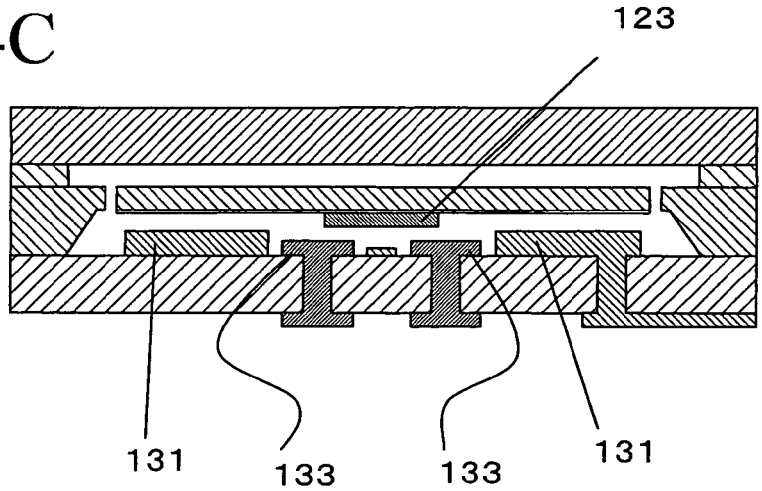

FIGS. 54A, 54B and 54C respectively relate to a micro-relay according to a twenty-ninth embodiment of the present invention. The present embodiment employs a preferable structure of the stationary electrode formed on the stationary electrode. FIGS. 54A and 54B are respectively cross-sectional views of comparative examples, and FIG. 54C is a cross-sectional view of a micro-relay according to the twenty-ninth embodiment of the invention. In the micro-relay shown in FIG. 54A, the stationary electrode 131 and the stationary contacts 133 supported by the stationary substrate 130 are approximately flush with each other. Thus, there is a large spacing between the stationary electrode 131 and the movable portion 133 serving as the movable electrode. Such a large spacing needs for a high drive voltage in order to obtain the designed electrostatic attraction. The structure shown in FIG. 54B may solve the above problem. In FIG. 54B, the movable contact 123 is placed in a recess formed on the inner surface of the movable portion 121, so that the movable contact 123 shifts upwards. However, it is difficult to form the structure of FIG. 54B, and an increased number of production steps is needed. This raises the cost.

In contrast, the stationary electrode 131 shown in FIG. 54C is higher than the stationary contacts 133. It is preferable that the difference in height between the stationary electrode 131 and the stationary contacts 133 is made slightly less than the height of the movable contact 123 measured from the top surface of the stationary substrate 130. According to the present embodiment, the structure is simple and the movable portion 121 can be surely attracted.

The insulation film on the upper side of the movable portion 121 and the structure of the cap substrate 110 are simply illustrated.

Thirtieth Embodiment

Figure 55A:
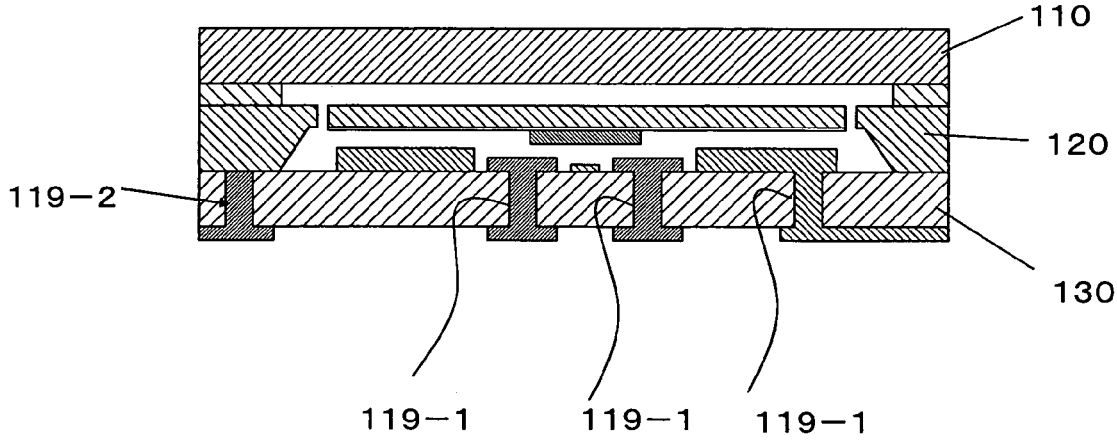
FIG. 55A is a cross-sectional view of a micro-relay according to a thirtieth embodiment of the present invention.

FIG. 55A is a cross-sectional view of a micro-relay according to a thirtieth embodiment of the present invention. This micro-relay is equipped with the movable plate 120 that has a unique interconnection structure. A through hole 119-2 is formed in the stationary substrate 130 via which the interconnection line extending from the movable plate 120 is extracted to the backside of the stationary substrate 130. The through hole 119-2 can be formed simultaneously with the through holes 119-1. Thus, the production process can be simplified as compared to the aforementioned embodiments of the present invention. The through hole 119-2 may be formed in the cap substrate 110 instead of the stationary substrate 130. It will be noted that the periphery of the movable portion and the structure of the cap substrate 110 are simply illustrated.

Thirty-First Embodiment

Figure 55B:
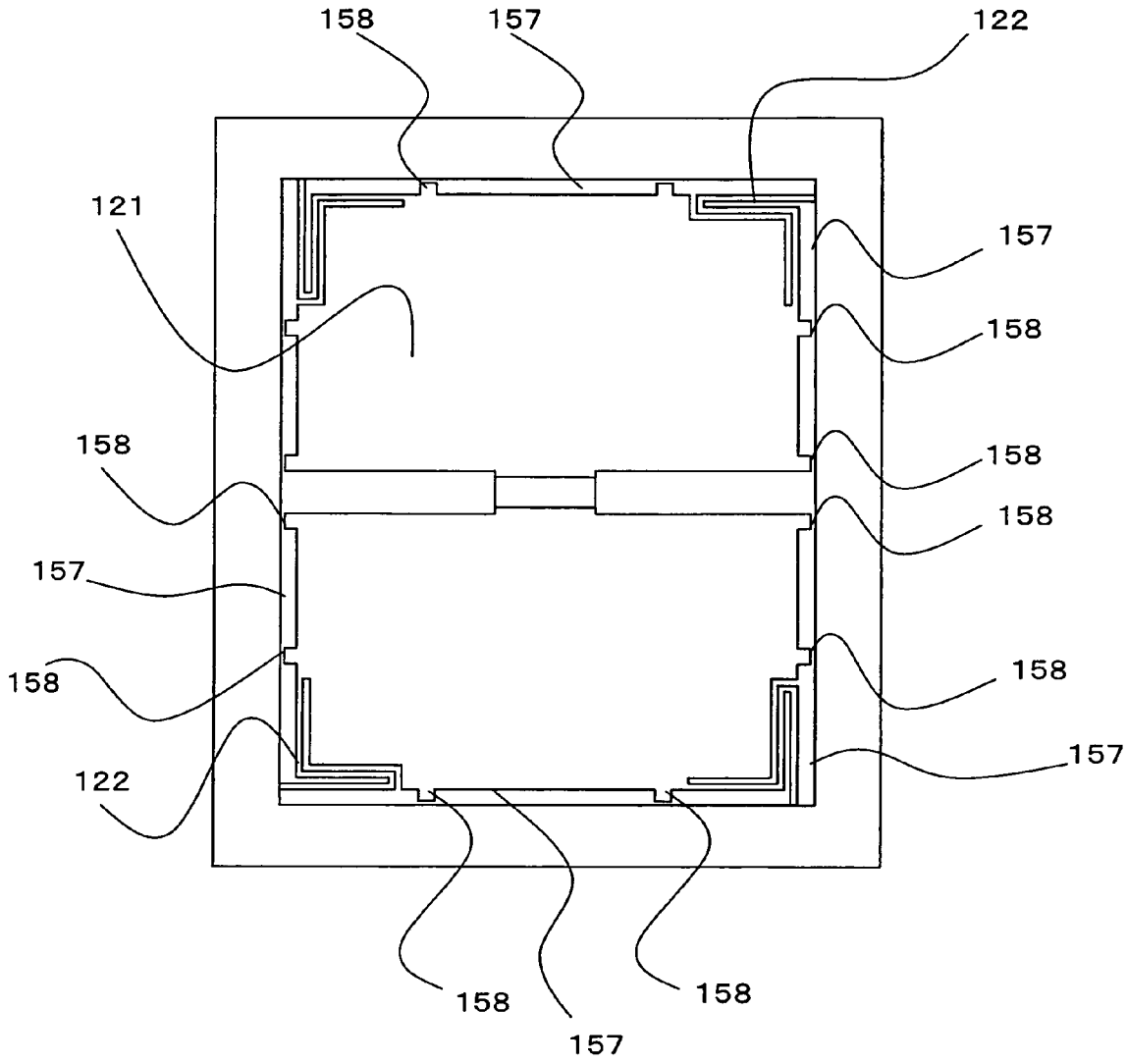
FIG. 55B is a plan view of a micro-relay according to a thirty-first embodiment of the present invention.

FIG. 55B is a plan view of a micro-relay according to a thirty-first embodiment of the present invention. This micro-relay is equipped with the movable plate 120 that has a unique structure. As shown in FIG. 55B, there are provided gaps 157 between the side edges and the frame 125, and multiple outer stoppers 158 that protrude from the side edges of the movable portion 121 towards the inner sides of the frame 125. The stoppers 158 restrict horizontal movement (in-plane movement) of the movable portion 121. The stoppers 158 may be formed integrally with the movable portion 121. Alternatively, a material having excellent elasticity may be added to the movable portion 121, so that crushproof can be improved.

Preferably, the stoppers 158 may be symmetrically arranged. The stoppers 158 are very small projections and do not prevent airflow caused by the up/down movement of the movable portion 121. The stoppers 158 integrally formed with the movable portion 121 do not need an additional production step.

The stoppers 158 may be provided to the frame 125 instead of the movable portion 121. It is also possible to provide the stoppers 158 to both the movable portion 121 and the frame 125.

As a variation of all the aforementioned sixteenth through thirty-first embodiments of the present invention, a ground pad or pattern may be provided on the entire outer or top surface of the cap substrate 110, so that the signal line can be shielded more effectively. The ground pattern also functions to protect electrostatic attraction from being affected by external turbulence such as static electricity and to prevent malfunctions of the micro-relay. It is also possible to provide an insulation film on the side surfaces of the laminated structure of the micro-relay chip on which a metal layer is provided for obtaining the shield effect. Preferably, the movable contacts 123 and the stationary contacts 113 and 133 have an underlying layer of Au, which is coated with a platinum base metal such as Rh, Ru, Pd or Pt. The Au underlying layer serves as a cushioning member, and the surface layer of the platinum base metal has a high degree of hardness. The contacts of the above multilayer structure do not easily stick to each other.

Figure 56A:
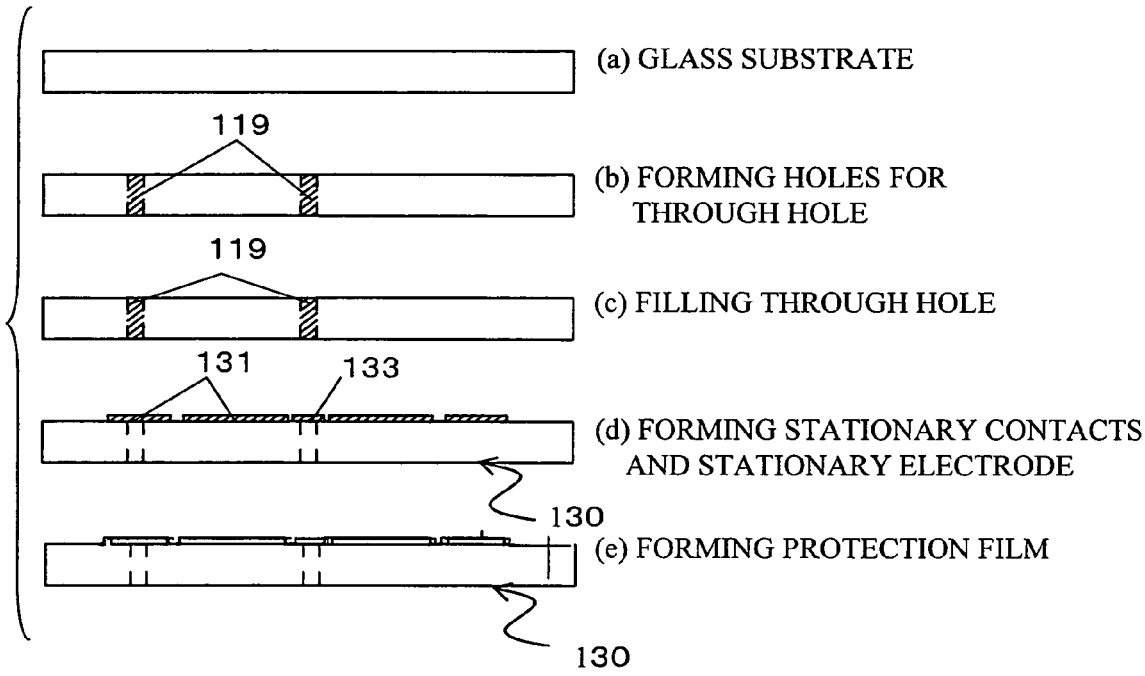
FIG. 56A shows a process of producing a stationary substrate used in the micro-relay according to the seventeenth embodiment of the present invention.
Figure 56B:
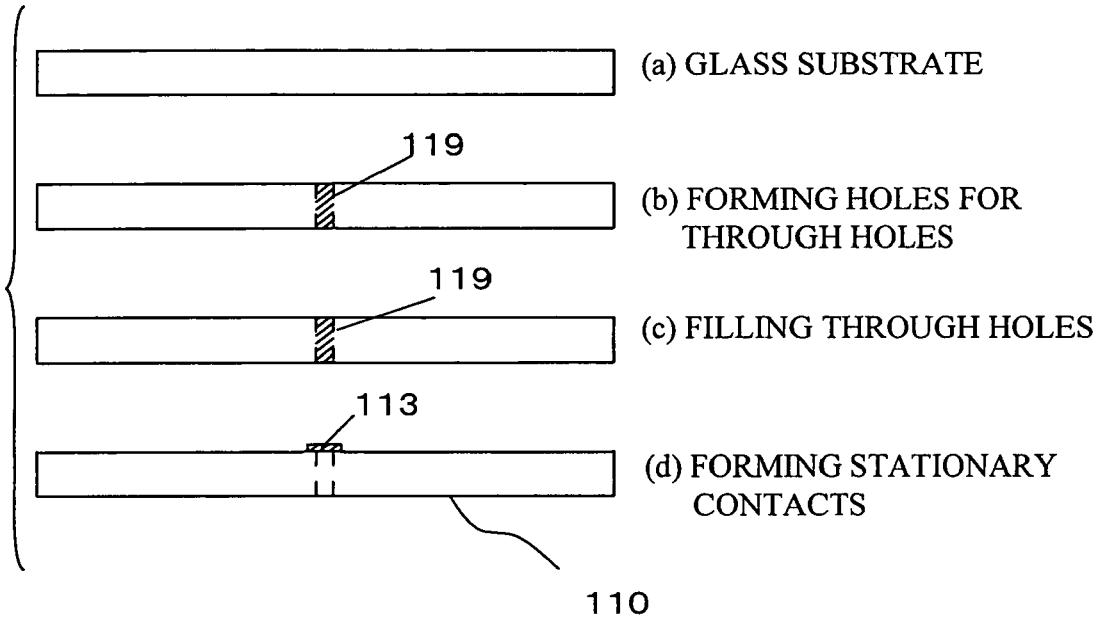
FIG. 56B shows a process for producing a stationary substrate employed in the micro-relay according to the seventeenth embodiment of the present invention.
Figure 56C:
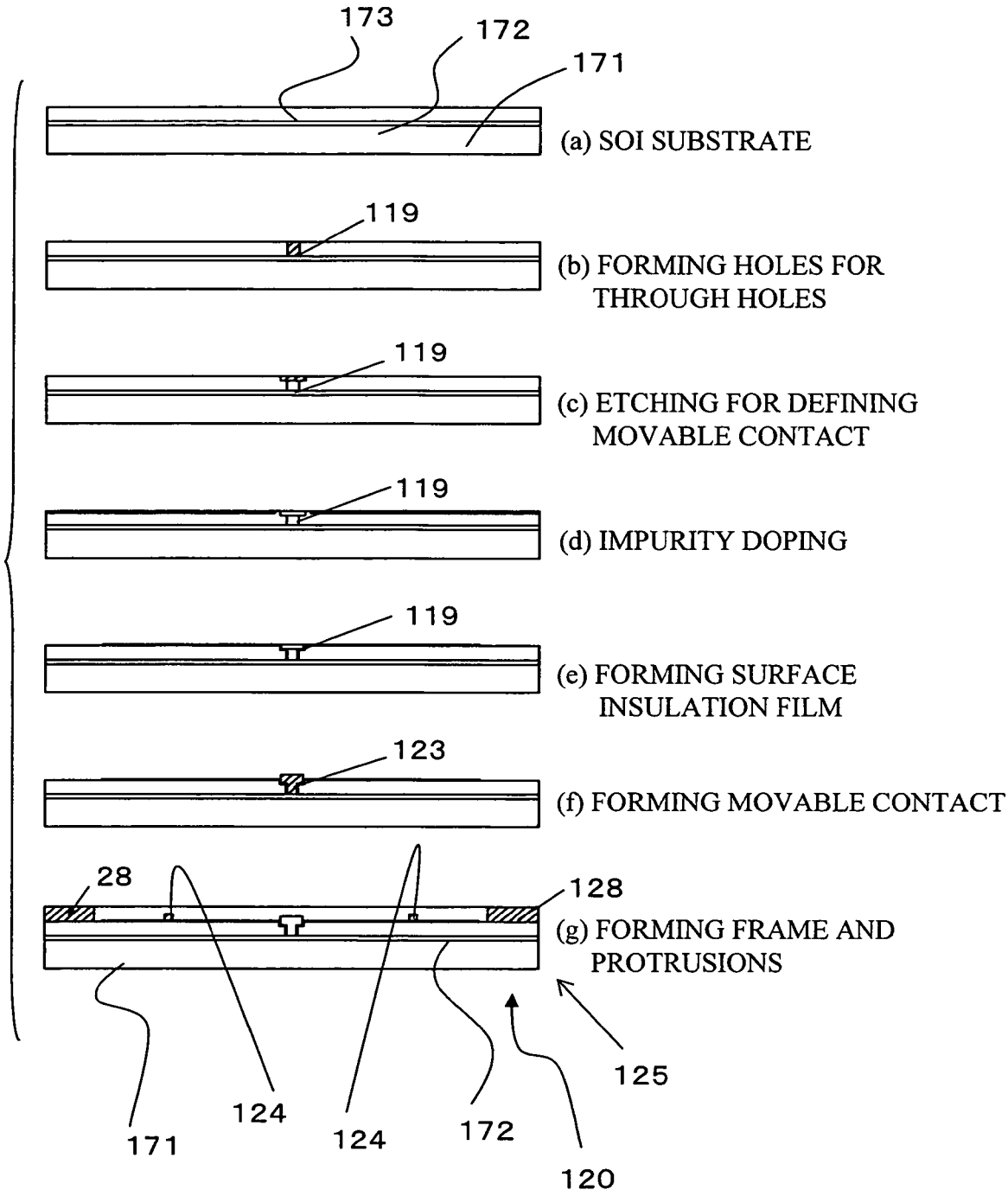
FIG. 56C shows a process for producing a cap substrate employed in the micro-relay according to the seventeenth embodiment of the present invention.
Figure 56D:
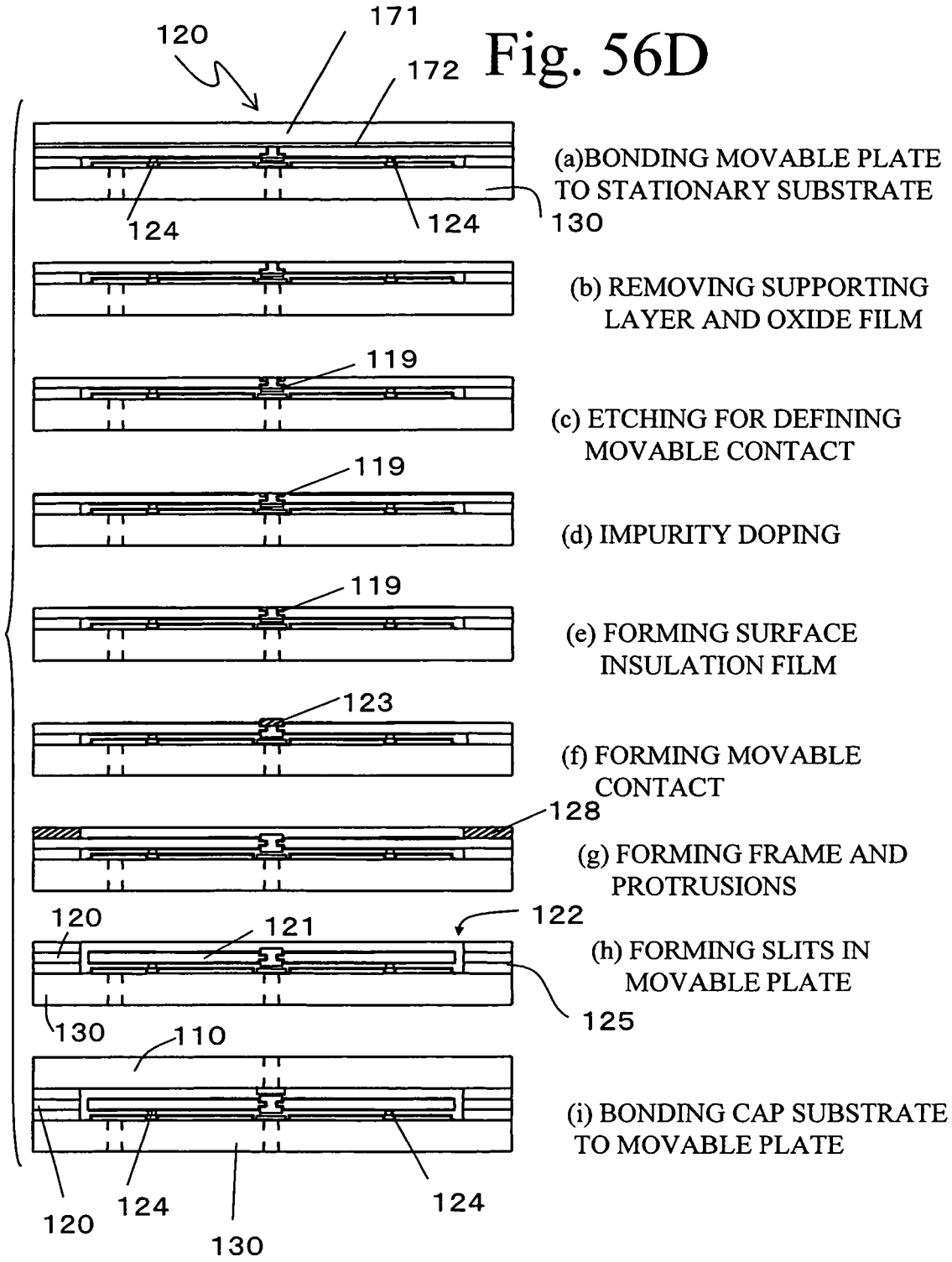
FIG. 56D shows a process for assembling the structural parts produced by the processes shown in FIGS. 56A through 56D.

A description will now be given, with reference to FIGS. 56A through 56D, of a method of fabricating the micro-relay chip 105 according to the seventeenth embodiment of the present invention that employs the spacers for defining the gap. FIG. 56A shows a process for producing the stationary substrate 130, and FIG. 56B shows a process for producing the cap substrate 10. FIG. 56C shows a process for producing the movable plate 120, and FIG. 56D shows a process for assembling the above structural parts. These processes utilize the semiconductor production techniques, such as film growth, exposure and etching.

The stationary substrate 130 is produced as shown in FIG. 56A. The glass substrate 130 that is 0.2-0.4 mm thick is prepared (step (a)). Preferably, the glass substrate 130 is made of Pyrex glass (registered trademark). As will be described later, this glass has a thermal expansion coefficient close to that of single crystal silicon used for the movable plate 120 that will be described later, so that the glass substrate 130 and the movable plate 120 can be joined very well.

Next, holes for the through holes 119 are formed in the glass stationary substrate 130 (step (b)). The inner walls of the holds are plated with are filled with an electrically conductive material (step (c)). Examples of the conductive material are gold, copper or aluminum.

Then, the stationary electrode 131 and the stationary contacts 133 are formed by sputtering or another appropriate process (step (d)). The electrode 131 and the contacts 133 may be made of gold or platinum, or may have a multilayer structure that has an Au underlying layer on which a platinum base metal such as Rh, Ru, Pd or Pt may be deposited. Particularly, it is preferable that the stationary contacts 133 that are brought into contact with the movable contact have a surface layer made of a platinum-based metal that has abrasion resistance. The Au underlying layer serves as a cushion and simultaneously reduces the resistance. The stationary substrate 130 thus formed has the glass substrate on which the stationary electrode 131 and the stationary contacts 133 are provided. As shown in step (e) of FIG. 56A, as necessary, a protection film made of $Si_3N_4$ or the like may be formed on the surface of the stationary electrode 130 by CVD (Chemical Vapor Deposition) or the like.

The process for producing the cap substrate 110 shown in FIG. 56B is the same as that shown in FIG. 56A. That is, the cap substrate 110 can be produced in the same manner as the stationary substrate 130.

The movable plate 120 is produced as shown in FIG. 56C, which shows the process for producing the movable plate 120 up to a step just before the movable plate 120 is joined to the stationary substrate 130. After the movable plate 120 is joined to the stationary substrate 130, it is further processed so that the movable plate 120 is finally completed. First, an SOI (Silicon On Insulator) substrate is prepared (step (a)). The SOI substrate has a laminate structure in which an oxide film 172 such as an $SiO_2$ film is formed on a comparatively thick supporting layer 171, and an active layer 173 made of single crystal silicon is formed on the oxide film 172.

Next, a through hole 119 used to form the movable contact 123 is formed in the SOI substrate (step (b)). As has been described, the movable contact 123 is penetrated through the through hole 119 and protrudes from both the upper and lower surfaces of the movable portion 121. A peripheral portion that surrounds the upper edge of the through hole 119 is etched so as to define a surface area for accommodating the upper contact portion of the movable contact 123 (step (c)). Then, the active layer 173 is doped with an impurity so that the active layer 173 has conductivity (step (d)). An insulation film made of $SiO_2$ or the like is deposited on the surface of the active layer 173 (step (e)). The insulation film electrically isolates the movable plate 120 from the movable contact 123.

Then, the through hole 119 is filled with a metal by plating or sputtering, so that the upper half of the movable contact 123 including the upper contact portion can be formed. Thereafter, polysilicon is deposited on an outer ring-like surface area that corresponds to the frame 125 of the movable plate 120. Thus, the spacer 128 of polysilicon is formed. Further, the protrusions 124 serving as the stoppers are formed on the insulation film.

The stationary substrate 130, the cap substrate 110 and the movable plate 120 are assembled so as to form a laminate, as shown in FIG. 56D. First, the semifinished movable plate 120 is bonded to the stationary substrate 130 (step (a)). The semifinished movable plate 120 obtained by the process of FIG. 56C is turned upside down. Then, the plate 120 is mounted on the stationary substrate 130 and is bonded thereto. Preferably, anodic bonding is used. When the stationary substrate 130 is set at a positive potential and the movable plate 120 is set at the ground potential, they can be tightly bonded with ease.

Subsequently, a process for forming the remaining half of the movable plate 120 is carried out. First, the supporting layer 171 and the oxide film 172 are removed (step (b)). Then, the semifinished plate 120 is processed by the same process as shown in FIG. 56C. That is, the surface portion around the edge of the through hole is etched in order to form the other contact portion of the movable contact 123 (step (c)). Then, the substrate 171 is doped with an impurity (step (d)). An insulation film is formed on the surface of the substrate 171 (step (e)), and the remaining half of the movable contact 123 is completed (step (f)). Then, polysilicon is deposited on the area corresponding to the frame 125 to thus form the spacer 128 and the protrusions 124 (step (g)).

Thereafter, slits for defining the hinge springs 122 are formed in the movable plate 120. The frame 125 and the movable portion 121 are connected via the hinge springs 122 (step (f)). When the movable plate 120 is made of single crystal silicon, the hinge springs 122 that are formed several times can be easily formed by RIE (Reactive Ion Etching).

Finally, the cap substrate 110 is mounted on the movable plate 120, and is bonded thereto by anodic bonding (step (g)). Preferably, anodic bonding is carried out in a pressure-reduced atmosphere, more preferably, in an inactive gas. Thus, the micro-relay can be hermetically sealed with no gas remaining in the interior. Now, multiple micro-relay chips arranged on the wafer are available. These chips are divided into the individual chips by dicing. Since the micro-relay chips are already hermetically sealed, the interiors thereof are not affected by dicing at all. The individual chips are respectively subjected to the process shown in FIGS. 31A through 31C, so that the micro-relay devices 100 can be obtained.

Thirty-Second Embodiment

Figure 57:
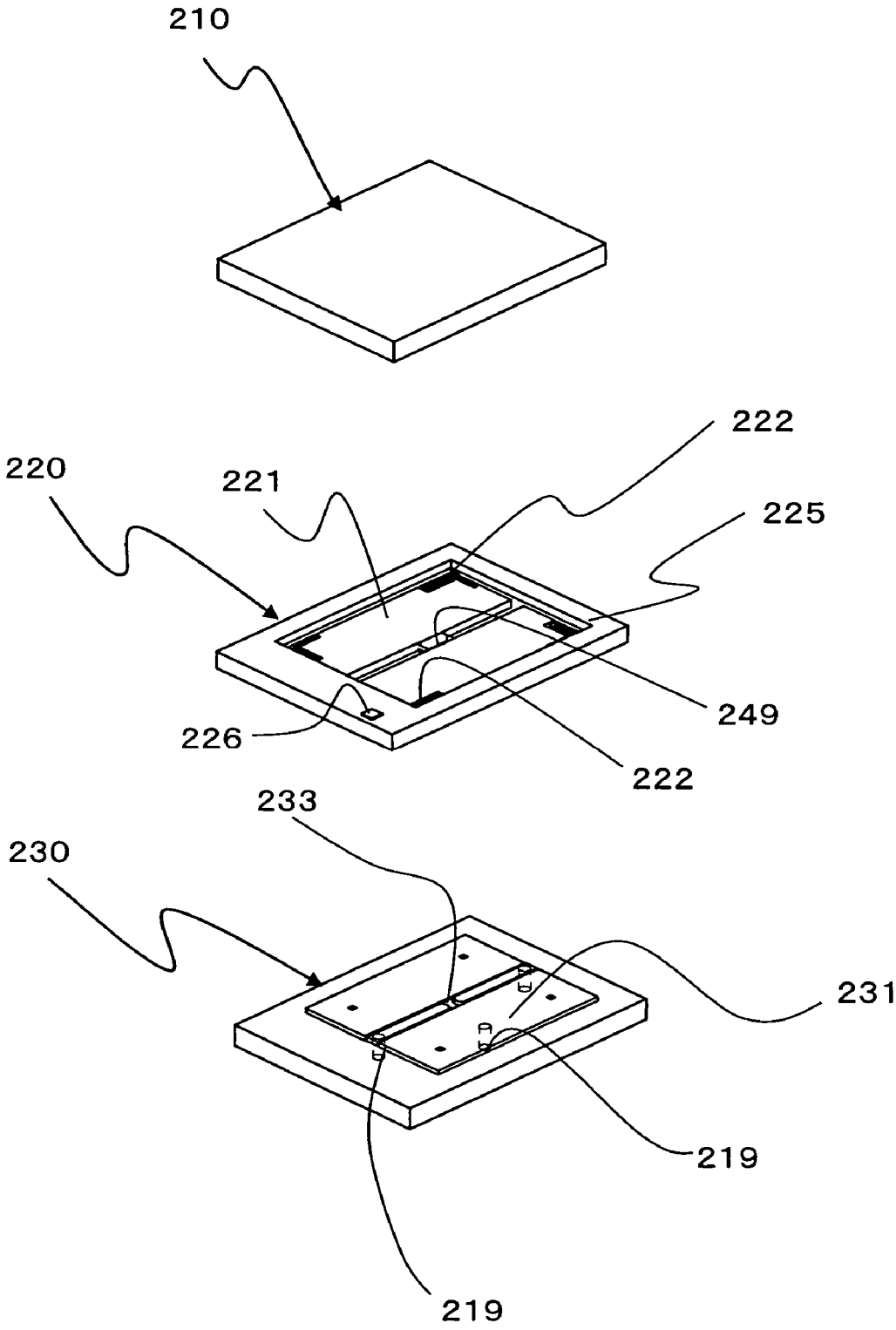
FIG. 57 is an exploded perspective view of a micro-relay according to a thirty-second embodiment of the present invention.
Figure 58A:
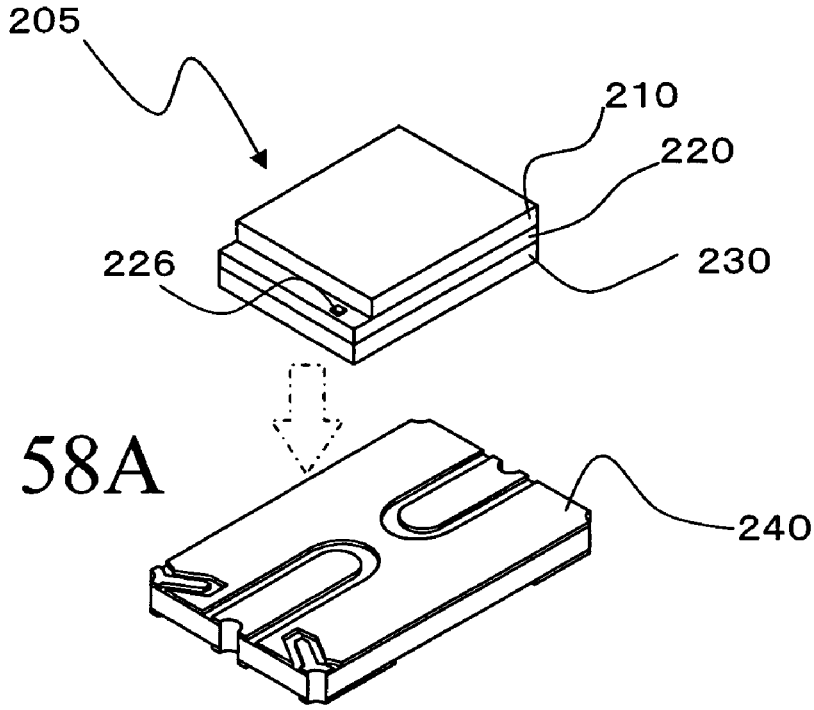
FIGS. 58A, 58B, and 58C show how to assemble a micro-relay device using a micro-relay chip shown in FIG. 57.
Figure 58B:
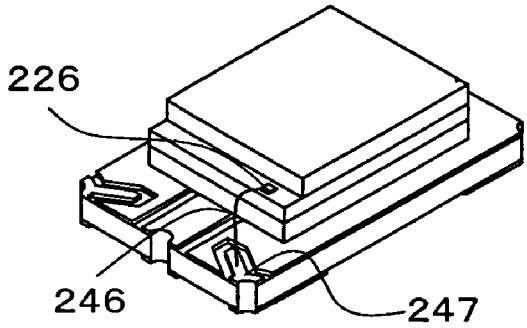
Figure 58C:
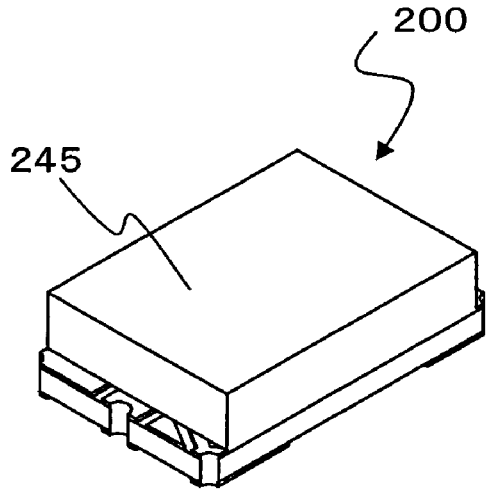
Figure 59:
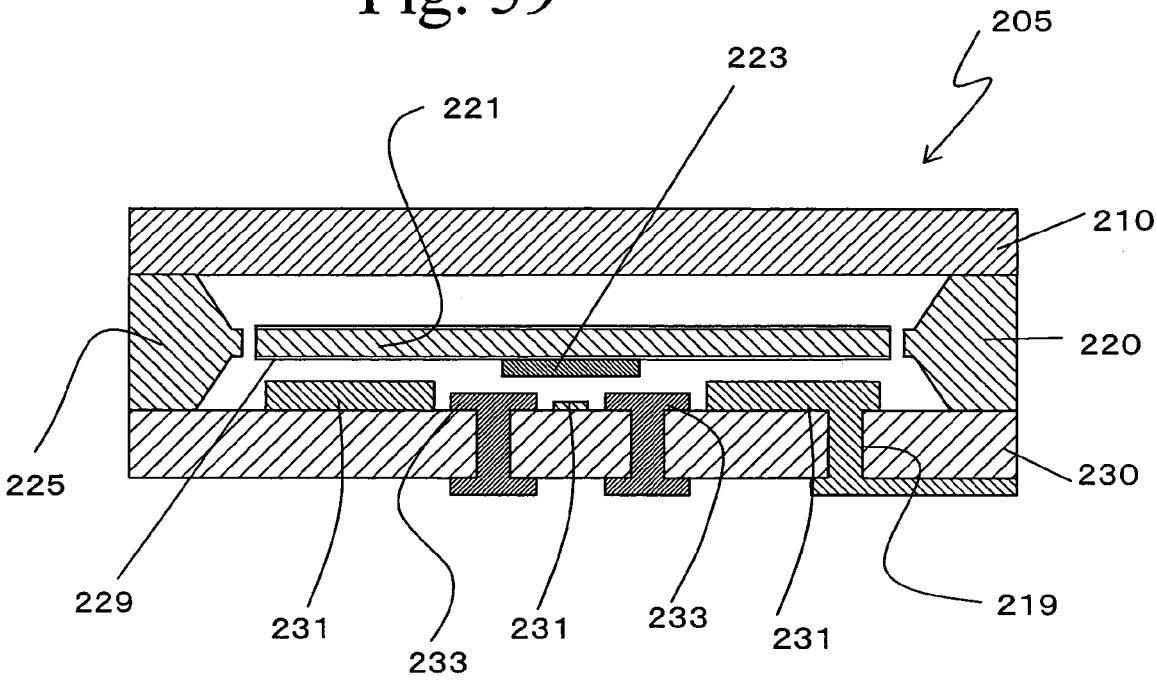
FIG. 59 is a cross-sectional view of the micro-relay shown in FIG. 57.

FIGS. 57 through 59 illustrate a micro-relay according to a thirty-second embodiment of the present invention. More particularly, FIG. 57 is an exploded perspective view of a chip part of the micro-relay. FIGS. 58A through 58C show how to assemble a micro-relay device 200 using a micro-relay chip 205. FIG. 59 schematically shows a cross section of the micro-relay chip 205. In the following, an outline of the micro-relay according to the present embodiment will be described first, and an internal structure will be described second.

The micro-relay chip 205 has a basic structure composed of an upper stationary substrate 210, a lower stationary substrate 230, and a movable plate 220 interposed between the substrates 210 and 230. Hereinafter, the upper stationary substrate 210 is referred to as cap substrate 210.

The movable plate 220 is formed by using a semiconductor material such as silicon single-crystal. The movable plate 220 includes a frame 225 shaped into a ring, and a movable portion 221, which moves up and down within the frame 225. The direction in which the movable portion 221 moves up and down is perpendicular to the plate surfaces of the cap substrate 210 and the stationary substrate 230. In order to realize the up/down movement of the movable portion 221, the movable portion 221 is connected to the frame 225 by hinge springs 222 that are elastically deformable. Though the frame 225 has a rectangular shape, it is not limited thereto but may have any shape having line symmetry. The multiple hinge springs 222 that support the movable portion 221 are provided at the line-symmetrical positions on the frame 225. In the thirty-second embodiment of the invention, the hinge springs 222 are provided at the four corners of the frame 225 to support the movable portion 221. As will be described later, an electrostatic attraction is exerted on the movable portion 221, which is thus moved up and down. The four hinge springs 222 act to enable the movable portion 221 to move up and down while being kept in the parallel state.

The movable portion 221 includes a movable electrode and a movable contact. As shown in the middle of FIG. 57, the movable portion 221 has an appearance such that two rectangular plates are joined via a small connecting portion 249. A movable contact 223 is provided below the connecting portion 249 so as to protrude downwards. The movable portion 221 is mostly the movable electrode, and only a part of the central portion of the movable portion 221 is occupied by the movable contact 223. Thus, the movable portion 221 is substantially the movable electrode in the present embodiment. The movable contact 223 and the movable electrode (the portion except the movable contact 223) are electrically isolated. The movable portion 221 has a base portion made of, for example, a silicon single-crystal, which is covered by an insulation film and is electrically isolated from the movable contact 223. As will be described in detail later, the movable contact 223 is provided in a through hole formed in the movable portion 221, and provides contact areas on the front and back surfaces thereof. The movable contact 223 or the surface thereof may be made of an electrically conductive material such as gold, platinum or copper.

The cap substrate 210 and the stationary substrate 230 are arranged so as to vertically sandwich the movable plate 220. More particularly, the frame 225 of the movable plate 220 is joined to the cap substrate 210 and the stationary substrate 230, and the movable portion 221 can be moved up and down in the cavity defined by joining. Each of the cap substrate 210 and the stationary substrate 230 has a respective base formed by an insulation member and a respective stationary electrode and stationary contact.

The stationary substrate 230 has a stationary electrode 231 and stationary contacts. The cap substrate 210 may have a plate shape or a lit shape having an internal cavity. It is required to define a clearance that allows the movable portion 221 of the cap substrate 210 to move smoothly. When the frame 225 has an appropriate thickness, the clearance can be secured and the plate-shaped cap substrate 210 may be used. In case where the frame has an insufficient thickness, it is required to dig in the lower surface of the cap substrate 210 to form a cavity that faces downwards in order to secure a sufficient clearance.

Figure 86:
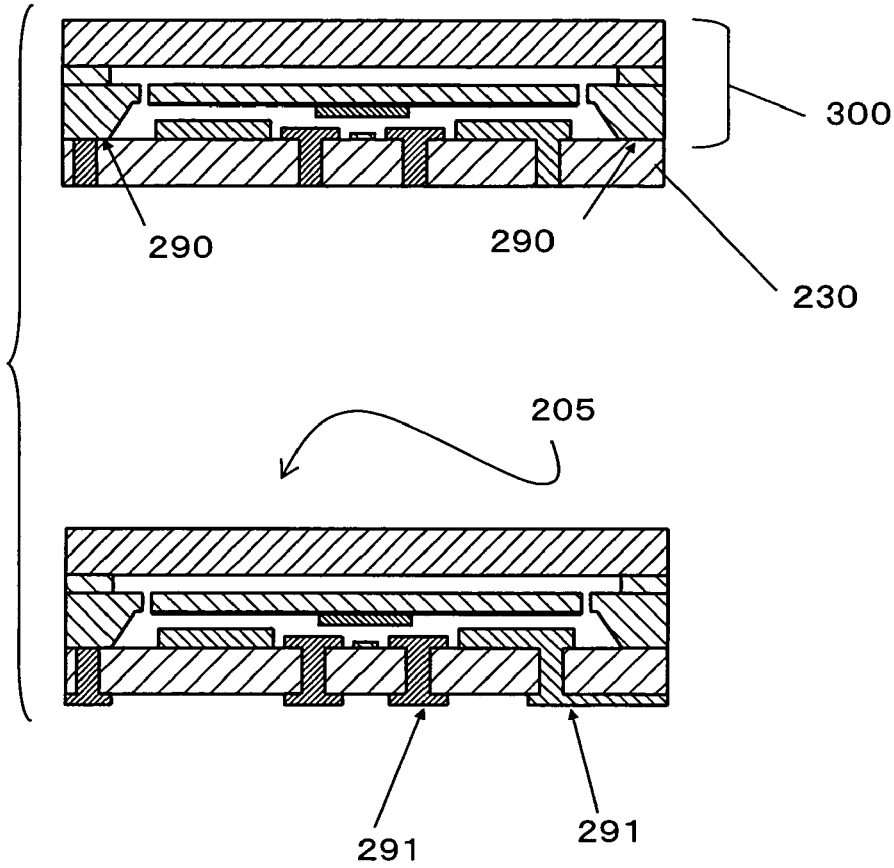
FIG. 86 shows a micro-relay produced by the process shown in FIG. 85.

In FIG. 86, a stationary electrode 231 and first stationary contacts 233 of the stationary substrate 230 are illustrated. The stationary electrode 231 and the stationary contact 233 are electrically isolated as in the case of the movable portion 221. The stationary electrode 231 of the stationary substrate 210 is disposed so as to face the movable portion 221 serving as the movable electrode. The stationary contacts 233 of the stationary substrate 230 are disposed so as to face the movable contact of the movable portion 221. Although not confirmed in FIG. 57, the movable contact 223 is provided on the lower surface of the movable portion 221. The stationary contacts 233 of the stationary substrate 230 are spaced apart from each other and are paired. When the movable portion 221 goes down, the lower movable contact 223 is brought into contact with the pair of stationary contacts 233, so that a signal line including the movable contact 223 and the pair of stationary contacts 233 can be established.

As shown in FIG. 57, through holes 219 are respectively provided in the stationary substrate 230. The through holes 219 are used to extract wiring or interconnection lines from the cavity defined by the cap substrate 210 and the stationary substrate 230. When the cap substrate 210 and the stationary substrate 230 are joined to the frame 225 so as to have airtightness, the resultant internal space can be hermetically sealed.

The hermetically sealed micro-relay chip 205 is fixed to a base substrate 240 as shown in FIGS. 58A and 58B. Finally, the assembly is covered with resin 245 as shown in FIG. 58C, so that a resin-packaged micro-relay can be provided. The movable plate 220 is equipped with an external pad 226, which is provided on a step-like portion of the micro-relay chip 205. The pad 226 is connected to an electrode pad 247 by a bonding wire 246. The base substrate 240 may be replaced with a leadframe.

The structure such that the cap substrate 210 and the stationary substrate 230 are joined to the frame 225 of the movable plate 220 with hermetical sealing can be realized by using glass for the cap substrate 210 and the stationary substrate 230. Silicon and glass can be tightly joined with ease by anodic bonding. In anodic bonding, a flat glass surface and a flat silicon surface that are brought into contact with each other are respectively connected to a negative power source and ground at a given temperature, and is supplied with a high dc voltage. It is recommended to use Pyrex glass (registered trademark) as glass for the cap substrate 210 and the stationary substrate 230. Pyrex glass has a thermal expansion coefficient close to that of silicon, and is thermally stable. Besides silicon, a metal may be processed by anodic bonding. Thus, the frame 225 of the movable plate 220 may be made of a metal usable in anodic bonding. In anodic bonding, there is no need to fuse part of adhesive or joining interface. Hence, the designed dimensions can be accurately achieved. It is desired to define the gaps between the movable portion 221 and the stationary substrates 210 and 230 with dimensional accuracy as high as possible. The gaps defined by anodic plating have high dimensional accuracy. During anodic bonding, oxygen gas is evolved. In case where gas remains in the hermetically sealed space, inner pressure increases. Increasing inner pressure may affect relay operation and break hermetical sealing. It is therefore preferred to perform anodic bonding in an inactive gas with reduced pressure.

When the micro-relay chip 205 is mounted on the base substrate 240 as shown in FIGS. 58A and 58B, flip-chip bonding may be used. The use of flip-chip bonding may further downsize the micro-relay. For downsizing, it is also possible to employ groove-like side casting lines on the periphery as lines commonly used by the cap substrate 210, the stationary substrate 230 and the movable plate 220, as will be described later.

FIG. 59 illustrates a cross section of the micro-relay chip 205 shown in FIGS. 57 and 58A through 58C. It is noted that FIG. 59 schematically illustrates the cross section so as to facilitate understanding the positional relationships among the structural parts of the micro-relay chip shown in FIGS. 57 and 58A-58C. For example, the pair of stationary contacts 233 extends up to the right and left ends in FIG. 57, but is shortened in FIG. 59 for illustrating the stationary electrodes 231. A further description of the micro-relay chip 205 will now be described with reference to FIG. 59. This figure shows the detailed structures of the cap substrate 210, the stationary substrate 230 and the movable plate 220. It will be noted that the stationary contacts 213 of the cap substrate 210, which are not illustrated in FIGS. 57 and 58A-58C, appear in FIG. 59. As shown in FIG. 59, the cap substrate 210 is like a flat plate. The movable plate 220 is shaped by etching so as to define upper and lower cavities with respect to the movable portion 221. The upper lower cavity makes clearance between the movable portion 221 and the cap substrate 210.

The stationary electrodes 231 on the lower stationary substrate 230 are positioned so as to face the movable portion 221. The movable contact 223 may bridge over the first stationary contacts 233 on the stationary substrate 230. As has been described, the pair of first stationary contacts 233 is provided in the signal line. When the movable contact 223 is moved down and is brought into contact with the stationary contacts 233, a circuit including the stationary contacts 233 can be made.

The movable contact 223 is provided so as to protrude from the lower surface of the movable portion 221. The movable contact 223 may be formed by forming the electrically conductive movable portion 221, depositing an insulation film 229 thereon, and forming an electrically conductive material by sputtering or plating.

A given voltage can be applied between the stationary electrodes 231 of the stationary substrate 230 and the movable portion 221. Each of the stationary electrodes 231 extends to the backside of the stationary substrate 230 via the respective through hole 219. The movable plate 220 may be made of silicon, and has been doped with an impurity for giving conductivity thereto. The through holes 219 may be filled with a conductor, or the inner walls thereof may be plated. The use of the through holes 219 makes it possible to hermetically seal the internal space defined by the stationary substrate 230 and the frame 225 of the movable plate 220.

In FIG. 59, the movable plate 220 and the stationary electrodes 231 may be selectively connected by a switch connected to interconnection lines (not shown) extending therefrom.

The movable plate 220 includes the frame 225, the movable portion 221 and the hinge springs 222, which can be integrally formed from the silicon substrate. By doping the silicon substrate with the impurity, conductivity from the frame 225 to the movable portion 221 can be easily secured. The movable portion 221 is not limited to the silicon substrate doped with the impurity, but may be formed by a silicon substrate on which metal electrodes are provided. As described before, the insulation film 229 is provided on the surfaces of the movable portion 221 in order to electrically isolate the movable portion 221 from the movable contact 223.

As is shown in FIG. 57, the movable portion 221 is supported by the hinge springs 222 respectively provided to the four corners of the frame 225 so that the movable portion 221 can move up and down. More particularly, when a voltage is applied between the movable portion 221 and the stationary electrode 231, the electrostatic attraction that develops therebetween moves the movable portion 221 towards the stationary substrate 230. That is, the movable portion 221 can move between the initial or home position and the stationary substrate 230. When the movable portion 221 is driven, the movable contact 223 is brought into contact with the stationary contacts 233 and is then maintained. Thus, the switch of the stationary contacts 213 and 233 and the movable contact 223 switch over so that the relay operation can be achieved.

Figure 60:
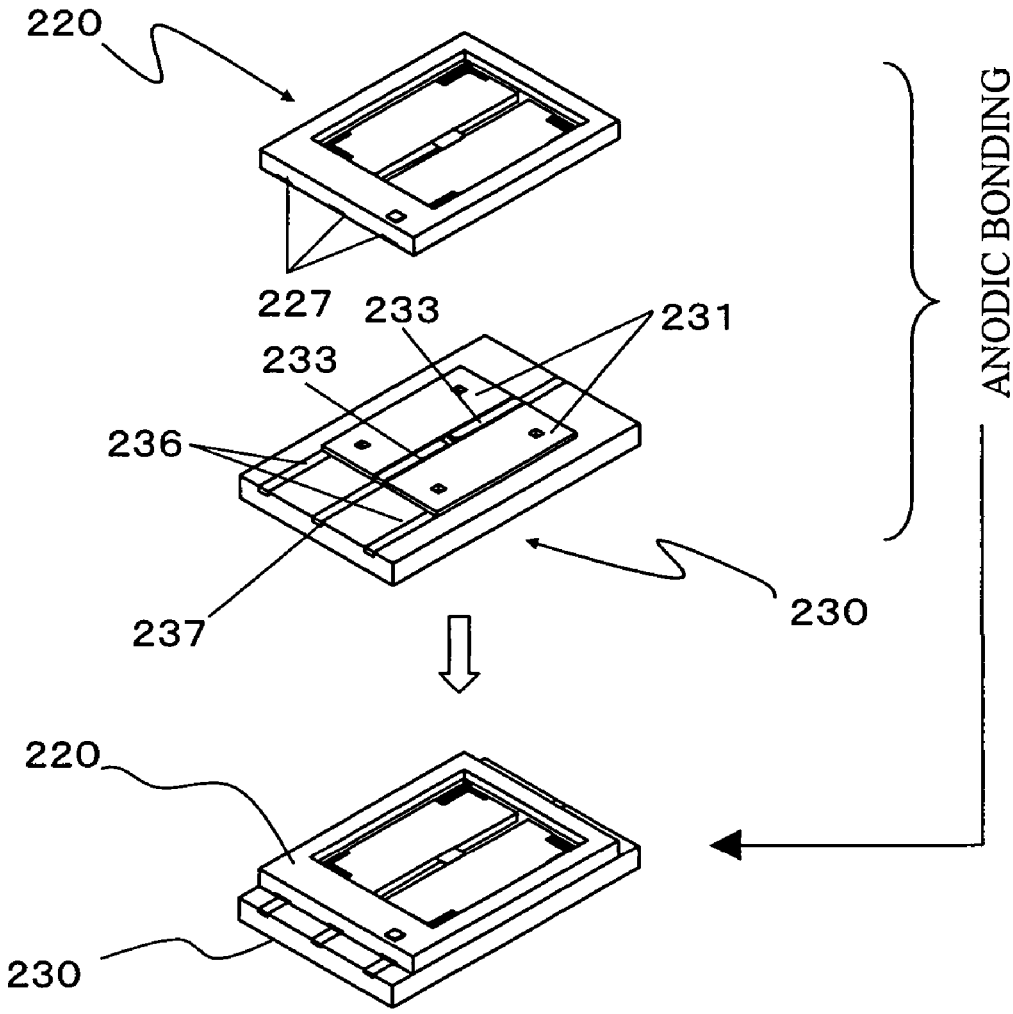
FIG. 60 is an exploded perspective view of a variation of the micro-relay according to the thirty-second embodiment of the present invention.
Figure 61:
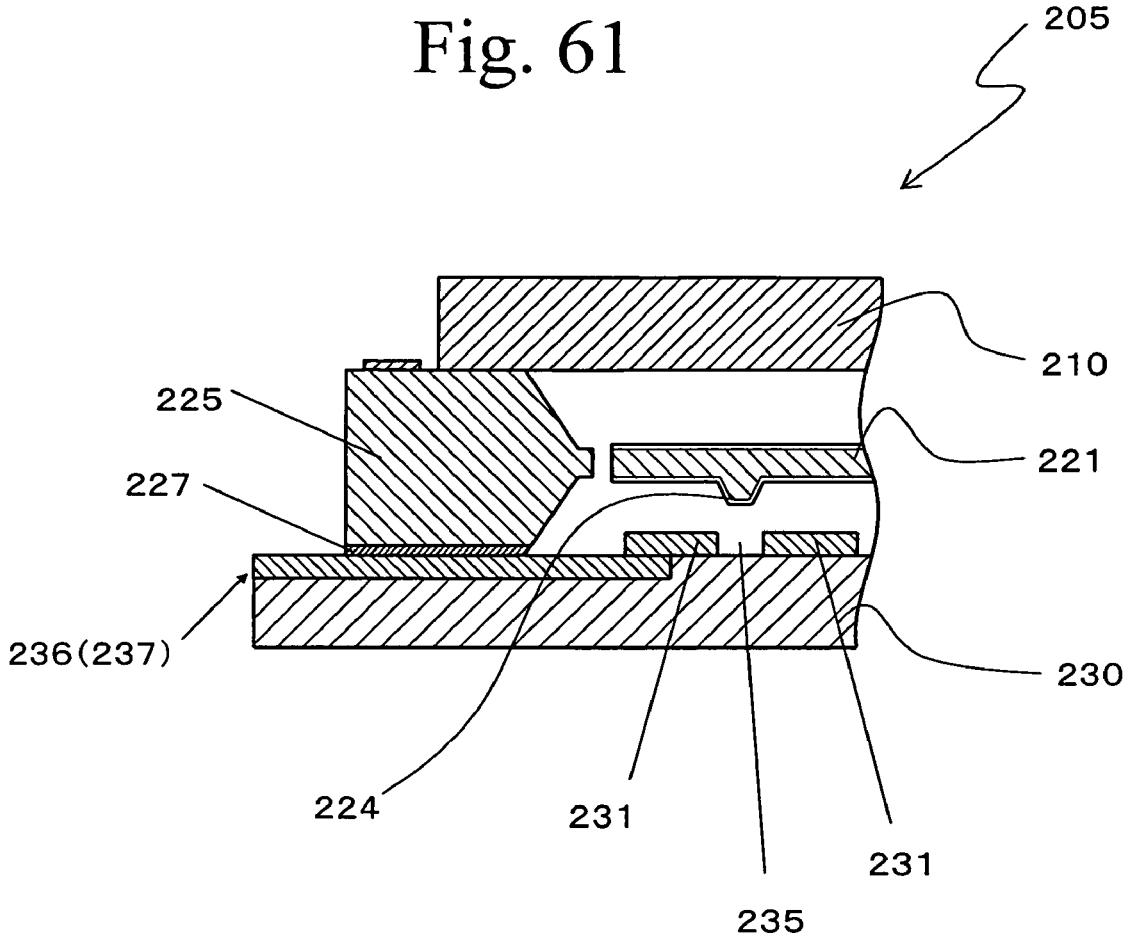
FIG. 61 is a cross-sectional view of a side portion of the variation shown in FIG. 60.

FIGS. 60 and 61 show a variation of the above-mentioned thirty-second embodiment of the present invention. As has been described, the through holes 219 are used to extract the wiring lines to the outside of the chip 205 from the substrate 230. The through holes 219 may be replaced by extraction lines that are buried in the substrate 230 in such a way that the flatness of the joining surfaces of the substrates 210 and 230 and the frame 225 of the movable plate 220 can be secured. The variation shown in FIGS. 60 and 61 employs such a structure as described above.

FIG. 60 is an exploded perspective view of the variation, and FIG. 61 is a cross-sectional view of a side portion of the variation. The micro-relay chip 205 of this variation employs an extraction line that is buried in the stationary substrate 230 joined to the movable plate 220. As is shown in FIG. 60, an extraction line 236 extending from the stationary electrode 231 is buried in the stationary substrate 230 so as to be flush with the surface of the stationary substrate 230. Similarly, extraction lines 237 extending from the stationary contacts 233 are buried in the stationary substrate 230 so as to be flush with the surface of the stationary substrate 230. The flat surface of the stationary substrate 230 secures reliable hermetical sealing made by anodic bonding. It should be noted that the use of the buried extraction lines 236 and 237 needs an insulation film 227 to secure electrical isolation from the stationary substrate 230.

Preferably, as shown in FIG. 61, there are provided protrusions 224 that are provided to the lower surface of the movable portion 221 and protrude downwards. The protrusions 224 serve as stoppers. Even if the movable portion 221 is moved down to make a contact with the stationary contact 233 and is further moved due to electrostatic attraction, the protrusions 224 will prevent the movable portion 221 from sticking to the stationary contacts 233. As shown in FIG. 61, recesses 235 are provided in the stationary electrode 231 so as to fact the lower protrusions 224. Preferably, the protrusions 224 have a height greater than the depth of the recesses 235 in order to prevent the movable portion 221 from tightly sticking to the stationary electrode 231. Instead of the recesses 235 provided in the stationary electrode 231, these electrodes may be provided with comparatively low protrusions.

Figure 62:
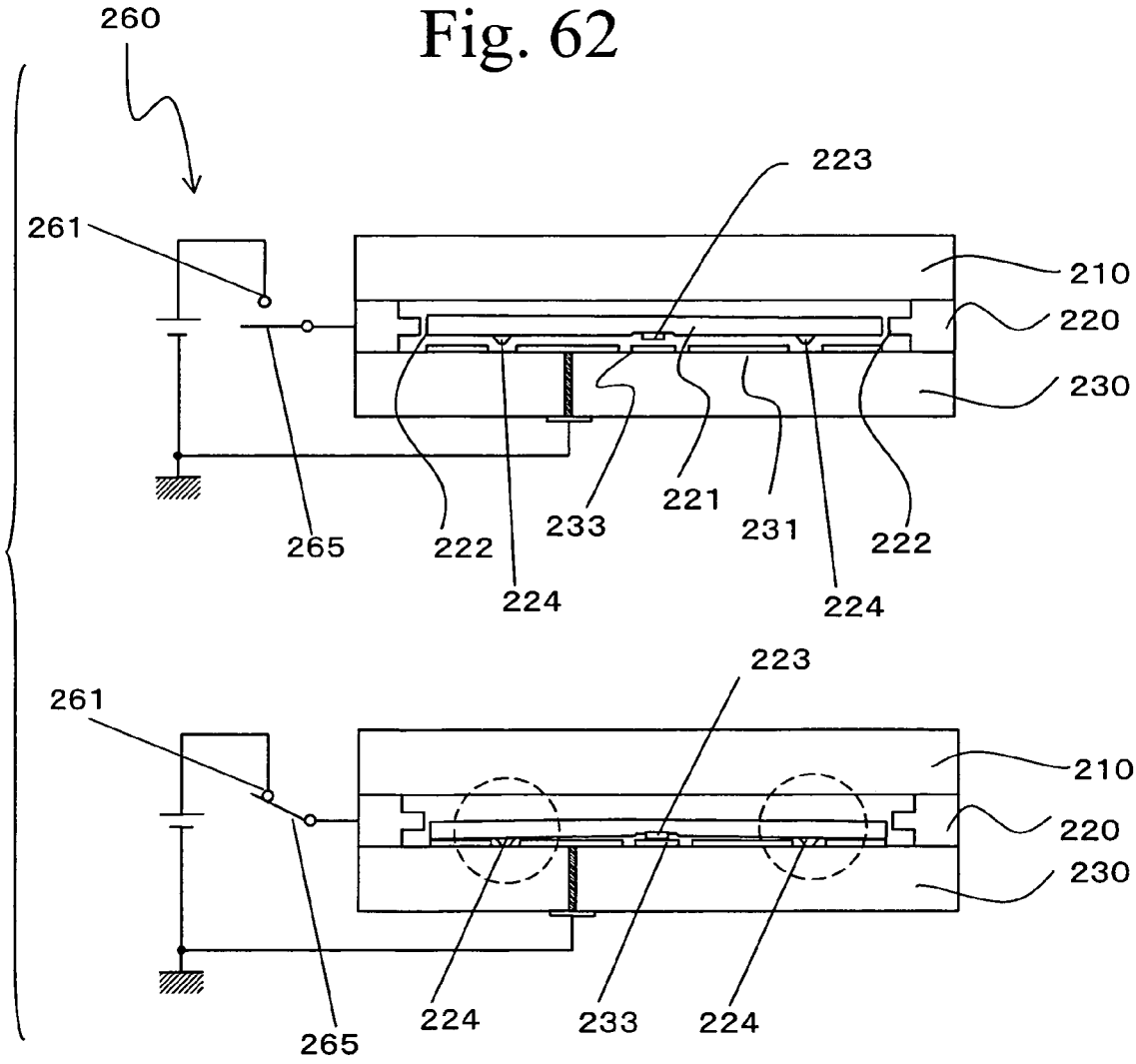
FIG. 62 shows an operation of the micro-relay according to the thirty-second embodiment of the present invention.

FIG. 62 shows an operation of the micro-relay according to the thirty-second embodiment of the present invention. A drive circuit 260 that drives the micro-relay is shown in FIG. 62. When a movable contact 265 is connected to a stationary contact 261, a voltage develops between the stationary electrode 231 and the movable plate 220. The upper part of FIG. 62 shows a neutral state in which no voltage is applied to the movable plate 220. The lower part of FIG. 62 shows the state in which the movable contact 265 contacts the stationary contact 261.

The stationary electrode 231 of the stationary substrate 230 is set at the ground potential in advance. As is shown in the lower part of FIG. 62, when the movable plate 220 is set at the positive potential, the movable plate 220 is attracted towards the stationary electrode 231, and the movable contact 223 is brought into contact with the stationary contacts 233. Even after the contact is made, the movable portion 221 is continuously attracted to the stationary electrode 231 due to further increased force. The movable portion 221 is thus bent, so that further increased contacting force exerted on the movable contact 223 and the stationary contacts 233 can reduce the contact resistance.

The protrusions 224 that serve as the stopper securely prevent surface-to-surface contact between the movable portion 221 and the stationary electrode 231 and prevent the movable portion 221 from sticking to the stationary electrode 231. Since the surfaces of the movable portion 221 are coated with the insulation film 229, the movable portion 221 is not short-circuited to the stationary electrode 231 even when it is brought into contact. If the protrusions 224 securely prevent the movable portion 221 from contacting the stationary electrode 231, the insulation film 229 may be omitted.

As shown in FIG. 62, when the movable contact 265 is detached from the stationary contact 261, the movable portion 221 returns to the initial position due to the restoring force of the hinge springs 222.

Thirty-Third Embodiment

Figure 63:
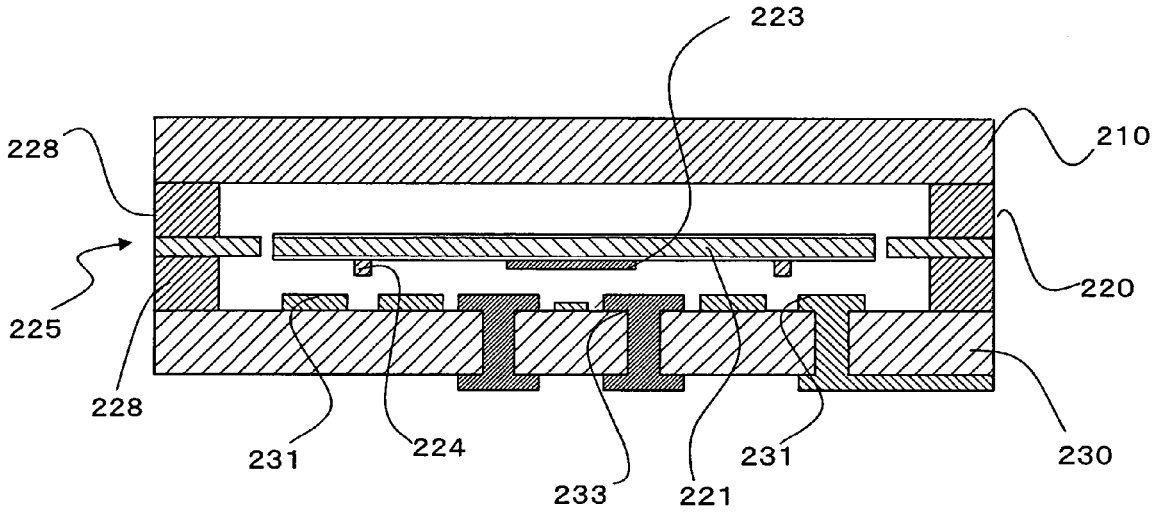
FIG. 63 is a cross-sectional view of a micro-relay according to a thirty-third embodiment of the present invention.

FIG. 63 is a cross-sectional view of a micro-relay according to a thirty-third embodiment of the present invention. In the above-mentioned thirty-second embodiment of the present invention, the movable plate 220 is formed by etching. The height (thickness) of the frame 225 of the movable plate 220 defines the contact-to-contact gap, and the upper thickness (height) thereof defines the clearance for movement. In this regard, it is required to produce the frame 225 accurately. The thirty-third embodiment of the present invention is a micro-relay that employs a spacer for defining the gap. The basic structure of the thirty-third embodiment is the same as that of the thirty-second embodiment, so that the same reference numerals refer to the same structural elements and a description thereof will be omitted.

The spacers 228 form the frame 225 according to the thirty-third embodiment of the invention. The spacers 228 may be formed by depositing polycrystalline silicon (polysilicon) or a metal. The spacers 228 thus formed can be subjected to anodic bonding, and realize the hermetically sealed micro-relay. The contact-to-contact gap can be accurately defined by the spacers 228 as in the case of etching. Generally, it takes a relatively long time to define the gap by etching, while it does not take such a long time to define the gap using the spacers 228.

Thirty-Fourth Embodiment

Figure 64:
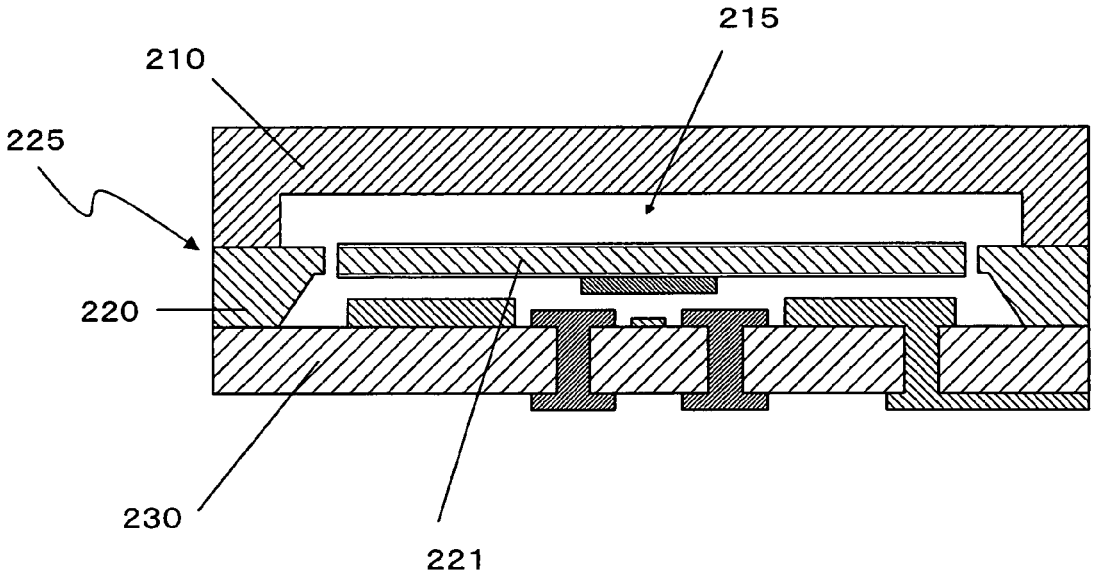
FIG. 64 is a cross-sectional view of a micro-relay according to a thirty-fourth embodiment of the present invention.

FIG. 64 shows a micro-relay according to a thirty-fourth embodiment of the present invention. This embodiment employs the cap substrate 210 that has a lid shape having a cavity 215 that is opened downward. The cap substrate 210 can be formed by digging in the central portion of a flat plate made of an insulation material by etching. The frame 225 associated with the cap substrate shown in FIG. 64 is comparatively simple. The frame 225 is substantially flush with the movable portion 221. Due to the presence of the cavity 215, a sufficient clearance can be secured between the movable portion 221 and the cap substrate 210. The use of the cap substrate 210 with the cavity 215 may omit the step of etching for defining the upper thickness of the frame 225. It is therefore possible to simplify the process for etching and spacer forming.

Thirty-Fifth Embodiment

Figure 65:
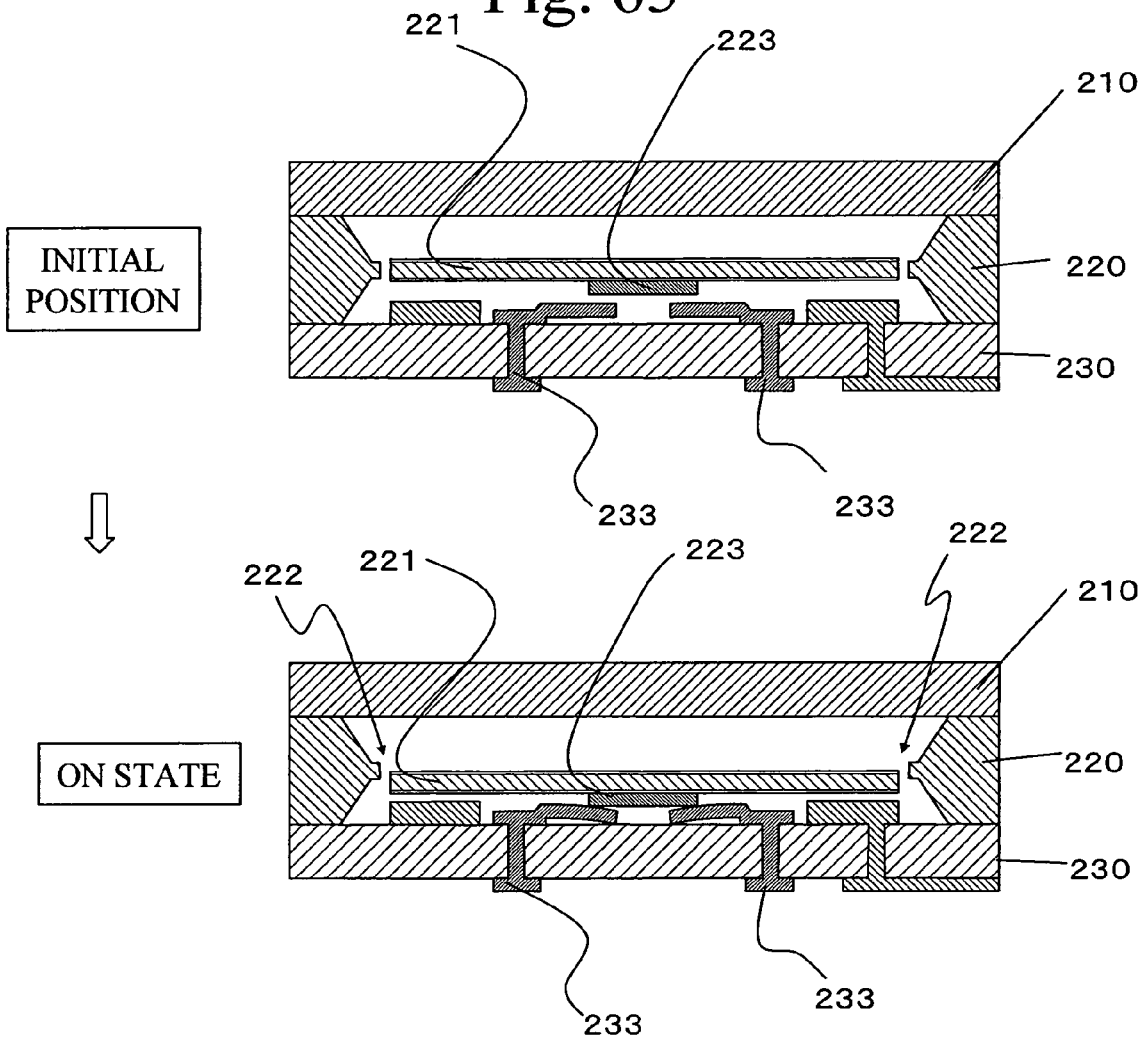
FIG. 65 shows a micro-relay according to a thirty-fifth embodiment of the present invention.

FIG. 65 shows a micro-relay according to a thirty-fifth embodiment of the present invention. This embodiment is characterized in that the stationary contacts of the stationary substrate have a cantilever structure. The same reference numerals as those used in the thirty-second embodiment of the invention are given to the same parts as those used therein.

Each of the stationary contacts 233 has a cantilever structure and a free end that is brought into contact with the movable contact 223. When the movable portion 221 moves down from the initial state in response to the drive voltage, the movable contact 223 depresses the free ends of the stationary contacts 233, so that a connection between the stationary contacts 233 can be made. When the supply of the drive voltage is stopped, the stationary contacts 233 that are in a deformed state push back the movable contact 223 due to restoring force caused by the deformation. In addition, there is another restoring force by the hinge springs 222. Therefore, enhanced restoring force is exerted on the movable portion 221, so that the movable contact 223 can be detached from the stationary contacts 233 with enhanced force. It is therefore possible to securely detach the movable contact 223 from the stationary contacts 233 and returns it to the initial position.

Thirty-Sixth Embodiment

Figure 66:
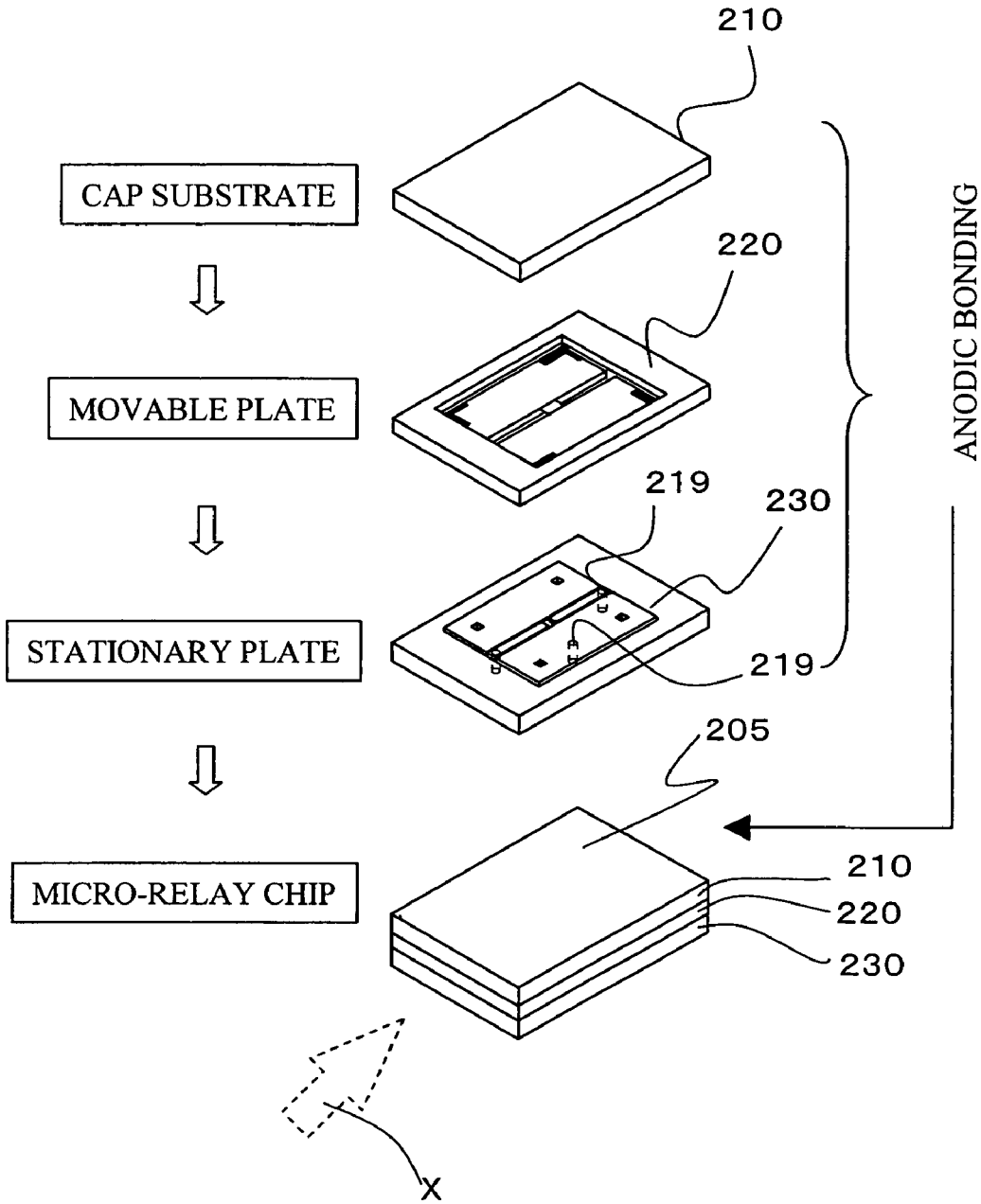
FIG. 66 is an exploded perspective view of a micro-relay according to a thirty-sixth embodiment of the present invention.
Figure 67:
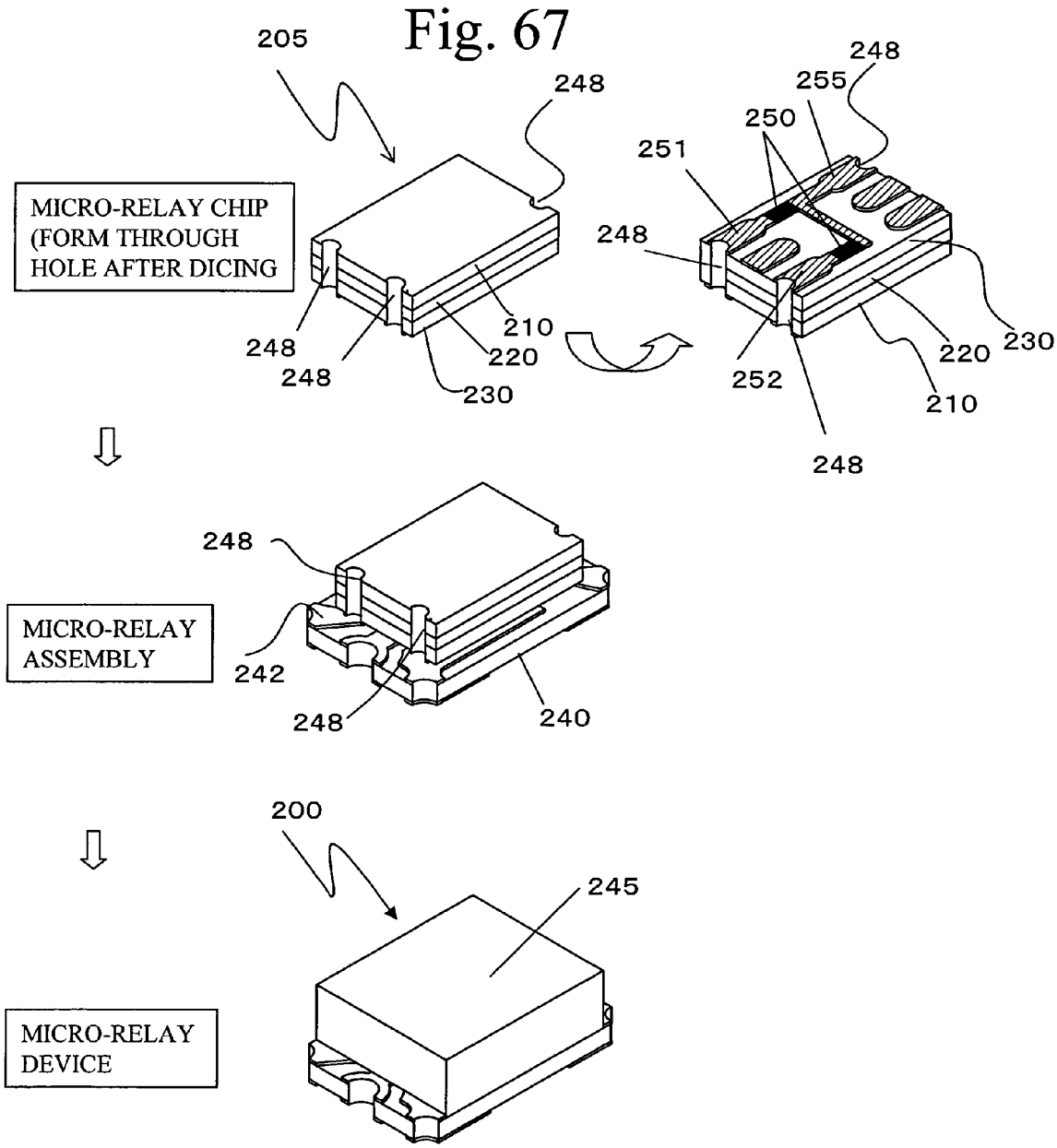
FIG. 67 is a perspective view of the micro-relay shown in FIG. 66.

FIGS. 66 and 67 show a micro-relay according to a thirty-sixth embodiment of the present invention. This micro-relay uses an interconnection line shared by the cap substrate 210, the stationary substrate 230 and the movable plate 220. In FIGS. 66 and 67, the same reference numerals as those shown previously refer to the same structural elements.

The micro-relay chip 205 shown in FIG. 67 has the movable plate 220 that is sandwiched between the cap substrate 210 and the stationary substrate 230 and is joined thereto by anodic bonding. As is shown by an arrow X in FIG. 66, the side surfaces of the members 210, 220 and 230 are flush with each other so that the outer appearance is simple. The through holes 219 are used to extract the electrical lines from the insides of the stationary substrate 230 and the cap substrate 210 to the outsides thereof as in the case of the thirty-second embodiment of the invention.

The micro-relay chip 205 shown in FIG. 67 has common interconnection paths (side castellation paths) 248, each of which is continuously provided on side surfaces of the cap substrate 210, the stationary substrate 230 and the movable plate 220. In the upper part of FIG. 67, the back surface of the micro-relay chip 205 on the right side thereof is illustrated on the right side thereof. The back surface of the micro-relay chip 205 is the bottom surface of the stationary substrate 230. On the bottom surface, provided are ground pads 251, electrode pads 252 and a pad connected to the movable plate 220. Discharge resistors 250, which will be described layer, are provided on the bottom surface.

The cap substrate 210 of the present embodiment does not have any electrode and contact and is therefore simple. Primarily, there is no need for interconnections between the inside of the cap substrate 210 and the outside of the micro-relay. However, it is preferable to design the plates 210, 220 and 230 so as to have almost the same size and provide the side castellation paths 248, as shown in FIGS. 66 and 67. The side castellation paths 248 makes it possible to form an interconnection line on the upper surface of the cap substrate 210

As is shown in the middle part of FIG. 67, the micro-relay chip 205 is flip-chip bonded to the base substrate 240 by solder balls, so that a micro-relay assembly can be formed. There is no need to use wire bonding for making connections between the micro-relay 205 and the base substrate 240. It can be seen from comparison with FIG. 58 that the base substrate 240 shown in FIG. 67 has a reduced size and a reduced wiring resistance can be obtained. Further, the micro-relay chip 205 does not need any steps for pads. In production, three layers are bonded and are processed to form through holes that are penetrated through these layers. An electrically conductive material is provided to the inner walls of the through holes. Then, the three layers are cut in the dicing process so as to equally divide each through hole into two. In this manner, the micro-relays with the side castellation paths 248 can be easily fabricated.

The top surface of the micro-relay chip 205 that is provided by the back surface of the cap substrate 210 may be coated with an appropriate protection film or the like. In this case, the base substrate 240 may be no longer needed. There may be no need to subject the micro-relay chip 205 to molding with resin. The micro-relay chip 205 is mountable in the bare state. Downsizing of the micro-relay may be further facilitated.

Thirty-Seventh Embodiment

Figure 68:
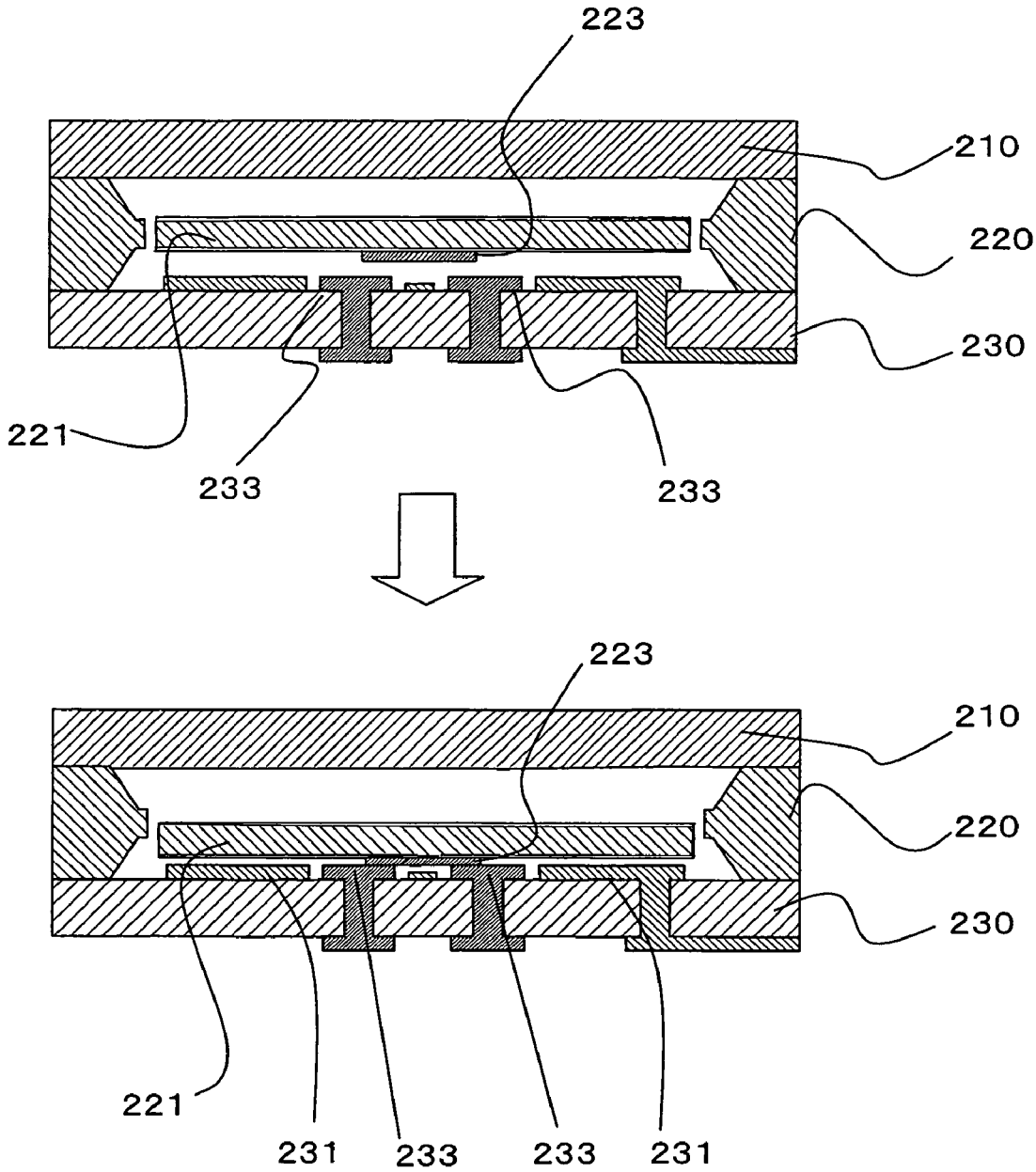
FIG. 68 shows a micro-relay according to a thirty-seventh embodiment of the present invention.

FIG. 68 shows cross sections of a micro-relay according to a thirty-seventh embodiment of the present invention. The movable portion 221 used in this embodiment is comparatively thick. More particularly, the thickness of the movable portion 221 is designed to have stiffness sufficient to prevent the movable portion 221 from being bent after the movable portion 221 is moved due to electrostatic attraction and the movable contact 223 is then brought into contact with the stationary contacts 233. It will be noted that the protrusions 224 in the thirty-second embodiment of the invention are taken into consideration bending of the movable portion 221 and are employed in order to prevent the movable portion 221 from sticking to the stationary electrode 231. In contrast, the movable portion 221 employed in the present embodiment is not bent due to electrostatic attraction, so that it does not need any protrusions like the protrusions 224. This simplifies the production process. The stationary electrodes 231 have a height sufficient to prevent the movable portion 221 from contacting them when the movable contact 223 is in contact with the stationary electrodes 233.

Figure 69:
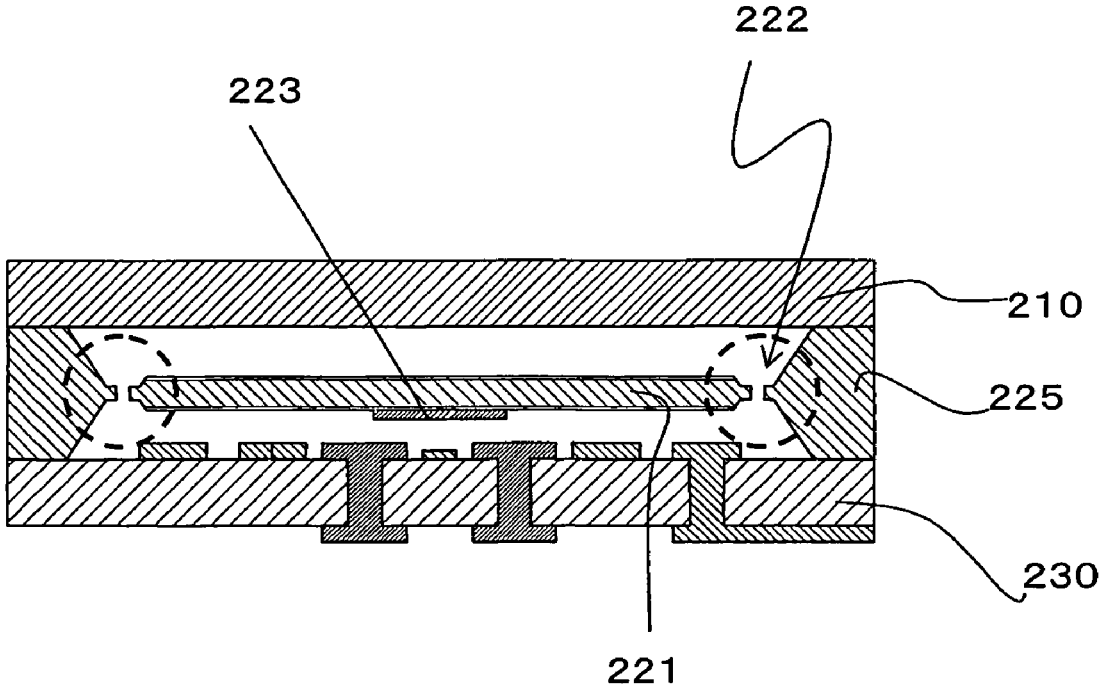
FIG. 69 is a cross-sectional view of a variation of the micro-relay shown in FIG. 68.

FIG. 69 shows a variation of the above-mentioned thirty-seventh embodiment of the present invention. As the thickness of the movable portion 221 increases, the stiffness of the hinge springs 222 surrounded by a circle increases. However, increased stiffness of the hinge springs 222 may make it more difficult for the movable portion 221 to move down from the initial position. Taking into the above into consideration, the hinge springs 222 have a thickness less than that of the movable portion 221 in order to have reduced stiffness and secure smooth descent from the home position.

Thirty-Eighth Embodiment

Figure 70A:
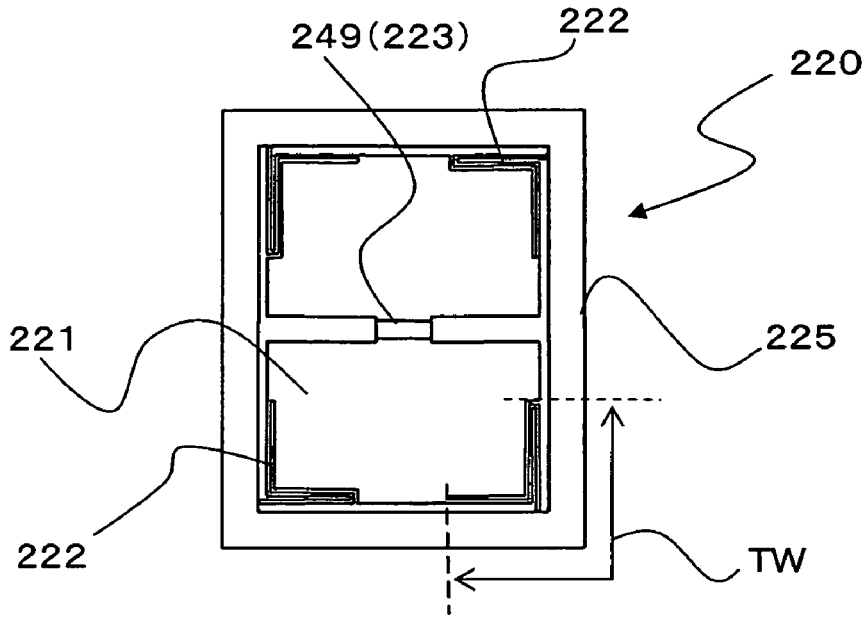
FIGS. 70A and 70B are plan views of a micro-relay according to a thirty-eighth embodiment of the present invention.
Figure 70B:
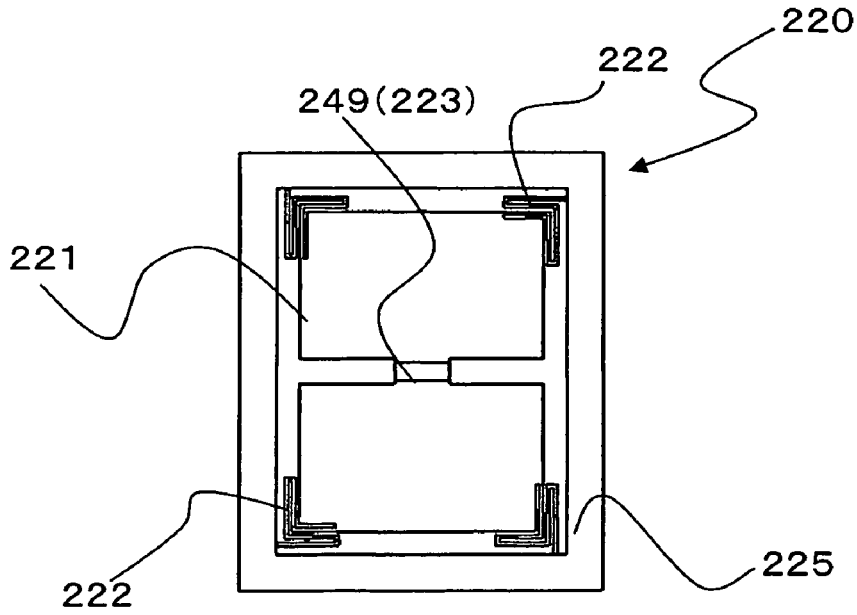

FIGS. 70A and 70B respectively show micro-relays according to a thirty-eighth embodiment of the present invention. The hinge springs 222 of the movable plate 220 used in this embodiment has a unique structure. The hinge springs 222 shown in FIG. 70A that are folded multiple times run within an extended range TW in order to reduce the stiffness. FIG. 70B shows another variation of the hinge springs 222 that has an increased number of times the hinge springs 222 are folded for the same purpose as mentioned above. The variations of the hinge springs 222 enable the movable portion 221 to smoothly move up and down, and are particularly suitable for the movable portion 221 having enhanced stiffness.

Thirty-Ninth Embodiment

Figure 71A:
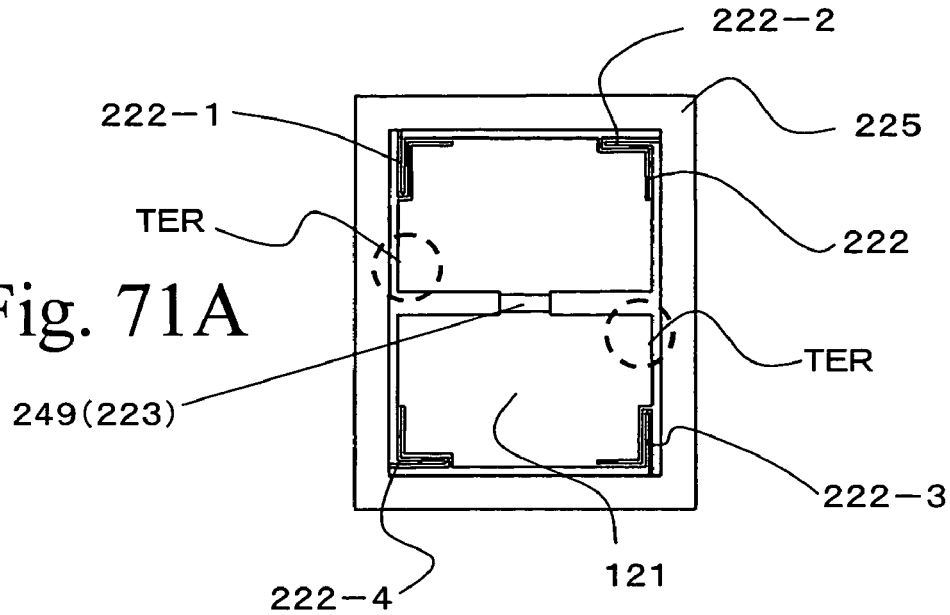
FIGS. 71A, 71B and 71C are plan views of a micro-relay according to a thirty-ninth embodiment of the present invention.
Figure 71B:
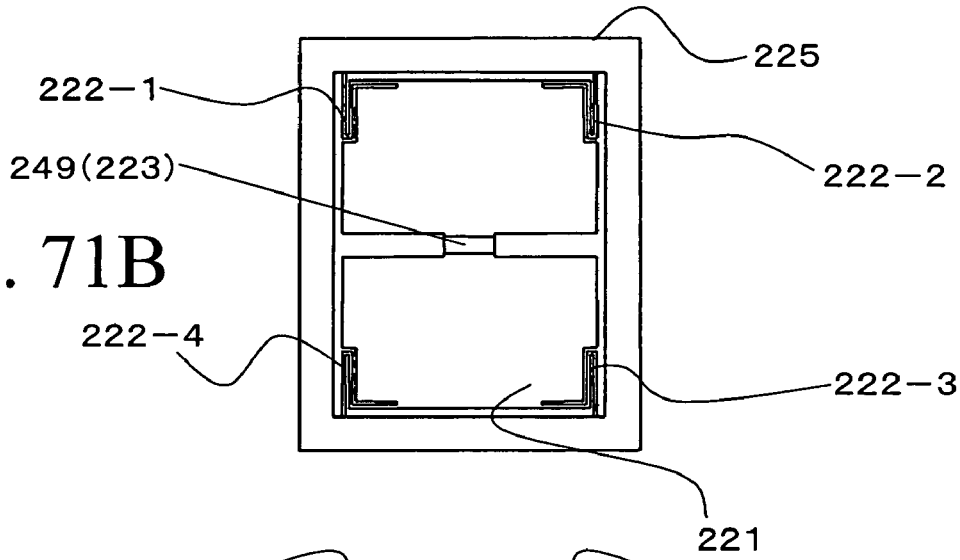
Figure 71C:
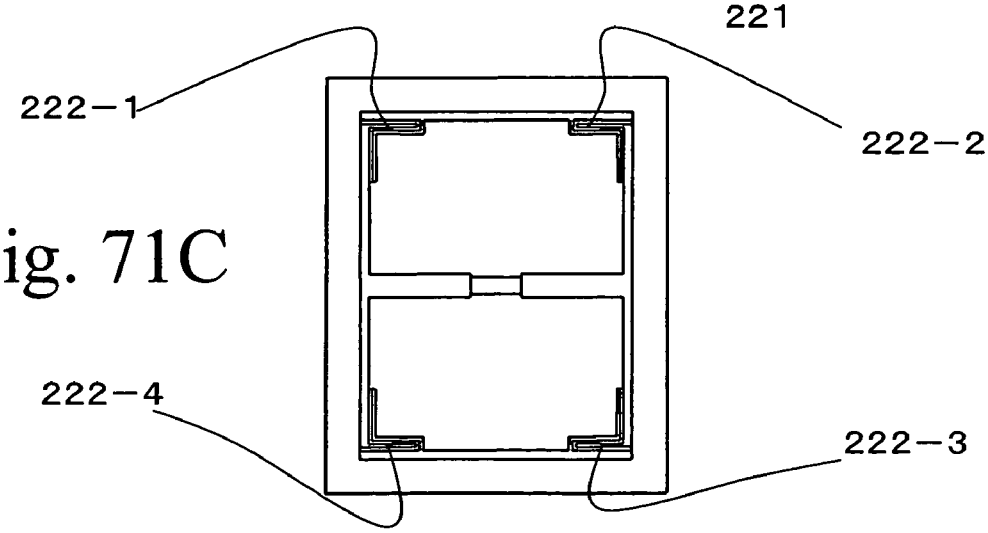

FIGS. 71A, 71B and 71C respectively show micro-relays according to a thirty-ninth embodiment of the present invention. The movable plate 220 has hinge springs mentioned below. FIG. 71A shows four hinge springs 222-1 through 222-4, each of which is connected to the respective side of the frame 225, thus supporting the movable portion 221. The hinge springs 222-1 through 222-4 enable the movable portion 221 to move up and down. However, it should be noted that a portion indicated by a circle TER tends to move considerably. Such a considerable movement may disturb smooth up/down movement of the movable portion 221.

In order to avoid the above problem, the hinge springs 222-1 through 222-4 shown in FIGS. 71B and 71C are joined to only two opposite sides of the frame 225. More particularly, in FIG. 71B, the hinge springs 222-1 and 222-4 are jointed to the left side of the frame 225, and the hinge springs 222-2 and 222-3 are joined to the right side thereof. In FIG. 71C, the hinge springs 222-1 and 222-2 are joined to the upper side of the frame 225, and the hinge springs 222-3 and 222-4 are joined to the lower side thereof. In FIGS. 71B and 71C, the hinge springs 222-1 through 222-4 are symmetrically arranged. The symmetrical arrangement balances the movable portion 221 very well and enables its smooth up/down movement. Further, the stability of the movable plate 220 can be improved, so that the protrusions 224 provided to the movable portion 221 in the sixteenth embodiment of the present invention may be omitted.

Fortieth Embodiment

Figure 72A:
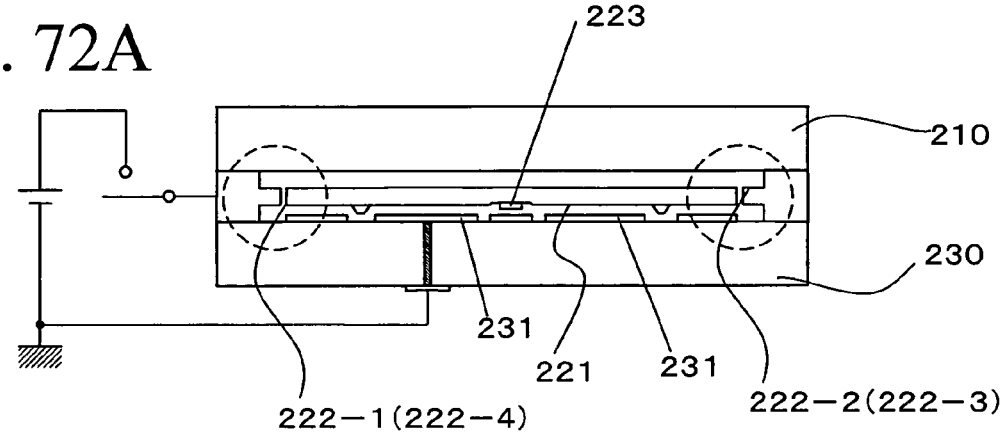
FIGS. 72A, 72B and 72C show a micro-relay according to a fortieth embodiment of the present invention.
Figure 72B:
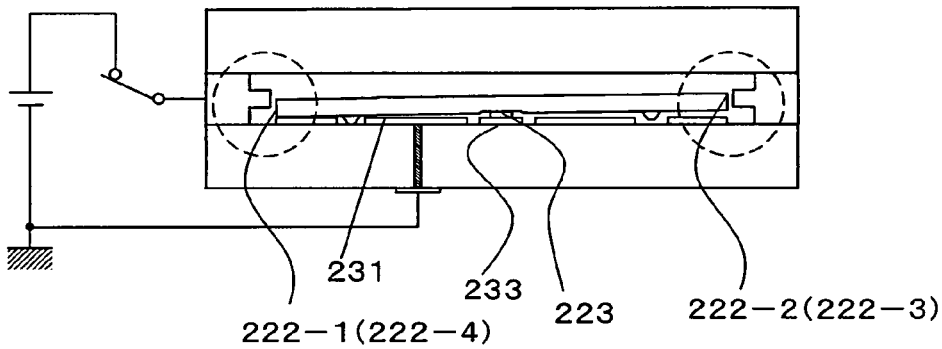
Figure 72C:
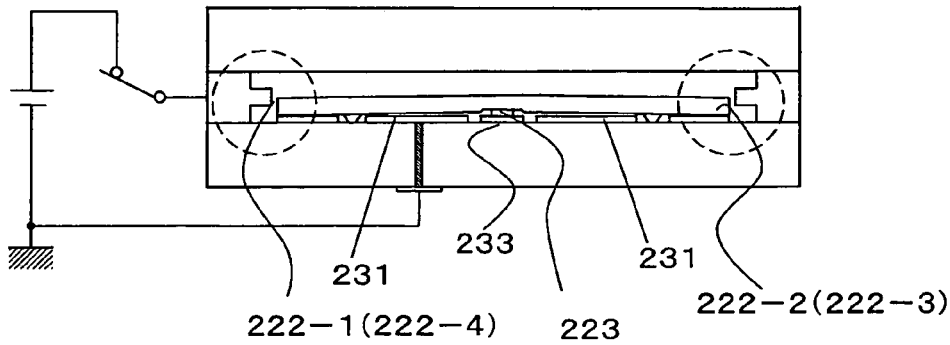

FIGS. 72A, 72B and 72C show a micro-relay according to a fortieth embodiment of the present invention. The balance of the spring constants of the hinge springs is changed so that an extremely minute friction can develop between the movable contact and the stationary contact. In the thirty-second embodiment of the present invention, the movable portion 221 moves up and down while it is kept in the horizontal state. In contrast, according to the fortieth embodiment, the spring constants of the hinge springs are positively adjusted so as to have different values. The four hinge springs 222-1 through 222-4 shown in FIG. 72A through 72C have different spring constants. The spring constants of the hinge springs 222-1 through 222-4 can be adjusted by changing their lengths, widths and/or thicknesses.

When the hinge springs 222-1 through 222-4 have different spring constants, the micro-relay operates as shown in FIGS. 72A through 72C. When electrostatic attraction develops in the neutral state, at least one of the hinge springs having a comparatively small spring constant moves first, and only one side of the movable portion 221 is attracted to the stationary electrode 231 as shown in FIG. 72B. In FIG. 72B, the hinge springs 222-1 and 222-4 have a comparatively small spring constant. Then, as shown in FIG. 72C, the distance between the movable portion 221 and the stationary electrode 231 decreases gradually, and the side of the movable portion supported by the remaining hinge springs 222-2 and 222-3 that have a comparatively large spring constant is attracted to the stationary electrode 231. Finally, both the opposite sides of the movable portion 221 are attracted to the stationary electrode 231. On the way from the state of FIG. 72B to that of FIG. 72C, the movable contact and the stationary contacts 233 slightly rub against each other (this is called wiping). The rubbing develops new contact surfaces due to wiping. That is, the rubbing inhibits an insulation coating film from being formed on the contact surfaces and inhibits insulation material from being deposited due to wiping. According to the present invention, the wiped contact surfaces are always available, this stabilizing the contact resistance and improving the reliability of the micro-relay.

The hinge springs 222-1 through 222-4 may be divided into groups, each of which has a respective spring constant. For example, in FIGS. 71A through 71C, the hinge springs 222-1 and 222-4 are grouped and assigned an identical spring constant, and the high springs 222-2 and 222-3 are grouped and assigned another identical spring constant.

Forty-First Embodiment

Figure 73:
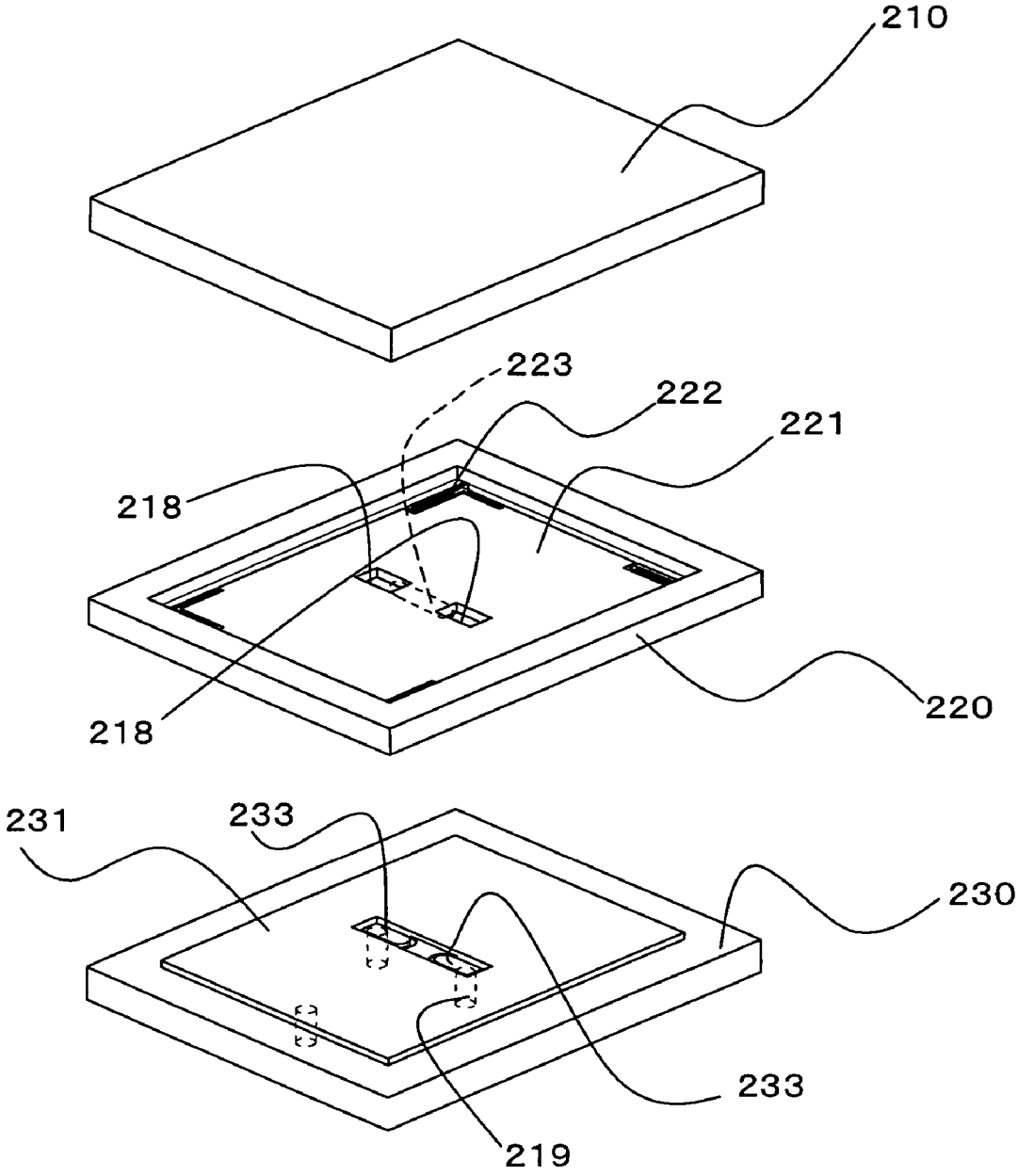
FIG. 73 is an exploded perspective view of a micro-relay according to a forty-first embodiment of the present invention.

FIG. 73 is an exploded perspective view of a micro-relay according to a forty-first embodiment of the present invention. The stationary electrode 231 and the movable portion 221 employed in this embodiment have enhanced stiffness in order to enable increased electrostatic attraction to develop therebetween. The movable portion 221 has a plate shape in which a pair of through holes 218 is formed, while the movable portion 221 used in the sixteenth embodiment is configured so as to have two plates joined by the movable contact 223. In FIG. 73, the movable contact 223 is attached to a surface portion on the backside of the movable portion 221 interposed between the through holes 218. The movable portion 221 used in this embodiment has higher stiffness than that composed of two plates joined by the movable contact 223. Further, the movable portion 221 in FIG. 73 has an increased electrode area, which develops stronger electrostatic attraction.

The stationary contacts 233 used in the forty-first embodiment have a reduced length, and are extracted from the backside of the stationary substrate 230 via the through holes 219. The stationary substrate 230 used in the present embodiment has an increased electrode area of the stationary electrode 231 because of reduction in the lengths of the stationary contacts 233. This structure improves the stiffness of the stationary electrode 231 and increases the electrostatic attraction exerted on the movable portion 221. The micro-relay thus configured has the mechanically strengthened movable portion 221 and the stationary electrode 231, which accepts increased electrostatic force. The driving efficiency is thus improved.

Even in a case where only one of the stationary electrode 231 and the movable portion 221 is employed, similar effects can be provided.

Forty-Second Embodiment

Figure 74A:
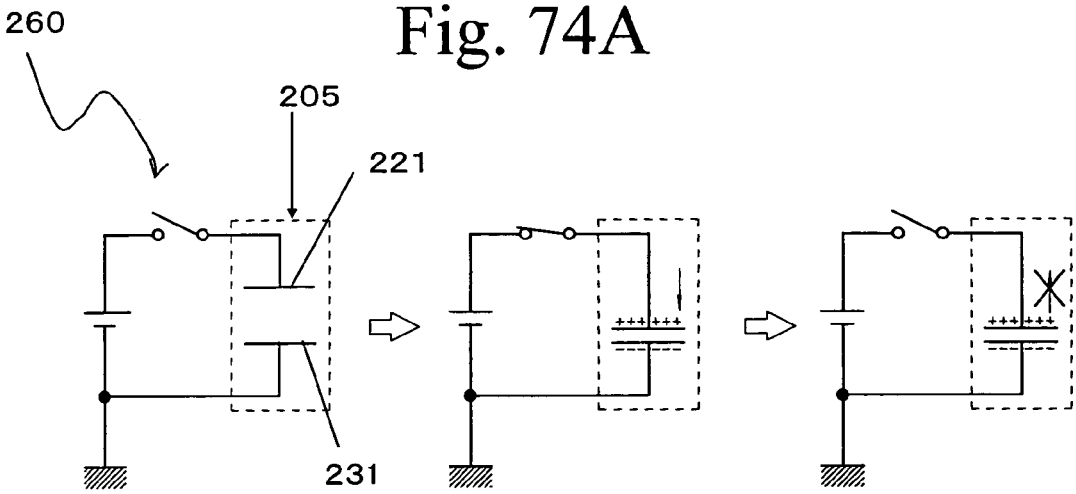
FIGS. 74A and 74B show a micro-relay according to a forty-second embodiment of the present invention.
Figure 74B:
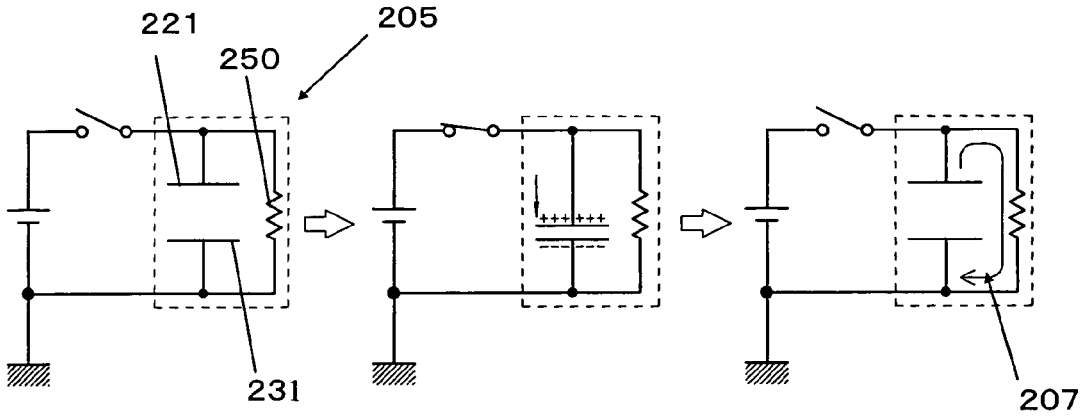

FIGS. 74A and 74B show a micro-relay according to a forty-second embodiment of the present invention. The present embodiment is equipped with a mechanism intended to remove the charges in the stationary electrode 231 and the movable portion 221. FIG. 74A shows a faulty that may occur in the absence of the discharge resistor. When a power supply 266 is turned OFF, charges remain in the stationary electrode 231 and the movable contact 221. In this case, the movable portion 221 may remain in the contact state, or a leakage current may flow to discharge the movable portion 221, so that the movable portion 221 returns to the initial state. There is also a possibility that the movement of the movable portion 221 is instable due to the remaining charges.

In contrast, a discharge resistor 250 is provided between the stationary electrode 231 and the movable contact 221. In other words, the resistor 250 is connected in parallel to the capacitor defined by the movable portion 221 and the stationary electrode 231. When the voltage is applied to the movable portion 221, the capacitor is charged. When the supply of the voltage is stopped, a current 207 flows to the ground as shown in FIG. 74B, so that the movable portion 221 can be discharged promptly and return to the initial position. The discharge resistor 250 may have a resistance of hundreds of kΩ to a few MΩ.

Forty-Third Embodiment

Figures 75A, 75B, 75C:
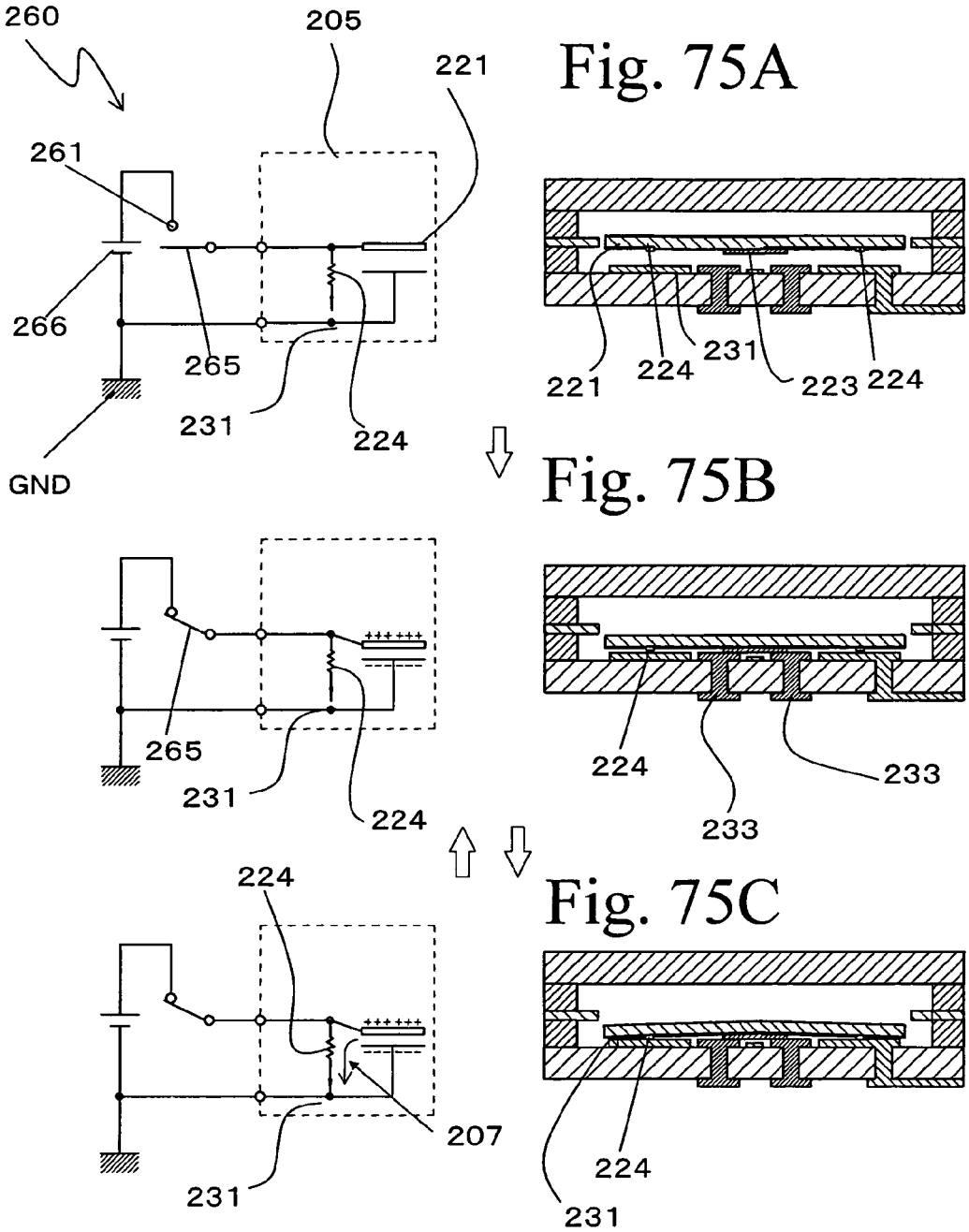
FIGS. 75A, 75B and 75C show a micro-relay according to a forty-third embodiment of the present invention.

FIGS. 75A, 75B and 75C show a micro-relay according to a forty-third embodiment of the present invention, in which the protrusions provided to the movable portion are assigned a discharge resistance function. As has been described previously, the protrusion 224 provided to the lower surface of the movable portion 221 serve as the stoppers that prevent the movable portion 221 from sticking to the stationary electrodes 231. According to the forty-third embodiment of the present invention, the protrusions 224 also function as discharge resistors, which remove the residual charges.

A resistor is provided on the surface of each protrusion 224 by doping silicon or polysilicon with an impurity. FIGS. 75A through 75C show an operation in which the movable portion 221 goes down. The movable contact 265 of the switch is turned ON from the state of FIG. 75A to make a connection with the contact 261, as shown in FIG. 75B. The movable portion 221 is thus electrically attracted to the stationary electrode 231. The movable contact 223 of the micro-relay is brought into contact with the stationary contacts 233, so that the circuit including the micro-relay is looped. At this time, the lower protrusions 224 have not yet been brought into contact with the stationary electrode 231. Then, the movable portion 221 is further attracted and the lower protrusions 224 are pressed against the stationary electrode 231. At that time, the lower protrusions 224 prevent the movable portion 221 from sticking to the stationary electrode 231 and simultaneously function as the discharge resistors between the movable portion 221 and ground. Thus, the lower protrusions 224 prevent the charges from remaining in the movable portion 221 and the stationary electrode 231. It is therefore possible to relax exclusive electrostatic attraction after the circuit is looped and effectively prevent sticking of the movable portion 221. Preferably, it is desired to take the time constant and the resonance frequency of the movable portion 221 into account in order to prevent vibration.

Forty-Fourth Embodiment

Figure 76:
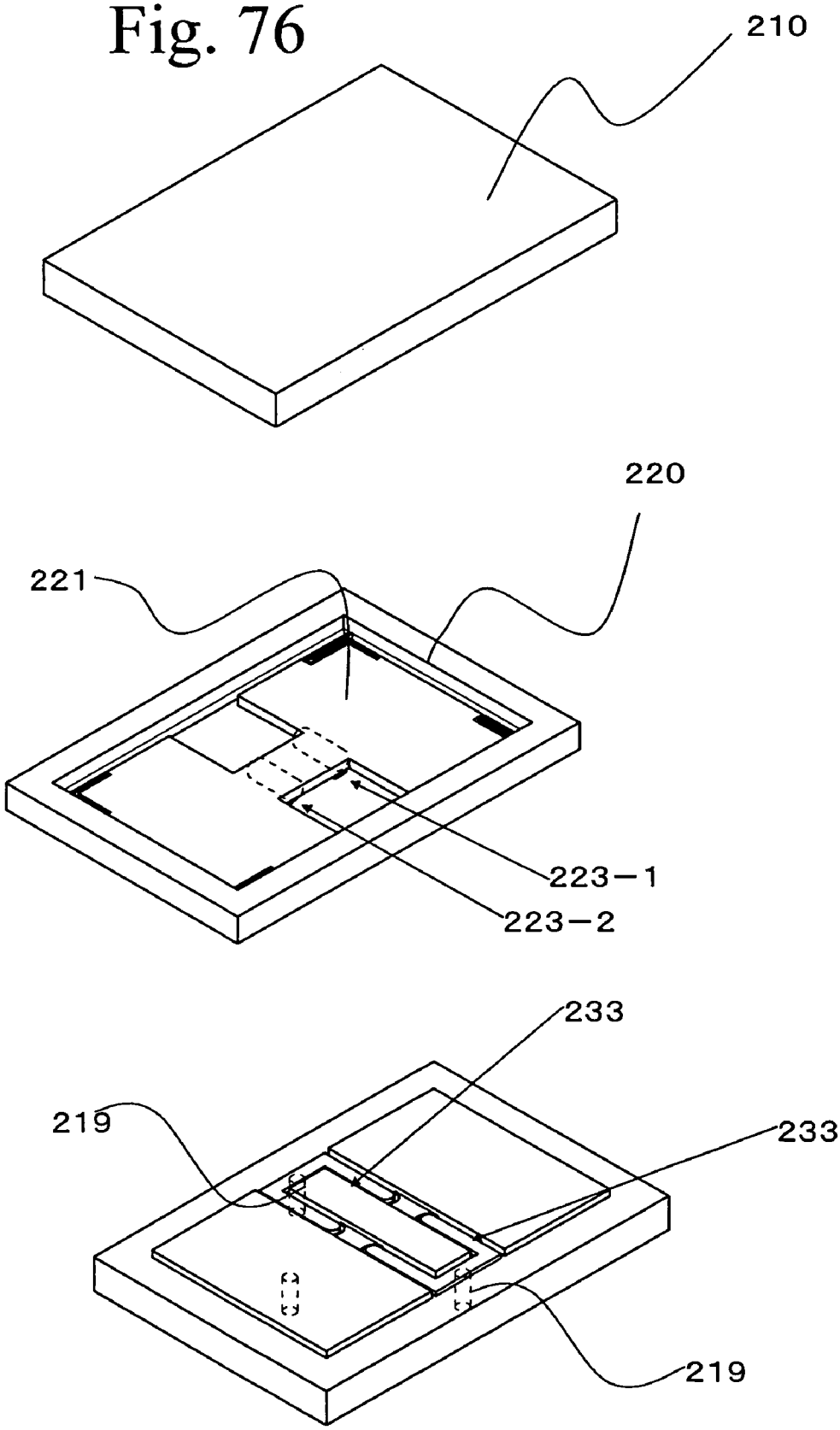
FIG. 76 is an exploded perspective view of a micro-relay according to a forty-fourth embodiment of the present invention.

FIG. 76 is an exploded perspective view of a micro-relay according to a forty-fourth embodiment of the present invention. The movable portion employed in this embodiment is equipped with two movable contacts 223-1 and 223-2. Correspondingly, the stationary contacts 213 provided to the stationary substrate 230 are approximately C-shaped contacts. The movable contact 223-1 makes contact with the two C-shaped contacts 233, and the movable contact 223-2 makes contact therewith. This is a redundant arrangement. That is, even if either the movable contact 223-1 or 223-2 or one of the C-shaped stationary contacts 233 becomes defective, the original function of the relay can be secured. The movable portion 221 may have three or more movable contacts.

Figure 77:
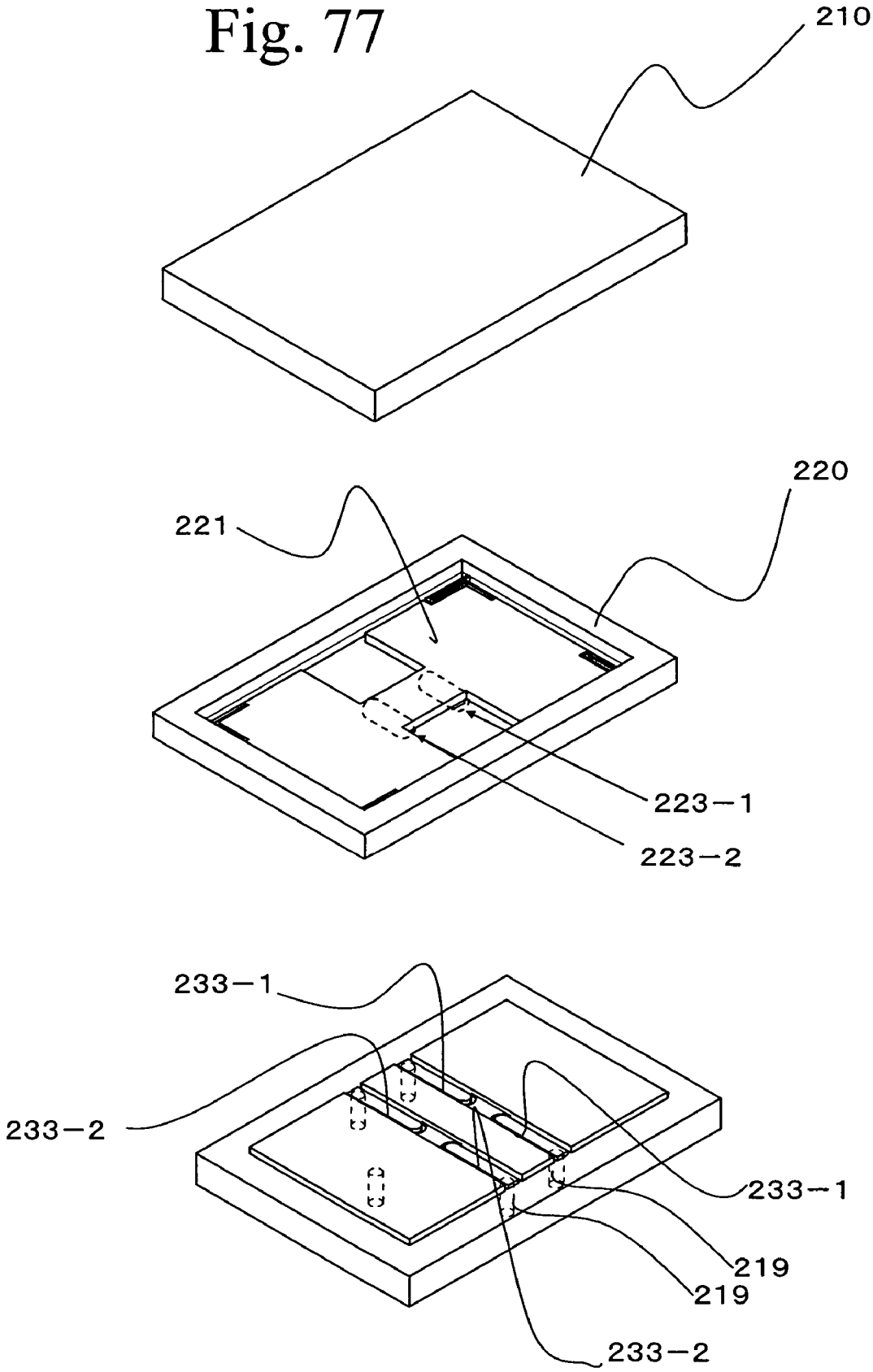
FIG. 77 is an exploded perspective view of a micro-relay that is a variation of the forty-fourth embodiment of the present invention.

FIG. 77 is an exploded perspective view of a micro-relay that is a variation of the forty-fourth embodiment of the present invention. In the above-mentioned structure shown in FIG. 76, each of the C-shaped stationary contacts 233 is divided into two contacts 233-1 and 233-2. The movable contact 223-1 makes contact with a pair of stationary contacts 233-1 and 233-2. Similarly, the movable contact 223-2 makes contact with another part of stationary contacts 233-1 and 233-2. According to this variation, the signal line has a redundant structure in addition to the redundant structure of contacts. Thus, the micro-relay of FIG. 53 is more reliable.

Forty-Fifth Embodiment

Figure 78A:
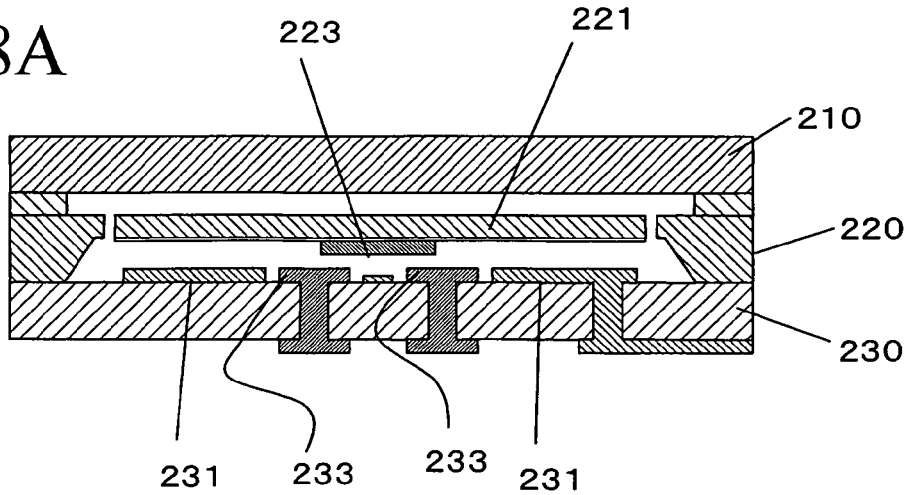
FIGS. 78A, 78B and 78C are cross-sectional views of a micro-relay according to a forty-fifth embodiment of the present invention.
Figure 78B:
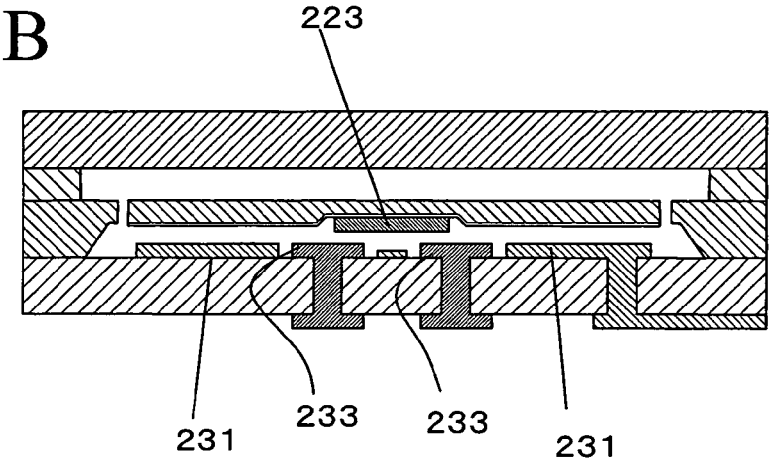
Figure 78C:
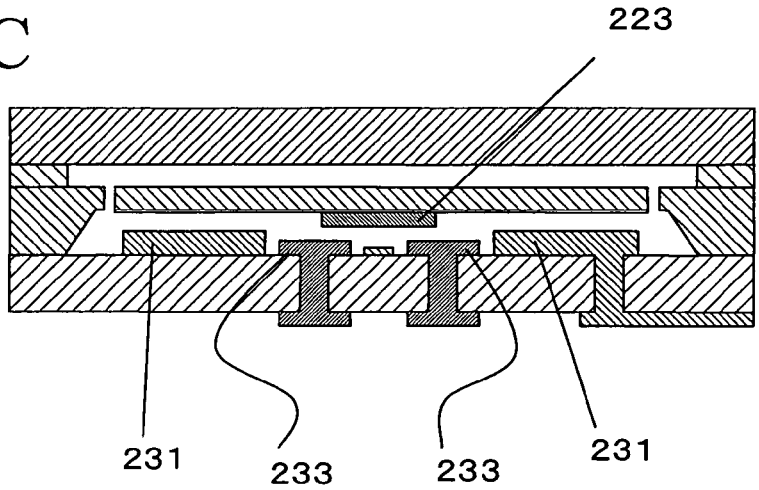

FIGS. 78A, 78B and 78C respectively relate to a micro-relay according to a forty-fifth embodiment of the present invention. The present embodiment employs a preferable structure of the stationary electrode formed on the stationary electrode. FIGS. 78A and 78B are respectively cross-sectional views of comparative examples, and FIG. 784C is a cross-sectional view of a micro-relay according to the forty-fifth embodiment of the invention. In the micro-relay shown in FIG. 78A, the stationary electrode 231 and the stationary contacts 233 supported by the stationary substrate 230 are approximately flush with each other. Thus, there is a large spacing between the stationary electrode 231 and the movable portion 233 serving as the movable electrode. Such a large spacing needs for a high drive voltage in order to obtain the designed electrostatic attraction. The structure shown in FIG. 78B may solve the above problem. In FIG. 78B, the movable contact 223 is placed in a recess formed on the inner surface of the movable portion 221, so that the movable contact 223 shifts upwards. However, it is difficult to form the structure of FIG. 78B, and an increased number of production steps is needed. This raises the cost.

In contrast, the stationary electrode 231 shown in FIG. 78C is higher than the stationary contacts 233. It is preferable that the difference in height between the stationary electrode 231 and the stationary contacts 233 is made slightly less than the height of the movable contact 223 measured from the top surface of the stationary substrate 230. According to the present embodiment, the structure is simple and the movable portion 221 can be surely attracted.

The insulation film on the upper side of the movable portion 221 and the structure of the cap substrate 210 are simply illustrated.

Forty-Sixth Embodiment

Figure 79:
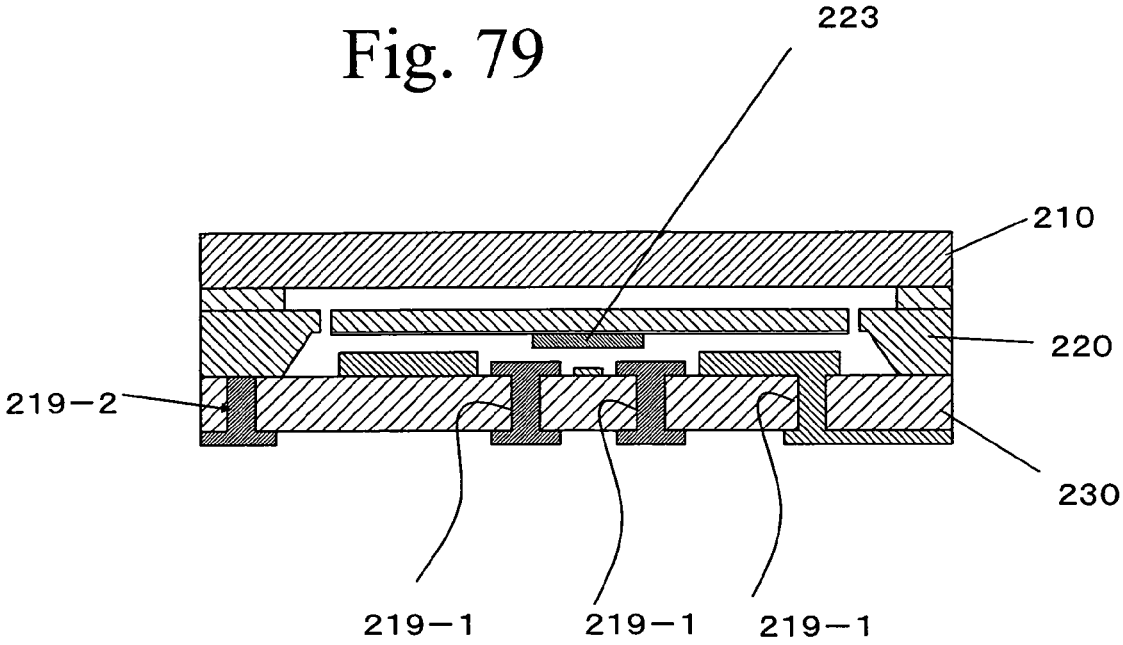
FIG. 79 is a cross-sectional view of a micro-relay according to a forty-sixth embodiment of the present invention.

FIG. 79 is a cross-sectional view of a micro-relay according to a forty-sixth embodiment of the present invention. This micro-relay is equipped with the movable plate 220 that has a unique interconnection structure. A through hole 219-2 is formed in the stationary substrate 230 via which the interconnection line extending from the movable plate 220 is extracted to the backside of the stationary substrate 230. The through hole 219-2 can be formed simultaneously with the through holes 219-1. Thus, the production process can be simplified as compared to the aforementioned embodiments of the present invention. The through hole 219-2 may be formed in the cap substrate 210 instead of the stationary substrate 230. It will be noted that the periphery of the movable portion and the structure of the cap substrate 210 are simply illustrated.

Forty-Seventh Embodiment

Figure 80:
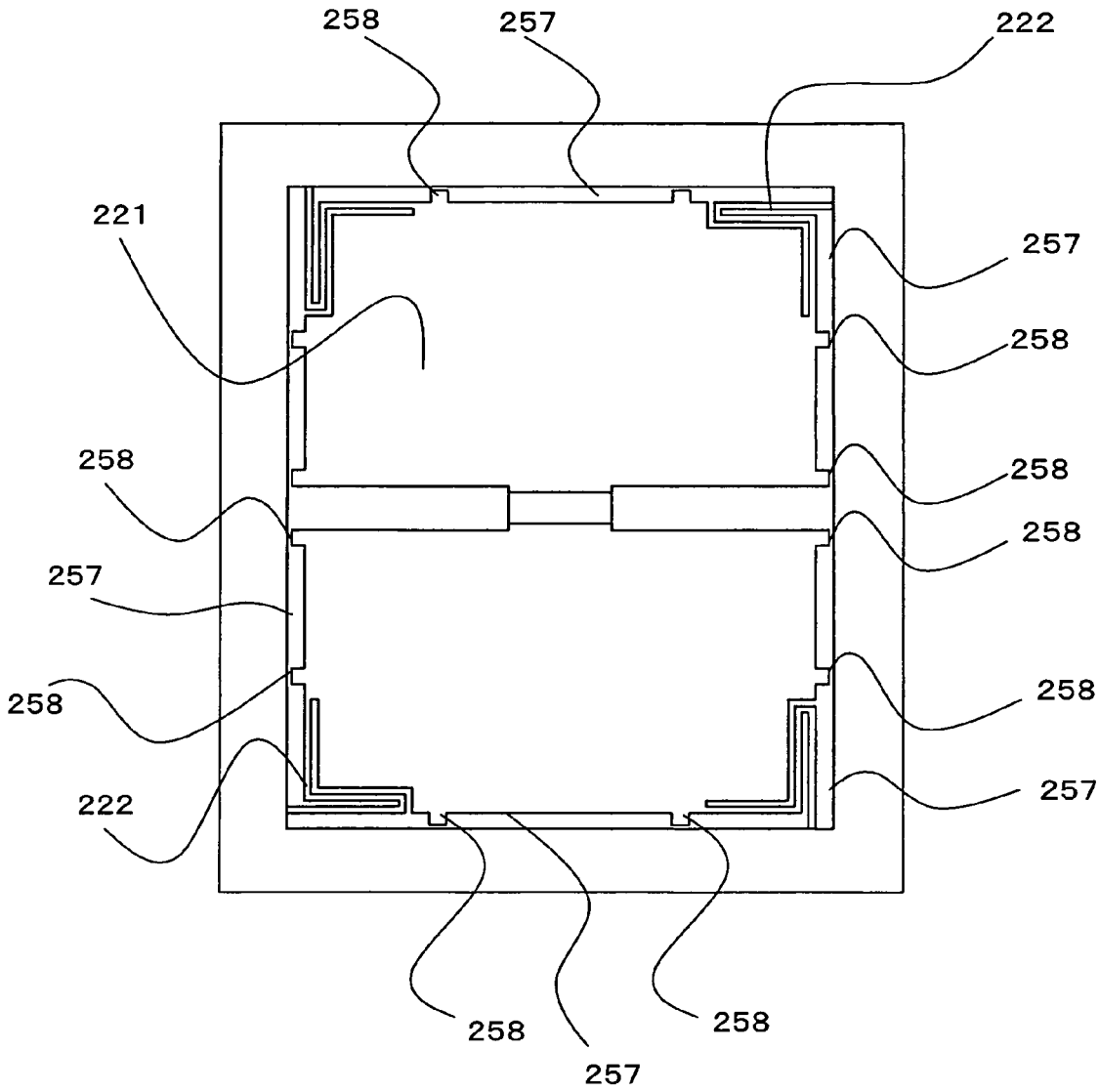
FIG. 80 is a plan view of a micro-relay according to a forty-seventh embodiment of the present invention.

FIG. 80 is a plan view of a micro-relay according to a forty-seventh embodiment of the present invention. This micro-relay is equipped with the movable plate 220 that has a unique structure. As shown in FIG. 80, there are provided gaps 257 between the side edges and the frame 225, and multiple outer stoppers 258 that protrude from the side edges of the movable portion 221 towards the inner sides of the frame 225. The stoppers 258 restrict horizontal movement (in-plane movement) of the movable portion 221. The stoppers 258 may be formed integrally with the movable portion 221. Alternatively, a material having excellent elasticity may be added to the movable portion 221, so that crushproof can be improved.

Preferably, the stoppers 258 may be symmetrically arranged. The stoppers 258 are very small projections and do not prevent airflow caused by the up/down movement of the movable portion 221. The stoppers 258 integrally formed with the movable portion 221 do not need an additional production step.

The stoppers 258 may be provided to the frame 225 instead of the movable portion 221. It is also possible to provide the stoppers 258 to both the movable portion 221 and the frame 225.

As a variation of all the aforementioned sixteenth through thirty-first embodiments of the present invention, a ground pad or pattern may be provided on the entire outer or top surface of the cap substrate 210, so that the signal line can be shielded more effectively. The ground pattern also functions to protect electrostatic attraction from being affected by external turbulence such as static electricity and to prevent malfunctions of the micro-relay. It is also possible to provide an insulation film on the side surfaces of the laminated structure of the micro-relay chip on which a metal layer is provided for obtaining the shield effect. Preferably, the movable contacts 223 and the stationary contacts 213 and 233 have an underlying layer of Au, which is coated with a platinum-base metal such as Rh, Ru, Pd or Pt. The Au underlying layer serves as a cushioning member, and the surface layer of the platinum-base metal has a high degree of hardness. The contacts of the above multilayer structure do not easily stick to each other.

Figure 81:
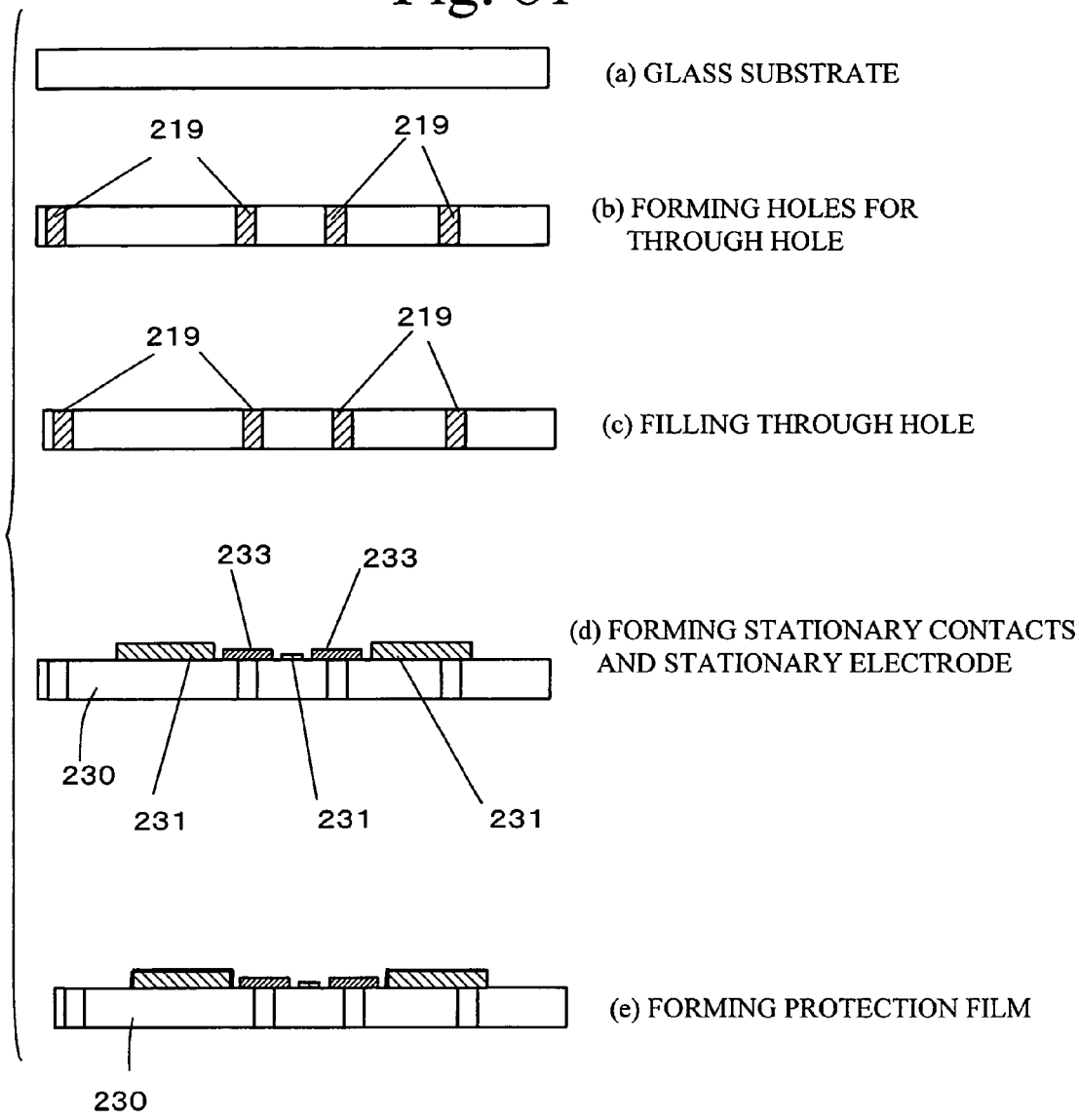
FIG. 81 shows a process for producing a stationary substrate employed in the micro-relay according to the thirty-third embodiment of the present invention.
Figure 82A:
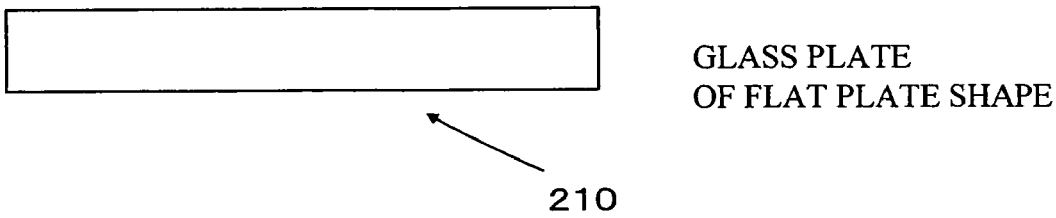
FIGS. 82A and 82B show a process for producing a cap substrate employed in the micro-relay according to the thirty-third embodiment of the present invention.
Figure 82B:
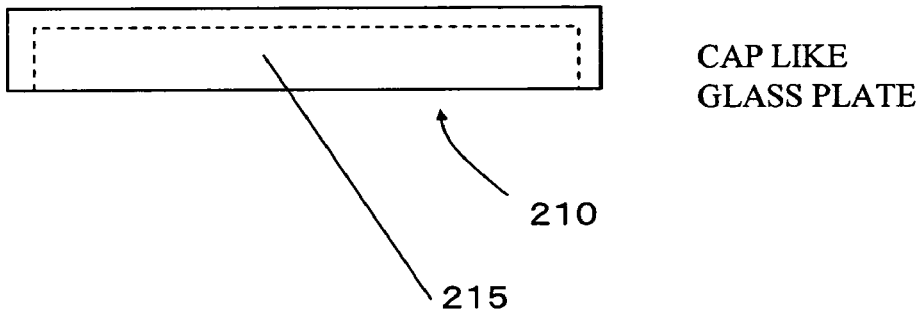
Figure 83:
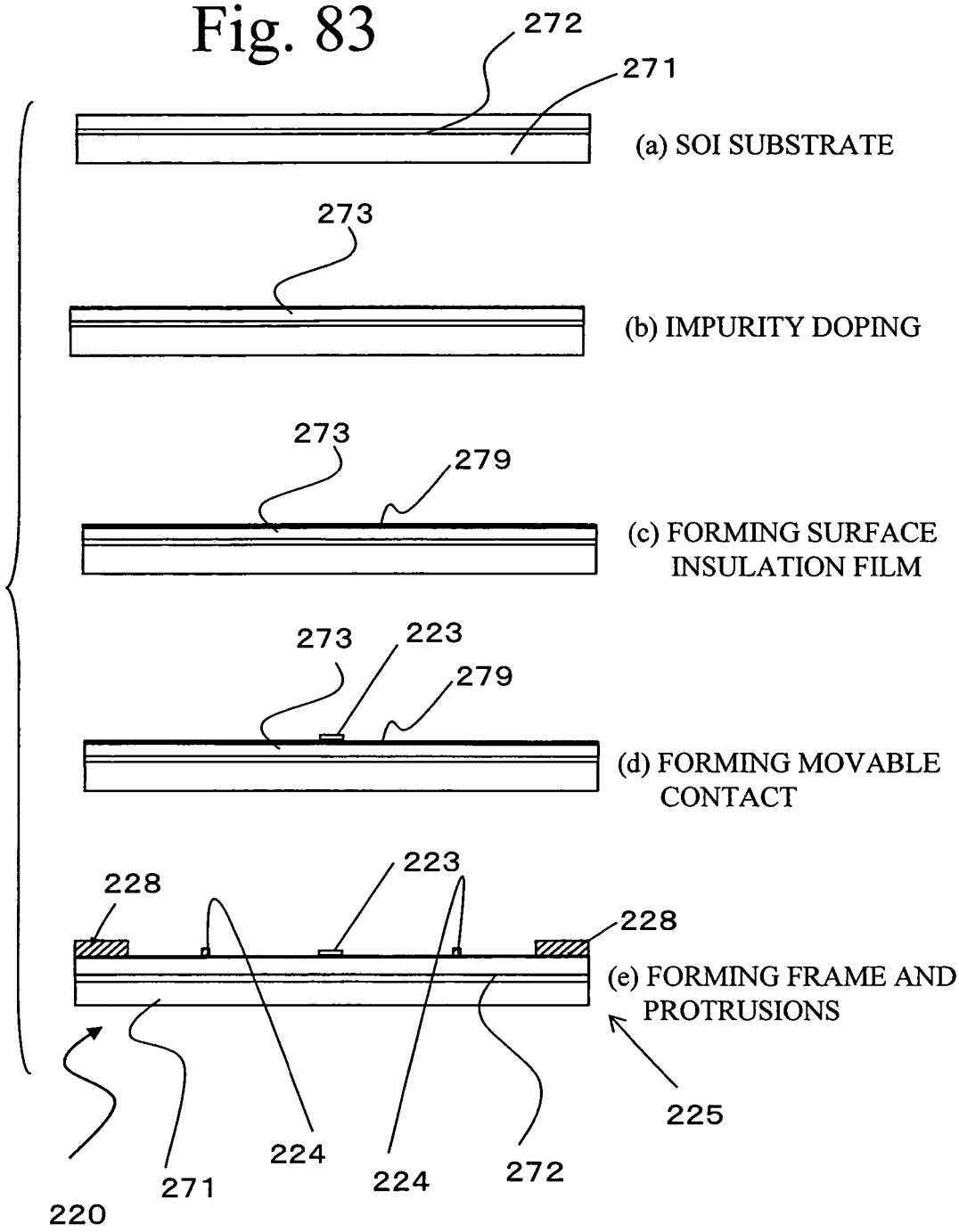
FIG. 83 shows a process for producing a movable plate employed in the micro-relay according to the thirty-third embodiment of the present invention.
Figure 84:
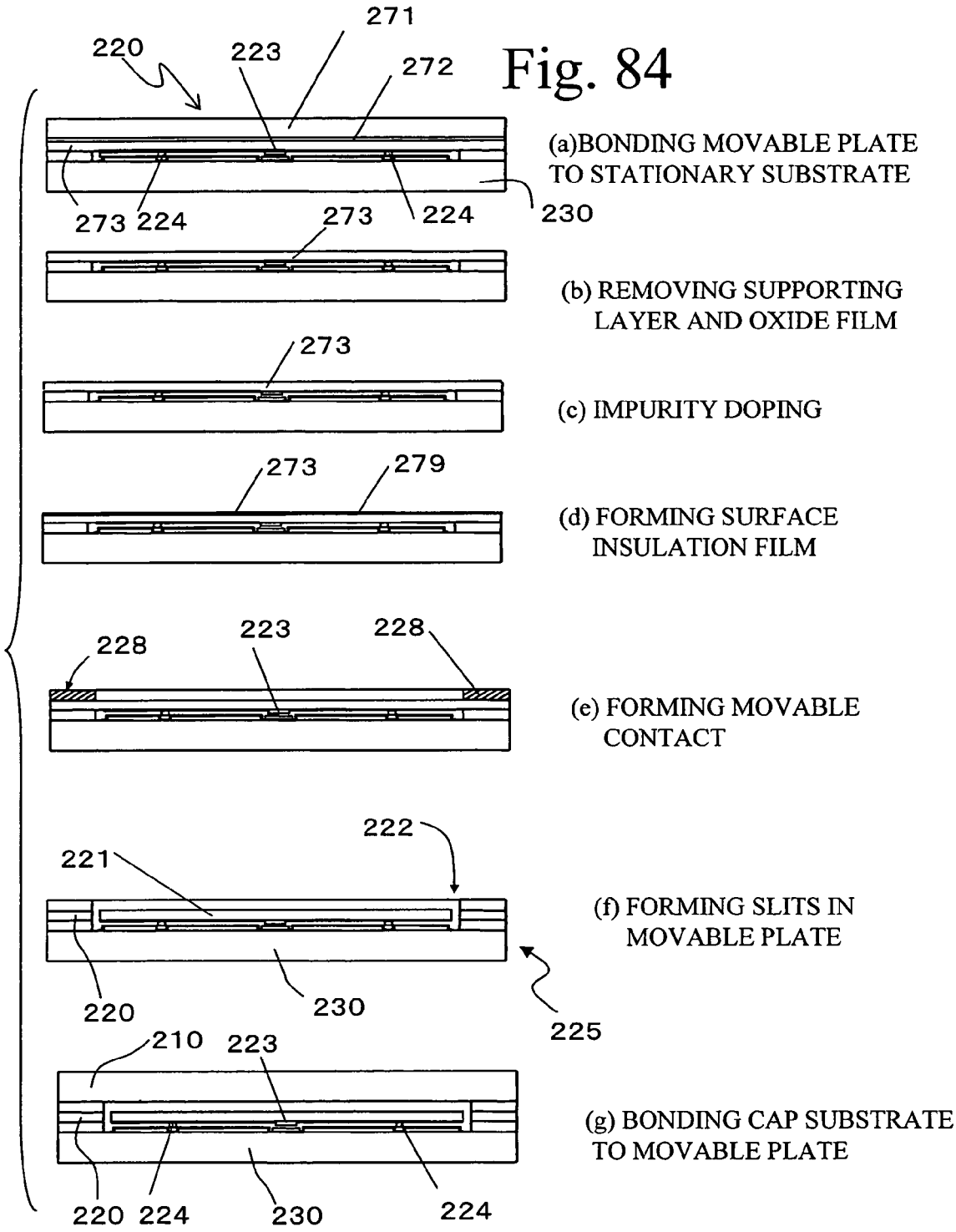
FIG. 84 shows a process for assembling the structural parts produced by the processes shown in FIGS. 81 through 83.

A description will now be given, with reference to FIGS. 81 through 84, of a method of fabricating the micro-relay chip 205 according to the thirty-third embodiment of the present invention that employs the spacers for defining the gap. FIG. 81 shows a process for producing the stationary substrate 230, and FIGS. 82A and 82B show a process for producing the cap substrate 210. FIG. 83 shows a process for producing the movable plate 220, and FIG. 84 shows a process for assembling the above structural parts. These processes utilize the semiconductor production techniques, such as film growth, exposure and etching.

The stationary substrate 230 is produced as shown in FIG. 81. The glass or silicon substrate 230 that is 0.2-0.4 mm thick is prepared (step (a)). Preferably, the glass substrate 230 is made of Pyrex glass (registered trademark). As will be described later, this glass has a thermal expansion coefficient close to that of single crystal silicon used for the movable plate 220 that will be described later, so that the glass substrate 230 and the movable plate 210 can be joined very well.

Next, holes for the through holes 219 are formed in the glass stationary substrate 230 (step (b)). The inner walls of the holds are plated with are filled with an electrically conductive material (step (c)). Examples of the conductive material are gold, copper or aluminum.

Then, the stationary electrode 231 and the stationary contacts 233 are formed by sputtering or another appropriate process (step (d)). The electrode 231 and the contacts 233 may be made of gold or platinum, or may have a multilayer structure that has an Au underlying layer on which a platinum-base metal such as Rh, Ru, Pd, Pt may be deposited. Particularly, it is preferable that the stationary contacts 233 that are brought into contact with the movable contact have a surface layer made of a platinum-based metal that has abrasion resistance. The Au underlying layer serves as a cushion and simultaneously reduces the resistance. The stationary substrate 230 thus formed has the glass substrate on which the stationary electrode 231 and the stationary contacts 233 are provided. As shown in step (e) of FIG. 81, as necessary, a protection film made of $Si_3N_4$ or the like may be formed on the surface of the stationary electrode by CVD (Chemical Vapor Deposition) or the like.

The process for producing the cap substrate 210 is shown in FIGS. 82A and 82B. The cap substrate 210 shown in FIG. 82A is like a flat plate. The frame 225 of the movable plate 220 has a sufficient thickness in order to secure a clearance when the plate-shaped cap substrate 210. In the present process, the spacer is formed in the frame 225 in order to secure the clearance between the movable portion 221 and the cap substrate 210.

The cap substrate 210 shown in FIG. 82B has the cavity 215. The use of the cavity 215 avoids consideration of the thickness of the upper portion of the frame 225 and simplifies the production process. The micro-relay according to the aforementioned thirty-fourth embodiment of the present invention employs the cap substrate 210 shown in FIG. 82. In the following description, the production method that uses the cap substrate shown in FIG. 82A will be described. The following description will facilitate to comparative understanding of some advantages brought by the use of the cap substrate 210 shown in FIG. 82B.

The movable plate 220 is produced as shown in FIG. 83, which shows the process for producing the movable plate 220 up to a step just before the movable plate 220 is joined to the stationary substrate 230. After the movable plate 220 is joined to the stationary substrate 230, it is further processed so that the movable plate 220 is finally completed. First, an SOI (Silicon On Insulator) substrate is prepared (step (a)) The SOI substrate has a laminate structure in which an oxide film 272 such as an $SiO_2$ film is formed on a comparatively thick supporting layer 271, and an active layer 273 made of single crystal silicon is formed on the oxide film 272.

The active layer 273 is doped with an impurity so that conductivity can be assigned thereto (step (b)). An insulation film 279 of, for example, $SiO_2$, is deposited on the surface of the active layer 273 by sputtering (step (c)). The insulation film 279 functions to electrically isolate the movable plate 221 and the movable contact 223 from each other. Subsequently, the movable contact 223 is formed by depositing a conductive film by sputtering or plating and patterning it (step (d)).

Then, the spacer 228 is formed by depositing polysilicon or metal on the outer portion (circumferential portion) corresponding to the frame 225 of the movable plate 220 (step (e)). The spacer 228 is used to adjust the height of the frame 225. The protrusions 224 that serve as the stopper may be formed as necessary. An integrated body thus formed includes a basic structure of the movable plate 220 supported by the stationary substrate 230.

The stationary substrate 230, the cap substrate 210 and the movable plate 220 are assembled so as to form a laminate, as shown in FIG. 84. First, the semifinished movable plate 220 is bonded to the stationary substrate 230 (step (a)). The semifinished movable plate 220 obtained by the process of FIG. 83 is turned upside down. Then, the plate 220 is mounted on the stationary substrate 230 and is bonded thereto. Preferably, anodic bonding is used. When the stationary substrate 230 is set at a positive potential and the movable plate 220 is set at the ground potential, they can be tightly bonded with ease.

Subsequently, a process for forming the remaining half of the movable plate 220 is carried out. First, the supporting layer 271 and the oxide film 272 are removed (step (b)). Then, the semifinished plate 220 is processed by the same process as shown in FIG. 83. That is, the plate 220 is doped with an impurity to assign conductivity thereto (step (c)). The insulation film 279 is formed on the plate 220 (step (d)), and polysilicon or the like is deposited to the surface portion that corresponds to the frame 225, so that the spacer 228 can be provided (step (e)). The spacer 228 thus deposited secures a clearance. That is, the thickness of the frame 225 is adjusted by the spacer 228 in order to secure the sufficient clearance between the cap substrate 210 and the movable portion 221. If the cap substrate 210 sown in FIG. 82B is employed, the step of part (e) of FIG. 84 can be omitted.

Thereafter, slits for defining the hinge springs 222 are formed in the movable plate 220. The frame 225 and the movable portion 221 are connected via the hinge springs 222 (step (f)). When the movable plate 220 is made of single crystal silicon, the hinge springs 222 that are formed several times can be easily formed by RIE (Reactive Ion Etching).

Finally, the cap substrate 210 is mounted on the movable plate 220, and is bonded thereto by anodic bonding (step (g)). Preferably, anodic bonding is carried out in a pressure-reduced atmosphere, more preferably, in an inactive gas. Thus, the micro-relay can be hermetically sealed with no gas remaining in the interior. Now, multiple micro-relay chips arranged on the wafer are available. These chips are divided into the individual chips by dicing. Since the micro-relay chips are already hermetically sealed, the interiors thereof are not affected by dicing at all. The individual chips are respectively subjected to the process shown in FIGS. 58A through 58C, so that the micro-relay devices 200 can be obtained.

Figure 85:
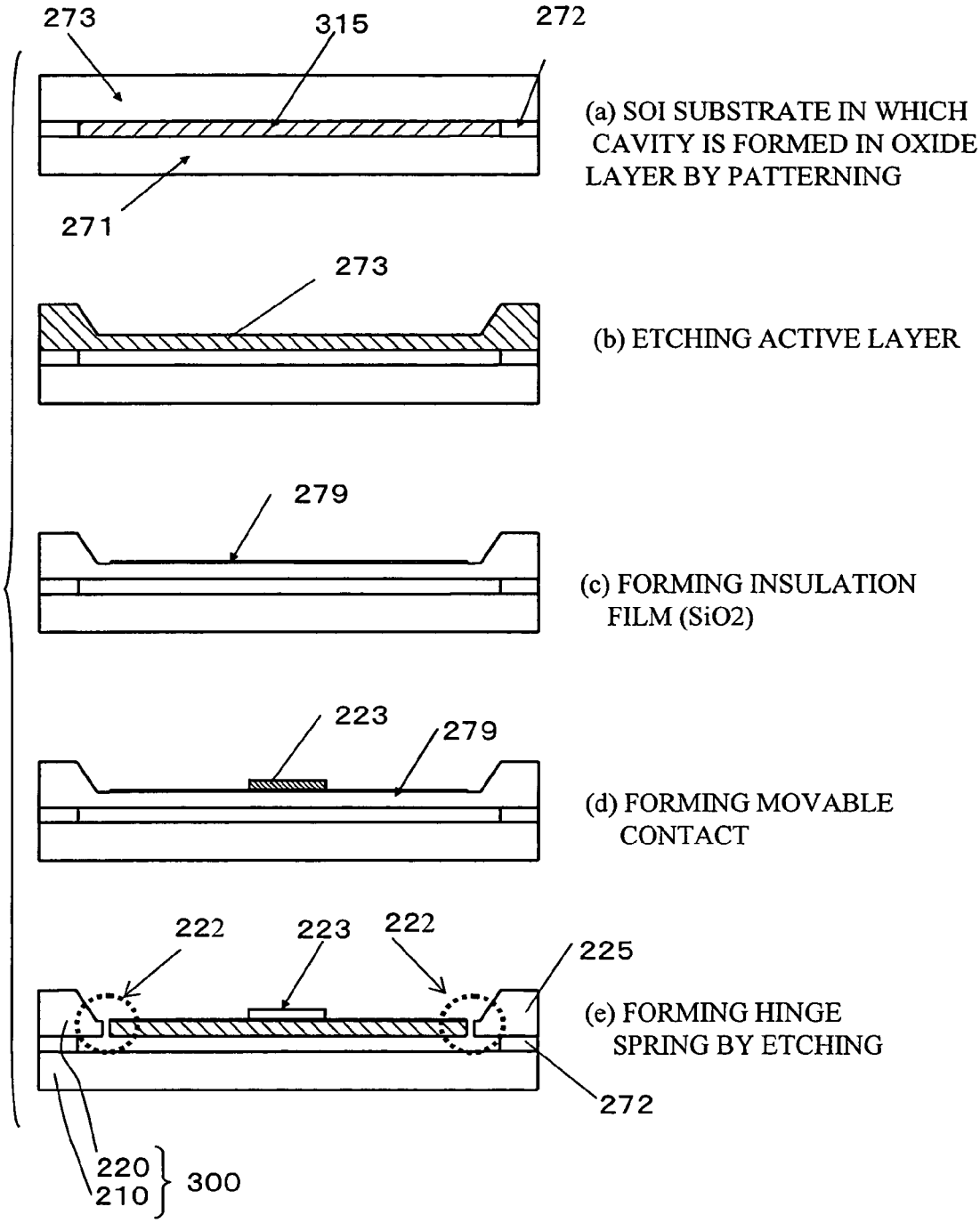
FIG. 85 shows a simplified process for producing the micro-relay.

FIGS. 85 and 86 show a simplified process of fabricating the micro-relay. In the foregoing description, the cap substrate 210 and the movable plate 220 are separate members, which are bonded by anodic bonding. As is described in FIG. 83 mentioned before, the SOI substrate is prepared for forming the movable plate 220. The SIO substrate has the active layer 273 made of silicon single crystal or the like on the insulation laminate of the supporting layer 271 made of silicon and the oxide layer 272 made of $SiO_2$. As has been described with reference to FIG. 84, the supporting layer 271 and the oxide layer 272 are removed.

In contrast, the process shown in FIGS. 85 and 86, the supporting layer 271 and the oxide layer 272 are efficiently used to form the integrated assembly of the cap substrate and the movable plate in order to simplify the process. An SOI substrate shown in FIG. 85 has the oxide layer 272 having an internal cavity 315 formed by patterning in advance (step (a)). This cavity 315 is designed to match the cavity 215 formed in the cap substrate for securing the clearance with respect to the movable portion. The cavity 315 may be formed by patterning the SOI substrate on the entire surface of which the oxide layer 272 is deposited.

The active layer 273 on the patterned oxide layer 272 is etched so that a recess for defining a portion corresponding to the frame 225 can be formed (step (b)). An insulation film 279 of $SiO_2$ is deposited on the bottom of the recess in the active layer 273 (step (c)). An electrically conductive material is deposited on the insulation film 279 by plating or sputtering and is then patterned into the movable contact 223 (step (d)). Then, the slits are formed in the outer portion of the movable plate 220 by dry etching. The slits thus formed define the hinge springs 222 that elastically couple the movable portion 221 with the frame (step (e)). The construction obtained by the step (e) is such that the supporting layer 271 is the cap substrate 210, which is integrally formed with the movable plate 220 via the oxide layer 272 serving as the spacer. That is, the process shown in FIG. 85 produces the movable plate 220 with the cap substrate being attached. This may be called integrated construction 300.

The cavity 315 of the SOI substrate may be filled with filler such as organic photoresist in order to prevent the movable plate 220 from being deformed. The filler is removed later.

Then, as shown in the upper part of FIG. 86, the integrated construction 300 is mounted on the stationary substrate 230 and an interface 290 is bonded by anodic bonding. This results in the hermetically sealed micro-relay. As shown in the lower part of FIG. 86, an interconnection pattern 291 may be formed on the back surface of the stationary substrate 230, so that the micro-relay chip 200 can be completed. It can be seen from the above description that the micro-relay can be produced by the simplified process. The stationary substrate 230 used in the process of FIG. 86 may be produced by the process shown in FIG. 81.

In the foregoing embodiments, the micro-relay is equipped with only one movable portion supported by the frame of the movable plate. In practice, many cases utilize multiple relays arranged close to each other in an electronic device. Such an arrangement may cause a problem of stub. In the following, a micro-relay equipped with multiple movable portions will be described. The micro-relay with multiple movable portions being integrated has excellent high-frequency (RF) characteristics. The present micro-relay has a structure that does not have an unnecessary stub on a signal transmission line.

First, a description will now be given of the stub in a circuit having a plurality of micro-relay. The basic micro-relay is equipped with a single movable contact and a pair of stationary contacts that may be short-circuited by the movable contact. If multiple basic micro-relays are used to form a circuit, a stub will be formed. The input impedance of the stub depends on the wavelength and the length of the stub as follows:

$$Zin=-jZolcot\beta 1 \quad (1)$$

where:

Zin: input impedance of the stub

Zo: characteristic impedance of the transmission line $\beta=2\pi/\lambda$ l: wavelength of the transmission line $\beta 1$: electrical length As the frequency is higher and the stub is longer, the problem becomes more conspicuous. Impedance mismatch will cause a reflected wave, which will increase insertion loss and delay in transmission. It will be noted that a stub is positively utilized for a particular frequency in filters and RF circuits. In contrast, the relay handles a very wide range from DC to RF and is therefore required to have no stub.

Figure 87:
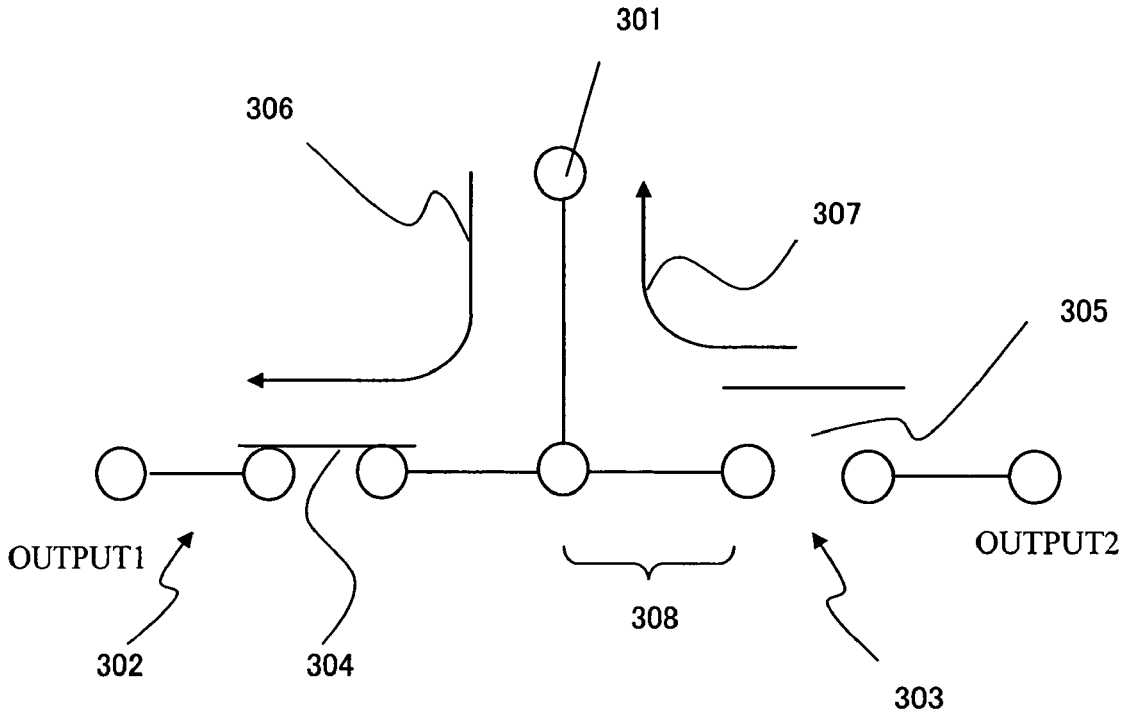
FIG. 87 schematically shows a stub in an arrangement of two micro-relays.

FIG. 87 schematically shows a stub in an arrangement of two micro-relays. The arrangement has a common line 301, a first line 302 and a second line 303. An output signal 1 is available on the first line 302, and an output signal 2 is available on the second line 303. A first micro-relay 304 and a second micro-relay 305 are arranged and are alternately turned on and off. In FIG. 87, the first micro-relay 304 is closed, and the second micro-relay 305 is open, so that a high-frequency signal can pass through the micro-relay 304. In this case, a line portion 308 functions as a stub, which causes a reflection 307 on the side of the second micro-relay 305.

Figure 88A:
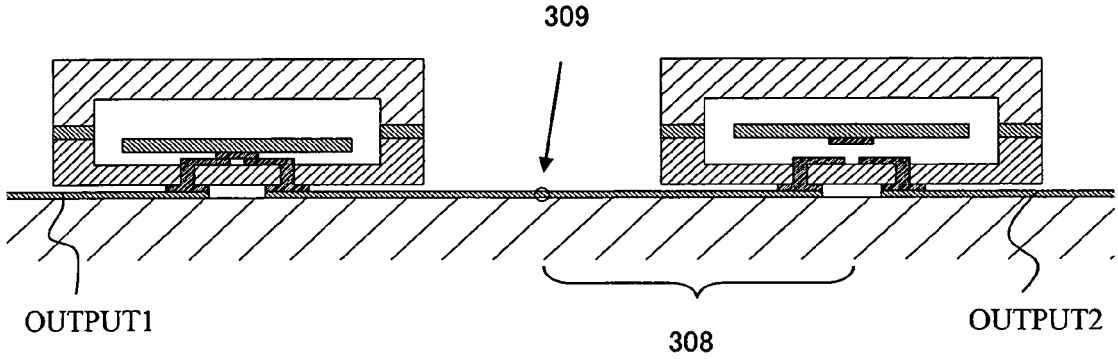
FIG. 88A shows occurrence of a stub in such an arrangement that two micro-relays are connected in parallel.
Figure 88B:
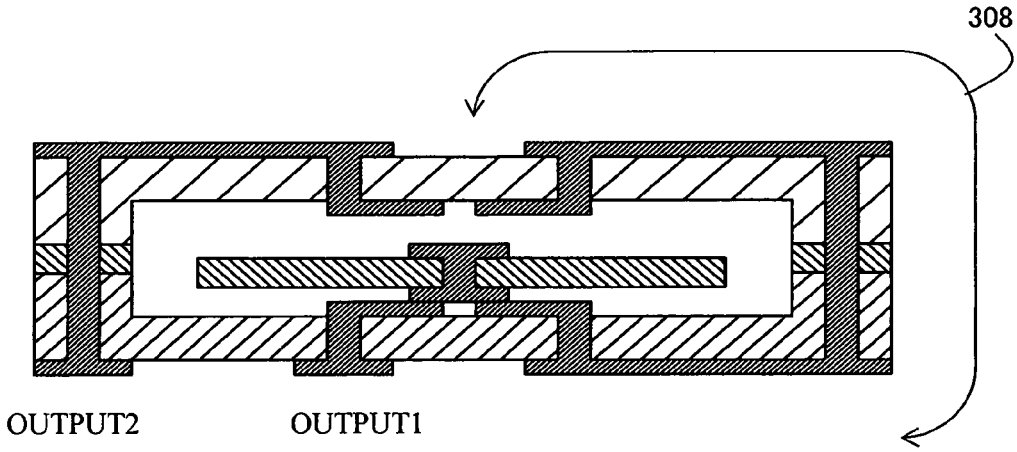
FIG. 88B shows occurrence of a stub when contacts are arranged on top and bottom surfaces of the micro-relay.

FIG. 88A shows occurrence of a stub in such an arrangement that two micro-relays are connected in parallel, and FIG. 88B shows occurrence of a stub when contacts are arranged on the top and bottom surfaces of the micro-relay. In FIG.

88A, the two micro-relays are connected via a branch point 309. When the left-side micro-relay is closed, a portion indicated by a reference numeral 308 functions as a stub. In the structure shown in FIG. 88B, a portion 308 functions as a stub. It can be seen from the above that two micro-relays are arranged close to each other, a stub exists. A micro-relay described below has a structure that has a reduced stub.

Figure 89:
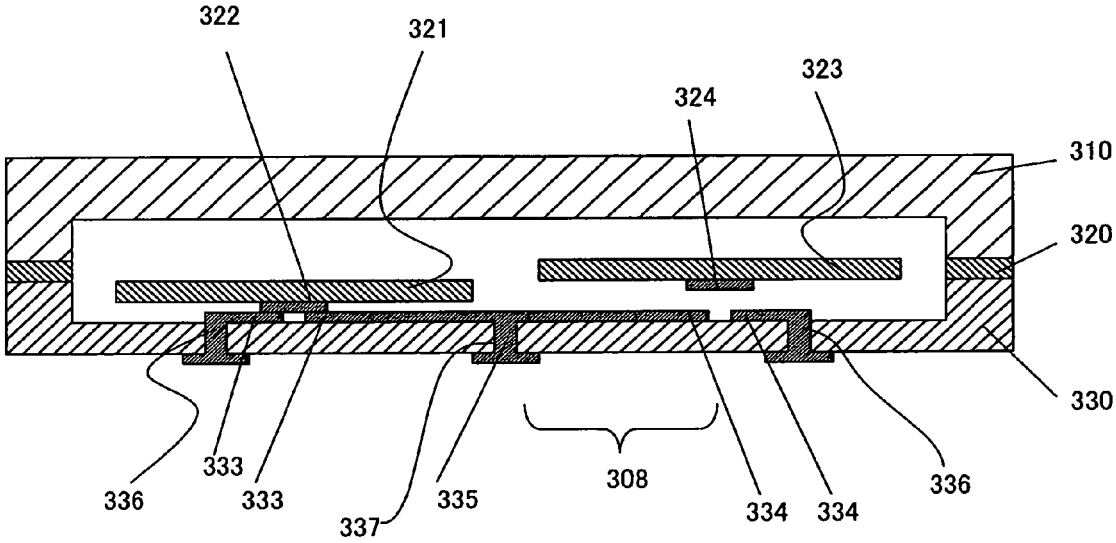
FIG. 89 is a cross-sectional view of a micro-relay with two movable portions in a movable plate.

FIG. 89 shows a micro-relay with two movable portions in the movable plate 320, which is sandwiched between the stationary substrate 330 and the cap substrate 310. The movable portion 320 has a first movable portion 321 and a second movable portion 323. The first movable portion 321 has a first movable contact 322, and the second movable portion 323 has a second movable contact 324. The other portions of the first movable portion 321 and the second movable portion 323 serve as movable electrodes.

First stationary contacts 333 and second stationary contacts 334 are provided on the stationary substrate 330. The first stationary contacts 333 are associated with the first movable contact 322, and the second stationary contacts 334 are associated with the second movable contact 324. A signal line connected to one of the first stationary contacts 333 is connected to a common terminal 335. Similarly, a signal line connected to one of the second stationary contacts 334 is connected to the common terminal 335. As shown in FIG. 89, when the first movable portion 321 descends and the first movable contact 322 makes a connection between the first stationary contacts 333, the half of the common line 308 serves as a stub. However, the common line 308 is very short in the micro-relay. Thus, the common line 308 will not substantially cause any adverse affect. It will be noted that the stationary electrodes arranged in the vicinity of stationary contacts 333 and 334 are omitted from illustration. These stationary electrodes will be described later.

Forty-Eighth Embodiment

Figure 90:
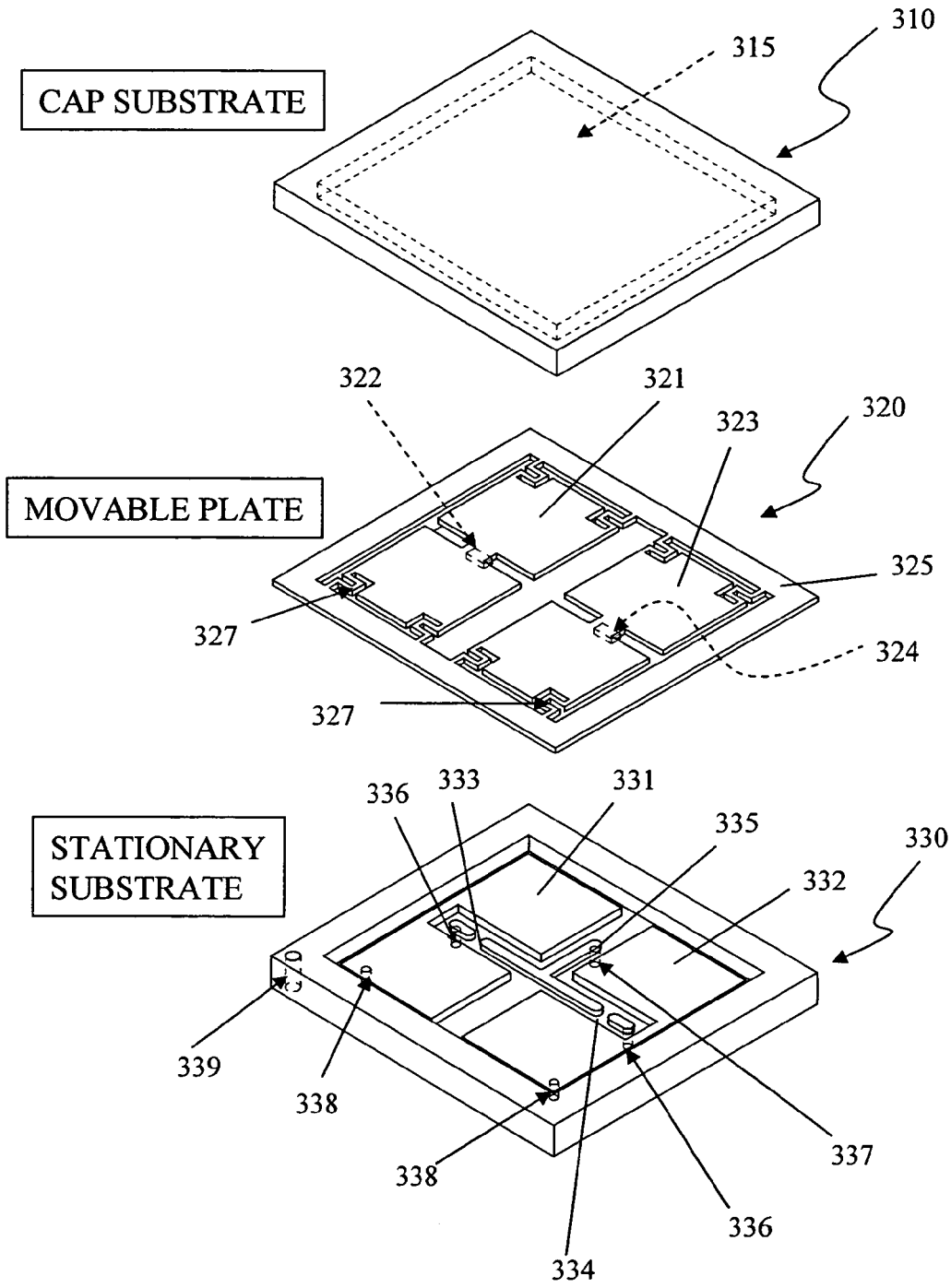
FIG. 90 is an exploded perspective view of a micro-relay according to a forty-eighth embodiment of the present invention.
Figure 91:
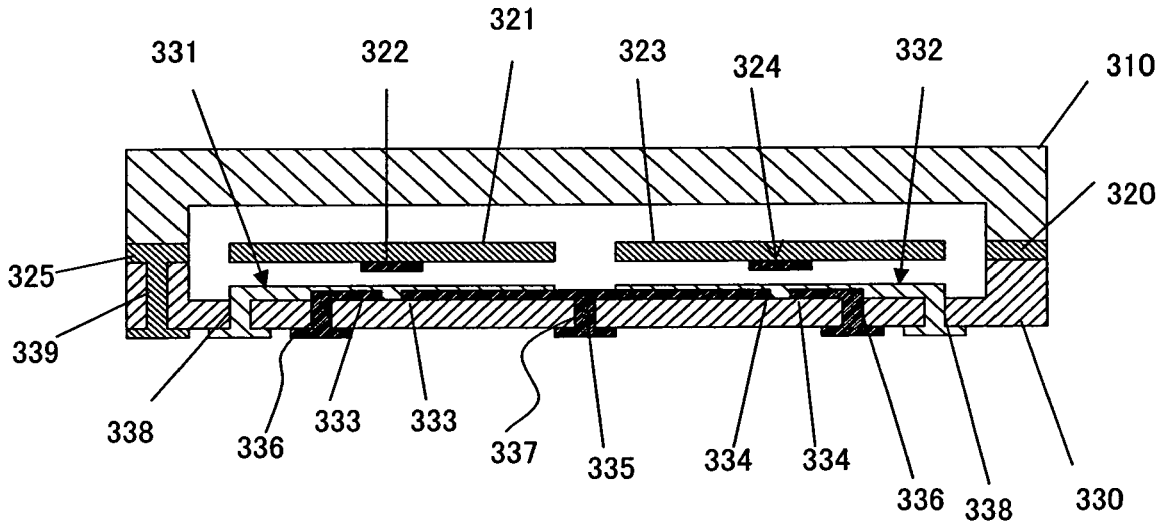
FIG. 91 is a cross-sectional view of the micro-relay shown in FIG. 90.

FIGS. 90 and 91 show a micro-relay according to a forty-eighth embodiment of the present invention. More particularly, FIG. 90 is an exploded perspective view of the micro-relay, and FIG. 91 shows a cross section thereof. These figures show the structure of the micro-relay shown in FIG. 89 in more detail.

The cap substrate 310 has the cavity 315, which makes a clearance with respect to the movable portions 321 and 323. The movable plate 320 has the first movable portion 321 and the second movable portion 323 within the frame 325. The first movable portion 321 has the first movable contact 322 on the lower surface thereof. The second movable portion 323 has the second movable contact 324 on the lower surface thereof.

The movable portions 321 and 323 are coupled to the frame 325 by hinge spring 327 so as to move up and down. The movable plate 320 may be made of silicon single crystal doped with an impurity for making conductivity. The plate of silicon single crystal is etched so that the movable portions 321 and 323 can be movably supported by the hinge springs 327 connected to the frame 325. The first movable portion 321 and the second movable portion 323 are electrically connected, and substantially function as movable electrodes.

The stationary substrate 330 has two stationary electrodes 331 and 332 that face the first movable contact 322 and the second movable contact 324. The firs stationary electrode 331 and the second stationary electrode 332 are electrically isolated from each other. Electricity is supplied to the stationary electrodes 331 and 332 from the outside of the micro-relay via through holes.

One of the first stationary contacts 333 that face the first movable contact 322 of the first movable portion 321 is connected to a terminal or wiring line via a through hole 336. Similarly, one of the second stationary contacts 334 that face the second movable contact 324 of the second movable portion 323 is connected to a terminal or wiring line via another through hole 336. The other first stationary contact 333 and the other second stationary contact 324 are connected to the common terminal 335, which is connected to an external wiring line via a through hole 337.

The present micro-relay employs the cap substrate 310 having the cavity 315, and the stationary substrate 330 having a step portion that accommodates the stationary contacts 333 and 334 and is lower than the peripheral portion in order to allow the movable portion 321 and 323 to move down. Thus, the movable portion 320 is flat thoroughly and the frame 325 is flush with the movable portion 321 and 323. The movable portion 320 may be foamed easily. Alternatively, the stationary substrate 330 is flat and the movable plate 320 has the frame 325 that is thicker than the movable portions 321 and 323 like the aforementioned many embodiments of the invention.

FIG. 91 schematically show the cross section of the micro-relay shown in FIG. 90. The frame 325 of the movable plate 320 is mounted on the peripheral portion of the stationary substrate 330, and the cap substrate 310 is mounted on the frame 325. A through hole 339 is formed in the peripheral portion of the stationary substrate 330 in order to supply the frame 325 of the movable plate 320 with electricity. A voltage is applied to the first movable portion 321 and the second movable portion 323 via the frame 325.

Electrostatic attraction forces develop between the first stationary electrode 331 and the first movable portion 321 and between the second stationary electrode 332 and the second movable contact 323. The first movable contact 322 bridges over the first stationary contacts 333, and the second movable contact 324 bridges over the second stationary contacts 334. When one of the two switches is closed, a stub formed by the common terminal 335 and the other switch is ignorable because the distance therebetween is very short.

Figure 92A:
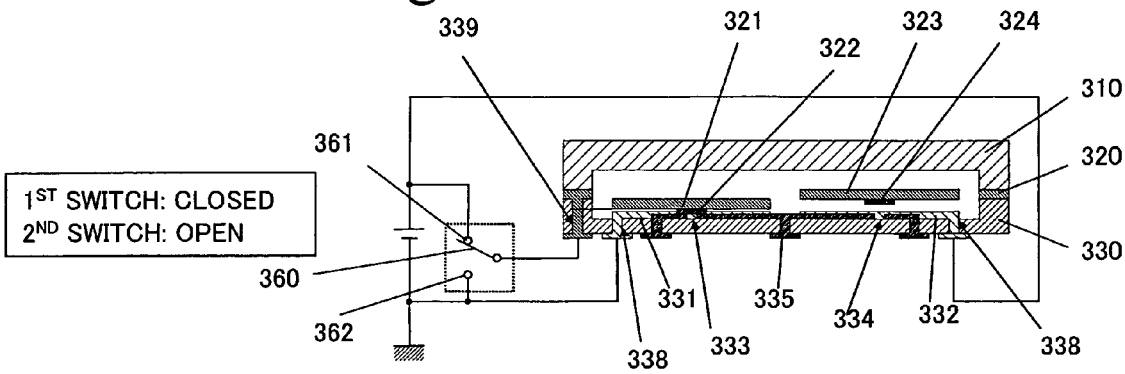
FIGS. 92A, 92B and 92C show an operation of the micro-relay according to the forty-eighth embodiment of the present invention.
Figure 92B:
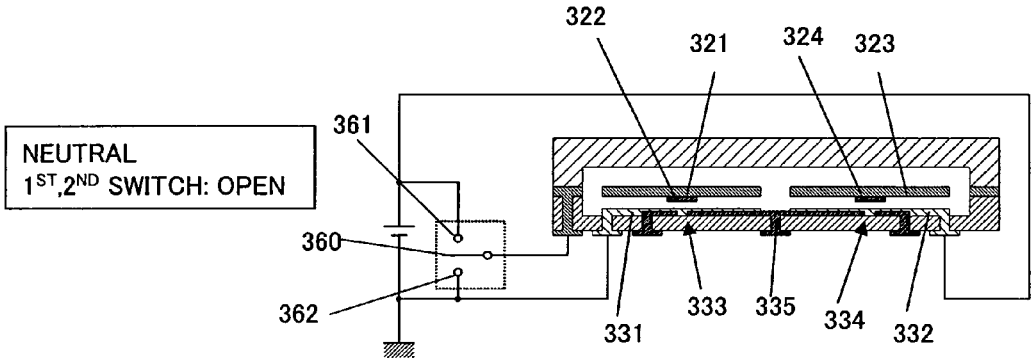
Figure 92C:
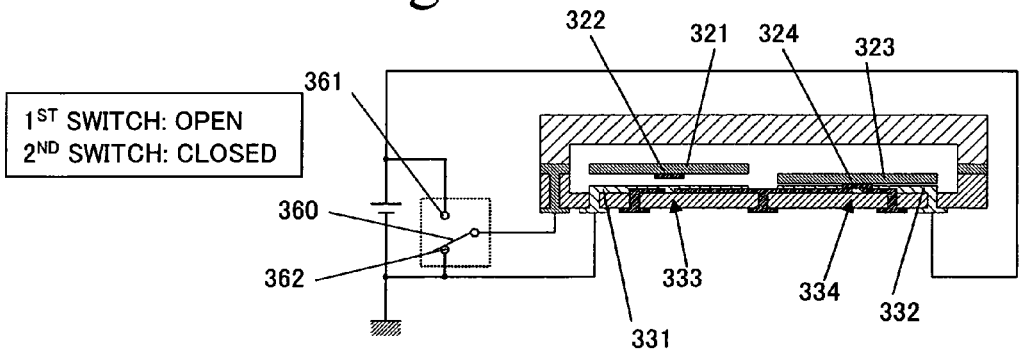

FIGS. 92A, 92B and 92C show an operation of the micro-relay according to the forty-eighth embodiment of the present invention. In these figures, there are illustrated a drive circuit that drives the micro-relay and an externally controlled switch 360. This switch 360 has contacts 361 and 362. As shown in FIG. 92A, When the movable contact of the switch 360 is connected to the contact 361, a voltage develops between the first stationary electrode 331 of the stationary substrate 330 and the first movable portion 321. Thus, the first movable portion 321 descends, and connects the first stationary contacts 333. In contrast, the second movable contact 324 does not make a connection with the second stationary contacts 334.

As shown in FIG. 92B, when the movable contact of the switch 360 is detached from the contacts 361 and 362, the micro-relay is in the neutral position in which the first stationary contacts 333 are open and the second stationary contacts 334 are also open. As shown in FIG. 92C, when the movable contact of the switch 360 is connected to the contact 362, a voltage develops between the second stationary electrode 332 and the second movable portion 323. Thus, the second movable portion 323 moves down, and connects the second stationary contacts 334.

As described above, according to the micro-relay of the present invention, the two switches are alternately closed and switching between the signal lines can be realized. In switching, there is substantially no adverse affect due to the presence of stub. In FIGS. 92A through 92C, the first stationary electrode 331 is set at the ground potential, and the second stationary electrode 332 is set at a positive potential. Alternatively, the movable plate 320 is set at a positive or ground potential, and the two stationary contact groups are separately controlled by respective control switches. In this case, the first movable portion 321 and the second movable portion 323 can be simultaneously closed.

Forty-Ninth Embodiment

Figure 93:
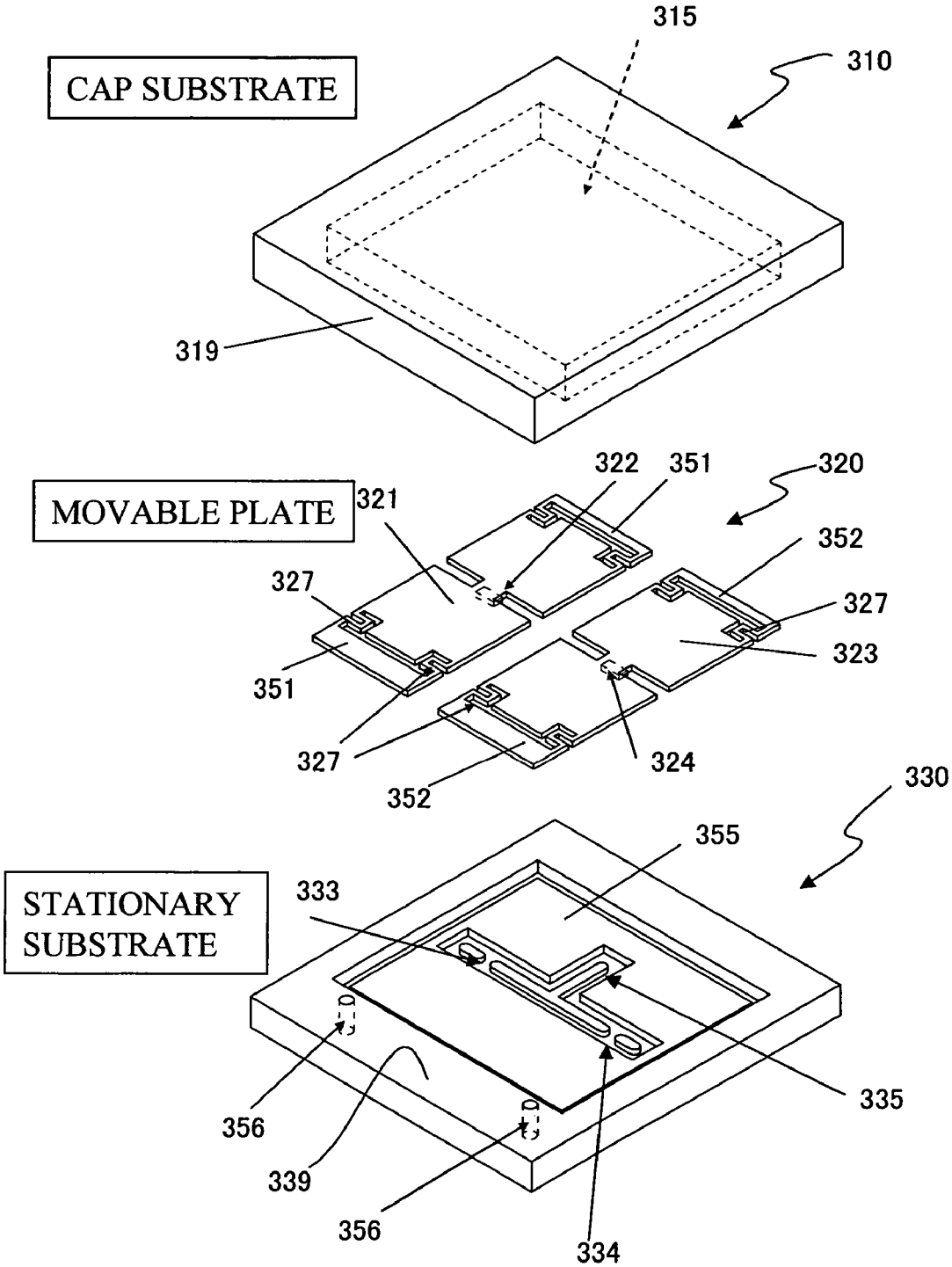
FIG. 93 is an exploded perspective view of a micro-relay according to a forty-ninth embodiment of the present invention.
Figure 94:
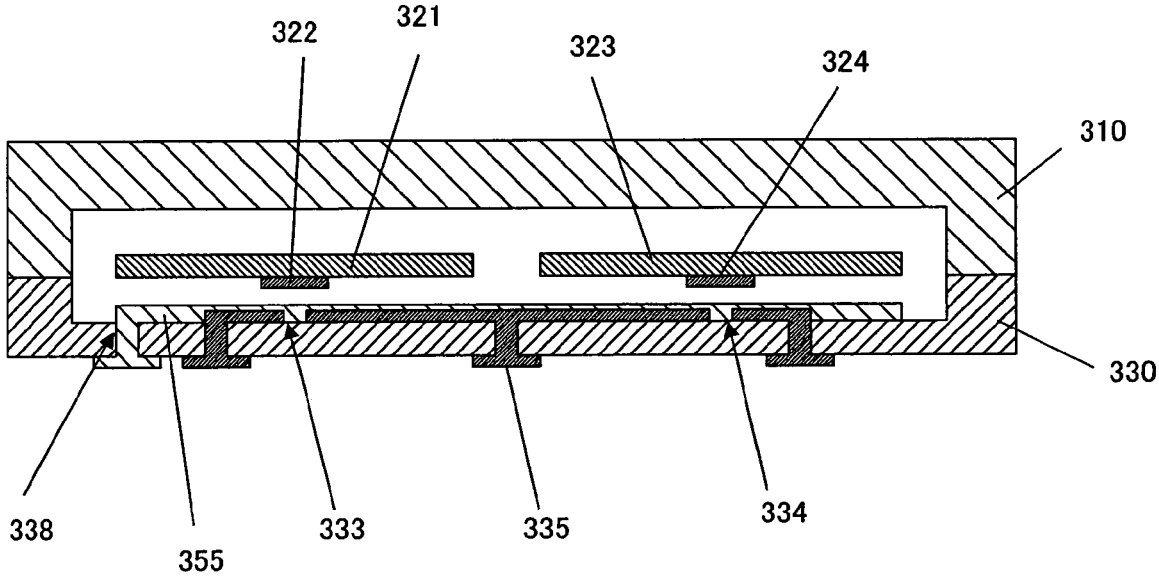
FIG. 94 is a cross-sectional view of the micro-relay shown in FIG. 93.

FIGS. 93 and 94 show a micro-relay according to a forty-ninth embodiment of the present invention. More particularly, FIG. 93 is an exploded perspective view of the micro-relay, and FIG. 94 is a cross-sectional view thereof. The present micro-relay differs from the micro-relay of the above-mentioned forty-eighth embodiment of the invention in that the two movable portions, namely, the first movable portion 321 and the second movable portion 323 are electrically isolated from each other. Further, the present micro-relay differs from the forty-eighth embodiment micro-relay in that the cap substrate 310 is joined to the stationary substrate 330.

The movable plate 320 includes the first movable portion 321 and the second movable portion 323 that are completely separated from each other. The first movable portion 321 is supported by supporting portions 351 via hinge springs 327. The supporting portions 351 may be considered as parts of the frame 351 employed in the aforementioned embodiments of the invention. Similarly, the second movable portion 323 is supported by supporting portions 352 via other hinge springs 327.

In the assembly process of the present micro-relay, the supporting portions 351 and 352 are mounted on a peripheral portion 339 of the stationary substrate 330. Through holes 356 for power feed are formed in the peripheral portion 339 and are located below the supporting portions 351 and 352. The cap substrate 310 is mounted so as to cover the first movable portion 321 and the second movable portion 323, as shown in FIG. 94. Although not illustrated, step portions are formed on a peripheral portion 319 of the cap substrate 310 so that the supporting portions 351 and 352 are sandwiched between the peripheral portion 339 and the peripheral portion 319.

A single stationary electrode 355, which is associated with the first movable portion 321 and the second movable portion 323, is provided on the stationary substrate 330. In contrast, the separate stationary electrodes are associated with the first movable portion 321 and the second movable portion 323 in the aforementioned forty-eighth embodiment of the invention. This difference brings about an operational difference, as will be described later. In FIG. 93, the single stationary electrode 355 has a size that corresponds to the movable portions 321 and 323. Alternatively, two separate stationary electrodes that are electrically connected may be employed.

FIGS. 95A through 95D show an operation of the micro-relay according to the forty-ninth embodiment of the invention. A drive circuit and two external switches 370 and 375 are connected to the micro-relay. The switch 370 has two stationary contacts 371 and 372, and the switch 375 has two stationary contacts 376 and 377.

Figure 95A:
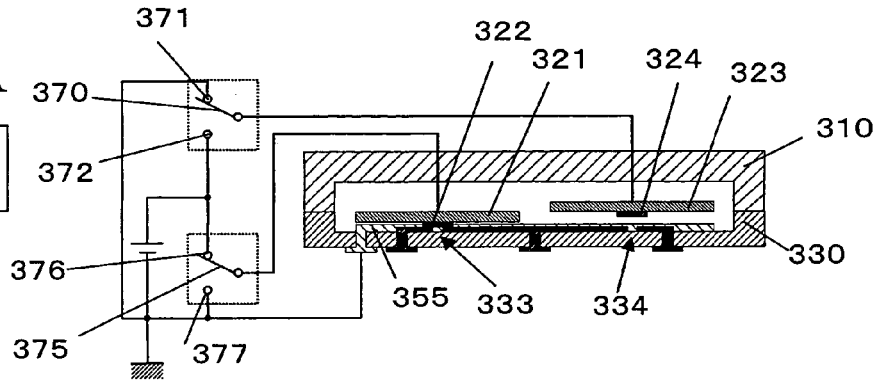
FIGS. 95A, 95B, 95C and 95D show an operation of the micro-relay according to the forty-ninth embodiment of the present invention.

As shown in FIG. 95A, when the movable contact of the switch 370 is connected to the contact 371, and the movable contact of the switch 375 is connected to the contact 376, a voltage develops between the stationary electrode 335 and the first movable portion 321. Thus, the first movable portion 321 goes down, and the first movable contact 322 closes the first stationary contacts 333. At that time, the second movable contact 324 is separate from the second stationary contacts 334.

Figure 95B:
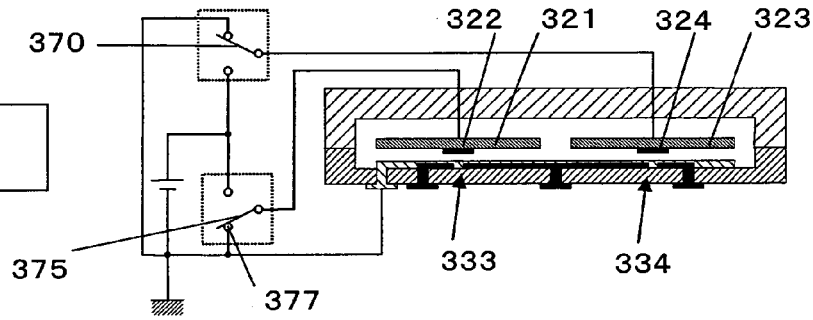

As shown in FIG. 95B, when the switch 375 switches over and selects the contact 377, the line between the stationary electrode 335 and the first movable portion 321 is disconnected, so that the first movable contact 322 is detached from the first stationary contacts 333. At that time, the second movable contact 324 and the second stationary contacts 334 are maintained in the open state (neutral state).

Figure 95C:
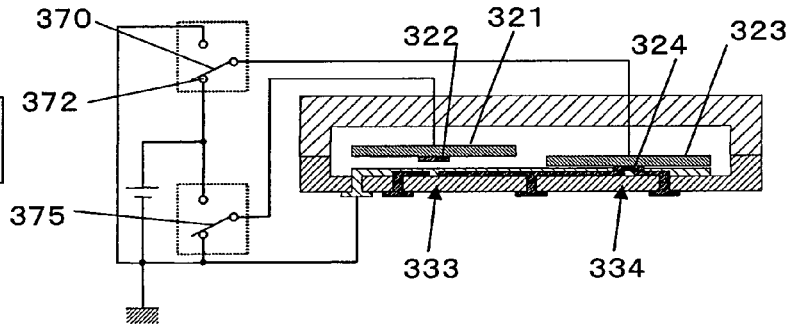

As shown in FIG. 95C, when the switch 370 switches over and selects contact 371, a voltage develops between the stationary electrode 335 and the second movable portion 323, and the second movable contact 324 closes the second stationary contacts 334. At that time, the first movable contact 322 and the first stationary contacts 333 are maintained in the open state.

Figure 95D:
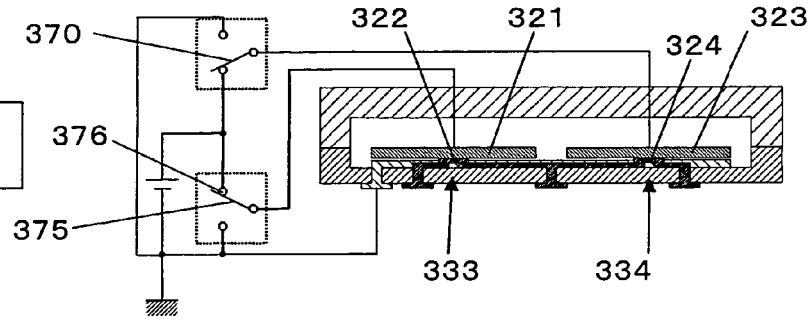

As shown in FIG. 95D, when the switch 375 switches over and selects the contact 376, a voltage develops between the stationary electrode 335 and the first and second movable portions 321 and 323. Thus, the first movable contact 322 closes the first stationary contacts 333, and the second movable contact 324 closes the second stationary contact 334. It should be noted that the two stationary contact groups can be closed alternately or simultaneously. In this switching, adverse affect does not exist substantially.

In the circuit configuration shown in FIGS. 95A-95D, the two movable portions 321 and 323 are electrically isolated and are controlled independently. The stationary electrode 355 is grounded and the drive voltage is selectively applied to the two switches of the micro-switch via the control switches 370 and 375. It is also possible to apply the ground potential to one of the two movable portions 321 and 323 and apply a positive voltage to the other movable portion. In this case, the two stationary contact groups cannot be closed simultaneously.

Fiftieth Embodiment

Figure 96:
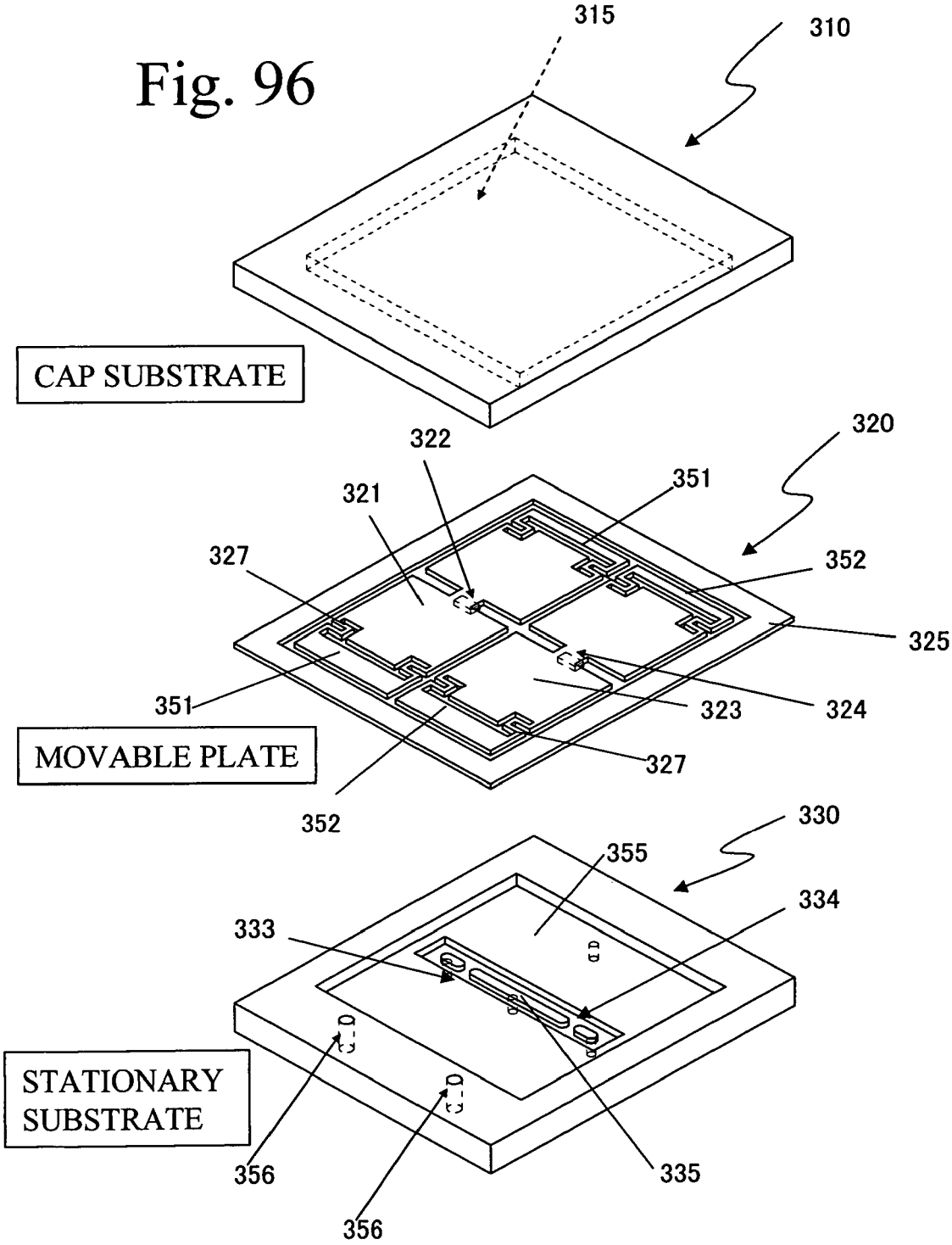
FIG. 96 is an exploded perspective view of a micro-relay according to a fiftieth embodiment of the present invention.

FIG. 96 is an exploded perspective view of a micro-relay according to a fiftieth embodiment of the present invention. In the present embodiment, the common terminal 335 is arranged on an imaginary straight line connecting the first stationary contacts 333 and the second stationary contacts 334. That is, the signal lines are arranged in line. This contributes to reducing the area or size of the stationary substrate 330.

The movable plate 320 employed in the present embodiment has two movable portions 321 and 323 that are arranged inside the frame 325 and are electrically isolated from each other. The frame 325 is separated from the first movable portion 321 and the second movable portion 323. The frame 325 functions as a spacer, and the movable plate 320 is sandwiched between the stationary substrate 330 and the cap substrate 310.

In the micro-relay according to the forty-eighth embodiment of the invention shown in FIG. 90, the frame 325 is electrically connected to the first movable portion 321 and the second movable portion 323, and the movable plate 320 is sandwiched between the stationary substrate 330 and the cap substrate 310. In the micro-relay according to the forty-ninth embodiment of the invention shown in FIG. 91, there is no frame and the first movable portion 321 and the second movable portion 323 are electrically isolated from each other. The stationary substrate 330 is joined to the cap substrate 310. In contrast, the micro-relay shown in FIG. 96 has an in-between arrangement.

Fifty-First Embodiment

Figure 97A:
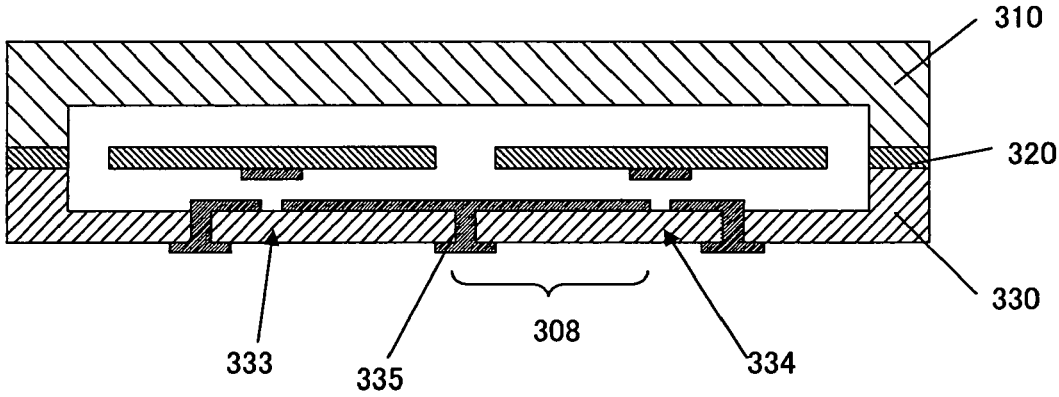
FIGS. 97A and 97B show a micro-relay according to a fifty-first embodiment of the present invention.
Figure 97B:
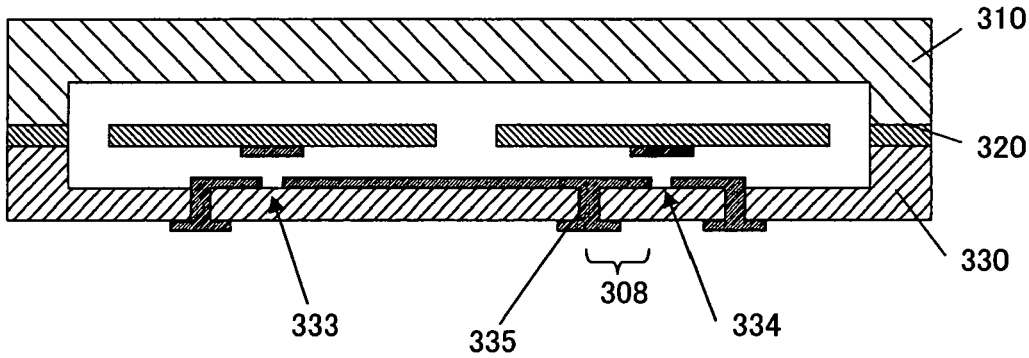

FIGS. 97A and 97B show a micro-relay according to a fifty-first embodiment of the present invention. This embodiment relates to the improvement in the signal line in the micro-relay shown in FIG. 96. FIG. 97A shows an arrangement in which the common terminal 335 is provided so that the stationary contacts 333 and 334 are positioned at equal intervals. FIG. 97B shows another arrangement in which the common terminal 335 is closer to the stationary contacts 334 than the stationary contacts 333. In the arrangement shown in FIG. 97A, identical stubs 308 are formed, so that the high-frequency characteristics of the micro-relay can be evened. In the arrangement shown in FIG. 97B, the stub 308 associated with the stationary contacts 334 is shorter than the other stub, so that special importance to the high-frequency characteristic of the switch having the stationary contacts 333 can be attached.

Forty-Second Embodiment

Figure 98:
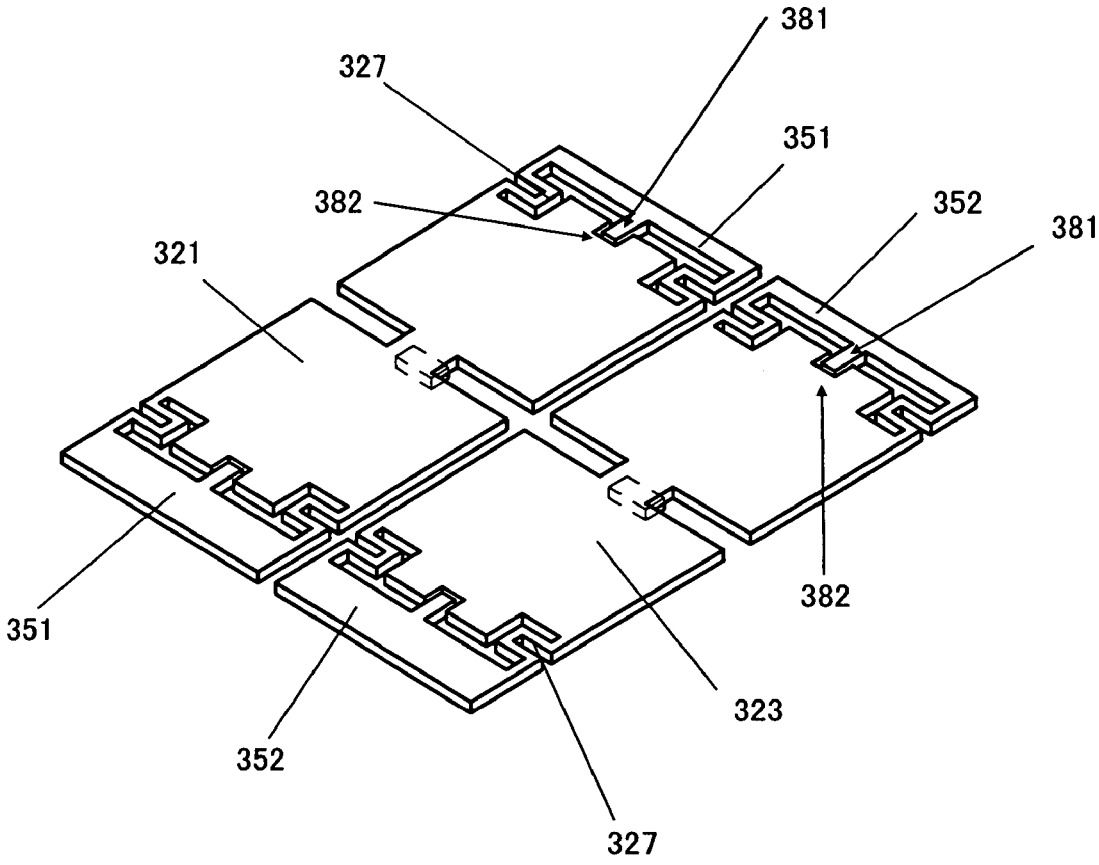
FIG. 98 is a perspective view of movable plates employed in a micro-relay according to a fifty-second embodiment of the present invention.

FIG. 98 shows movable plates employed in a micro-relay according to a fifty-second embodiment of the invention that restricts lateral movement of the movable portions. FIG. 98 shows movable portions 321 and 323 supported by supporting portions 351 and 352. Protrusions 381 are provided to the frames or supporting portions 351 and 352, and counterpart recesses 382 are formed in the movable portions 321 and 323. The combination of the protrusions 381 and the recesses 382 restricts the lateral movement and improves the crushproof of the micro-relay.

Figure 99A:
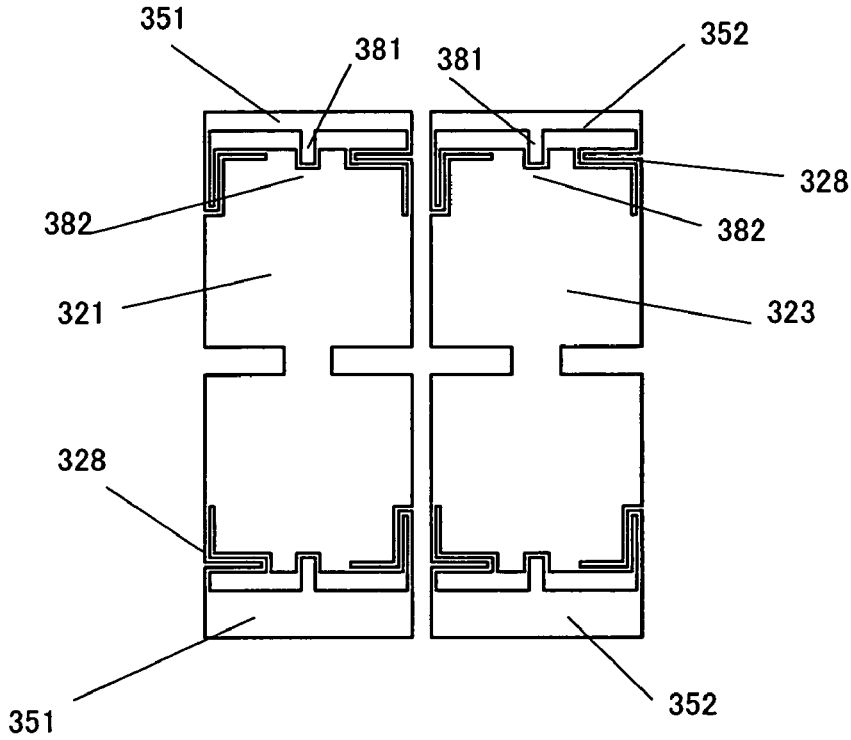
FIGS. 99A and 99B show movable plates employed in a variation of the micro-relay according to the fifty-second embodiment of the present invention.
Figure 99B:
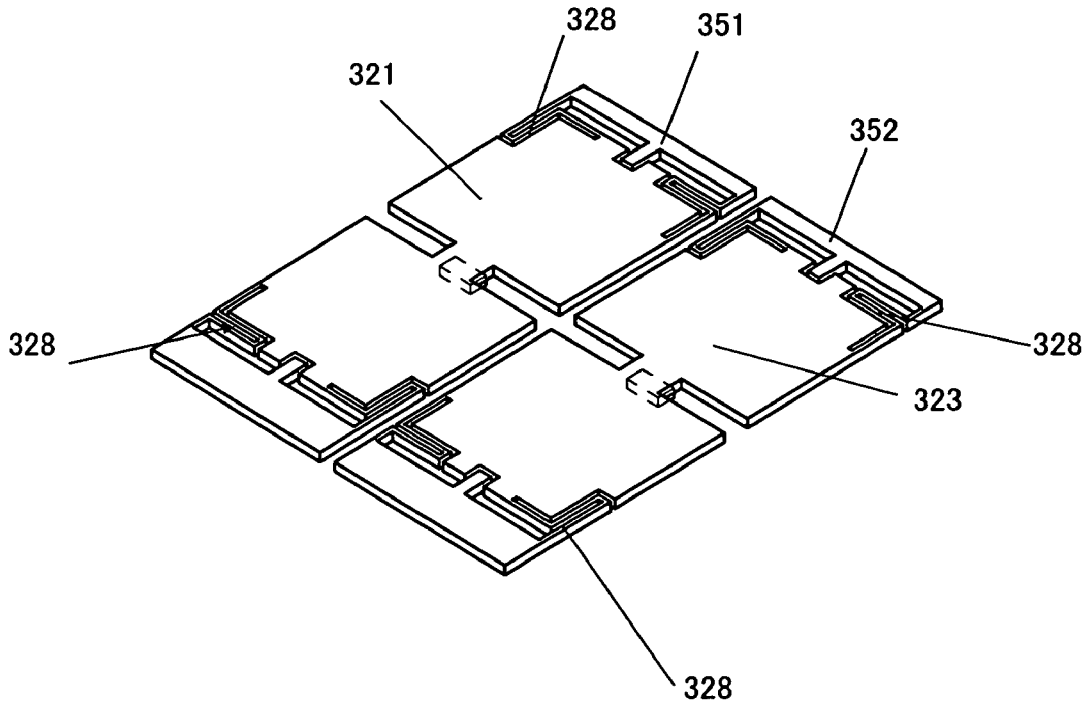

FIGS. 99A and 99B show a variation of the forty-second embodiment of the present invention. More particularly, FIG. 99A is a plan view of movable portions employed in this variation, and FIG. 99B is a perspective view thereof. The hinge springs 328 are comparatively thin. The thin hinge springs 328 has small stiffness and facilitate to movement of the movable portions.

Figure 100:
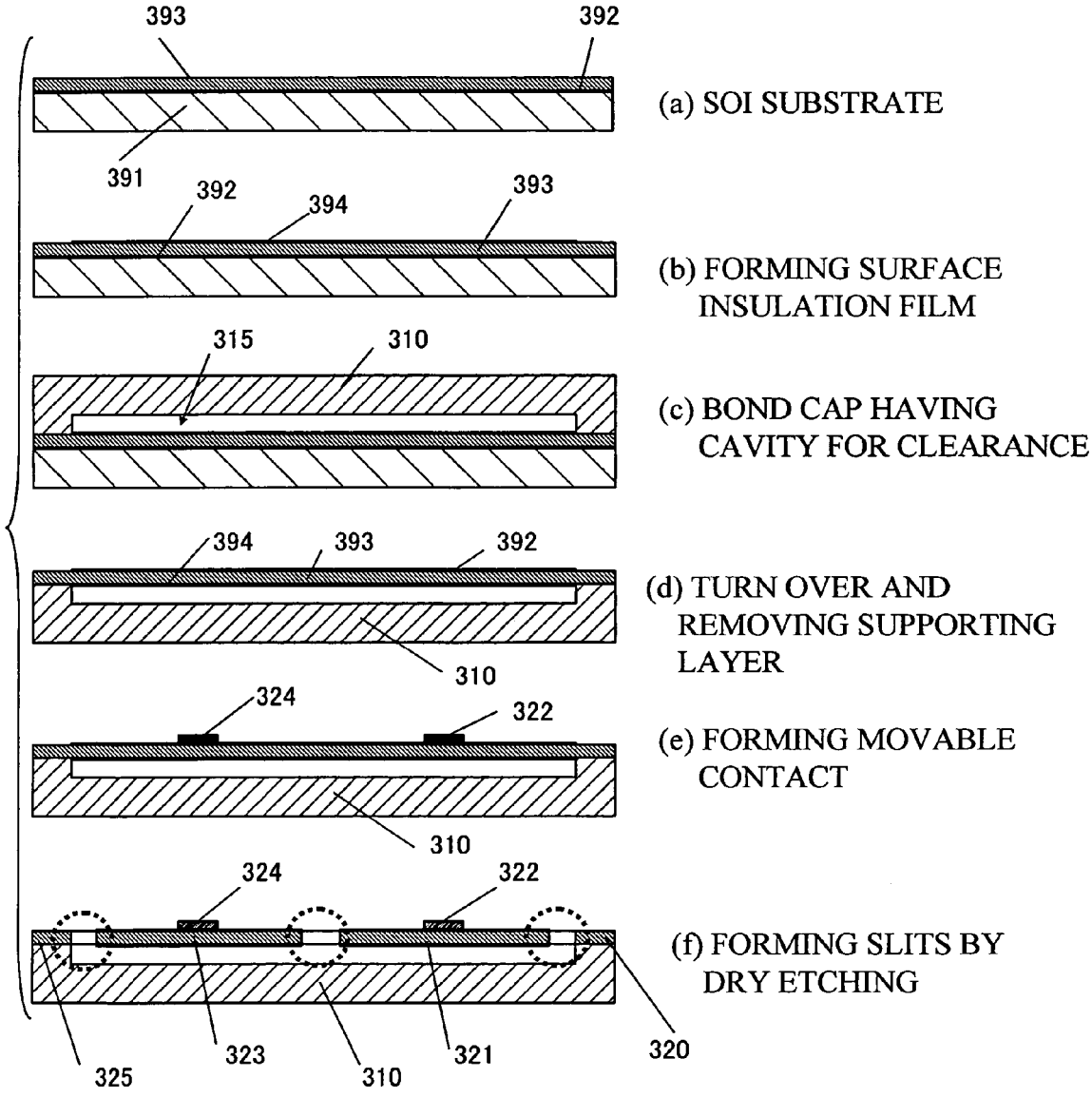
FIG. 100 shows a process for producing the micro-relay according to the fifty embodiment of the present invention.
Figure 101:
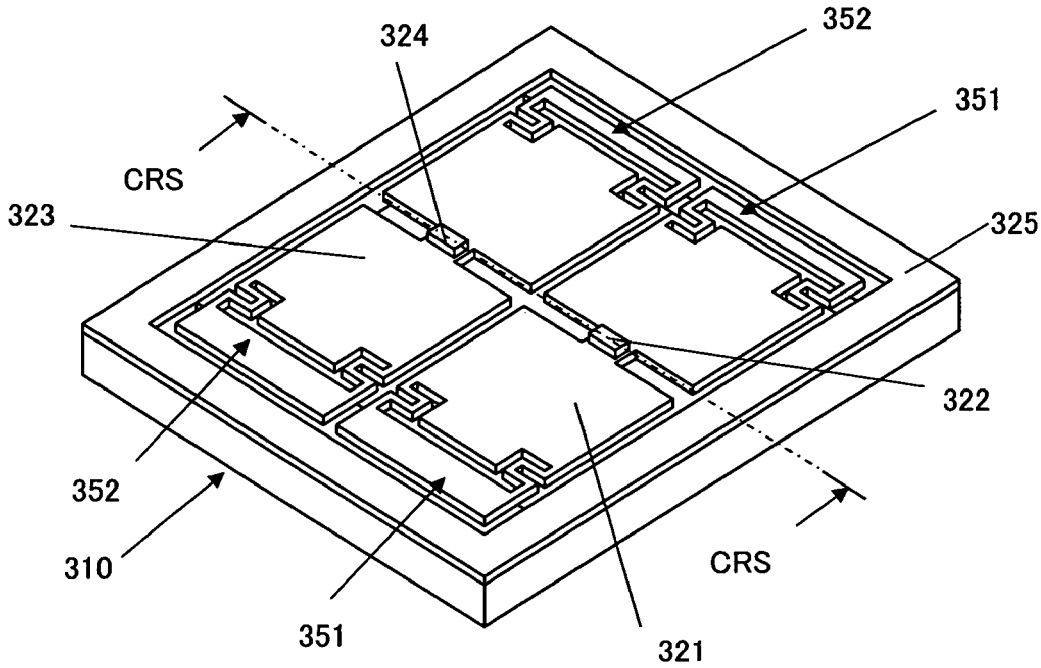
FIG. 101 is a perspective view of a joined body used in the fifth embodiment of the present invention.
Figure 102:
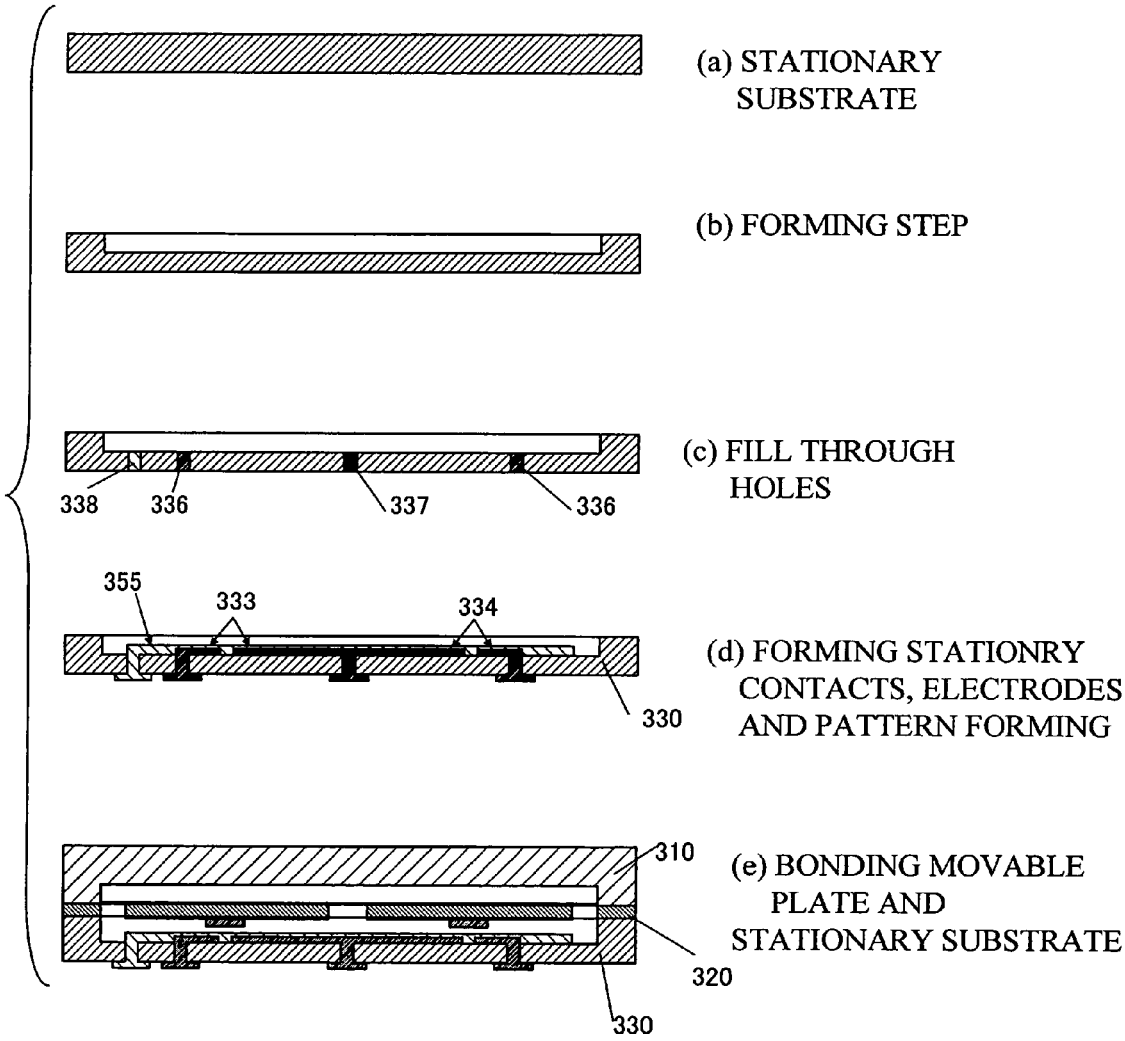
FIG. 102 shows a process for producing a stationary substrate and attaching it to the joined body.

A description will now be given, with respect to FIGS. 100 through 102, of a method of fabricating the micro-relay with the two movable portions electrically isolated according to the fifty embodiment of the present invention. FIG. 100 shows a process of producing the cap/movable plate joined body in which the movable plate 320 and the cap substrate 310 are joined. FIG. 101 is a perspective view of the joined body. FIG. 102 shows a process of producing the stationary substrate and attaching it to the joined body.

FIG. 100 shows the process up to completion of the joined body. First, an SOI substrate is prepared (step (a)). The SOI substrate has a supporting layer 391 that is a thick silicon substrate, and an active layer 393 made of silicon single crystal and provided on an oxide layer (insulating layer) 392 on the supporting layer 391. The active layer 393 of the SOI substrate is doped with an impurity, and is thus assigned conductivity. Then, an oxide film 394 is deposited on the surface on the active layer 393 by sputtering (step (b)).

Then, the cap substrate 310 having the cavity 315 is joined to the oxide film 394 (step (c)). The cap substrate 310 may be a glass or semiconductor member. The joined body is turned over and the unnecessary supporting layer 391 is removed (step (d)). Subsequently, an electrically conductive material is grown on the oxide layer 392 at given intervals, so that the first movable contact 322 and the second movable contact 324 can be formed by sputtering or plating (step (e)).

Thereafter, slits are formed in the movable plate 320. The slits separates the frames 225, the first movable portion 321 and the second movable portions 323 from each other. This results in a structure such that the supporting portions 351 and the first movable portion 321 are connected by the hinge springs and a structure such that the supporting portions 352 and the second movable portion 323 are connected by the hinge springs. It will be noted that the supporting portions 351 and 352 do not appear in FIG. 100.

The process shown in FIG. 100 produces the cap/supporting plate joined body that is a semifinished body of the micro-relay shown in FIG. 101. The cross section shown in FIG. 101 is taken along a line CRS-CRS shown in FIG. 100. It can be seen from FIG. 101 that the first movable portion 321 is supported by the frame 353 and the supporting portions 351, and the second movable portion 323 is supported by the frame 325 and the supporting portions 352. When the movable plate 320 is made of silicon single crystal, the construction shown in FIG. 101 may be easily realized by RIE (reactive ion etching).

Then, the stationary substrate 330 is produced by the process shown in FIG. 102. The glass or silicon substrate 330 that is 0.2-0.4 mm thick is prepared (step (a)). Preferably, the glass substrate 330 is made of Pyrex glass (registered trademark). The glass or silicon substrate is processed so that the peripheral portion remains to define the resultant recess for the stationary electrodes and contacts (step (b)). The step portion of the stationary substrate 330 defines a clearance for movement of the movable portions 321 and 323. The clearance may be defined by using the flat stationary substrate 330 and the movable plate having a comparatively thick frame.

Then, holes 336, 337 and 338 for making through holes are formed in the glass substrate. The through holes 336 are used to extract the interconnection lines from the first and second stationary contacts. The through hole 337 is used to extract the interconnection line from the common terminal. The through hole 338 is used to extract the interconnection line from the stationary electrode 355. The through holes 336, 337 and 338 may be formed by laser or sand blast. The holes 336, 337 and 338 are filled with an electrically conductive material by plating or the like (step (c)). The electrically conductive material may be gold, copper, or aluminum.

Then, the stationary electrode 335, the first stationary contact 333 and the second stationary contact 334 are formed by sputtering or plating. These electrode and the contacts may have an underlying layer of Au, which is coated with a platinum-base metal such as Rh, Ru, Pd or Pt. The Au underlying layer serves as a cushioning member, and the surface layer of the platinum-base metal has a high degree of hardness. Then, the interconnection lines are formed on the bottom surface of the stationary substrate 330.

Then, as shown in step (e) of FIG. 102, the cap/movable plate joined body and the stationary substrate 330 are bonded so as to form a laminate thereof by anodic bonding in such a manner that the stationary substrate 330 is set at a minus potential, and the movable plate 320 is set at a positive potential.

Preferably, anodic bonding is carried out in a pressure-reduced atmosphere, more preferably, in an inactive gas (such as $N_2$) or a high insulation gas (such as $SF_6$). Thus, the micro-relay can be hermetically sealed with no gas remaining in the interior. Now, multiple micro-relay chips arranged on the wafer are available. These chips are divided into the individual chips by dicing. Since the micro-relay chips are already hermetically sealed, the interiors thereof are not affected by dicing at all. The individual chips are respectively subjected to the process shown in FIGS. 58A through 58C, so that the micro-relay devices 200 can be obtained.

Figure 103:
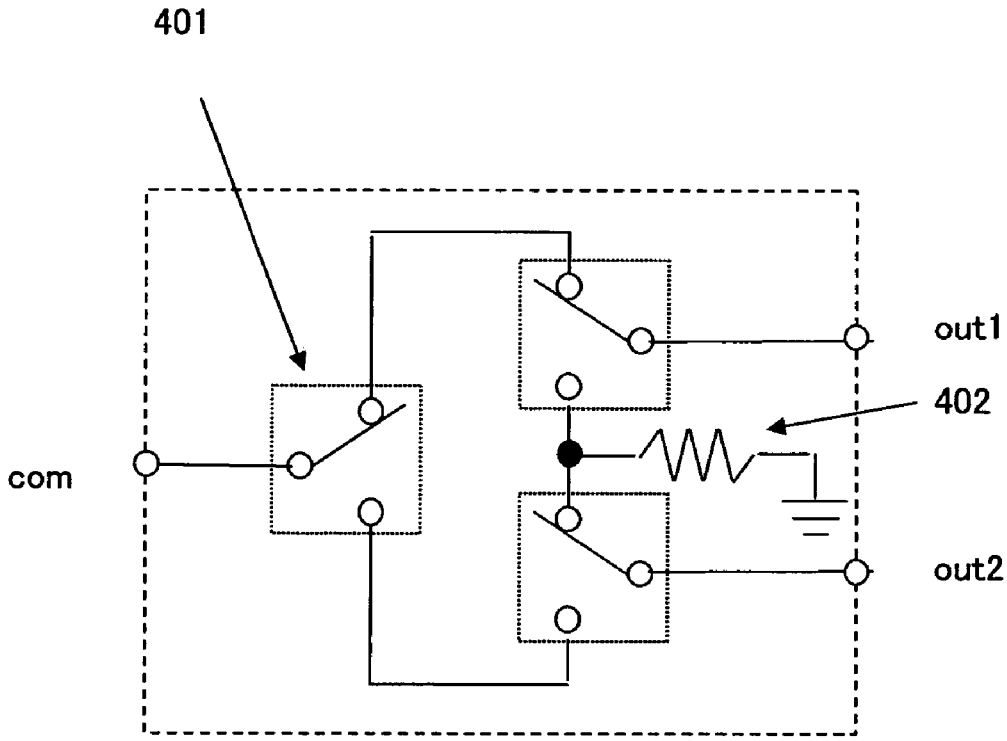
FIG. 103 is a circuit diagram of an application of the micro-relay according to the present invention.
Figure 104:
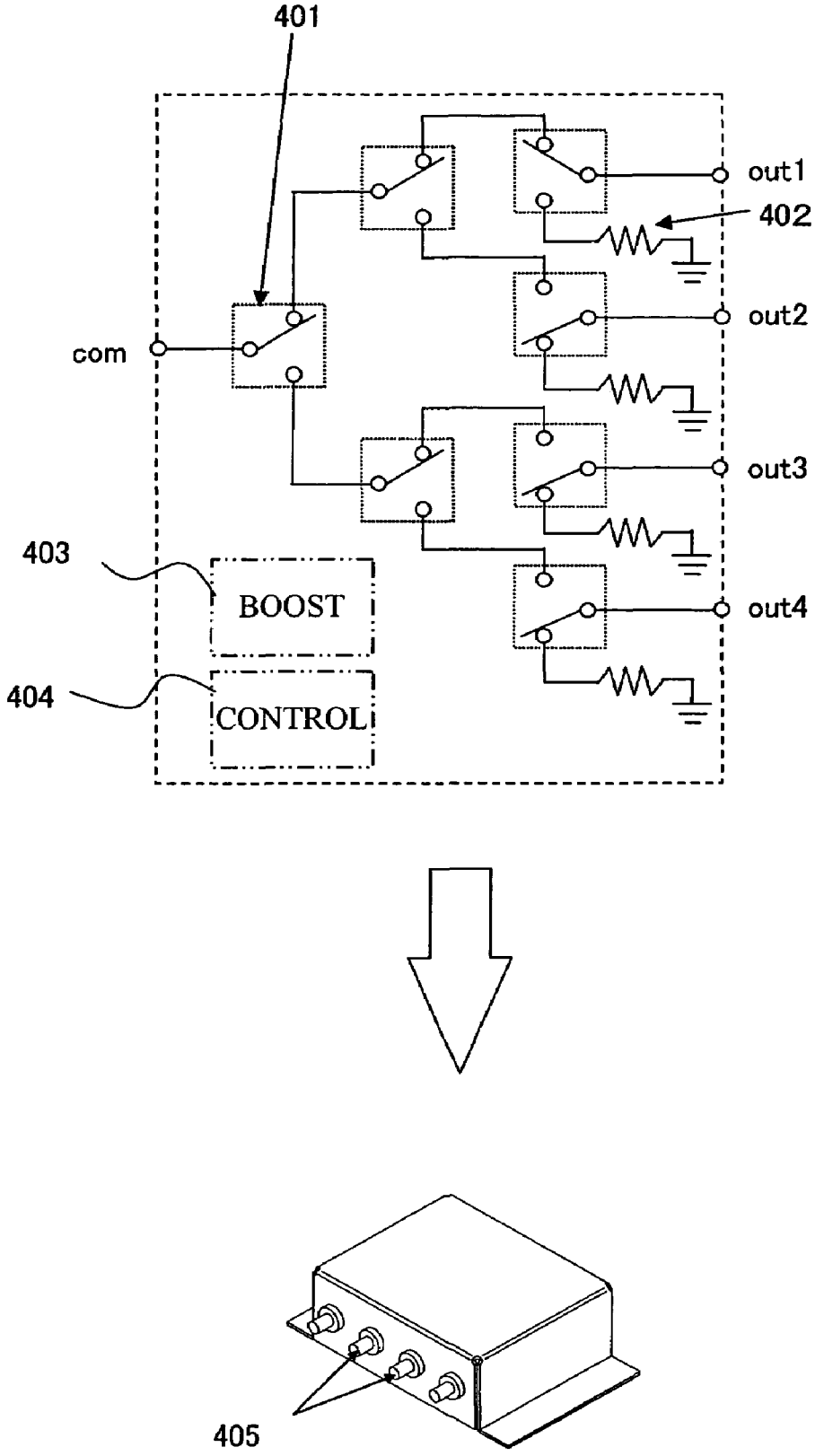
FIG. 104 shows another application of the micro-relay according to the present invention.
Figure 105:
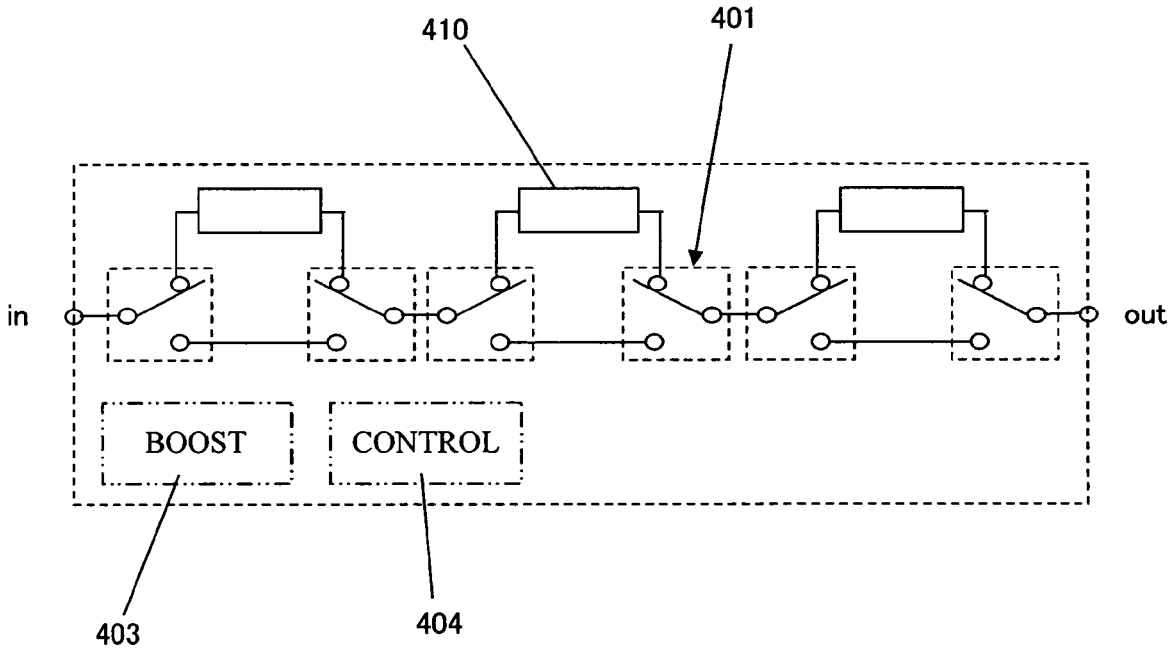
FIG. 105 is a circuit diagram of yet another application of the micro-relay according to the present invention.

FIGS. 103 through 105 show applications of the micro-relay including two switches. FIG. 103 shows a non-reflection relay module that has multiple micro-relays 401, each of which has two stationary contacts and is mounted on a circuit board. The minimum unit of the non-reflection type relay module is so-called 1*c* contact structure, and contacts that are not used are grounded via a termination resistor 402. The use of multiple micro-relays each having two stationary contacts switches can realize a compact relay module.

FIG. 104 show another module equipped with multiple micro-relays. This module has a one-input/four-output arrangement. Coaxial cables may be connected to the module. A boost circuit 403 may be incorporated into the module, which can be driven with a low voltage. A control circuit 404 that controls the switches may be incorporated into the module. The contact structure may be any of various types such as SPDT (1*c*), SP4T and SP6T.

FIG. 105 shows an attenuator module that utilizes multiple micro-relays each having two stationary contacts. An input signal is attenuated by a combination of switches 401 and resistors 410, and an attenuated signal is output. Although all the relays and resistors may be integrated on a single wafer, it is preferable to arrange discrete relays and resistors on a circuit board. Particularly, there is a difficulty in formation of high resistors suitable for the attenuator device on the wafer.

The aforementioned embodiments of the invention employ two movable portions. It is also possible to use three or more movable portions. The movable portions may be arranged in line or in two-dimensional formation. It should be noted that some structures of the micro-relays with the single movable portion mentioned before may be applied to the micro-relays with the two movable potions, and some structures of the micro-relays with the two movable portions mentioned before may be applied to the micro-relays with the single movable portion.

The present invention is not limited to the specifically disclosed embodiments, and variations and modifications may be made without departing from the scope of the present invention.

What is claimed is:

1. A micro-relay comprising:

a first substrate having stationary contacts and a stationary electrode;

a second substrate, having a stationary contact, arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and multiple movable contacts facing the stationary contacts, the movable portion moving between the first and second substrates due to electrostatic attraction that develops between the movable electrode and the stationary electrode, wherein the stationary contacts have branch portions that are contactable to the multiple movable contacts, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrates, the movable contacts are disconnected therefrom and make a connection with the stationary contact of the second substrate that is at a ground potential.

2. The micro relay according to claim 1:

wherein the stationary contacts that are contactable to the multiple movable contacts are provided independently.

3. A micro-relay comprising:

a first substrate having a contact as a stationary contact and an electrode as a stationary electrode;

a second substrate, having a stationary contact, facing the first substrate; and a movable plate arranged between the first and second substrates, the movable plate including:

a frame sandwiched between the first and second substrates forming a hermetical sealed structure, a portion parallel relative to the first and second substrates having a movable electrode facing the stationary electrode, and a movable contact facing the stationary contact, and a plurality of hinge springs movingly suspending the portion from the frame while maintaining a parallel state relative to the first and second substrates, wherein the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

4. The micro-relay as claimed in claim 3, wherein the first substrate has through holes via which interconnection lines extending from the first substrate are extracted to an outside of the micro-relay.

5. The micro-relay as claimed in claim 3, wherein the first substrate has through holes via which interconnection lines extending from the movable plate are extracted to an outside of the micro-relay.

6. The micro-relay as claimed in claim 3, wherein interconnection lines extending from the first substrate to an outside of the micro-relay are flush with a surface of the first substrate.

7. The micro-relay as claimed in claim 3, wherein the hinge springs are arranged symmetrically.

8. The micro-relay as claimed in claim 3, wherein the second substrate has a flat plate shape.

9. The micro-relay as claimed in claim 3, wherein the frame has a thickness that defines spaces between the movable plate and the first stationary contact and between the movable plate and the second stationary contact.

10. A micro-relay comprising:

a first substrate having stationary contacts and a stationary electrode;

a second substrate, having a stationary contact, arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein at least one of the frame and the movable portion has a stopper that restricts in-plane movement of the movable portion, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

11. A micro-relay comprising:

a first substrate having stationary contacts and a stationary electrode;

a second substrate, having a stationary contact, arranged so as to face the first substrate; and a movable plate arranged between the first and second substrates, the movable plate comprising: a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein the movable portion has protrusions that prevent the movable portion from sticking to the first substrate, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

12. A micro-relay comprising:

a first substrate having stationary contacts and a stationary electrode;

a second substrate, having a stationary contact, arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein the second substrate has a stationary contact facing the movable contact, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

13. A micro-relay comprising:

a first substrate having stationary contacts and a stationary electrode;

a second substrate arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein the second substrate has a stationary contact and stationary electrodes that face the movable contact, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

14. A micro-relay comprising:

a first substrate having stationary contacts and a stationary electrode;

a second substrate arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein the second substrate has a stationary electrode that faces the movable electrode, and a stationary contact that faces the movable contact, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

15. A micro-relay comprising:

a first substrate having stationary contacts and a stationary electrode;

a second substrate arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein:

the second substrate has a stationary electrode that faces the movable electrode, and a stationary contact that faces the movable contact; and the movable contact is separated from the stationary contacts of the first and second substrates in the absence of electrostatic attraction, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

16. A micro-relay comprising:

a first substrate having stationary contacts and a stationary electrode;

a second substrate arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein:

the second substrate has a stationary electrode that faces the movable electrode, and a stationary contact that faces the movable contact;

the movable contact is separated from the stationary contacts of the first and second substrates in the absence of electrostatic attraction; and the movable contact is brought into contact with the stationary electrode of the second substrate or the stationary contacts of the first substrate due to electrostatic attraction, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

17. A micro-relay comprising:

a first substrate having stationary contacts and a stationary electrode;

a second substrate arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein:

the second substrate has a stationary electrode that faces the movable electrode, and stationary contacts that face the movable contact; and the movable contact is separated from the stationary contacts of the first and second substrates in the absence of electrostatic attraction, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

18. A micro-relay comprising:

a first substrate having stationary contacts and a stationary electrode;

a second substrate, having a stationary contact, arranged so as to face the first substrate and having stationary contacts; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein the stationary contacts of the first substrate are for use in signal transmission, and the stationary contacts of the second substrate are for use in signal transmissions, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

19. A micro-relay comprising:

a first substrate having stationary contacts and a stationary electrode;

a second substrate, having a stationary contact, arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein the second substrate has a stationary electrode, and an interconnection line extending from the stationary electrode of the second substrate is extracted to an outside of the micro-relay via a through hole formed in the second substrate, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

20. A micro-relay comprising:

a first substrate having stationary contacts and a stationary electrode;

a second substrate arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein the second substrate has a stationary contact facing the movable contact, and wherein an interconnection line extending from the stationary contact is extracted to an outside of the second substrate via a through hole formed in the second substrate, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

21. A micro-relay comprising:

a first substrate having stationary contacts and a stationary electrode;

a second substrate arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein the second substrate has a stationary contact facing the movable contact, and the movable plate has protrusions that prevent the movable portion from sticking to the second substrate, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

22. A micro-relay comprising:

a first substrate having stationary contacts and a stationary electrode;

a second substrate arranged so as to face the first substrate; and a movable plate arranged between the first and second substrates, the movable plate comprising:

a frame sandwiched between the first and second substrates to realize a hermetical sealed structure, a movable portion parallel relative to the first and second substrates, and a plurality of hinge springs movingly suspending the movable portion from the frame while maintaining a parallel state relative to the first and second substrates, the movable portion having a movable electrode facing the stationary electrode, and a movable contact facing the stationary contacts, the movable portion moving between the first and second substrates due to electrostatic attraction that develops between the movable electrode and the stationary electrode, wherein the second substrate has a stationary contact facing the movable contact, and the movable plate has protrusions that prevent the movable portion from sticking to the first and second substrates, the multiple movable contacts are located between the stationary contacts without making contact with any of the stationary contacts of the first and second substrates when a voltage is not applied between the movable electrode and the stationary electrode, and when the multiple movable contacts are released from a connecting state in which the movable contacts make a connection with the stationary contacts of the first substrate, the movable contacts are disconnected therefrom and make a connection with the stationary contact of the second substrate that is at a ground potential.

23. A micro-relay comprising:

a first substrate having stationary contacts and a stationary electrode;

a second substrate arranged so as to face the first substrate;

a movable plate arranged between the first and second substrates, the movable plate having a frame and a movable portion, the frame being sandwiched between the first and second substrates to realize a hermetical sealed structure, the movable portion having a movable electrode facing the stationary electrode, and a movable contact facing the stationary contacts, the movable portion moving between the first and second substrates due to electrostatic attraction that develops between the movable electrode and the stationary electrode;

a base substrate that supports the first substrate;

members that connect the movable electrode and the stationary electrode to pads formed on the base substrate; and resin that covers the first and second substrates and the movable plate.

24. A micro-relay comprising:

a first substrate having stationary contacts and a stationary electrode;

a second substrate arranged so as to face the first substrate; and a movable plate arranged between the first and second substrates, the movable plate having a frame and a movable portion, the frame being sandwiched between the first and second substrates to realize a hermetical sealed structure, the movable portion having a movable electrode facing the stationary electrode, and a movable contact facing the stationary contacts, the movable portion moving between the first and second substrates due to electrostatic attraction that develops between the movable electrode and the stationary electrode, wherein the frame has a protrusion and the movable portion has a counterpart recess.

25. A micro-relay comprising:

a first substrate having stationary contacts and a stationary electrode;

a second substrate arranged so as to face the first substrate; and a movable plate arranged between the first and second substrates, the movable plate having a frame and a movable portion, the frame being sandwiched between the first and second substrates to realize a hermetical sealed structure, the movable portion having a movable electrode facing the stationary electrode, and a movable contact facing the stationary contacts, the movable portion moving between the first and second substrates due to electrostatic attraction that develops between the movable electrode and the stationary electrode, wherein the movable portion and the frame have an identical thickness.

* * * * *

UNITED STATES PATENT AND TRADEMARK OFFICE

CERTIFICATE OF CORRECTION

PATENT NO. : 7,551,048 B2
APPLICATION NO. : 10/634876
DATED : June 23, 2009
INVENTOR(S) : Hideki Iwata et al.

It is certified that error appears in the above-identified patent and that said Letters Patent is hereby corrected as shown below:

Column 63, Line 54, change "transmissions," to --transmission,--.

Signed and Sealed this

Twentieth Day of October, 2009

David J. Kappos

David J. Kappos
*Director of the United States Patent and Trademark Office*